US007148000B2

(12) United States Patent
Oyamada et al.

(10) Patent No.: US 7,148,000 B2
(45) **Date of Patent: *Dec. 12, 2006**

(54) HEAT-DEVELOPABLE PHOTOSENSITIVE MATERIAL AND IMAGE-FORMING PROCESS

(75) Inventors: Takayoshi Oyamada, Kanagawa (JP); Kouta Fukui, Kanagawa (JP); Toyohisa Oya, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/126,977

(22) Filed: Apr. 22, 2002

(65) Prior Publication Data

US 2003/0087204 A1 May 8, 2003

(30) Foreign Application Priority Data

Apr. 23, 2001 (JP) ..... 2001-124796
Aug. 30, 2001 (JP) ..... 2001-261976

(51) Int. Cl.
*G03C 1/498* (2006.01)

(52) U.S. Cl. ..... 430/619; 617/620

(58) Field of Classification Search ..... 430/619, 430/350, 617, 620, 965, 264, 944
See application file for complete search history.

(56) References Cited

U.S. PATENT DOCUMENTS 4,021,240 A 5/1977 Cerquone et al.
4,782,004 A 11/1988 Takeuchi et al.
5,001,032 A * 3/1991 Katayama et al. ..... 430/203
5,496,695 A 3/1996 Simpson et al.
5,958,668 A * 9/1999 Matsumoto ..... 430/619
5,976,756 A 11/1999 Nakamura et al.
6,013,421 A 1/2000 Nakamura et al.
6,040,130 A * 3/2000 Alton et al. ..... 430/617
6,090,538 A * 7/2000 Arai et al. ..... 430/619
6,358,677 B1 * 3/2002 Taniguchi et al. ..... 430/619
6,413,712 B1 * 7/2002 Yoshioda et al. ..... 430/619
6,645,714 B1 * 11/2003 Oya et al. ..... 430/619
6,800,430 B1 * 10/2004 Kyota et al. ..... 430/619
6,924,089 B1 * 8/2005 Oya et al. ..... 430/350
2002/0098449 A1 * 7/2002 Oya et al. ..... 430/351

FOREIGN PATENT DOCUMENTS

JP 43-4924 2/1968
JP 9-304875 A 11/1997
JP 10-221806 A 8/1998
JP 11-271920 8/1999

OTHER PUBLICATIONS

Office Action dated Aug. 18, 2003, for U.S. Appl. No. 10/209,260 issued as U.S. Patent 6,924,089.

* cited by examiner

*Primary Examiner*—Thorl Chea
(74) *Attorney, Agent, or Firm*—Sughrue Mion, PLLC

(57) ABSTRACT

The present invention is directed to a heat-developable photosensitive material and an image-forming process using the heat-developable photosensitive material. The material generally includes at least one photosensitive silver halide, a reducing agent for silver ions, a binder, and non-photosensitive organic silver salt particles on one surface of a support. The non-photosensitive organic silver salt particles are specified and the reducing agent is specified. The material may include specific non-photosensitive organic silver salt particles and a development accelerator.

7 Claims, 1 Drawing Sheet

HEAT-DEVELOPABLE PHOTOSENSITIVE MATERIAL AND IMAGE-FORMING PROCESS

BACKGROUND OF THE INVENTION

1. Field of the Invention

The present invention relates to a heat-developable photosensitive material having photosensitivity, which may be referred to as a "heat-developable photosensitive material" hereinafter, and an image-forming process using the same. More specifically, the present invention relates to a heat-developable photosensitive material which has a high development activity, a high sensitivity and an excellent image-keeping property, and causes less fogging in non-image portions; a heat-developable photosensitive material having a low Dmin and an excellent image-keeping property by including characteristic organic silver salt particles; and an image-forming process using the heat-developable material.

2. Description of the Related Art

In recent years, a reduction in the waste amount of processing solution has been intensely demanded from the standpoints of environment preservation and saving space in the fields of films for medical diagnosis and films for photoengraving. Thus, techniques about heat-developable photosensitive materials are made necessary for medical diagnosis films and photoengraving films which can be effectively exposed to light with a laser image setter or a laser imager, and can form a black image having high resolution and sharpness. According to these heat-developable photosensitive materials, a simpler heat-developable processing system which requires no solution-type processing chemicals and gives no damage to environment can be supplied to clients.

Similar matters are demanded in the field of ordinary image-medical forming materials. Particularly for images for diagnosis, high image quality superior in sharpness and granularity is necessary because fine depiction is required. Moreover, images of cool black tone are preferred from the standpoint of easiness of diagnosis. At present, various hard copy systems using pigment or dye, such as an ink-jet printer or an electrophotographic apparatus, are in circulation as ordinary image-forming systems. However, satisfactory systems are not made practicable as systems for outputting medical images.

Incidentally, a thermal image-forming system using an organic silver salt is described in, for example, U.S. Pat. Nos. 3,152,904 and 3,457,075, and "Thermally Processed Silver Systems" (Imaging Processes and Materials) Neblette, the 8th edition, written by D. Klosterboer, and edited by J. Sturge, V. Walworth and A. Shepp (Chapter 9, p. 279 (1989)).

In particular, a heat-developable photosensitive material has a photosensitive layer wherein in general a catalytically-active amount of a photocatalyst (for example, silver halide), a reducing agent, a reducible silver salt (for example, an organic silver salt), and an optional color tone adjuster for controlling the color tone of silver are dispersed in a matrix made of a binder.

The heat-developable photosensitive material is image-wise exposed to light, and then heated at a high temperature (for example, 80° C. or more), so as to cause redox reaction between the reducible silver salt (which functions as an oxidizer) and the reducing agent. In this way, a silver image in black is formed. The redox reaction is accelerated by catalytic effect of a latent image of the silver halide generated by the exposure. Therefore, the silver image in black is formed in the exposed area. Such technique is disclosed in many literatures including U.S. Pat. No. 2,910,377 and Japanese Patent Application Publication (JP-B) No. 43-4924.

In the heat-developable photosensitive material, it is preferable that the redox reaction between the reducible silver salt and the reducing agent advances at a realistic temperature for a realistic time, thereby giving a sufficient image density. Thus, in the present situation, it is desired to make further progress with heat-developable photosensitive materials having a high sensitivity and a high development ability and causing the reaction to advance rapidly.

In a heat-developable photosensitive material using an organic silver salt, the organic silver salt and so on are not fixed. For this reason, after a silver image is formed by heat, there is a probability that a further silver image is caused to appear by light, heat or the like. Of course, under ordinary use conditions, such a phenomenon is not caused. However, for example, in the case that a processed film is put in a car in summer for the purpose of the carriage thereof or the like, or in the case that a film is preserved under conditions severe for heat-developable photosensitive material, there arises a trouble such as discoloration of the whole of the film or transfer of characters on a bag in which the film is preserved onto the film, that is, a problem that fogging is caused at the time of the preservation thereof.

Technique of raising the content of silver behenate in the organic silver salt is described in Japanese Patent Application Laid-Open (JP-A) No. 11-271920. However, a reducing agent for organic silver salt particles described in this publication does not produce a remarkable effect upon development ability, image-keeping property, and prevention of fogging at the time of preservation.

Furthermore, it is found out that image-keeping property is improved by raising the silver behenate content. However, problems that development-advance is delayed and poor sensitivity is caused arise.

SUMMARY OF THE INVENTION

An object of the present invention is to solve the above-mentioned problems in the prior art and provide a heat-developable photosensitive material which has a high development activity to overcome delay of development, a high sensitivity, a low Dmin, and an excellent image-keeping property and causes less generation of fogging at the time of preservation; and an image-forming process using the heat-developable photosensitive material.

The inventors made eager investigations. As a result, the inventors have found out that the above-mentioned object is attained by a heat-developable photosensitive material including at least one photosensitive silver halide, a reducing agent for silver ions, a binder, and non-photosensitive organic silver salt particles on one surface of a support, wherein the non-photosensitive organic silver salt particles are specified and the reducing agent is specified; a heat-developable photosensitive material including specified non-photosensitive organic silver salt particles and at least one development accelerator; and an image-forming process using the heat-developable photosensitive material. Thus, the present invention has been made.

Specifically, the present invention which attains the above-mentioned object is as follows.

A first aspect of the present invention provides a heat-developable photosensitive material including at least one photosensitive silver halide, a reducing agent for silver ions, a binder, and non-photosensitive organic silver salt particles on one surface of a support, wherein the content of silver behenate in the non-photosensitive organic silver salt particles is 90% by mole or more and 100% by mole or less, and the reducing agent is a compound represented by the following general formula (I):

General Formula (I)

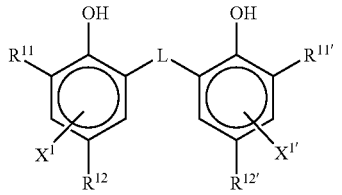

wherein $R^{11}$ and $R^{11'}$ each independently represents an alkyl group having 1 to 20 carbon atoms, $R^{12}$ and $R^{12'}$ each independently represents a hydrogen atom or a substituent with which the corresponding benzene ring can be substituted, L represents a —S— group or a —$CHR^{13}$— group wherein $R^{13}$ represents a hydrogen atom or an alkyl group having 1 to 5 carbon atoms, and $X^1$ and $X^{1'}$ each independently represents a hydrogen atom or a substituent with which the corresponding benzene ring can be substituted.

A second aspect of the present invention provides a heat-developable photosensitive material according to the first aspect in which in the compound represented by the general formula (I), $R^{11}$ and $R^{11'}$ each independently represents a secondary or tertiary alkyl group having 3 to 8 carbon atoms, $R^{12}$ and $R^{12'}$ each independently represents an alkyl group, L represents a —$CHR^3$— group, $R^{13}$ represents a hydrogen atom or an alkyl group having 1 to 5 carbon atoms, and $X^1$ and $X^{1'}$ each represents a hydrogen atom.

A third aspect of the present invention provides a heat-developable photosensitive material according to the first aspect in which in the compound represented by the general formula (I), $R^{11}$ and $R^{11'}$ each independently represents a secondary or tertiary alkyl group having 3 to 8 carbon atoms, $R^{12}$ and $R^{12'}$ each independently represents a methyl group or an ethyl group, L represents a —$CHR^{13}$— group, $R^{13}$ represents a hydrogen atom, and $X^1$ and $X^{1'}$ each represents a hydrogen atom.

A fourth aspect of the present invention provides a heat-developable photosensitive material according to the first aspect in which the content of silver behenate in the non-photosensitive organic silver salt particles is 94% by mole or more and 100% by mole or less.

A fifth aspect of the present invention provides a heat-developable photosensitive material according to the first aspect in which the silver stearate in the non-photosensitive organic silver salt particles is 1% by mole or less and the sphere-equivalent diameter of the non-photosensitive organic silver salt particles is 0.05 μm or more and 1 μm or less.

A sixth aspect of the present invention provides a heat-developable photosensitive material according to the first aspect in which the non-photosensitive organic silver salt particles are squamiform particles.

A seventh aspect of the present invention provides a heat-developable photosensitive material including at least one photosensitive silver halide, a reducing agent for silver ions, a binder, and non-photosensitive organic silver salt particles on one surface of a support, the content of silver behenate in the non-photosensitive organic silver salt particles being 90% by mole or more and 99.9% by mole or less, and the photosensitive material including at least one development accelerator.

An eighth aspect of the present invention provides a heat-developable photosensitive material according to the seventh aspect in which the non-photosensitive organic silver salt particles have (1) a silver stearate content of 1% by mole or less, (2) a slenderness ratio of 1 or more and 9 or less, (3) an aspect ratio of 1.1 or more and 30 or less, and (4) a sphere-equivalent diameter of 0.05 μm or more and 1 μm or less.

A ninth aspect of the present invention provides a heat-developable photosensitive material according to the seventh aspect in which the development accelerator is a phenol derivative or a hydrazine derivative.

A tenth aspect of the present invention provides a heat-developable photosensitive material according to the ninth aspect in which the phenol derivative which is the development accelerator is represented by the following general formula (P) or the general formula (Q):

General Formula (P)

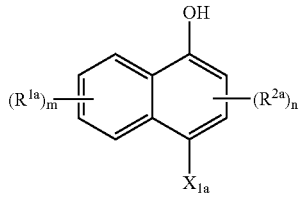

General Formula (Q)

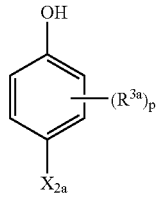

wherein $X^{1a}$ and $X^{2a}$ each independently represents a hydrogen atom or a substituent, $R^{1a}$ to $R^{3a}$ each independently represents a hydrogen atom or a substituent, m and p each independently represents an integer of 0 to 4, and n is an integer of 0 to 2.

An eleventh aspect of the present invention provides a heat-developable photosensitive material according to the seventh aspect which includes, as the development accelerator, at least one selected from the following general formulae (1) to (4):

General Formula (1)

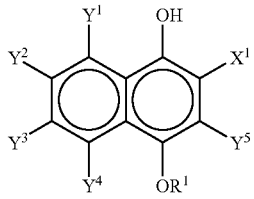

General Formula (2)

$Q^1$—NHNH—$R^{1b}$

-continued

General Formula (3)

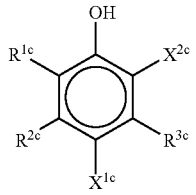

General Formula (4)

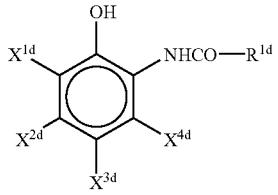

wherein $R^1$ represents an alkyl, aryl, alkenyl, heterocyclic, acyl, alkoxycarbonyl, carbamoyl or alkynyl group, $X^1$ represents an acyl, alkoxycarbonyl, carbamoyl or sulfonyl or sulfamoyl group, and $Y^1$ to $Y^5$ each independently represents a hydrogen atom or a substituent, wherein $Q^1$ represents a 5- to 7-membered unsaturated ring bonded to —NHNH—$R^{1b}$ through its carbon atom, $R^{1b}$ represents a carbamonyl, acyl, alkoxycarbonyl, aryloxycarbonyl, sulfonyl or sulfamoyl group, wherein $R^{1c}$, $R^{2c}$, $R^{3c}$, $X^{1c}$ and $X^{2c}$ each independently represents a hydrogen atom, a halogen atom, or a substituent bonded to the benzene ring through its carbon, oxygen, nitrogen, sulfur or phosphorus atom, provided that at least one of $X^{1c}$ and $X^{2c}$ is a group represented by —$NR^4R^5$ wherein $R^4$ and $R^5$ each independently represents a hydrogen atom, or an alkyl, alkenyl, alkynyl, aryl or heterocyclic group, or a group represented by —C(=O)—R, —C(=O)—C(=O)—R, —$SO_2$—R, —SO—R, —P(=O)$(R)_2$, or —C(=NR')—R wherein R and R' each independently represents a hydrogen atom, or an alkyl, aryl, heterocyclic, amino, alkoxy or aryloxy group, and adjacent groups of these substituents may be bonded to each other to form a ring, wherein $X^{1d}$ represents a substituent, $X^{2d}$ to $X^{4d}$ each independently represents a hydrogen atom or a substituent, none of $X^{1d}$ to $X^{4d}$ is a hydroxy group and $X^{3d}$ is not a sulfonamide group, the substituents represented by $X^{1d}$ to $X^{4d}$ may be bonded to each other to form a ring, and $R^{1d}$ represents a hydrogen atom, or an alkyl, aryl, heterocyclic, amino or alkoxy group.

A twelfth aspect of the present invention provides a heat-developable photosensitive material according to the seventh aspect in which the content of silver arachidate in the non-photosensitive organic silver salt particles is 6% by mole or less.

A thirteenth aspect of the present invention provides a heat-developable photosensitive material according to the seventh aspect in which the content of silver behenate in the non-photosensitive organic silver salt particles is 95% by mole or more and 99.9% by mole or less.

A fourteenth aspect of the present invention provides a heat-developable photosensitive material according to the seventh aspect in which the content of silver behenate in the non-photosensitive organic silver salt particles is 97% by mole or more and 99.9% by mole or less.

A fifteenth aspect of the present invention provides a heat-developable photosensitive material according to the seventh aspect in which the non-photosensitive organic silver salt particles are prepared by adding an aqueous silver nitride solution, and a solution or suspension of an alkali metal salt of an organic acid to a closed mixing container.

A sixteenth aspect of the present invention provides a heat-developable photosensitive material according to the seventh aspect in which the non-photosensitive organic silver salt particles are desalted by ultrafiltration.

A seventeenth aspect of the present invention provides a heat-developable photosensitive material according to the seventh aspect in which at least some of the non-photosensitive organic silver salt particles are contained in a layer prepared from a coating solution, the coating solution including a solvent including water in a content of at least 80%.

A first aspect of the process of the present invention provides an image-forming process including the step of processing the following heat-developable photosensitive material for a heat-development time of 7 seconds or more and 15 seconds or less: a heat-developable photosensitive material including at least one photosensitive silver halide, a reducing agent for silver ions, a binder, and non-photosensitive organic silver salt particles on one surface of a support, the content of silver behenate in the non-photosensitive organic silver salt particles being 90% by mole or more and 99.9% by mole or less, and the photosensitive material including at least one development accelerator.

A second aspect of the process of the present invention provides an image-forming process, including the step of exposing the following heat-developable photosensitive material with a laser ray having an exposure wavelength of 600 nm to 1100 nm: a heat-developable photosensitive material including at least one photosensitive silver halide, a reducing agent for silver ions, a binder, and non-photosensitive organic silver salt particles on one surface of a support, the content of silver behenate in the non-photosensitive organic silver salt particles being 90% by mole or more and 99.9% by mole or less, and the photosensitive material including at least one development accelerator.

DESCRIPTION OF THE PREFERRED EMBODIMENTS

[Heat-developable Photosensitive Material: First Aspect]

Figure 1:
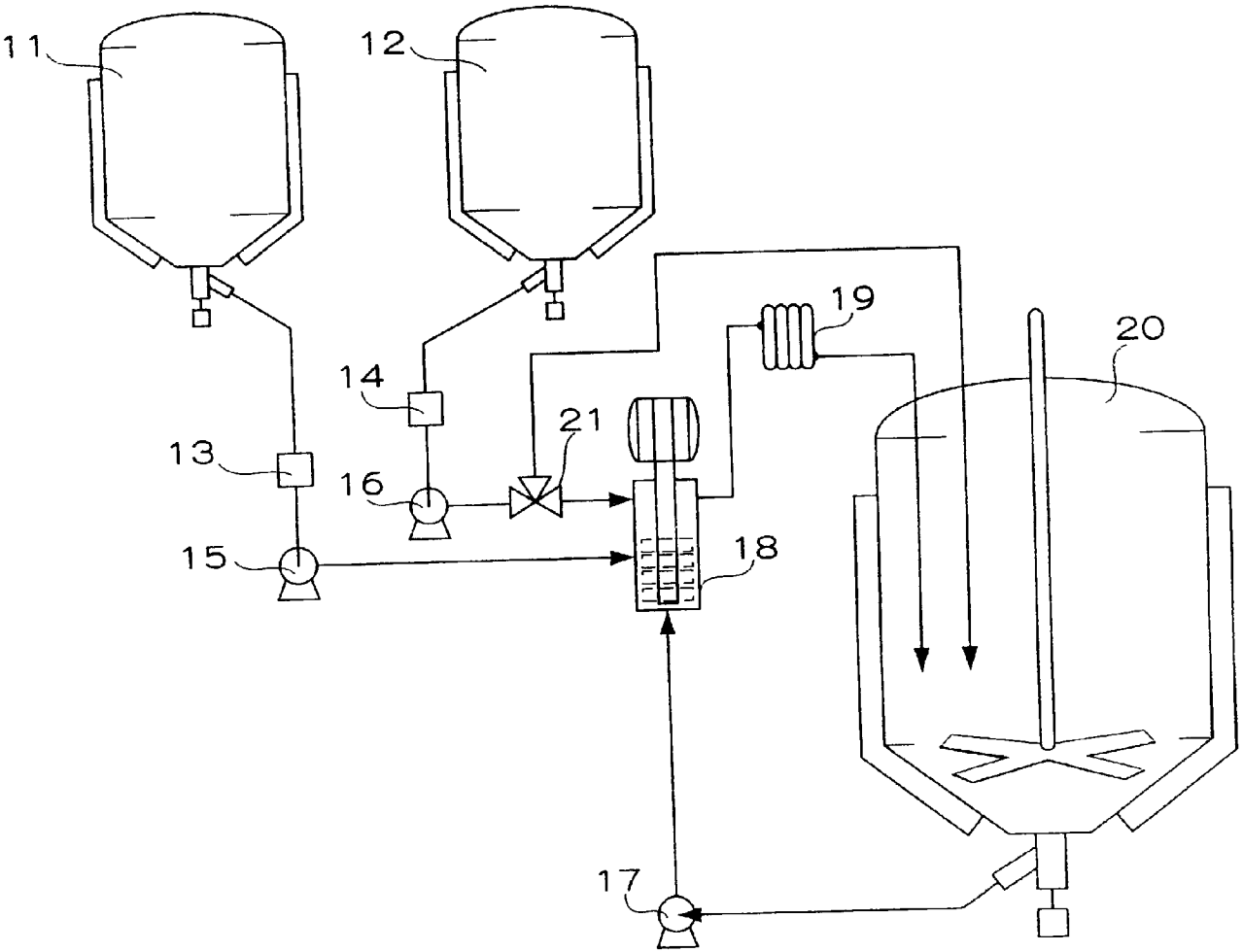
FIG. 1 illustrates an embodiment of a manufacturing apparatus of a non-photosensitive organic silver salt used in the present invention.

Hereinafter, among heat-developable photosensitive materials of the present invention, the first aspect will be described in detail below.

A heat-developable photosensitive material of the present invention includes at least one photosensitive silver halide, a reducing agent for silver ions, a binder and non-photosensitive organic silver salt particles on one surface of a support, wherein the content of silver behenate in the non-photosensitive organic silver salt particles is in the range from 90% by mol or more to 100% by mol or less and the reducing agent is a compound represented by the following general formula (I):

General Formula (I)

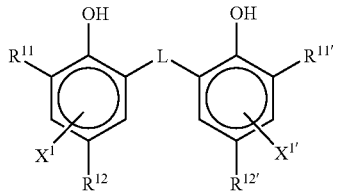

In the general formula (I), each of $R^{11}$ and $R^{11'}$ independently represents an alkyl group having 1 to 20 carbon atoms. Each of $R^{12}$ and $R^{12'}$ independently represents a hydrogen atom or a substituent with which the corresponding benzene ring can be substituted, L represents a —S— group or a —$CHR^{13}$— group. $R^{13}$ represents a hydrogen atom or an alkyl group having 1 to 5 carbon atoms. Each of $X^1$ and $X^{1'}$ independently represents a hydrogen atom or a substituent with which the corresponding benzene ring can be substituted.

More particularly, a heat-developable photosensitive material of the present invention has a layer (hereinafter, in some cases, may be referred to as "photosensitive layer") containing at least one photosensitive silver halide, a reducing agent for silver ions, a binder and non-photosensitive organic silver salt particles, and further has a non-photosensitive layer. And on the other surface of the support, it is preferable that it has a backing layer.

The photosensitive layer is consisted of one or more layers, and in the case where it is consisted of one layer, a photosensitive silver halide, non-photosensitive organic silver salt particles, a reducing agent and a binder are contained within the layer, and further, if necessary, a color tone adjuster, a coating auxiliary agent and the other auxiliary agents and the like are contained if it is desired. On the other hand, in the case where it is consisted of two layers, a photosensitive silver halide and non-photosensitive organic salt particles are contained in the first layer (usually, a layer adjacent to the support) and some other components are contained in the second layer or both layers.

At the photosensitive layer, a protective layer provided on a photosensitive layer side (further side from the support), an intermediate layer provided between a plurality of photosensitive layers and between a photosensitive layer and the protective layer, an undercoat layer provided between the photosensitive layer and the support, and the like are listed.

Moreover, on the other surface of the support (side opposing to the side on which the photosensitive layer is provided), it is preferable that a backing layer is provided.

<Non-photosensitive Organic Silver Salt Particle>

Here, non-photosensitive organic silver salt particles used for a heat-developable photosensitive material of the present invention will be described below.

The present invention is characterized in that the content of silver behenate in non-photosensitive organic silver salt particles is in the range from 90% by mol or more to 100% by mol or less.

A non-photosensitive organic silver salt according to the present invention (hereinafter, in some cases, may be simply referred to as "organic silver salt") is comparatively stable to light, however, in the case where the non-photosensitive organic silver salt is heated to 80° C. or more in the presence of a photocatalyst exposed to light (latent image of a photosensitive silver halide or the like) and a reducing agent, it is a silver salt forming a silver image.

As an organic silver salt, it may be any organic material containing a source which is capable of reducing a silver ion. As such non-photosensitive organic silver salts, these have been described in the official gazette of Japanese Patent Application Laid-Open (JP-A) No. 06-130543, JP-A No. 08-314078, JP-A No. 09-127643, the paragraph Nos. [0048] and [0049] of JP-A No. 10-62899, JP-A No. 10-94074, JP-A No. 10-94075, the paragraph from the 24th line of the 18th page to the 37th line of the 19th page of European Patent Publication No. 0803764 A1, European Patent Publication No. 0962812 A1, European Patent Publication No. 1004930 A2, JP-A No. 11-349591, JP-A No. 2000-7683, JP-A No. 2000-72711, JP-A No. 2000-112057, JP-A 2000-155383 and the like.

As a non-photosensitive organic silver salt according to the present invention, a silver salt of an organic acid is preferable, particularly a silver salt of fatty carboxylic acid having a long chain (having 10 to 30 carbon atoms, preferably having 15 to 28 carbon atoms) is preferable, and as preferable examples of silver salts of organic acids, silver behenate, silver arachidate, silver stearate, silver oleate, silver laurate, silver caproate, silver myristate, silver palmitate, their mixtures and the like are listed.

The present invention is characterized in that the content of silver behenate in non-photosensitive organic silver salt particles is in the range from 90% by mol or more to 100% by mol or less. As a result of this, the present invention is preferable from the viewpoint that an organic silver salt having a low Dmin and a high sensitivity and an excellent image-keeping property can be obtained, it is more preferable that it is in the range from 94% by mol or more to 100% by mol or less, and it is particularly preferable that it is in the range from 97% by mol or more to 100% by mol or less.

Moreover, in the present invention, it is preferable that the content of silver stearate in non-photosensitive organic silver salt particles is in the range of 1% by mol or less, and it is preferable that its sphere-equivalent diameter is in the range from 0.05 μm or more to 1 μm or less.

As a result of making the content of the silver stearate 1% by mol or less, a silver salt of an organic acid having a low Dmin and a high sensitivity and an excellent image-keeping property is obtained. As the content of the silver stearate, it is preferable that its content is 0.5% by mol or less, and it is particularly preferable that it is substantially not contained.

As a result of making the sphere-equivalent diameter be in the range from 0.05 μm or more to 1 μm or less, flocculation is not easily generated in the photosensitive material and the image-keeping property is excellent. As the sphere-equivalent diameter, it is preferable that it is in the range from 0.1 μm or more to 1 μm or less. In the present invention, a method for measuring a sphere-equivalent diameter shotting directly using an electron microscope and subsequently image-processing the negative film.

Furthermore, in the case where it contains silver arachidate as a silver salt of an organic acid, it is preferable that the content of silver arachidate is 6% by mol or less from the viewpoint of obtaining a low Dmin and a silver salt of an organic acid having an excellent image-keeping property, and it is more preferable that it is 3% by mol or less.

In a heat-developable photosensitive material of the present invention, it is preferable that a non-photosensitive organic silver salt particle is a squamiform particle, and it is more preferable that it is a squamiform particle having the slenderness ratio in the range from 1 or more to 9 or less.

In the present specification, a squamiform silver salt of an organic acid will be defined as follows: the silver salt of an organic acid is observed using an electron microscope. If the shape of the silver salt particle of the organic acid is approximate to that of a rectangular parallelopiped and the sides of this rectangular parallelopiped are measured to be a, b and c, from the shortest side (c may be equal to b), calculating by the shorter values, a and b, x is found by the following equation:

$$x=b/a$$

and $y=c/b$.

In this way, x and y are found for about 200 particles. If the average value is called x (average), particles satisfying the relationship 30≧x(average)≧1.5 are regarded as squamiform particles. It is preferably in the range of 30≧x (average)≧1.5, and more preferably in the range of 20≧x (average)≧2.0. Note that a particle in a needle shape is in the range of 1≦x(average)<1.5. Moreover, the average value of y, y (average), is defined as the slenderness ratio. As the slenderness ratio of a squamiform particle, it is preferable that this is in the range from 1 or more to 9 or less, and more preferable that it is in the range from 1 or more to 6 or less, and further preferable that it is in the range from 1 or more to 3 or less.

In the squamiform particle, a can be supposed as the thickness of a particle in a tubular shape in which the plane of b and c is made as the principal plane. It is preferable that the average of a is in the range from 0.01 μm or more to 0.23 μm or less, and it is more preferable that it is in the range of 0.1 μm or more to 0.20μm or less.

In the squamiform particle, it is defined that the sphere-equivalent diameter of a particle/a is the aspect ratio. As the aspect ratio of a squamiform particle, it is preferable that it is in the range from 1.1 or more to 30 or less from the viewpoint that it does not easily generate flocculation in the photosensitive material and the image-keeping property becomes excellent, and it is more preferable that it is in the range from 1.1 or more to 15 or less.

It is preferable that the particle size distribution of an organic silver salt is a monodispersed distribution. In the monodispersed distribution, a percentage (variation coefficient) corresponding to the standard deviation of volume-weighted average diameter of the organic silver salt divided by the volume-weighted average diameter, found by a method for finding the standard deviation of the volume-weighted average diameter of the organic silver salt, is preferably 100% or less, more preferably 80% or less and further preferably 50% or less. As a method of measuring this, it can be found, for example, from the particle size (volume-weighted average diameter) obtained by irradiating an organic silver salt dispersed in the liquid using a laser beam and by finding autocorrelation function with respect to a time change of fluctuation of its scattering beam.

[Preparation of Non-photosensitive Organic Silver Salt Particle]

A non-photosensitive organic silver salt particle in the present invention is preferable in such a point that it is prepared at the reaction temperature of 60° C. or less from the viewpoint that a particle having a low Dmin is prepared. As an agent to be added, for example, an alkali metal aqueous solution of an organic acid may be added at a temperature higher than the temperature of 60° C., however, the temperature of the reaction bath into which the reactive liquid is added is preferably at 60° C. or less. Furthermore, it is preferable that it is added at 50° C. or less, and particularly preferable that it is added at 40° C. or less.

Although a non-photosensitive organic silver salt particle in the present invention is prepared by reacting a solution containing silver ions such as silver nitrate and an alkali metallic salt solution of an organic acid or its suspension, it is preferable that the addition of 50% or more of the total additional silver amount is performed at the same time with the addition of the alkali metallic salt solution or its suspension of an organic acid. As a method for adding it, a method for adding it on the liquid level of the reaction bath, a method for adding it in the liquid, and further, a method for adding it in the sealing and mixing means described later and the like are listed, but any of these may be utilized.

Although one example of a method for preparing it by adding it in the sealing and mixing means will be described as follows, the present invention is not limited to this. FIG. 1 is one embodiment of a manufacturing apparatus of a non-photosensitive organic silver salt used in the present invention. In FIG. 1, a solution containing silver ions (e.g., silver nitrate aqueous solution) and an organic alkali metallic salt solution are stored in tanks 11, 12 by setting the predetermined temperature, respectively. The reference numerals 13 and 14 denote flow-meters for measuring a flow rate when these solutions are added to a mixing apparatus 18 sealed with and filled with liquids via pumps 15 and 16. In the present embodiment, a pump 17 for re-supplying the prepared organic silver salt dispersed matters as the third component to the mixing apparatus 18 is equipped. The liquid whose reaction is terminated within the mixing apparatus 18 is introduced into a heat exchanger 19 and rapidly cooled.

The pH of a solution containing silver ions used in the present invention (e.g., silver nitrate aqueous solution) is preferably a pH in the range from pH 1 or more to pH 6 or less, and further preferably a pH in the range from pH 1.5 or more to pH 4 or less. Furthermore, in order to adjust the pH, an acid and an alkali can be added. The kinds of acids and alkalies are not limited.

An organic silver salt in the present invention may be maturated by raising the reaction temperature after the addition of a solution containing silver ions (e.g., silver nitrate aqueous solution) and/or an alkali metallic salt solution of an organic acid is terminated. It is considered that the maturation in the present invention is different from the reaction temperature described above. At the time of maturation, the addition of a silver nitrate and an alkali metallic salt solution or suspension of an organic acid is not performed at all. It is preferable that the maturation is performed at the temperature in the range from the reaction temperature plus 1° C. or more to the reaction temperature plus 20° C. or less, and it is preferable that it is in the range from the reaction temperature plus 1° C. or more to the reaction temperature plus 10° C. or less. Note that it is preferable that the maturation time is determined by performing the method of trial and error.

In the preparation of an organic silver salt in the present invention, the addition of an alkali metallic salt solution of an organic acid may be performed the number of times from two times or more to six times or less by dividing it. As a result of dividing the portions and adding these here, for example, addition for enhancing the photographic performance, addition for changing the hydrophilic nature of the surface and the like can give a variety of functions to the particle. The number of the divided additions is preferably in the range from two times or more to four times or less. Now, since a salt of an organic acid is solidified unless it is at a high temperature, when the divided additions are performed, it is necessary to consider to have a plurality of addition lines for dividing it or contrive a method for circulating it or the like.

In the preparation of an organic silver salt in the present invention, it is preferable that the amount ranging from 0.5% by mol or more to 30% by mol or less of the number of moles of the total addition of an alkali metallic salt solution of an organic acid is singly added after the addition of a solution containing silver ions is terminated. It is preferable that the amount ranging from 3% by mol or more to 20% by mol or less is singly added. It is preferable that this addition is performed with one portion of the divided addition amount. This may be added in the sealing and mixing means or in any of the reaction bathes, but it is preferable that this is added in the reaction bath. The hydrophilic nature of the surface of the particles can be enhanced by carrying out this addition, as a result of it, the layer preparing property of the sensitive material is made better, and the layer peeling off is improved.

Although the silver ion concentration of a solution containing silver ions used in the present invention is optionally determined, it is preferable that as a molar concentration, it is in the range from 0.03 mol/L or more to 6.5 mol/L or less, and it is more preferable that it is in the range from 0. 1 mol/L or more to 5 mol/L or less.

Upon carrying out the present invention, in order to form a non-photosensitive organic silver salt particle, in at least one of a solution containing silver ions, an alkali metallic salt solution or its suspension of an organic acid and a solution previously prepared in a reactive bath, it is preferable that an alkali metallic salt of an organic acid contains an amount capable of making it a substantially transparent solution but does not contain an associated body in a string shape and a micelle. Although the solution may be a single organic solvent, it is preferable that it is a mixed solution with water.

As an organic solvent used in the present invention, if it is water soluble and has the above-described natures, the kind of it is not particularly limited, but it is not preferable if it interferes with the photographic performances, it is preferable that it is an alcohol, acetone or the like capable of being mixed with water, and it is further preferable that it is the tertiary alcohol having 4 to 6 carbon atoms.

It is preferable that an alkali metal of the alkali metallic salt of an organic acid is concretely Na, K. An alkali metallic salt of an organic acid is prepared by adding NaOH or KOH to the organic acid. At this time, it is preferable that the amount of alkali is made to be the equivalent weight or less of the organic acid and non-reacted organic acid is remained. The residual amount of the organic acid in this case is in the range from 3% by mol or more to 50% by mol or less, and preferably in the range from 3% by mol or more to 30% by mol or less with respect to the total amount of the organic acid. Moreover, after an alkali is added more than the desired amount, an acid such as nitric acid, sulfuric acid or the like is added, and it may be prepared by neutralizing the portion of the excessive alkali.

Furthermore, as a solution containing silver ions and an alkali metallic salt solution of an organic acid or a liquid of a sealing and mixing container in which the above-described both solutions are added, for example, a compound indicated by the general formula (1) described in JP-A No. 62-65035 gazette, nitrogen heterocyclic compound containing a water-soluble group as described in JP-A No. 62-150240 gazette, inorganic peroxide as described in JP-A No. 50-101019 gazette, a sulfur compound as described in JP-A No. 51-78319 gazette, a disulfide compound and hydrogen peroxide as described in JP-A No. 57-643 gazette or the like can be added.

As an alkali metallic salt solution of an organic acid used in the present invention, it is preferable that the amount of an organic solvent is in the range from 3% or more to 70% or less as a solvent volume with respect to the volume of water, and it is more preferable that it is in the range from 5% or more to 50% or less. At the time, since the optimal solvent volume changes at the reaction temperature, the optimal amount can be determined by performing a method of trial and error.

The concentration of an alkali metallic salt of an organic acid used in the present invention is in the range from 5% by weight or more to 50% by weight or less as weight ratio, it is preferable that it is in the range from 7% by weight or more to 45% by weight or less, and further preferable that it is in the range from 10% by weight or more to 40% by weight or less.

As a temperature of tertiary alcohol of an alkali metallic salt of an organic acid that is added into the sealing and mixing means or reaction container, it is preferable that it is in the range from 50° C. or more to 90° C. or less for the purpose of maintaining the required temperature so as to avoid the phenomena of crystallization and solidification of an alkali metallic salt of an organic acid, and more preferable that it is in the range from 60° C. or more to 85° C. or less, and most preferable that it is in the range from 65° C. or more to 85° C. or less. Moreover, in order to control the reaction temperature at a certain level, it is preferable that a certain level of the temperature selected from the above-described range is controlled.

As a result of having done it, the speed at which the tertiary alcohol aqueous solution of an alkali metallic salt of an organic acid at a high temperature is rapidly cooled down in the sealing and mixing means and precipitated into a refined, crystallized shape, and the speed at which it is made an organic silver salt by the reaction with a solution containing silver ions are preferably controlled, then the crystallization form of the organic silver salt, the size of the crystal, crystal size distribution can be preferably controlled. And at the same time, as a heat-developable material, particularly as a heat-developable photosensitive material, the performances can be enhanced.

In the reaction container, a solvent may have been previously contained, and water is preferably used as a solvent previously put, however, mixed solvent with the tertiary alcohol is preferably used.

A dispersion auxiliary agent soluble to an aqueous medium can be added to the tertiary alcohol aqueous solution of an alkali metallic salt of an organic acid, a solution containing silver ions, or a reaction solution. As a dispersion auxiliary agent, any may be used if it is capable of dispersing the formed organic silver salt. As a concrete example, it is in conformity with the description on the dispersion auxiliary agent of an organic silver salt described later.

In a method for preparing an organic silver salt, it is preferable that desalting/dehydration step is performed after the silver salt is formed. There are no limitations for its method, a means which is well known/commonly used can be used. For example, a well known method for filtering such as a centrifugal filtration, an absorption filtration, an ultrafiltration, a flock-forming washing with water by a condensation method, or the like, and the removal of supernatant by centrifuge separation precipitation or the like are preferably used. Desalting/dehydration may be performed once, or may be repeated a plurality of times. The addition and removal of water may be performed in series, or may be performed individually. As the desalting/dehydration, it is preferable that the desalting/dehydration is performed in such a degree that the conductivity of water finally dehydrated is 300 μS/cm or less, it is more preferable that it is performed in such a degree that the conductivity is 100 μS/cm or less, and it is most preferable that it is performed in such a degree that the conductivity is 60 μS/cm or less. There is no particular lower limit of the conductivity in this case, however, usually the lower limit is about 5 μS/cm.

As an ultrafiltration method, for example, a method used for desalting /condensation of silver halide emulsion can be applied. Research Disclosure No. 10: 208 (1972), No. 13: 122(1975), No. 16:351 (1977) and the like can be made reference to. The pressure difference and flow rate which are important as operational conditions can be selected with reference to the characteristic curves described in Haruhiko Ohya "Membrane Technologies Handbook", Saiwai Shobo Publishing (1978), pp. 275, however, it is necessary to find out the optimal conditions for the purpose of suppressing flocculation of the particles and fogging upon processing dispersed matter of the organic silver salt of the object. Moreover, in a method for refilling the solvent which is lost through the membrane permeability, there are a constant volume method for adding a solvent in series and a batch method for dividing a solvent in an intermittent manner and adding, however, the constant volume method is preferable since the desalting processing time is relatively short.

As a solvent thus refilled, purewater obtained by performing the ion exchange or distillation is used, however, in order to maintain the pH value of the object, a pH adjusting agent or the like may be mixed, may be directly added to the organic silver salt dispersed matter.

As an ultrafiltration membrane, a tabular type, a spiral type, a cylindrical type, a hollow fiber type and the like already incorporated as a module are commercially available from Asahi Kasei, Daicel Chemical, Toray, Nittoh Electric Engineering and the like, however, from the viewpoints of the total membrane area and washability, a spiral type or a hollow fiber type is preferably used.

Moreover, it is preferable that the fraction molecular weight which is to be an index of threshold of the component capable of permeating the membrane is ⅕ or less of the molecular weight of the polymer dispersing agent which is to be used.

As a dehydration by an ultrafiltration in the present invention, it is preferable that the liquid has been previously dispersed to such an extent that the size of a particle is made about 2-fold of the final particle size at the deposition weighted average prior to the processing. As a dispersing means, any method such as a highly pressurized homogenizer, a microfluidizer or the like described later may be used.

It is preferable that the temperature of the liquid is maintained at a low temperature until the desalting operation is proceeded from the step after the formation of the particle. This is because when an organic solvent used at the time when an alkali metallic salt of an organic acid is dissolved is in a state where it permeates through the particle of the generated organic silver salt, a silver nucleus is easily generated by the shearing field and pressure field at the time when the permeation of the liquid is operated and it passes through the ultrafiltration membrane. Therefore, in the present invention, the ultrafiltration operation is performed while maintaining the temperature of an organic silver salt particle dispersed matter in the range from 1 to 30° C., and preferably while maintaining in the range from 5° C. to 25° C.

Furthermore, in order to make the coated surface state of a heat-developable materials, particularly heat-developable photosensitive material, it is preferable that a dispersing agent is added to the organic silver salt which has been desalted, dehydrated and dispersed to be a refined, dispersed matter.

The known method or the like can be applied to a method for manufacturing an organic silver salt and its method for dispersing it, which are used in the present invention. For example, the above-described official gazette of JP-A No. 08-234358, JP-A No. 10-62899, European Patent Publication No. 0803763 A1, European Patent Publication No. 0962812 A1, JP-A No. 11-349591, JP-A No. 2000-7683, JP-A No. 2000-72711, JP-A No. 2000-53682, JP-A No. 2000-75437, JP-A No. 2000-86669, JP-A No. 2000-143578, JP-A No. 2000-178278, JP-A No. 2000-256254, the respective specifications of Japanese Patent Application No. 11-348228-348230, Japanese Patent Application No. 11-203413, Japanese Patent Application No. 11-115457, Japanese Patent Application No. 11-180369, Japanese Patent Application No. 11-297964, Japanese Patent Application No. 11-157838, Japanese Patent Application No. 11-202081, Japanese Patent Application No. 2000-90093, Japanese Patent Application No. 2000-195621, Japanese Patent Application No. 2000-191226, Japanese Patent Application No. 2000-213813, Japanese Patent Application No. 2000-214155, Japanese Patent Application No. 2000-191226 can be made reference to.

As a method for dispersing an organic silver salt into a refined particle, it can be mechanically dispersed by utilizing the known refining means (for example, a high speed mixer, a homogenizer, a high speed impact mill, a Banbury mixer, a homomixer, a kneader, a ball mill, a vibrating ball mill, a planetary ball mill, an attaritor, a sand mill, a beads mill, a collide mill, a jet mill, a roller mill, a thoron mill and a high speed stone mill).

In order to obtain a small particle sized, uniform fatty silver salt solid dispersed matter having a high S/N ratio without flocculation, it is preferable that a large force is uniformly given in such a range that the damage of the organic silver salt particle which is an image formation medium and the organic silver salt particle being at a high temperature are not generated. Therefore, a dispersing method for dropping the pressure after the dispersed matter consisted of an organic silver salt and dispersing agent solution is converted into a high speed flow is preferable. As a dispersing medium, in this case, any may be used if it is the solvent with which the dispersing auxiliary agent functions, however, it is preferable that it is only water, but it may contain an organic solvent if it is 20 wt % or less. Moreover, since the fogging is raised and the sensitivity is significantly lowered if a photosensitive silver salt is coexistent with it at the time when it is dispersed, it is more preferable that it substantially does not contain the photosensitive silver salt at the time when it is dispersed. In the present invention, the amount of a photosensitive silver salt in a dispersion liquid where it is dispersed is 0.1 mol % or less with respect to 1 mol of the organic silver salt in the liquid, and it is preferable that the photosensitive silver salt is not added.

On a dispersing apparatus and its technology used for carrying out a method for re-dispersing as described above, for example, the detailed descriptions are described in "Dispersing system rheology and dispersing technology" (Toshio Kajiuchi and Hiromoto Usui: 1991, Shinzansha Publishing, Co., Ltd., pp. 357–403), "The progress of chemical Engineering, the 24th collection" (Chemical Engineering Society Incorporated Association, Tokai Branch Office Ed; 1990, Maki Shoten, pp. 184–185), JP-A No. 59-49832, U.S. Pat. No. 4,533,254, JP-A No. 08-137044, JP-A No. 08-238848, JP-A No. 02-261525, JP-A No. 01-04933, or the like, a method for re-dispersing in the present invention is a method for performing a refined dispersion by generating the rapid pressure dropping in the dispersing liquid after a dispersing liquid containing at least an organic silver salt is pressurized by a high pressure pump or the like, intromitted into the piping, and then made it pass through a narrow slit provided within the piping.

On a high pressure homogenizer, in general, it is considered that (a) a "sheering force" generated at the time when a dispersoid passes through the narrow gap (about 75 μm–about 350 μm) at a high pressure and high speed, and (b) an impact force generated at the time when the liquid-liquid impact is enforced in a narrow space highly pressurized or wall surface is enforced is not changed, a cavitation force due to the subsequent pressure dropping is further reinforced, and a uniform, efficient dispersion is carried out. As this kind of dispersing apparatus, a Gorlin homogenizer has been listed from old times, however, in this apparatus, the dispersed liquid intromitted at a high pressure is converted into a high speed flow in a narrow gap on the cylindrical surface, the energized flow strikes on the surrounding wall surface, and the emulsification/dispersion is carried out by its impact. As the above-described liquid-liquid impact, a Y type chamber of a microfluidizer, a spherical chamber utilizing a spherical type check valve and the like are listed, as a liquid-wall surface impact, a Z type chamber of a microfluidizer and the like are listed. The utilized pressure is, in general, in the range from 100 to 600 kg/cm$^2$ (from 1 to 6 MPa), the flow rate is in the range from several to 30 m/sec, the devices in which the number of times of the coalitions is increased by making the high speed flow section in a tooth of saw shape have been also devised. As such a representative apparatus, a Gorlin homogenizer, a microfluidizer made by Mirofluidex International Corporation, a microfluidizer made by Mizuho Industry, Co., Ltd., a nanomizer made by Tokushu Kika Kogyo, Co., Ltd., and the like are listed. These have been also described in JP-A No. 08-238848, JP-A No. 08-103642 and U.S. Pat. No. 4,533,254.

Although an organic silver salt can be dispersed into a desired particle size by adjusting the flow rate, the pressure difference at the time when the pressure is dropped and the processing number of times, from the viewpoint of photograph characteristics and particle size, it is preferable that the flow rate is in the range from 200 to 600 m/sec, the pressure difference at the time when the pressure is dropped is in the range from 900 to 3000 kg/cm$^2$ (from 9 to 300 MPa), and further, it is more preferable that the flow rate is in the range from 300 to 600 m/sec, the pressure difference is in the range from 1500 to 3000 kg/cm$^2$ (from 15 to 30 MPa). The number of times of dispersion processing can be selected according to the necessity. Usually, the range from once to 10 times is selected, however, from the viewpoint of the productivity, the range from once to three times or the like is selected. It is not preferable from the viewpoints of dispersion property/photographic property that the temperature of such a dispersion liquid is raised to a high temperature under the high pressure, the particle size is easily enlarged at such a high temperature such as over 90° C. or the like and the fogging tends to be increased. Therefore, it is preferable that a cooling apparatus is included in the step prior to the step in which it is converted into the a high pressure, a high speed flow, or the step after the pressure is dropped, or a cooling apparatus is included in both steps, the temperature of such a dispersion is maintained in the range from 5 to 90° C. and it is further preferable that it is maintained in the range from 5 to 80° C., and it is particularly preferable that it is maintained in the range from 5 to 65° C. It is particularly effective to set the cooling apparatus at the time when the dispersion is performed at a high pressure ranging from 1500 to 3000 kg/cm$^2$ (from 15 to 30 MPa).

As a cooling apparatus, according to the predetermined heat exchange amount, a cooling apparatus using a static mixer for duplex tube and triplet tube, a multitube type heat exchanger, a hose type heat exchanger or the like can be appropriately selected. Moreover, in order to enhance the efficiency of the heat exchanging, the size of the tube, the thickness, the quality of the material and the like may be selected in consideration of utilized pressure. As a refrigeration medium used for the cooler, from the viewpoint of heat exchanging amount, a refrigeration medium such as water from a well at the temperature of 20° C., chilled water at the temperature ranging from 5 to 10° C. processed in a refrigerator and ethylene glycol/water or the like at the temperature of −30° C. can be used according to the necessity.

When an organic silver salt is solidified and refined into a particle using a dispersing agent, for example, a synthesizing anionic polymer such as polyacrylate, acrylate copolymer, maleate copolymer, maleic acid monoester copolymer, acryloyl-methylpropane sulfonate compolymer and the like, a semi-synthesized anionic polymer, such as carboxymethyl starch, caroxymethyl cellulose and the like, anionic polymer such as alginate polymer, pectate polymer and the like, an anionic surfactant described in JP-A No. 52-92716, WO 88/04794 and the like, a compound described in Japanese Patent Application No. 07-350753 or the known anionic, nonionic, cationic surfactants, and the other known polymers such as polyvinyl alcohol, polyvinyl pyrrolidone, carboxymethyl cellulose, hydroxypropyl cellulose, hydroxypropylmethyl cellulose, and the like or polymer compounds existing in the nature such as gelatin and the like can be appropriately selected and used. Moreover, in case where a solvent is uses as a dispersion medium, polyvinyl butyral, butylethyl cellulose, methacrylate copolymer, maleic anhydride ester copolymer, polystyrene and butadiene-styrene copolymer and the like are preferably used.

Although it is a general method in which a dispersing auxiliary agent is mixed with an organic silver salt in a powder or in a wet cake prior to the dispersion and intromitted into a dispersing apparatus as a slurry, a method may be used in which an organic silver salt powder or wet cake is made by performing the processing with heat treatment or solvent in a state of previously having mixed with an organic silver salt. The pH may be controlled by a suitable pH preparation agent before and after the dispersion or during the dispersion.

Except that the dispersion is performed by mechanical force, a coarse dispersion may be performed in the solvent by controlling pH, and subsequently, the refining of the particle may be performed by changing pH in the presence of a dispersion auxiliary agent. At this time, as a solvent used for coarse dispersion, a fatty acid solvent may be used.

It should be noted that since the fogging is increased and the sensitivity is significantly lowered if a photosensitive silver salt is coexistent with an organic silver salt at the time when the organic silver salt is dispersed, it is more preferable that it substantially does not contain the photosensitive silver salt at the time when the organic silver salt is dispersed. In the present invention, the amount of a photosensitive silver salt in a dispersion liquid where it is dispersed is 0.1% by mol or less with respect to 1 mol of the organic silver salt in the liquid, it is preferable that the photosensitive silver salt is not added.

In the present invention, although it is possible that a photosensitive material is manufactured by mixing an organic silver salt aqueous dispersion liquid and a photosensitive silver salt aqueous dispersion liquid and the mixture ratio of the organic silver salt and the photosensitive silver salt is selected according to the objects, the ratio of the photosensitive silver salt to the organic silver salt is preferably in the range from 1 to 30% by mol, further preferably in the range from 3 to 20% by mol, and particularly preferably in the range from 5 to 15% by mol. Upon mixing, a method in which two kinds or more of the organic silver salt aqueous dispersion liquid and two kinds or more of the photosensitive silver salt aqueous dispersion liquid are mixed is preferably used in order to adjust the photographic properties.

Although an organic silver salt of the present invention can be used in a desired amount, as a silver amount, the range from 0.1 to 5 g/m$^2$ is preferable and it is more preferable that it ranges from 1 to 3 g/m$^2$.

<Reducing Agent>

A heat-developable photosensitive material of the present invention includes at least one photosensitive silver halide, a reducing agent for silver ions, a binder and non-photosensitive organic silver salt particles on one surface of a support, wherein the content of silver behenate in the non-photosensitive organic silver salt particle is in the range from 90% by mol or more to 100% by mol or less and the reducing agent is a compound represented by the following general formula (I):

General Formula (I)

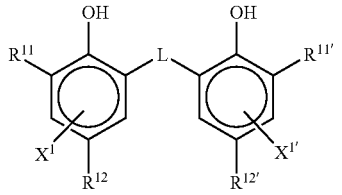

In the general formula (I), each of $R^{11}$ and $R^{11'}$ independently represents an alkyl group having 1 to 20 carbon atoms. Each of $R^{12}$ and $R^{12'}$ independently represents a hydrogen atom or a substituent with which the corresponding benzene ring can be substituted. L represents a —S— group or a —CHR$^{13}$— group. $R^{13}$ represents a hydrogen atom or an alkyl group having 1 to 5 carbon atoms. Each of $X^1$ and $X^{1'}$ independently represents a hydrogen atom or a substituent with which the corresponding benzene ring can be substituted.

In a heat-developable photosensitive material of the present invention, when the content of silver behenate in a non-photosensitive organic silver salt particle is in the range from 90% by mol or more to 100% by mol or less, an heat-developable photosensitive material having a low Dmin and an excellent image-keeping property can be obtained, and further, a high sensitive heat-developable photosensitive material having a high developing activity without delaying the development, and having the slight fogging on a non-imaging section can be obtained.

The general formula (I) will be described in detail below.

Each of $R^{11}$ and $R^{11'}$ independently represents a substituted or unsubstituted alkyl group having 1 to 20 carbon atoms. Substituents of the alkyl group are not particularly limited, but an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a halogen atom and the like are preferably listed.

Each of $R^{12}$ and $R^{12'}$ independently represents a hydrogen atom or a substituent with which the corresponding benzene ring can be substituted, each of $X^1$ and $X^{1'}$ independently represents a hydrogen atom or a substituent with which the corresponding benzene ring can be substituted. As groups capable of being substituted with benzene rings, respectively, an alkyl group, an aryl group, a halogen atom, an alkoxy group and an acyl amino group are preferably listed.

L represents a —S— group or a —CHR$^{13}$— group. $R^{13}$ represents a hydrogen atom or an alkyl group having 1 to 5 carbon atoms, and the alkyl group may have a substituent.

As a concrete example of an alkyl group which is unsubstituted, a methyl group, an ethyl group, a propyle group, a butyl group, a heptyl group, an undecyl group, an isopropyl group, a 1-ethylpentyl group, a 2,4,4-trimethylpentyl group and the like are preferably listed.

As an example of a substituent of the alkyl group, similarly to a substituent of $R^{11}$, a halogen atom, an alkoxy group, an alkylthio group, an aryloxy group, an arylthio group, an acylamino group, a sulfonamide group, a sulfonyl group, a phosphryl group, an oxycarbonyl group, a carbamoyl group, a sulfamoyl group and the like are preferably listed.

As the $R^{11}$ and $R^{11'}$, a secondary or tertiary alkyl group having 3 to 15 carbon atoms is preferred, and concretely, an isopropyl group, an isobutyl group, a t-butyl group, a t-amyl group, a t-octyl group, a cyclohexyl group, a cyclopentyl group, a 1-methylcyclohexyl group, a 1-methylcyclopropyl group and the like are preferably listed, and as the $R^{11}$ and $R^{11'}$, a secondary or tertiary alkyl group having 3 to 8 carbon atoms is more preferred, among these, a t-butyl group, a t-amyl group, and a 1-methylcyclohexyl group are further preferred, and a t-butyl group is most preferred.

As the $R^{12}$ and $R^{12'}$, an alkyl group is preferred, and an alkyl group having 1 to 20 carbon atoms is more preferred, concretely, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group and the like are preferably listed, and more preferably a methyl group, an ethyl group, a propyl group, an isopropyl group, a t-butyl group and the like are listed.

As the $X^1$ and $X^{1'}$, a hydrogen atom, a halogen atom, and an alkyl group are preferred, and a hydrogen atom is more preferred.

As the L, —CHR$^{13}$ — group is preferred.

As the $R^{13}$, a hydrogen atom or an alkyl group having 1 to 5 carbon atoms is preferred, and as the alkyl group, a methyl group, an ethyl group, a propyl group, an isopropyl group, a 2,4,4-trimethylpentyl group are preferably listed.

As $R^{13}$, particularly, a hydrogen atom, a methyl group, a propyl group or an isopropyl group is preferred.

In the case where the $R^{13}$ is a hydrogen atom, as the $R^{12}$ and $R^{12'}$, an alkyl group having 1 to 5 carbon atoms is preferred, a methyl group, an ethyl group, a propyl group are more preferred, and a methyl group and an ethyl group are most preferred.

In the case where the $R^{13}$ is a primary or secondary alkyl group having 1 to 5 carbon atoms, as the $R^{12}$ and $R^{2'}$, a methyl group is preferred. As a primary or secondary alkyl group having 1 to 5 carbon atoms, a methyl group, an ethyl group, a propyl group and an isopropyl group are more preferred, and a methyl group, an ethyl group and a propyl group are further preferred.

In the case where all of the $R^{11}$, $R^{11'}$, $R^{12}$ and $R^{12'}$ are methyl groups, as $R^{13}$, the secondary alkyl group is preferred, in this case, as the secondary alkyl group of $R^{13}$, an isopropyl group, an isobutyl group and a 1-ethylpentyl group are preferred, and an isopropyl group is particularly preferred.

As a compound represented by the general formula (I), it is particularly preferred that each of $R^{11}$ and $R^{11'}$ independently represents the secondary or tertiary alkyl group independently having 3 to 8 carbon atoms, each of $R^{12}$ and $R^{12'}$ independently represents an alkyl group, L represents —$CHR^{13}$— group, $R^{13}$ represents an hydrogen atom or an alkyl group having 1 to 5 carbon atoms, and $X^1$ and $X^{1'}$ represent hydrogen atoms.

Hereinafter, concrete examples of compounds represented by the general formula (I) which is a reducing agent of the present invention (exemplified compounds from I-2 to I-27) are indicated, but the present invention is not limited at all by these.

(I-2)

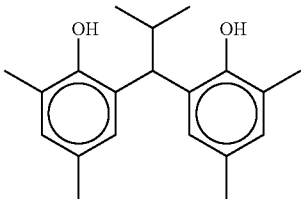

(I-3)

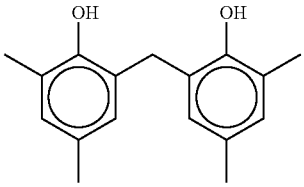

(I-4)

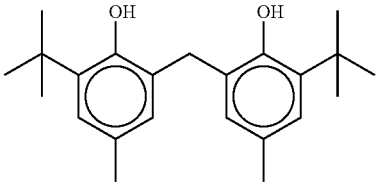

(I-5)

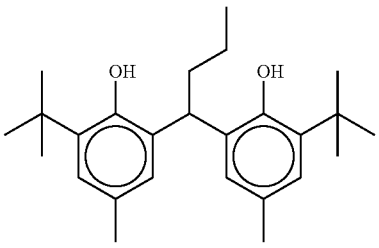

-continued (I-6)

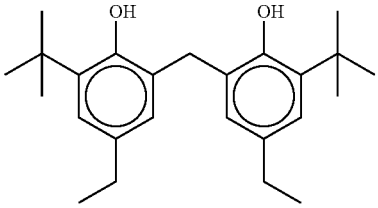

(I-7)

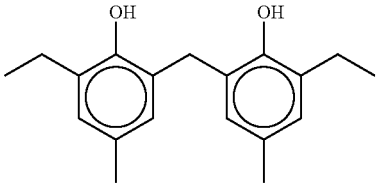

(I-8)

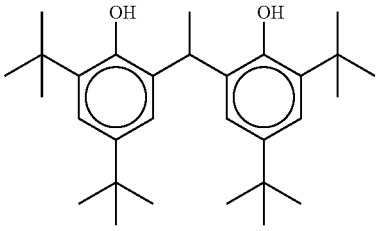

(I-9)

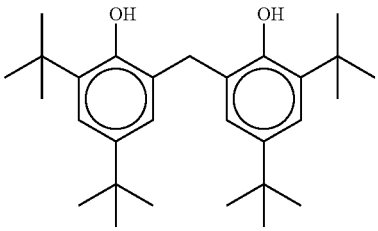

(I-10)

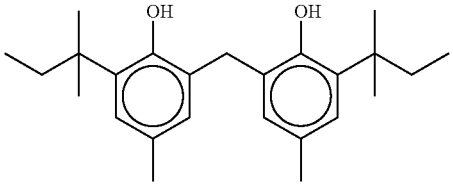

(I-11)

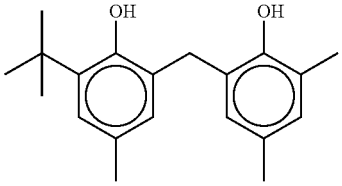

(I-12)

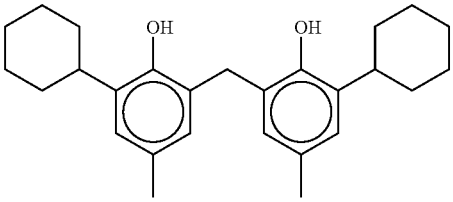

-continued
(I-13)
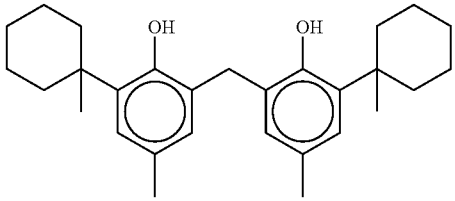
(I-14)
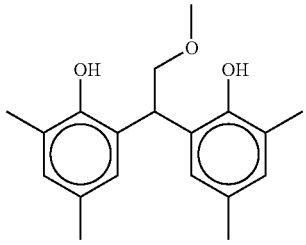
(I-15)
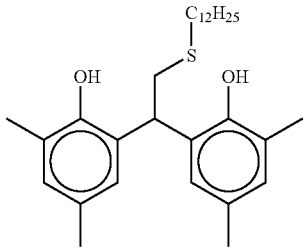
(I-16)
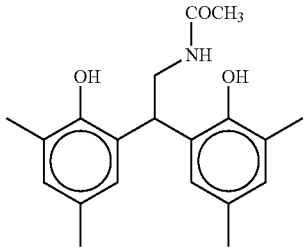
(I-17)
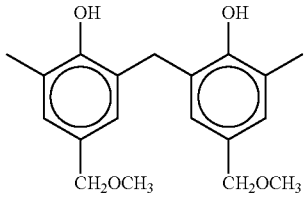
(I-18)
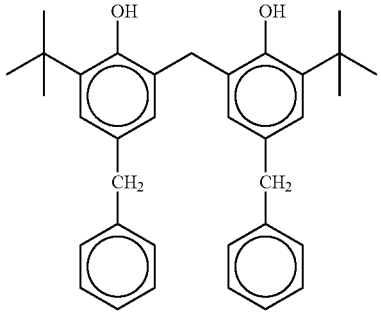
-continued
(I-19)
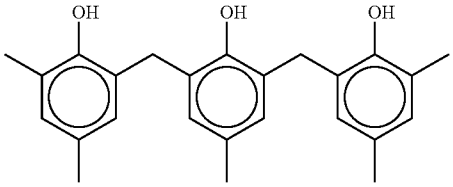
(I-20)
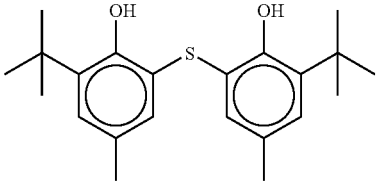
(I-21)
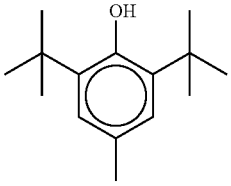
(I-22)
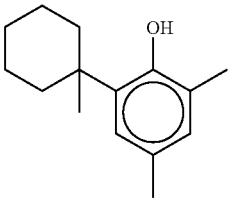
(I-23)
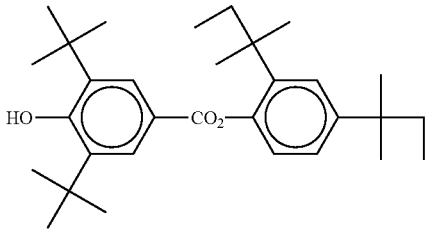
(I-24)
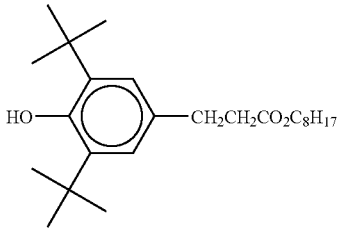
(I-25)
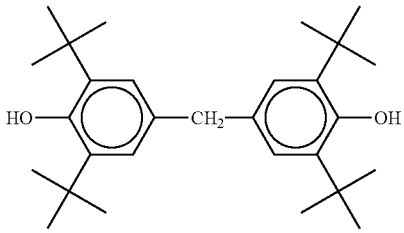

-continued (I-26)

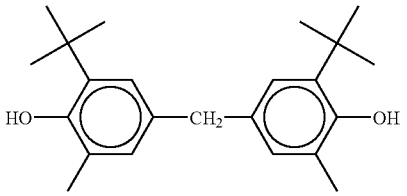

(I-27)

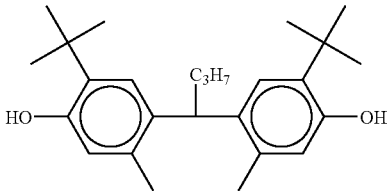

In the present invention, as a reducing agent of an organic silver salt, the other reducing agent may be used in combination with a compound represented by the general formula (I). As a reducing agent for an organic silver salt which can be used in combination, it may be any material (preferably, organic material) capable of reducing a silver ion to a metal silver. Such a reducing agent has been described in the paragraph numbers of [0043] to [0045] of JP-A No. 11-65021, and the paragraph from the 34th line of the seventh page to the 12th line of the 18th page of European Patent Publication No. 0803764 A1. Among these, reducing agents of hindered phenols reducing agents and bisphenol reducing agents are preferred.

As an additive amount of a reducing agent represented by the general formula (I) in the present invention, it is preferable that it is in the range from 0.01 to 5.0 g/m$^2$, and it is more preferable that it is in the range from 0.1 to 3.0 g/m$^2$, then, it is preferable that the content of it ranges from 5 to 50% by mol with respect to silver 1 mol on the surface having the image formation layer, and it is more preferable that it ranges from 10 to 40% by mol.

Moreover, it is preferable that the reducing agent is contained in an image formation layer.

In the present invention, the reducing agent is made contained in a coating liquid by any method such as in a solution form, an emulsion dispersion form, a solid refined particle dispersed matter form and the like and may be contained in a photosensitive material.

As a well known emulsion dispersion method, a method for mechanically preparing an emulsion dispersed matter using an oil such as dibutylphthalate, tricresyl phosphate, glyceryl triacetate or diethyl phthalate and the like, an auxiliary solvent such as ethyl acetate, cyclohexanone and the like are listed.

Moreover, as a method for dispersing a solid refined particle, a method for preparing a solid dispersed matter by dispersing the powder of a reducing agent in an appropriate solvent such as water or the like using a ball mill, a collide mill, a vibrating ball mill, a sand mill, a jet mill, a roller mill or supersonic wave. Note that a protective colloid (e.g., polyvinyl alcohol), a surfactant (e.g., anionic surfactant such as sodium triisopropyl naphthalene sulfonate (mixture of three kinds of isopropyl groups whose substitution positions are different)) may be used at the time. Antiseptic agent (e.g., benzoisothiazolinone sodium salt) can be contained in an aqueous dispersed matter.

For a heat-developable photosensitive material of the present invention, a phenol derivative represented by the formula (A) described in the specification of Japanese Patent Application No. 11-73951 as a development accelerator is preferably used.

<Hydrogen-bonding Compound>

It is preferable that in a heat-developable photosensitive material of the present invention, a hydrogen-bonding compound is contained on one surface of the support.

As the hydrogen-bonding compound, since a compound represented by the general formula (I) of the present invention is a reducing agent of bisphenols having a hydroxyl group (—OH) of an aromatic character, it is preferable that a non-reducing compound having a group capable of forming a hydrogen bonding with such a group is used.

As a group for forming a hydrogen bonding with a hydroxyl group or an amino group, a phosphoryl group, a sulfoxide group, a sulfonyl group, a carobonyl group, an amide group, an ester group, an urethane group, an ureido group, a tertiary amino group, an aromatic group containing nitrogen and the like are listed. Among these, a compound having a phosphoryl group, a sulfoxide group, an amide group (however, not having >N—H group but blocked as >N—Ra (Ra represents a substituent except for H)), an urethane group (however, not having >N—H group but blocked as >N—Ra (Ra represents a substituent except for H)) and ureido group (however, having >N—H group but blocked as >N—Ra (Ra represents a substituent except for H)) is preferred.

In the present invention, particularly preferred hydrogen-bonding compound is a compound represented by the following general formula (II):

General Formula (II)

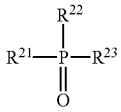

In the general formula (II), each of $R^{21}$, $R^{22}$ and $R^{23}$ independently represents an alkyl group, an aryl group, an alkoxy group, an aryloxy group, an amino group or a heterocyclic group, and these groups may be a group which is unsubstituted, or have a substituent. Moreover, among $R^{21}$, $R^{22}$ and $R^{23}$, any two may form a ring by bonding each other.

As a substituent in the case where $R^{21}$, $R^{22}$ and $R^{23}$ have a substituent, a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group and the like are listed, among these, an alkyl group or an aryl group is preferred, for example, a methyl group, an ethyl group, an isopropyl group, a t-butyl group, a t-octyl group, a phenyl group, a 4-alkoxyphenyl group, a 4-acyloxyphenyl group or the like is more preferred.

As the alkyl group represented by $R^{21}$, $R^{22}$ and $R^{23}$, concretely, a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group and a 2-phenoxypropyl group are listed, among these, a cyclohexyl group, a 1-metyl cyclohexyl group, a benzyl group, a phenetyl group, a 2-phenoxypropyl group are preferred.

As the aryl group represented by $R^{21}$, $R^{22}$ and $R^{23}$, a phenyl group, a cresyl group, a xylyl group, a naphthyl group, a 4-t-butylphenyl group, a 4-t-octylphenyl group, a 4-anisidyl group, a 3,5-dichlorophenyl group and the like are listed, among these, a phenyl group, a cresyl group, a xylyl group, a naphthyl group and a 4-t-butylphenyl group are preferred, and a 4-t-butylphenyl group is particularly preferred.

As the alkoxy group represented by $R^{21}$, $R^{22}$ and $R^{23}$, a methoxy group, an ethoxy group, a butoxy group, an octyloxy group, a 2-ethylhexyloxy group, a 4-methylcyclohexyloxy group, a benzyloxy group and the like are listed, among these, a cyclohexyloxy group is preferred.

As the aryloxy group represented by $R^{21}$, $R^{22}$ and $R^{23}$, a phenoxy group, a cresyloxy group, an isopropylphenoxy group, a 4-t-butylphenoxy group, a naphthoxy group, a biphenyloxy group and the like are listed, among these, a phenoxy group is preferred.

As the amino group represented by $R^{21}$, $R^{22}$ and $R^{23}$, a dimethylamino group, a diethylamino group, a dibutylamino group, a dioctylamino group, a N-methyl-N-hexylamino group, a dicyclohexyamino group, a diphenylamino group, a N-methyl-N-phenylamino group and the like are listed, among these, a dimethylamino group, a dicyclohexylamino group and a diphenylamino group are preferred.

Among groups represented by the $R^{21}$, $R^{22}$ and $R^{23}$, an alkyl group, an aryl group, an alkoxy group and aryloxy group are more preferred. From the effects of the present invention, it is more preferable that among $R^{21}$, $R^{22}$ and $R^{23}$, at least one or more represent an alkyl group or an aryl group, and it is particularly preferable that two or more represent an alkyl group or an aryl group. Moreover, from the viewpoint of capable of being available at lower cost, it is a preferred case where $R^{21}$, $R^{22}$ and $R^{23}$ represent an identical group.

Hereinafter, although concrete examples of hydrogen-bonding compounds (from II-1 to II-17) including compounds represented by the general formula (II) used in the present invention are indicated, the present invention is not limited to these.

(II-1)

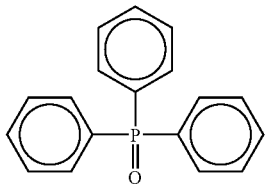

(II-2)

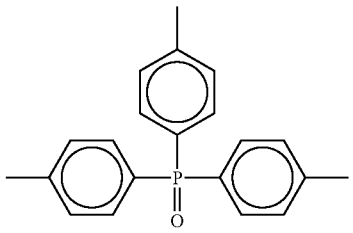

-continued (II-3)

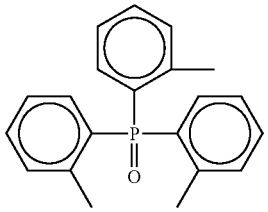

(II-4)

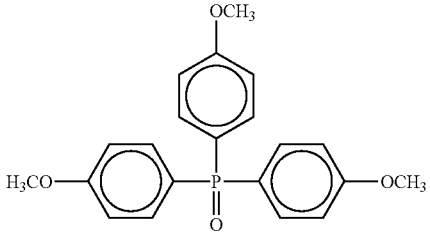

(II-5)

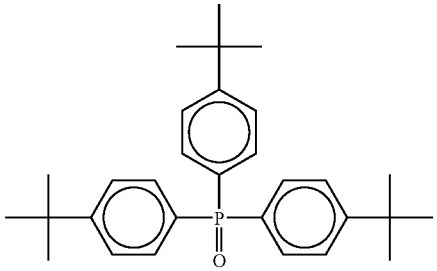

(II-6)

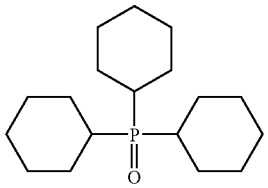

(II-7)

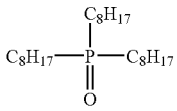

(II-8)

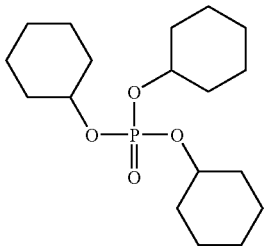

(II-9)

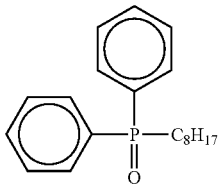

-continued (II-10)

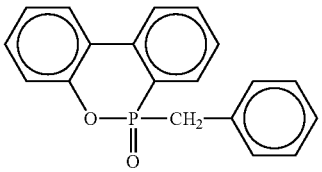

(II-11)

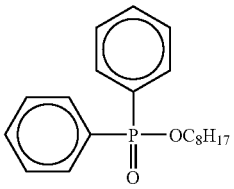

(II-12)

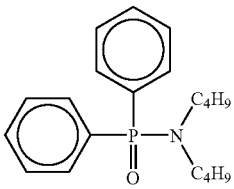

(II-13)

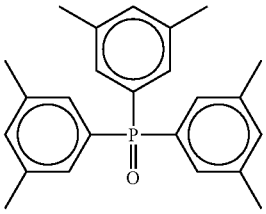

(II-14)

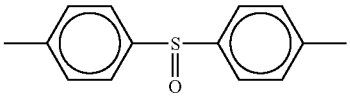

(II-15)

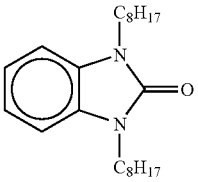

(II-16)

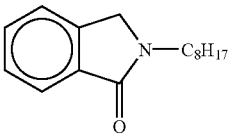

(II-17)

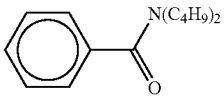

As a concrete example of a hydrogen-bonding compound, ones described in the respective specifications of Japanese Patent Application No. 2000-192191 and Japanese Patent Application No. 2000-194811 are listed except for ones described above.

A compound represented by the general formula (II) used in the present invention is made contained in a coating liquid such as in a solution form, an emulsion dispersion form, a solid refined particle dispersed matter form and the like, similarly to the reducing agent and may be used in a photosensitive material. The compound forms a hydrogen bonding complex with a compound having a phenol type hydroxyl group and an amino group in a solution state, depending on the combination of the reducing agent and the compound represented by the general formula (II), it can be isolated as a complex in a crystal state. In order to obtain the stable performance, it is preferable that the crystal powder thus isolated is used as a solid dispersion refined particle dispersed matter. Moreover, a method in which the reducing agent and a compound represented by the general formula (II) are mixed in a powder state, and the complex is formed during the dispersion by utilizing a sand grinder mill or the like can be also preferably used.

It is preferable that a compound represented by the formula (II) is used in the range from 1 to 200% by mol with respect to a reducing agent represented by the general formula (I) of the present invention (in the case where it is used in combination with the other reducing agents, the total sum of the reducing agent represented by the general formula (I) and the reducing agent used in combination), it is more preferable that it is used in the range from 10 to 150% by mol, and it is further preferable that it is in the range from 30 to 100% by mol.

<Photosensitive Silver Halide>

A photosensitive silver halide used for a heat-developable photosensitive material of the present invention is not particularly limited as a halogen composition, silver chloride, salt silver bromide, silver bromide, iodine silver bromide, and iodine salt silver bromide can be used. Among these, silver bromide and iodine silver bromide are preferred.

The distribution of the halogen composition in a particle may be uniform, the distribution may be one in which the halogen composition is changed in a stepwise, or changed in series. Moreover, a silver halide particle having a core/shell structure can be preferably used.

It is preferable that it has the double structure through the quintet structure as a structure, and it is more preferable that a core/shell particle having the double structure through the quartet structure can be used. Moreover, the technology with which silver bromide is localized on the surface of silver chloride or salt silver bromide particle can be preferably used.

A method for forming a photosensitive silver halide is well known to a person skilled in the art, for example, methods described in Research Disclosure No. 17029 (June, 1978) and U.S. Pat. No. 3,700,458 can be used, however, concretely, a method in which a photosensitive silver halide is prepared by adding silver supplying compound and halogen supplying compound in a gelatin or the other polymer solutions, and subsequently it is mixed with an organic silver salt is used. Moreover, a method described in the paragraph numbers from [0217] to [0224] of JP-A No. 11-11937 gazette, methods described in the specifications of Japanese Patent Application No. 11-98708 and Japanese Patent Application No. 2000-42336 are also preferable.

It is preferable that the particle size of a photosensitive silver halide is small for the purpose of suppressing the whitish turbidity emerging after the image formation, concretely, it is preferable that the size is 0.20 μm or less, it is more preferable that it is in the range from 0.01 μm to 0.15 μm or less, and it is further preferable that it is in the range from 0.02 μm or more to 0.12 μm or less. Note that as used herein, the term "particle size" refers to a diameter found when the projected area of a silver halide particle (in the case of a tabular particle, the projected area of the principal plate) is converted into a circle image having the identical area.

As a shape of a silver halide particle, a particle in a cubic shape, a particle in an octahedral shape, a particle in a tabular shape, a particle in a spherical shape, a particle in a bar shape, a particle in an Irish potato shape and the like can be listed, however, in the present invention, a particle in a cubic shape is particularly preferred. A particle whose corner of a silver halide particle is rounded can be also preferably used.

Although there is no particular limitations for facial index (Miller indices) of outside surface of a photosensitive silver halide particle, it is preferable that the ratio of the face {100} whose spectral sensitization efficiency is high occupying the face is high in the case where the spectral sensitization pigment is absorbed. As a ratio, it is preferable that the ratio is 50% or more, it is more preferable that the ratio is 65% or more, and it is further preferable that the ratio is 80% or more. The facial ratio of Miller indices {100} can be found by a method described in T. Tani; J. Imaging Sci., 29:165 (1985), which utilizes the absorption dependency of the face {111} and the face {100} in the sensitization pigment absorption.

In the present invention, a silver halide particles in which 6-cyano metallic complex is existed on the outermost surface of the particle is preferred. As a 6-cyano metallic complex, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, $[Re(CN)_6]^{3-}$ and the like are preferably listed. Among these, in the present invention, 6-cyano Fe complex is preferred.

Since the 6-cyano metallic complex exists in an ionic form in an aqueous solution, the counter cation is not important, but it is important to be easily miscible with water, and suitable for precipitation operation of silver halide emulsion, accordingly, it is preferable that an alkali metallic ion such as a sodium ion, a potassium ion, a rubidium ion, a cesium ion and a lithium ion and the like, an ammonium ion, an alkyl ammonium ion (e.g., a tetramethyl ammonium ion, a tetraethyl ammonium ion, a tetrapropyl ammonium ion, a tetra (n-butyl) ammonium ion) are used.

The 6-cyano metallic complex can be added by intimately mixing it with a mixed solvent and gelatin mixed with an organic solvent suitable to be miscible with water except for water (e.g., alcohols, ethers, glycols, ketones, esters, amides or the like).

As an additive amount of the 6-cyano metallic complex, it is preferable that it is in the range from $1\times10^{-5}$ mol or more per one mole of silver to $1\times10^{-2}$ mol or less, and it is more preferable that it is in the range from $1\times10^{-4}$ mol or more to $1\times10^{-3}$ mol or less.

In order that the 6-cyano metallic complex is existed on the outermost surface of the silver halide particle, 6-cyano metallic complex is directly added after the addition of silver nitrate aqueous solution used for the particle formation is terminated, before the termination of the preparation step prior to chemical sensitizing step for precious metal sensitizing such as chalcogen sensitizing and gold sensitizing of sulfur sensitizing, selenium sensitizing and tellurium sensitizing, during the washing step, during the dispersing step, or before the chemical sensitizing step.

In order not to grow the silver halide refined particle, it is preferable that 6-cyano metallic complex is quickly added after the formation of the particle, and it is preferable that it is added before the termination of the preparation step.

Note that the addition of the 6-cyano metallic complex may be initiated after 96% by mass of the total amount of silver nitrate to be added for forming a particle has been added, it is preferable that the addition is initiated after 98% by mass has been added, and it is particularly preferable that after 99% by mass has been added.

When the 6-cyano metallic complex is added after the silver nitrate aqueous solution has been added immediately before the particle formation is completed, it can absorb on the outermost surface of the silver halide particle, and most of it forms a slightly soluble salt with a silver ion on the particle surface. Since the silver salt of this 6-cyano iron (II) is less slightly soluble than Ag I, the re-dissolving by the refined particle can be prevented, and it becomes possible that a silver halide refined particle whose particle size is small is manufactured.

In the present invention, a photosensitive silver halide salt particle can contain a metal or a metallic complex of the 8th group through the 10th group of the periodic table (indicating the 1st group through the 18th group). As a central metal of metal or metallic complex of the 8th group through the 10th group of the periodic table, rhodium, ruthenium and iridium are preferred. These metallic complexes may be one kind, and two kinds or more of similar metals and dissimilar metals may be used in combination.

As a preferable content, it is preferable that it is in the range from $1\times10^{-9}$ mol to $1\times10^{-3}$ mol with respect to one mole of silver. These heavy metals, metallic complexes and methods for adding these have been described in JP-A No. 07-225449, the paragraph numbers of [0018] through [0024] of JP-A No. 11-65021, and the paragraph numbers of [0227] through [0240] of JP-A No. 11-119374.

Furthermore, metal atom (e.g., $[Fe(CN)_6]^{4-}$) capable of being contained in a photosensitive silver halide particle used in the present invention, a method for desalting a photosensitive silver halide emulsion and a chemical sensitizing method have been described in the paragraph numbers of [0046] through [0050] of JP-A No. 11-84574 gazette, the paragraph numbers of [0025] through [0031] of JP-A No. 11-65021 gazette, and the paragraph numbers of [0242] through [0250] of JP-A No. 11-119374 gazette.

As a gelatin contained in a photosensitive silver halide, a variety of gelatins can be used. In order to maintain the dispersion state well in a coating liquid containing an organic silver salt of a photosensitive silver halide emulsion, it is preferable that a gelatin having a low molecular weight in the range from 500 to 60,000 is used. Although these gelatins having a low molecular weight is used during the formation of the particle or during the dispersion after the desalting treatment, it is preferable that it is used during the dispersion after the desalting treatment.

As a sensitizing pigment capable of being applied to the present invention, a sensitizing pigment capable of spectrally sensitizing the silver halide particle in the desired wavelength region upon being absorbed by the photosensitive silver halide particle, a sensitizing pigment having a spectral sensitivity suitable for spectral characteristics of the exposure light source can be advantageously selected.

Sensitizing pigments and methods of adding these have been described in the paragraph numbers of [0103] through [0109] of JP-A No. 11-65021 gazette, compounds represented by the general formula (II) in JP-A No. 10-186572 gazette, pigments represented by the general formula (I) and the paragraph number of [0106] in JP-A No. 11-119374 gazette, U.S. Pat. No. 5,510,236, pigments described in Example 5 of U.S. Pat. No. 3,871,887, pigments disclosed in the official gazette of JP-A No. 02-96131, JP-A No. 59-48753, the paragraph from the 38th line of the 19th page to the 35th line of the 20th page of European Patent Publication No. 0803764 A1, the respective specifications of Japanese Patent Application No. 2000-86865, Japanese Patent Application No. 2000-102560, and Japanese Patent Application No. 2000-205399.

These sensitizing pigments may be singly used, or two kinds or more may be used in combination. The timing at which the sensitizing pigment is added in a silver halide emulsion in the present invention, the period after the desalting step and until the coating is preferred, the period after the desalting until the initiation of chemical maturation is more preferred.

The addition amount of a sensitizing pigment of the present invention can be adjusted to the desired amount corresponding to the performances such as sensitivity and fogging, however, it is preferable that it is in the range from $10^{-6}$ to 1 mol per one mole of silver halide of a photosensitive layer, and it is further preferable that it is in the range from $10^{-4}$ and to $10^{-1}$ mol.

In the present invention, in order to enhance the spectral sensitization efficiency, a strong color sensitizing agent can be used. As a strong color sensitizing agent used in the present invention, compounds described in European Patent Publication No. 587,338, U.S. Pat. No. 3,877,943, U.S. Pat. No. 4,873,184, JP-A No. 05-341432, JP-A No. 11-109547, JP-A No. 10-111543 and the like are listed.

It is preferable that a photosensitive silver halide particle in the present invention is chemically sensitized by sulfur sensitizing method, selenium sensitizing method or tellurium sensitizing method. As a compound preferably used in the sulfur sensitizing method, the selenium sensitizing method and the tellurium sensitizing method, the known compound, for example, compounds described in JP-A No. 07-128768 gazette or the like can be used. In the present invention, it is particularly preferable that tellurium sensitizing is employed, and it is more preferable that compounds described in the document described in the paragraph number of [0030] of JP-A No. 11-65021 gazette, and compounds represented by the general formulas (II), (III) and (IV) are used.

In the present invention, the chemical sensitizing can be carried out at any time if the timing is after the formation of the particle and before the coating, and it can be done after the desalting, (1) before the spectral sensitizing, (2) at the same time with spectral sensitizing, (3) after the spectral sensitizing, (4) immediately before the coating and the like. It is particularly preferable that it is performed after the spectral sensitizing.

As an amount of the usage of sulfur, selenium and tellurium sensitizing agents used in the present invention, although it is changed depending on the silver halide particles, chemical maturation conditions or the like, it is used in the range from $10^{-8}$ to $10^{-2}$ mol per 1 mol of silver halide and it is preferable that it is used in the range from about $10^{-7}$ to about $10^{-3}$ mol.

As the conditions for chemical sensitizing used in the present invention, there is no particular limitation, but as pH, it is in the range from 5 to 8, as pAg, it is in the range from 6 to 11, and as the temperature, it is in the range from about 40 to about 95° C.

To a silver halide emulsion used in the present invention, thiosulfonic acid compound may be added by a method indicated in European Patent Publication No. 293,917 gazette.

As a photosensitive silver halide emulsion used for a heat-developable photosensitive material of the present invention, only one species may be used, or two species or more (e.g., ones having different average particle sizes, ones having different halogen composition, ones having different crystal habits, ones having different chemical sensitizing conditions) may be used in combination. The gradation can be adjusted by employing a plurality of species of photosensitive silver halides having different sensitivities. The technologies concerning with these have been described in JP-A No. 57-119341 gazette, JP-A No. 53-106125 gazette, JP-A No. 47-3929 gazette, JP-A No. 48-55730 gazette, JP-A No. 46-5187 gazette, JP-A No. 50-73627 gazette, JP-A No. 57-150841 gazette and the like.

As a difference of sensitivity, it is preferable that the difference of 0.2 log E or more in the respective emulsion is held.

Although the additive amount of a photosensitive silver halide is indicated by the coating silver amount per 1 $m^2$ of the sensitive material, it is preferable that the amount is in the range from 0.03 to 0.6 $g/m^2$, and it is more preferable that it is in the range from 0.07 to 0.4 $g/m^2$, and it is most preferable that it is in the range from 0.05 to 0.3 $g/m^2$, and with respect to 1 mol of the organic silver salt, it is preferable that a photosensitive silver halide is added in the range from 0.01 mol or more to 0.5 mol or less, and it is more preferable that it is added in the range from 0.02 mol or more to 0.3 mol or less.

As a method for mixing a photosensitive silver halide and an organic silver salt which have been prepared independently and their mixture conditions, there are method in which a silver halide particle and an organic silver salt whose preparation have been terminated independently are mixed by a high speed stirring apparatus, a ball mill, a sand mill, a collide mill, a vibrating mill, a homogenizer and the like, or methods in which a photosensitive silver halide whose preparation has been terminated is mixed with an organic silver salt at any timing during its preparation and the organic silver salt is prepared and the like, however, so long as the effects of the present invention is sufficiently exerted, there is no particular limitations.

It is preferable to mix two kinds or more of organic silver salt dispersion liquid and two kinds or more photosensitive silver salt dispersion liquid, in order to adjust photographic property.

Although a preferable timing for adding a photosensitive silver halide of the present invention in the coating liquid of the image formation layer is, from 180 minutes before the coating until the immediately before it, and preferably, from 60 minutes before it until 10 seconds before it, as a method for mixing and its mixture conditions, so long as the effects of the present invention are sufficiently exerted, there are no particular limitations. As a concrete method for mixing, a method in which these are mixed in a tank where the average retention time calculated from the additive flow rate and the intromitted amount to a coater is made to be in the desired time, and a method of using a static mixer and the like described in the 8th chapter of N. Harnby, M. F. Edwards, A. W. Nienow: translated by Kohji Takahashi, "Liquid mixing Technologies" (Nikkan Industries News, Co., Ltd., 1993) are listed.

<Binders>

In a heat-developable photosensitive material of the present invention, as a binder contained in a layer containing an organic silver salt, any polymer may be used.

As a preferred binder, it is transparent or translucent, in general, colorless, natural resins, polymers and copolymers, synthesized resins, polymers and copolymer, and a medium for forming the other films, for example, gelatins, rubbers, poly (vinyl alcohol), hydroxyethyl celluloses, cellulose acetates, cellulose acetate-butylates, poly (vinylpyrrolidone), casein, starch, poly (acrylate), poly (methyl metacrylate), poly (vinyl chloride), poly (methacrylate), styrene-maleic anhydride copolymers, styrene-acrylonitrile copolymers, styrene-butadiene copolymers, poly (vinyl acetal) (e.g., poly (vinyl formal) and poly (vinyl butyral)), poly (ester), poly (urethane), phenoxy resins, poly (vinylidene chloride), poly (epoxide), poly (carbonate), poly (vinyl acetate), poly (olefin), cellulose esters, and poly (amide) are listed.

A binder may be coated and formed from water, an organic solvent or an emulsion.

In the present invention, as the glass transition temperature of a binder of a layer containing an organic silver salt, it is preferable that the temperature is in the range from 10° C. or higher to 80° C. or lower (hereinafter, in some cases, may be referred to as high Tg binder), it is more preferable that it is in the range from 20° C. to 70° C., and it is further preferable that it is in the range from 23° C. or higher to 65° C. or lower.

Note that in the present specification, Tg is calculated by the following expression:

$$1/Tg=\Sigma(Xi/Tgi)$$

where as the polymer, suppose that n pieces of monomer components from i=1 to i=n are copolymerized. Xi represents the weight fraction for a monomer of ordinal number of i ($\Sigma Xi=1$), and Tgi represents the glass transition temperature (absolute temperature) of a homopolymer consisted of monomer of ordinal number of i. However, $\Sigma$ sums up the total of i=1 through n. Note that the value of Polymer Handbook (3rd Edition) (J. Brandrup, E. H. Immergut: Wiley-Interscience, 1989) has been employed as the value of the glass transition temperature of a homopolymer of each monomer.

As a polymer to be a binder, a single species may be used or two species or more may be used in combination if it is necessary. Moreover, a polymer whose glass transition temperature is 20° C. or higher and a polymer whose glass transition temperature is less than 20° C. may be used in combination. In the case where two species or more of polymers whose Tgs are different from each other are blended and used, it is preferable that the weight average of Tg is within the above-described range.

In the present invention, the performances are enhanced in the case where a layer containing an organic silver salt is coated using a coating liquid in which 30% by mass or more of the solvent is water, dried and formed, further in the case where the binder of the layer containing the organic silver salt is soluble in an aqueous solvent (water solvent) or capable of dispersing, and particularly in the case where the layer is consisted of latex polymer whose equilibrium moisture content at 25° C. and 60% relative humidity is 2% by mass or less.

The most preferable form is one prepared so that the ion conductivity is 2.5 mS/cm or less, as such a method for preparing it, a method for purifying and processing it using a separating function membrane after synthesizing the polymer is listed.

Here, an aqueous solvent in which a polymer to be the binder is soluble or capable of dispersing refers to water or a solvent that a water-miscible organic solvent of 70% by mass has been mixed to water. As a water-miscible organic solvent, for example, alcohol based one such as methyl alcohol, ethyl alcohol, propyl alcohol and the like, Cellosolv based one such as methyl Cellosolv, ethyl Cellosolv, butyl Cellosolv and the like, ethyl acetate, dimethylformamide and the like can be listed.

Note that even in the case where the polymer to be the binder is not thermodynamically dissolved, a system where it exists in what is called a dispersed state, as used herein, the term "aqueous solvent" is used.

Moreover, "equilibrium moisture content at 25° C. and 60% relative humidity (RH)" can be expressed as follows by utilizing weight $W_1$ of a polymer which is in a moisture conditioning equilibrium state in the atmosphere at 25° C. and 60% relative humidity and weight $W_0$ in an absolutely dried state at 25° C.:

$$\text{equilibrium moisture content at 25° C. and 60\% RH}=\{(W_1-W_0)/W_0\}\times 100\ (\%\text{ by mass})$$

The definition and a measuring method of moisture content can be made reference to, for example, "Polymer Engineering Course 14: Method for Testing Polymer Masterials" (Polymer Society Ed; Chijin Shokan).

As an equilibrium moisture content of a polymer to be a binder in the present invention at 25° C. and 60% RH, it is preferable that the equilibrium moisture content is 2% by mass or less, however, more preferable that it is in the range from 0.01% by mass or more to 1.5% by mass or less, and it is further preferable that it is in the range from 0.02% by mass or more to 1% by mass or less.

In the present invention, as a polymer to be a binder, it is particularly preferable that the polymer can be dispersed in an aqueous solvent. As an example of a dispersed state, a latex in which a water-insoluble hydrophobic refined particle is dispersed, and a polymer in which its polymer molecules are dispersed and form a molecular state or a micelle are listed, however, any one of these is preferable. As the average particle diameter of the dispersed particle, it is preferable that the average diameter is in the range from 1 to 50000 nm, and it is more preferable that it is in the range from about 5 to about 1000 nm. Concerning with a particle diameter distribution of the dispersed particles, there is no particular limitation, particles having a wide particle diameter distribution or particles having a monodispersed particle distribution may be used.

In the present invention, as a preferable aspect of a polymer capable of dispersing in an aqueous solvent, hydrophobic polymers such as acryl based polymer, poly (ester), rubbers (e.g., SBR resin), poly (urethane), poly (vinyl chloride), poly (vinyl acetate), poly (vinylidene chloride), poly (olefin) and the like can be preferably used. As these polymers, a polymer having a linear chain, a branched polymer, and a crosslinked polymer may be used, what is called homopolymer in which a single monomer is polymerized may be used, and a copolymer in which two species or more monomers are polymerized may be used. In the case of copolymer, a random copolymer or a block copolymer may be used.

As molecular weights of these polymers, it is preferable that it is in the range from 5000 to 1000000 at the number average molecular weight, and it is more preferable that it is in the range from 10000 to 200000. A polymer whose molecular weight is too small is insufficient for dynamical strength of a silver halide emulsion layer, and a polymer whose molecular weight is too large is bad for layer forming property and it is not preferable.

As a preferable concrete example of the polymer latex, the followings can be listed. Hereinafter, examples are indicated using a raw material monomer, the numerical value within the parenthesis indicates % by mass, and the molecular weight indicates a number average molecular weight. In the case where a multifunctional monomer is used, the molecular weight concept cannot be applied since a crosslinked structure is made, it is described as "cross-linkable", and the description of a molecular weight was omitted. Tg represents the glass transition temperature.

P-1; latex of -MMA(70)-EA(27)-MAA(3)-(molecular weight; 37000)

P-2; latex of -MMA(70)-2EHA(20)-St(5)-AA(5)-(molecular weight; 40000)

P-3; latex of -St(50)-Bu(47)-MAA(3)-(crosslinkable)

P-4; latex of -St(68)-Bu(29)-AA(3)-(crosslinkable)

P-5; latex of -St(71)-Bu(26)-AA(3)-(crosslinkable, Tg 24° C.)

P-6; latex of -St(70)-Bu(27)-IA(3)-(crosslinkable)

P-7; latex of -St(75)-Bu(24)-AA(1)-(crosslinkable)

P-8; latex of -St(60)-Bu(35)-DVB(3)-MAA(2)-(crosslinkable)

P-9; latex of -St(70)-Bu(25)-DVB(2)-AA(3)-(crosslinkable)

P-10; latex of -VC(50)-MMA(20)-EA(20)-AN(5)-AA(5)-(molecular weigh; 80000)

P-11; latex of -VDC(85)-MMA(5)-EA(5)-MAA(5)-(molecular weight; 67000)

P-12; latex of -Et(90)-MAA(10)-(molecular weight; 12000)

P-13; latex of -St(70)-2EHA(27)-AA(3) (molecular weight; 130000)

P-14; latex of -MMA(63)-EA(35)-AA(2) (molecular weight; 33000)

P-15; latex of -St(70.5)-Bu(26.5)-AA(3) (crosslinkable, Tg23° C.)

P-16; latex of -St(69.5)-Bu(27.5)-AA(3) (crosslinkable, Tg20.5° C.)

The abbreviations of the structure represent the following monomers: MMA; methylmethacrylate, EA; ethylacrylate, MAA; methacrylic acid, 2EHA; 2-Ethylhexylacrylate, St; styrene, Bu; butadiene, AA; acrylic acid, DVB; divinyl benzene, VC; vinyl chloride, AN; acrylonitrile, VDC; vinylidene chloride, Et; ethylene, and IA; itaconic acid.

The polymer latexes described above are also commercially available, and the following polymers can be utilized: as an example of acryl based polymer, Cevian A-4635, 4718, 4601 (described above; made by Daicel Chemical Industry, Co., Ltd.), Nipol Lx 811, 814, 821,820, 857 (described above; made by Nippon Zeon, Co., Ltd.) and the like, as an example of poly (ester), FINETEX ES 650, 611, 675, 850 (described above; made by Dainippon Ink and Chemicals, Incorporated), WD-size, WMS (described above; made by Eastman Chemical, Co., Ltd.) and the like, as an example of poly (urethane), HYDRAN AP 10, 20, 30 and 40 (described above; made by Dainippon Ink and Chemicals, Inc.) and the like, as an example of rubbers, LACSTAR 7310K, 3307B, 4700H and 7132C (described above; made by Dainippon Ink and Chemicals, Inc.) and, Nipol Lx 416, 410, 438C and 2507 (described above; made by Nippon Zeon, Co., Ltd.) and the like, as an example of poly (vinyl chloride), G351, G576 (described above; made by Nippon Zeon, Co., Ltd.) and the like, as an example of poly (vinylidene chloride), L502, L513 (described above; made by Asahi Kasei, Co., Ltd.) and the like, as an example of poly (olefin), Chemipearl S 120, SA 100 (described above; made by Mitsui Petrolium Chemicals, Co., Ltd.) and the like can be listed.

These polymer latexes may be singly used, or two species of these may be blended if it is necessary.

As a polymer latex used in the present invention, particularly a latex of styrene-butadiene copolymer is preferable. It is preferable that the mass ratio of monomer unit of styrene in the styrene-butadiene copolymer and monomer unit of the butadiene is in the range from 40:60 to 95:5. Moreover, the ratio of monomer unit of styrene and monomer unit of butadiene occupying the copolymer is in the range from 60 to 99% by mass. The preferable range of molecular weight is similar to the one.

As a latex of styrene-butadiene copolymer preferably used in the present invention, the P-3 through P-8, 14 and 15, and LACSTAR-3307B, 7132C, Nipol Lx 416 which are commercially available and the like are listed.

To the layer containing the organic silver salt of a heat-developable photosensitive material of the present invention, if it is necessary, a hydrophilic polymer such as gelatin, polyvinyl alcohol, methyl cellulose, hydroxypropyl cellulose, carboxymethyl cellulose and the like may be added. The additive amount of these hydrophilic polymers is preferably 30% by mass or less of the total binder of the layer containing the organic silver salt, and more preferably 20% by mass or less.

As the layer containing the organic silver salt in the present invention (i.e., image formation layer), it is preferable that it is a layer formed by a polymer latex. It is preferable that as the amount of the binder of the layer containing the organic silver salt, the mass ratio of the total binder/organic silver salt is in the range from 1/10 to 10/1, and further it is preferable that it is in the range from 1/5 to 4/1.

Moreover, usually, the layer containing an organic silver salt is also a photosensitive layer (emulsion layer) in which a photosensitive silver halide, that is, a photosensitive silver salt, is contained, in this case, as the mass ratio of the total binder/silver halide, it is preferable that it is in the range from 400 to 5, and it is more preferable that it is in the range from 200 to 10.

As the total binder amount of the image formation layer in the present invention, it is preferable that the amount is in the range from 0.2 to 30 g/m$^2$, and it is more preferable that it is in the range from 1 to 15 g/m$^2$. To the image formation layer in the present invention, a crosslinking agent for crosslinking, a surfactant for improving the coating property and the like may be added.

<Other Component>

Here, the other components used for a heat-developable photosensitive material of the present invention will be described below.

In a heat-developable photosensitive material of the present invention, as a solvent of coating liquid for the layer containing an organic silver salt (here for being simplified, the solvent and the dispersion medium represented as a solvent collectively), it is preferable that an aqueous solvent containing 30% by mass of water is used. As components except for water, any water-miscible organic solvent such as methyl alcohol, ethyl alcohol, isopropyl alcohol, methyl Cellosolv, ethyl Cellosolv, dimethylformamide, ethyl acetate and the like may be used. It is preferable that the water content in a solvent of the coating liquid is 50% by mass or more, and it is more preferable that it is 70% by mass or more.

As a preferable example of a solvent composition, except for water, water/methyl alcohol=90/10, water/methyl alcohol=70/30, water/methyl alcohol/dimethylformamide=80/15/5, water/methyl alcohol/ethyl Cellosolv=85/10/5, water/methyl alcohol/isopropyl alcohol=85/10/5 and the like are preferably listed (the numerical values represent % by mass).

As an antifoggant, stabilizer and stabilizer precursor capable of being employed in the present invention, patented ones described in the paragraph number of [0070] of JP-A No. 10-62899 gazette, in the paragraphs from the 57th line of the 20th page to the 7th line of the 21st page of European Patent Publication No. 0803764A1, compounds described in the official gazette of JP-A No. 09-281637, and JP-A No. 09-329864 are listed.

Moreover, as an antifoggant preferably used in the present invention, organic halides are listed, and as these, ones disclosed in the patent described in the paragraph numbers of [0111] and [0112] of JP-A No. 11-65021 gazette are listed. Particularly, organic halogen compounds represented by the formula (P) of JP-A No. 2000-284399 gazette, organic polyhalogen compounds represented by the general formula (II) of JP-A No. 10-339934 gazette, and organic polyhalogen compounds described in the specification of Japanese Patent Application No. 11-205330 are preferable.

Hereinafter, preferable organic polyhalogen compounds in the present invention will be concretely described. The preferable polyhalogen compounds of the present invention are compounds represented by the following general formula (III):

$$Q\text{-}(Y)n\text{-}C(Z_1)(Z_2)X \qquad \text{General formula (III):}$$

In the general formula (III), Q represents an alkyl group, an aryl group or a heterocyclic group, Y represents bivalent linking group, n represents 0 or 1, $Z_1$ and $Z_2$ represent a halogen atom, and X represents a hydrogen atom or an electron withdrawing group.

In the general formula (III), Q represents a phenyl group substituted by an electron withdrawing group in which Hammett replacing group constant up is preferably a positive value. As the Hammett substituent constant, Journal of Medicinal Chemistry, 1973, Vol. 16, No.11, 1207–1216 and the like can be made reference to.

As these preferable electron withdrawing groups, for example, a halogen atom (fluorine atom (σp value: 0.06)), a chlorine atom (σp value: 0.23), a bromine atom (σp value: 0.23), an iodine atom (σp value: 0.18), a trihalomethyl group (tribromomethyl (σp value: 0.29), a trichloromethyl group (σp value: 0.33), a trifluoromethyl group (σp value: 0.54), a cyano group (σp value: 0.66), a nitro group (σp value: 0.78), a fatty/aryl or heterocyclic sulfonyl group (e.g., methanesulfonyl group (σp value: 0.72), fatty/aryl or heterocyclic acyl group (e.g., acetyl group (σp value: 0.50), a benzoyl group (σp value: 0.43), an alkynyl group (e.g., C≡CH(σp value: 0.23), fatty/aryl or heterocyclic oxycarbonyl group (e.g., methoxycarbonyl (σp value: 0.45), a phenoxycarbnyl group (σp value: 0.44), a carbamoyl group (σp value: 0.36), a sulfamoyl group (σp value: 0.57), a sulfoxide group, heterocyclic group, phosphoryl group and the like are listed.

As a σp value, it is preferable that the value is in the range from 0.2 to 2.0, and it is more preferable that it is in the range from 0.4 to 1.0.

Among the preferable electron withdrawing groups, a carbamoyl group, alkoxycarbonyl group, an alkylsulfonyl group, and an alkylphosphoryl group are particularly preferable, and among these, the carbamoyl group is most preferable.

In the general formula (III), as a X, an electron withdrawing group is preferable, and concretely, a halogen atom, a fatty/aryl or heterocyclic sulfonyl group, a fatty/aryl or heterocyclic acyl group, a fatty/aryl or heterocyclic oxycarbonyl group, a carbamoyl group, and a sulfamoyl group are more preferable, and a halogen atom is particularly preferable.

Among the halogen atoms, a chlorine atom, a bromine atom, and iodine atom are preferable, a chlorine atom and a bromine atom are further preferable, and the bromine atom is particularly preferable.

In the general formula (III), as a Y, —C(═O)—, —SO— or $SO_2$— is preferable, among these, —C(═O)— and —$SO_2$— are more preferable, and —$SO_2$— is particularly preferable. N represents 0 or 1, and preferably n represents 1.

Hereinafter, in the present invention, concrete examples (exemplified compounds; III-1 through III-23) of the compounds represented by the general formula (III) preferably used as an antifoggant are shown.

(III-1)

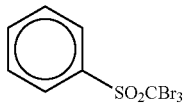

(III-2)

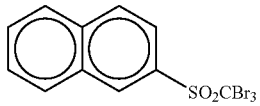

(III-3)

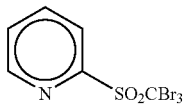

(III-4)

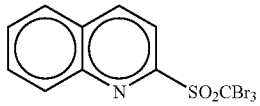

(III-5)

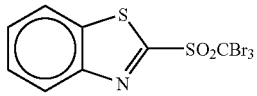

(III-6)

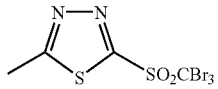

(III-7)

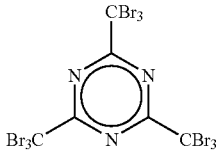

(III-8)

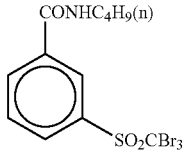

(III-9)

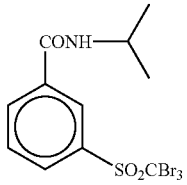

-continued (III-10)

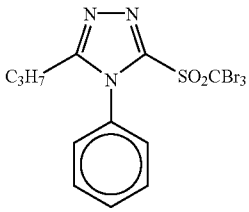

(III-11)

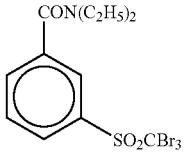

(III-12)

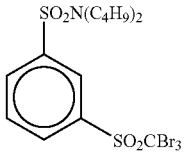

(III-13)

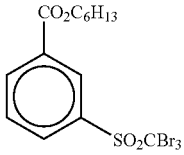

(III-14)

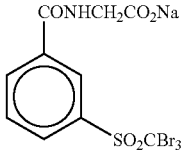

(III-15)

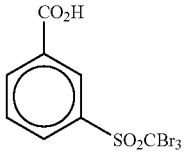

(III-16)

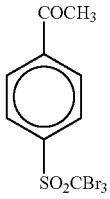

(III-17)

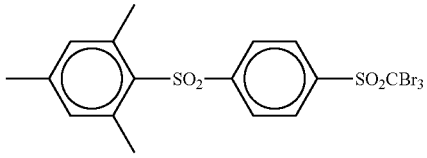

(III-18)

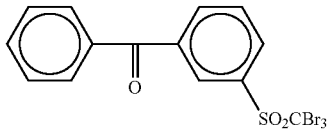

-continued (III-19)

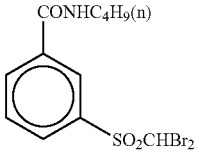

(III-20)

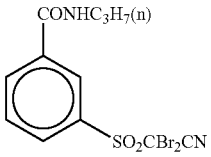

(III-21)

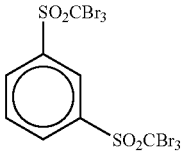

(III-22)

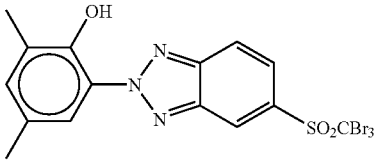

(III-23)

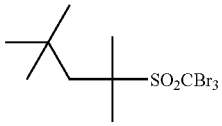

In a heat-developable photosensitive material of the present invention, it is preferable that compounds represented by the general formula (III) is used in the range from $10^{-4}$ to 1 mol per each one mole of non-photosensitive silver salt of the image formation layer, it is more preferable that it is used in the range from $10^{-3}$to 0.8 mol, and it is further preferable that it is used in the range from $5\times10^{-3}$ to 0.5 mol.

In the present invention, as a method of making the photosensitive material contain an antifoggant, methods described in the methods for containing reducing agents are listed, as an organic polyhalogen compound, it is preferable that the compound is added as a solid refined particle dispersed matter.

As the other antifoggants, mercury (II) salt described in the paragraph number of [0113] of JP-A No. 11-65021 gazette, benzoic acids described in the paragraph number of [0114] of JP-A No. 11-65021 gazette, salicyclic acid derivative described in the specification of JP-A No. 2000-206642, formalin scavenger compound represented by the formula (S) in the specification of JP-A No. 2000-221634, triazine compound according to claim 9 of JP-A No. 11-352624 gazette, 4-hydroxy-6-methyl-1,3,3a,7-tetrazainden, compounds represented by the general formula (III) described in JP-A No. 06-11791 gazette, and the like are listed.

A heat-developable photosensitive material in the present invention may contain azolium salt for the purpose of preventing it from being fogged.

As the azolium salt, a compound represented by the general formula (XI) described in JP-A No. 59-193447 gazette, a compound described in Japanese Patent Application Publication No. 55-12581, a compound represented by the general formula (II) described in JP-A No. 60-153039 gazette are listed.

The azolium salt may be added to any site of the heat-developable photosensitive material, however, as a layer for adding it, it is preferable that it is added to the layer having the surface containing a photosensitive layer, and it is more preferable that it is added to a layer containing an organic silver salt.

As an additive timing of the azolium salt, it may be performed in any step of preparing the coating liquid, and in the case where it is added to the layer containing an organic silver salt, it may be performed in any step from the time period for preparing the organic silver salt to the time period for preparing the coating liquid, however, the time period after the preparation of an organic silver salt until the time period immediately before the coating is preferable.

As a method for adding azolium salt, it may be performed in any forms such as in powder, in solution, or in refined particle dispersed matter. Moreover, it may be added as a solution mixed with a sensitizing pigment, a reducing agent, a color tone adjuster and the like.

As an additive amount of azolium salt in the present invention, any amount may be added, however, it is preferable that the amount is in the range from $1\times10^{-6}$ mol or more to 2 mol or less per each one mole of silver, and it is further preferable that it is in the range from $1\times10^{-3}$ mol or more to 0.5 mol or less.

To a heat-developable photosensitive material of the present invention, a mercapto compound, a disulfide compound and a thione compound can be contained in order to suppress or promote the development and control the development, in order to enhance the spectral sensitizing efficiency, and in order to enhance the keeping property before and after the development and so on, this has been described in the paragraph numbers of [0067] through [0069] of JP-A No. 10-62899 gazette, in the paragraph numbers of [0033] through [0052] of JP-A No. 10-186572 gazette as compounds and their concrete examples, in the paragraph from the 36th line to the 56th line of the 20th page of European Patent Publication No. 0803764 A1 and Japanese Patent Application No. 11-273670 and the like.

Among these, a mercapto substituted complex aromatic compound is preferable.

In a heat-developable photosensitive material of the present invention, the addition of a color tone adjuster is preferable, as a color tone adjuster, it has been described in the paragraph numbers of [0054] and [0055] of JP-A No. 10-62899 gazette, in the paragraph from the 23rd line to the 48th line of the 21 st page of European Patent Publication No. 0803764 A1, and in the respective specifications of JP-A No. 2000-356317 and Japanese Patent Application No. 2000-187298.

Phthalazinones (phthalzinone, phthalazionone derivative or metallic salt; for example, 4-(1-naphthyl)phthalazinone), 6-chlorophthalazinone, 5,7-dimethoxyphthalazinone and 2,3-dihydro-1,4-phthalazinedione); combinations of phthalazinones and phthalic acids (for example, phthalic acid, 4-methylphthalic acid, 4-nitrophthalic acid, diammonium phthalate, sodium phthalate, potassium phthalate and tetrachlorophthalic anhydride); phthalazines (phthalazine, phthalazine derivatives or metallic salt; for example, 4-(1-naphthyl)phthalazine, 6-isopropyphthalazine, 6-t-butylphthalazine, 6-chlorophthalazine, 5,7-dimethoxyphthalazine and 2,3-dihydrophthalazine); combinations of phthalazines and phthalic acids are particularly preferable, and particularly, the combinations of phthalazines and phthalic acids are more preferable.

A plasticizer and a lubricant capable of being used for a photosensitive layer in a heat-developable photosensitive material of the present invention have been described in the paragraph number of [0117] of JP-A No. 11-65021 gazette, an ultra-high contrast agent for forming an ultra-high contrast image, its method for adding it and its amount have been described in the paragraph number of [0118] of JP-A No. 11-65021 gazette, in the paragraph numbers of [0136] through [0193] of JP-A No. 11-22389 gazette, in the compounds of the formulas (H), formulas (1) through (3), formulas (A), (B) described in the specification of Japanese Patent Application No. 11-87297, and in the compounds of the general formulas (III) through (V) (concrete compounds: [Chemical formulas [21] through [24]) described in the specification of Japanese Patent Application 1No. 11-91652, and a high contrast accelerator has been described in the paragraph number of [0102] of JP-A No. 11-65021 gazette, and in the paragraph numbers of [0194] and [0195] of JP-A No. 11-223898.

In order to use formic acid and formate as a strongly enforcing fogging material, it is preferable that the material is contained on the side having the image formation layer containing a photosensitive silver halide at 5 mol or less per each one mole of silver and it is more preferable that it is contained at 1 mol or less.

In a heat-developable photosensitive material of the present invention, in the case where an ultra-high contrast agent is used, it is preferable that acid made by hydration of, that is the addition of water to, diphosphorus pentaoxide or its salt is used in combination with the agent.

As an acid made by hydration of diphosphorus pentaoxide or its salt, methaphosphoric acid (salt), pyrophosphoric acid (salt), orthophosphoric acid (salt), triphosphoric acid (salt), tetraphosphoric acid (salt), hexamethaphosphoric acid (salt) and the like can be listed. Among acids made by hydration of diphosphorus pentaoxide or its salts, orthophosphoric acid (salt) and hexamethaphosphoric acid (salt) are particularly preferably used. As concrete salts, sodium orthophosphate, dihydrogen sodium orthophosphate, sodium hexamethaphosphate, ammonium hexamethaphosphate and the like are preferably listed.

As the amount of its use of an acid made by hydration of diphosphorus pentaoxide or its salt (amount of coating per 1 $m^2$ of a photosensitive material), although the desired amount is used corresponding to the performances such as the sensitivity, fogging and the like, it is preferable that the amount is in the range from 0.1 to 500 $mg/m^2$, and it is more preferable that it is in the range from 0.5 to 100 $mg/m^2$.

<Layer Configuration>

A heat-developable photosensitive material in the present invention can be provided with a surface protective layer for the purpose of preventing the image formation layer from attaching. The surface protective layer may be a single layer, or may be a plurality of layers. The surface protective layer has been described in the paragraph numbers of [0119]-[0120] of JP-A No. 11-65021 gazette, and in the specification of Japanese Patent Application No. 2000-171936.

As a binder of a surface protective layer of the present invention, it is preferable that gelatin is used, but it is also preferable that polyvinyl alcohol (PVA) is used, or used in combination.

As the gelatin, an inert gelatin (e.g., Nitta Gelatin 750), phthalic gelatin (e.g., Nitta Gelatin 801) and the like can be used.

As the PVA, one described in the paragraph numbers of [0009] through [0020] of JP-A No. 2000-171936 gazette is listed, PVA-105 which is a completely saponificated material, PVA-205 and PVA-335 which are a partially saponificated material, and MP-203 which is a denatured polyvinyl alcohol (described above; trade names made by Kuraray, Co., Ltd.) and the like are preferably listed. As polyvinyl alcohol coating amount (per 1 $m^2$ of support) of surface protective layer (per each one layer), it is preferable that the amount is in the range from 0.3 to 4.0 $g/m^2$, and it is more preferable that it is in the range from 0.3 to 2.0 $g/m^2$.

In the case where a heat-developable photosensitive material of the present invention is used for the printing use in which particularly, the size change is to be a problem, it is preferable that a polymer latex is used for a surface protective layer and a backing layer.

These kinds of polymer latexes have been described in "Synthetic Resin Emulsion" (Taira Okuda, Hiroshi Inagaki, Ed., published by Koubunshikankoukai (1978)), "Applications of Synthetic Latex" (Takaaki Sugimura, Yasuo Kataoka, Souchi Suzuki, and Keiji Kasahara, Ed., published by Koubunshikankoukai (1993)), "Chemistry of Synthetic Latex" (Sohichi Muroi, published by Koubunshikankoukai (1970)) and the like, concretely, a latex of copolymer at a ratio of methylmethacrylate (33.5% by mass)/ethylacrylate (50% by mass)/methacrylic acid (16.5% by mass), a latex of copolymer at a ratio of methylmethacrylate (47.5% by mass)/butadiene (47.5% by mass)/itaconic acid (5% by mass), a latex of copolymer at a ratio of ethylacrylate/methacrylic acid, a latex of copolymer at a ratio of methylmethacrylate (58.9% by mass)/2-ethylhexylacrylate (25.4% by mass)/styrene (8.6% by mass)/2-hydroxyethyl metacrylate (5.1% by mass)/acrylic acid (2.0% by mass), a latex of copolymer at a ratio of methyl methacrylate (64.0% by mass)/styrene (9.0% by mass)/butyl acrylate (20.0% by mass)/2-hydroxyethyl methacrylate (5.0% by mass)/acrylic acid (2.0% by mass) and the like are listed.

Furthermore, as a binder for a surface protective layer, the combinations of polymer latexes described in the specification of Japanese Patent Application No. 11-6872, the technology described in the paragraph numbers of [0021] through [0025] of the specification of Japanese Patent Application No. 11-143058, the technology described in the paragraph numbers of [0027] and [0028] of the specification of Japanese Patent Application No. 11-6872, the technology described in the paragraph numbers of [0023] through [0041] of the specification of Japanese Patent Application No. 10-199626 may be applied. As the ratio of polymer latex of the surface protective layer, it is preferable that the ratio is in the range from 10% by mass or more to 90% by mass or less of the total binders, and it is particularly preferable that the ratio is in the range from 20% by mass or more to 80% by mass or less.

As the coating amount (per 1 $m^2$ of support) of the total binders (including water-soluble polymer and latex polymer) for a surface protective layer (per each layer), it is preferable that the amount is in the range from 0.3 to 5.0 $g/m^2$, and it is more preferable that it is in the range from 0.3 to 2.0 g /$m^2$.

As a temperature for preparation of an image formation layer coating liquid of the present invention, it is preferable that the temperature is in the range from 30° C. or more to 65° C. or less, it is more preferable that it is in the range from 35° C. or more to less than 60° C., and it is further preferable that it is in the range from 35° C. or more to 55° C. or less. Moreover, it is preferable that the temperature of an image formation layer coating liquid immediately after the addition of a polymer latex is maintained in the range from 30° C. or more to 65% or less.

An image formation layer of the present invention is configured by one or more layers on a support. In the case where it is configured by one layer, it includes an organic silver salt, a photosensitive silver halide, a reducing agent and a binder, and if it is necessary, it includes the additional materials if desired, such as a color tone adjuster, a coating auxiliary agent and the other auxiliary agents. In the case where it is configured by two or more layers, an organic silver salt and a photosensitive silver halide must be contained in the first image formation layer (usually, a layer adjacent to the support), and some other components must be contained in the second image formation layer or both layers.

As the configuration of a heat-developable photosensitive material for a plurality of colors, it may contain the combinations of these two layers concerning with the respective colors, and it may contain the whole components within a single layer as described in U.S. Pat. No. 4,708,928. In the case of a heat-developable photosensitive material for a plurality of dyes and colors, as described in U.S. Pat. No. 4,460,681, in general, the respective emulsion layers are discriminated from each other and maintained by utilizing a functional or non-functional barrier layer between the respective photosensitive layers.

On a photosensitive layer of the present invention, from the viewpoints of improving the tone, preventing the interference stripes from being generated at the time of exposure to the laser beam, and preventing the irradiation, a variety of dyes and pigments (e.g., C. I. Pigment Blue 60,C.I. Pigment Blue 64, C. I. Pigment Blue 15:6) can be employed. These have been described in detail in the official gazette of WO 98/36322, JP-A No. 10-268465, and JP-A No. 11-338098.

In a heat-developable photosensitive material of the present invention, an antihalation layer can be provided against the photosensitive layer on the far side from the light source.

A heat-developable photosensitive material has, in general, a non-photosensitive layer in addition to a photosensitive layer. As non-photosensitive layers, these layers can be classified into (1) a protective layer provided above the photosensitive layer (on far side rather than the support), (2) an intermediate layer provided between a plurality of photosensitive layers and between a photosensitive layer and a protective layer, (3) undercoat layer provided between a photosensitive layer and a support, and (4) a backing layer provided on the opposite side of a photosensitive layer, from the respective positions of the arrangement. A filter layer is provided on a photosensitive material as a layer of (1) or (2). An antihalation layer is provided on a photosensitive material as a layer of (3) or (4).

The antihalation layers have been described in the paragraph numbers of [0123] and [0124] of JP-A No. 11-65021 gazette, in the official gazette of JP-A No. 11-223898, JP-A No. 09-230531, JP-A No. 10-36695, JP-A No. 10-104779, JP-A No. 11-231457, JP-A No. 11-352625, and JP-A No. 11-352626 and the like.

The antihalation layer contains an antihalation dye having an absorbance at the exposure wavelength. In the case where the wavelength is in the infrared region, an infrared ray absorption dye may be employed, and in this case, it is preferable that a dye not having an absorbance in the visible region is used.

In the case where an antihalation is performed by utilizing a dye having an absorbance in the visible region, it is preferable so that the color of the dye does not substantially remain after the image formation, it is preferable that the means for decoloring by the heat of heat-developing is employed, and it is particularly preferable that a non-photosensitive layer is made function as an antihalation layer by adding thermally decoloring dye and a base precursor to the non-photosensitive layer. These technologies have been described in JP-A No. 11-231457 gazette and the like.

The additive amount of the decoloring dye is determined depending on the use of the dye. In general, such an amount that is required by an optical density (absorbance) exceeding over 0.1 at the time when the optical density is measured at the wavelength of the object is used. It is preferable that the optical density is in the range from 0.2 to 2. The usage amount of a dye for obtaining such an optical density is, in general, in the range from about 0.001 to about 1 g/m$^2$.

Note that when thus decoloring a dye, the optical density after the heat-developing can be lowered to be 0.1 or less. Two kinds of decoloring dyes may be used in combination with a thermally decoloring type recording material and a heat-developable photosensitive material. Similarly, two kinds or more of base precursors may be used in combination.

In a thermally decoloring using such decoloring dyes and base precursors, it is preferable that a material (e.g., diphenyl sulfone, 4-chlorophenyl (phenyl) sulfone) for lowering the melting point by 3° C. (degrees) or more by blending it with a base precursor as described in JP-A No. 11-352626 gazette is used in combination from the viewpoints of thermally decoloring property and the like.

In the present invention, a coloring agent having the absorption maximum at 300 nm–450 nm can be added for the purpose of improving the silver tone and time period changing of an image. These coloring agents have been described in the official gazette of JP-A No. 62-210458, JP-A No. 63-104046, JP-A No. 63-103235, JP-A No. 63-208846, JP-A No. 63-306436, JP-A No. 63-314535, JP-A No. 01-61745, and the specification of Japanese Patent Application No. 11-276751 and the like.

These coloring agents are usually added in the range from 0.1 mg/m$^2$ to 1 g/m$^2$, and it is preferable that a layer to which the agent is added is the backing layer provided on the opposite side of the photosensitive layer.

It is preferable that a heat-developable photosensitive material in the present invention is what is called a one-side photosensitive material having at least one photosensitive layer containing photosensitive silver halide emulsion on one side of the support, and having a backing layer on the other side.

In the present invention, it is preferable that matting agent is added in order to improve the conveyance, matting agents have been described in the paragraph numbers of [0126] and [0127] of JP-A No. 11-65021 gazette. When the amount of a matting agent is indicated by the coating amount per 1 m$^2$ of the photosensitive material, it is preferable that the coating amount of a matting agent is in the range from 1 to 400 mg/m$^2$, and it is more preferable that it is in the range from 5 to 300 mg/$^2$.

Moreover, any matting degree of an emulsion surface may be employed unless a stardust failure is generated, it is preferable that Beck smoothness of it is in the range from 30 seconds or more to 2000 seconds or less, and it is particularly preferable that it is in the range from 40 seconds to 1500 seconds. A Beck smoothness can be easily found according to Japanese Industrial Standards (JIS) P8119 "Smoothness Test Method for Paper and Board by Beck Testing Device" and TAPPI standard method T479.

In the present invention, as a matting degree of the backing layer, it is preferable that the Beck smoothness is in the range from 1200 seconds or less to 10 seconds or more, it is preferable that it is in the range from 800 seconds or less to 20 seconds or more, and it is further preferable that it is in the range from 500 seconds or less to 40 seconds or more.

In the present invention, it is preferable that the matting agent is contained in the outermost surface layer or a layer functioning as the outermost surface layer of the photosensitive material or in a layer close to the outer surface, and in a layer acting as what is called a protective layer.

A backing layer capable of being applied to the present invention has been described in the paragraph numbers of [0128] through [0130] of JP-A No. 11-65021 gazette.

As a heat-developable photosensitive material, it is preferable that pH of membrane surface of prior to the heat-developing processing is 7.0 or less, and it is more preferable that it is 6.6 or less. As its lowest limit, there are no particular limitations, but it is about 3. The most preferable range of pH is in the range from 4 to 6.2.

For adjusting pH of a membrane surface, it is preferable from the viewpoint of reducing the pH of the membrane surface that an organic acid such as phthalic acid derivative or the like, a nonvolatile acid such as sulfuric acid or the like, and a volatile base such as ammonia or the like are used. It is particularly preferable to use ammonia for achieving the lower pH membrane surface since ammonia is readily volatile and it can be removed prior to the step of coating and the step of heat-developing.

Moreover, it is preferable that non-volatile base such as sodium hydroxide, potassium hydroxide and lithium hydroxide and ammonia are used in combination. Note that a method for measuring a pH of membrane surface has been described in the paragraph number of [0123] of the specification of Japanese Patent Application No. 11-87297.

A hardening agent may be used in the respective layers such as a photosensitive layer, a surface protective layer, a backing layer and the like of the present invention. As an example of a hardening agent, there are respective methods described in the paragraph from pp.77 to pp.87 of T. H. James: "The Theory of the Photographic Process" (fourth edition, published by Macmillan Publishing Co., Inc., 1977), then, besides chrom alum, 2,4-dichloro-6-hydroxy-s-triazine sodium salt and N,N-ethylene bis(vinylsulfone acetamide), N,N-propylene (vinylsulfone acetamide), multivalent metallic ion described in pp.78 and other pages of the above-described literature, polyisocyanates described in U.S. Pat. No. 4,281,060, JP-A No. 06-208193 gazette and the like, epoxy compounds described in U.S. Pat. No. 4,791,042 and the like, and vinylsulfone based compounds described in JP-A No. 62-89048 gazette and the like are preferably used.

The hardening agent is added as a solution, the timing of the addition of this solution to a protective layer coating liquid is from 180 minutes before the coating until immediately before it, preferably from 60 minutes before it until 10 seconds before it, however, as a method for mixing and mixing conditions, there are no particular limitations as far as the effects of the present invention sufficiently exert.

As a concrete method for mixing, a method in which these are mixed in a tank where the average retention time calculated from the additive flow rate and the intromitted amount to a coater is made to be in the desired time, and a method of using a static mixer and the like described in the 8th chapter of N. Harnby, M. F. Edwards, A. W. Nienow:

translated by Kohji Takahashi, "Liquid Mixing Technologies" (Nikkan Industries News, Co., Ltd., 1993) are listed.

Surfactants capable of being applied to a heat-developable photosensitive material of the present invention have been described in the paragraph number of [0132] of JP-A No. 11-65021 gazette, Solvents have been described in the paragraph number of [0133] of JP-A No. 11-65021 gazette, supports have been described in the paragraph number of [0134] of JP-A No. 11-65021 gazette, antistatic and electrically conductive layers have been described in the paragraph number of [0135] of JP-A No. 11-65021 gazette, methods for obtaining a color image have been described in the paragraph number of [0136] of JP-A No. 11-65021 gazette, slip agents have been described in the paragraph numbers of [0061] through [0064] of JP-A No. 11-84573 gazette, and in the paragraph numbers of [0049] through [0062] of the specification of Japanese Patent Application No. 11-106881.

To a heat-developable photosensitive material of the present invention, further, an antioxidant, a stabilizer, a plasticizer, an ultraviolet ray absorbing agent or a coating auxiliary agent may be added. A variety of additive agents are added to either of a photosensitive layer or a non-photosensitive layer. These can be made reference to WO 98/36322, EP803764 A1, JP-A No. 10-186567, JP-A No. 10-18568 and the like.

<Supports>

Next, a support used for a heat-developable photosensitive material of the present invention will be described below.

As a transparent support used in the present invention, in order to relax the interior distortion remained in the film at the time when the film is biaxially oriented and in order to null the distortion by heat shrinkage generated during the heat-developing processing, a polyester for which the heat-developing processing is provided in the range of the temperature from 130 to 185° C., particularly a poly (ethylene terephthalate) (PET) is preferably used.

In the case of a heat-developable photosensitive material for medical use, a transparent support may be colored with a blue dye (e.g., Dye-1 described in Example of JP-A No. 08-240877), or may be colorless. To a support, it is preferable to apply undercoat technologies concerning with water-soluble polyesters described in JP-A No. 11-84574 gazette, styrene butadiene copolymers described in JP-A No. 10-186565 gazette, and vinylidene copolymers described in JP-A No.2000-39684 gazette and in the paragraph numbers of [0063] through [0080] of the specification of Japanese Patent Application No. 11-106881.

Moreover, as an antistatic layer or undercoat, the technologies described in JP-A No. 56-143430 gazette, JP-A No. 56-143431 gazette, JP-A No.58-62646 gazette, JP-A No. 56-120519 gazette, the paragraph numbers of [0040] through [0051] of JP-A No. 11-84573 gazette, U.S. Pat. No. 5,575,957, and paragraph numbers of [0078] through [0084] of JP-A No. 11-223898 gazette.

It is preferable that a heat-developable photosensitive material of the present invention is a mono-sheet type (a type in which an image can be formed on the heat-developable photosensitive material without utilizing the other sheet like a receiving image material).

<Preparation of Heat-developable Photosensitive Material>

A heat-developable photosensitive material in the present invention may be coated by any method. Concretely, a variety of coating operation are used including an extrusion coating, a slide coating, a curtain coating, an immersing coating, a knife coating, a flow coating, or an extrusion coating using a kind of hopper described in U.S. Pat. No. 2,681,294, and an extrusion coating or a slide coating described in the paragraph from pp.399 to pp.536 of Stephen F. Kistler, Petert M. Schweizer: "Liquid Film Coating" (published by Chapman & Hall, 1997) is preferably used, and particularly the slide coating is preferably used.

An example of a form of a slide coater used for a slide coating has been described in FIG. 11b.1 of pp.422 of the above-described reference. Moreover, if desired, by methods described in the paragraph from pp.399 to pp536 of the above-described reference, and methods described in U.S. Pat. No. 2,761,791, and U. K. Patent No. 837,095, two or more layers can be coated at the same time.

It is preferable that a coating liquid for a layer containing an organic sliver salt in the present invention is what is called a thixotropy fluid. As this technology, one can make reference to JP-A No. 11-52509 gazette.

As to a coating liquid for a layer containing an organic silver salt in the present invention, it is preferable that its viscosity at 0.1 $S^{-1}$ of shearing speed is in the range from 400 mPa·s or more to 100,000 mPa·s or less, and it is more preferable that it is in the range from 500 mPa·s or more to 20,000 mPa·s or less. Moreover, at $1000S^{-1}$ of shearing speed, it is preferable that its viscosity is in the range from 1 mPa·s or more to 200 mPa·s or less, and it is more preferable that it is in the range from 5 mPa·s or more to 80 mPa·s or less.

As technologies capable of being used for a heat-developable photosensitive material of the present invention, the technologies described in EP803764A1, EP883022A1 and WO 98/36322, in the official gazette of JP-A No. 56-62648, JP-A No. 58-62644, JP-A No. 09-43766, JP-A No. 09-281637, JP-A No. 09-297367, JP-A No. 09-304869, JP-A No. 09-311405, JP-A No. 09-329865, JP-A No. 10-10669, JP-A No. 10-62899, JP-A No. 10-69023, JP-A No. 10-186568, JP-A No. 10-90823, JP-A No. 10-171063, JP-A No. 10-186565, JP-A No. 10-186567, JP-A No. 10-186569-JP-A No. 10-186572, JP-A No. 10-197974, JP-A No. 10-197982, JP-A No. 10-197983, JP-A No. 10-197985-JP-A No. 10-197987, JP-A No. 10-207001, JP-A No. 10-207004, JP-A No. 10-221807, JP-A No. 10-282601, JP-A No. 10-288823, JP-A No. 10-288824, JP-A No. 10-307365, JP-A No. 10-312038, JP-A No. 10-339934, JP-A No. 11-7100, JP-A No. 11-15105, JP-A No. 11-24200, JP-A No. 11-24201, JP-A No. 11-30832, JP-A No. 11-84574, JP-A No. 11-65021, JP-A No. 11-109547, JP-A No. 11-125880, JP-A No. 11-129629, JP-A No. 11-133536-JP-A No. 11-133539, JP-A No. 11-133542, JP-A No. 11-133543, JP-A No. 11-223898, JP-A No. 11-352627, JP-A No. 11-305377, JP-A No. 11-305378, JP-A No. 11-305384, JP-A No. 11-305380, JP-A No. 11-316435, JP-A No. 11-327076, JP-A No. 11-338096, JP-A No. 11-338098, JP-A No. 11-338099 and JP-A No. 11-343420, and in the respective specifications of Japanese Patent Application No. 2000-187298, Japanese Patent Application No. 2000-10229, Japanese Patent Application No. 2000-47345, Japanese Patent Application No. 2000-206642, Japanese Patent Application No. 2000-98530, Japanese Patent Application No. 2000-98531, Japanese Patent Application No. 2000-112059, Japanese Patent Application No. 2000-112060, Japanese Patent Application No. 2000-112104, Japanese Patent Application No. 2000-112064 and Japanese Patent Application No. 2000-171936 are also listed.

<Image Formation Using Heat-developable Photosensitive Material>

Although a heat-developable photosensitive material of the present invention may be developed by any method, usually, it is developed by raising the temperature of the heat-developable photosensitive material exposed in an image-wise. As a temperature of development, it is preferable that the temperature is in the range from 80 to 250° C., and it is more preferable that it is in the range from 100 to 140° C. As a developing time, it is preferable that the developing time is in the range from 1 to 60 seconds, it is more preferable that the developing time is in the range from 5 to 30 seconds, and it is particularly preferable that the developing time is in the range from 10 to 20 seconds.

As a method of heat-development, a plate type heater method is preferable. Among a method of heat-development using a plate heater method, a method described in JP-A No. 11-133572 gazette is preferable, this is a heat-development apparatus for obtaining a visible image by contacting the heat-developable photosensitive material whose latent image has been formed with a heating means in a heat development section, wherein the heating means including a plate-heater, and a plurality of pieces of presser rollers are provided and arranged in an opposing manner along one surface of the plate heater, and the heat-development is carried out by making the heat-developable photosensitive material pass through between the presser roller and the plate heater.

Dividing the plate heater into two to six sections stepwisely and its tip section is preferably cooled down by about 1–10° C. These methods have been also described in JP-A No. 54-30032, water and organic solvents contained in the heat-developable photosensitive material can be removed to the exterior of the system and can also suppress the change of the support shape of the heat-developable photosensitive material by rapidly heating the heat-developable photosensitive material.

Although a photosensitive material of the present invention may be exposed to light by any method, as an exposure light source, a laser beam is preferable. As a laser beam according to the present invention, a gas laser ($Ar^+$, He—Ne), a YAG laser, a pigment laser, a semiconductor laser, or the like is preferable. Moreover, a semiconductor laser and the second harmonic generation element can be also used. It is preferable that a red to infrared ray emitting gas laser or a semiconductor laser is used.

As a laser imager for medical use equipped with an exposure section and a heat-development section, Fuji Medical dry laser imager FM-DP L can be listed. Concerning with FM-DP L, the reference has been described in Fuji Medical Review No.8, pp.39–55, needless to say, these technologies are applied to a laser imager of a heat-developable photosensitive material of the present invention. Moreover, as a heat-developable photosensitive material for a laser imager in the "AD network" proposed by Fuji Medical System, which is a network system adapted to DICOM standards, it can be also applied.

It is preferable that a heat-developable photosensitive material of the present invention, which forms a black and white image due to a silver image, is used as a heat-developable photosensitive material for medical diagnosis, a heat-developable photosensitive material for industrial photograph, a heat-developable photosensitive material for printing, and a heat-developable photosensitive material for COM.

[Heat-developable Photosensitive Material: Seventh Aspect]

Next, among heat-developable photosensitive materials of the present invention, the seventh aspect will be described below.

A heat-developable photosensitive material includes at least one kinds of photosensitive silver halide, a reducing agent for silver ions, a binder and a non-photosensitive organic silver salt particle on one surface of a support, the content of silver behenate in the non-photosensitive organic silver salt particle being in the range from 90% by mol or more to 99.9% or less, and the photosensitive material including at least one development accelerator.

<Non-photosensitive Organic Silver Salt>

A non-photosensitive organic silver salt capable of being used for a heat-developable photosensitive material of the present invention (hereinafter, in some cases, may be simply referred to as "organic silver salt") is comparatively stable to light, however, in the case where the non-photosensitive organic silver salt is heated to 80° C. or more in the presence of a photocatalyst exposed to light (latent image of a photosensitive silver halide or the like) and a reducing agent, it is a silver salt forming a silver image. An organic silver salt may be any organic material containing a source which is capable of reducing a silver ion.

As these non-photosensitive organic silver salts, these have been described in the official gazette of JP-A No. 06-130543, JP-A No. 08-314078, JP-A No. 09-127643, the paragraph Nos. [0048] and [0049] of JP-A No. 10-62899, JP-A No. 10-94074, JP-A No. 10-94075, the paragraph from the 24th line of the 18th page to the 37th line of the 19th page of European Patent Publication No. 0803764 A1, European Patent Publication No. 0962812 A1, European Patent Publication No. 1004930 A2, JP-A No. 11-349591, JP-A No. 2000-7683, JP-A No. 2000-72711, JP-A No. 2000-112057, JP-A 2000-155383 and the like.

A silver salt of an organic acid, particularly a silver salt of fatty carboxylic acid having a long chain (having 10 to 30 carbon atoms, preferably having 15 to 28 carbon atoms) is preferable.

As preferable examples of organic silver salts, silver behenate, silver arachidate, silver stearate, and their mixtures are listed, however, the present invention is characterized in that the content of silver behenate in a non-photosensitive organic silver salt particle is in the range from 90% by mol or more to 99.9% by mol or less, thereby capable of obtaining an organic silver salt having a low Dmin and an excellent image-keeping property. Moreover, it is more preferable that it is in the range from 95% by mol or more to 99.9% by mol or less, and it is particularly preferable that it is in the range from 97% by mol or more to 99.9% by mol or less.

It is preferable that the content of silver stearate is in the range of 1% by mol or less. As a result of making the content of the silver stearate 1% by mol or less, a silver salt of an organic acid having a low Dmin and an excellent image-keeping property is obtained. It is more preferable that its content is 0.5% by mol or less, and it is particularly preferable that it is substantially not contained.

Moreover, it is preferable that the content of silver arachidate is 6% by mol or less from the viewpoint of obtaining a low Dmin and a silver salt of an organic acid having an excellent image-keeping property, and it is more preferable that it is 3% by mol or less.

As a shape of an organic silver salt capable of being used in the present invention, it is preferable that it is a squamiform particle having the slenderness ratio in the range from 1 or more to 9 or less. If the slenderness ratio is in the range from 1 or more to 9 or less, it is preferable since breaking is not occurred, as a result of it, the image-keeping property becomes excellent.

In the present specification, a squamiform silver salt of an organic acid will be defined as follows: the silver salt of an organic acid is observed using an electron microscope. If the shape of the silver salt particle of the organic acid is approximate to that of a rectangular parallelopiped and the sides of this rectangular parallelopiped are measured to be a, b and c, from the shortest side (c may be equal to b), calculating by the shorter values, a and b, x is found by the following equation:

$$x=b/a$$

and $y=c/b$.

In this way, x and y are found for about 200 particles. If the average value is called x (average), particles satisfying the relationship $30 \geqq x(\text{average}) \geqq 1.5$ are regarded as squamiform particles. It is preferably in the range of $30 \geqq x(\text{average}) \geqq 1.5$, and more preferably in the range of $20 \geqq x(\text{average}) \geqq 2.0$. Note that a particle in a needle shape is in the range of $1 \leqq x(\text{average}) < 1.5$. Moreover, the average value of y, y (average), is defined as the slenderness ratio. As the slenderness ratio of an organic silver salt particle of the present invention, it is preferable that the aspect ratio is in the range from 1 or more to 9 or less, and more preferable that it is in the range from 1 or more to 6 or less, and further preferable that it is in the range from 1 or more to 3 or less. in a squamiform particle, a can be supposed as the thickness of a particle in a tubular shape in which its plane of b and c are made as sides is made as the principal plane. It is preferable that the average of a is in the range from 0.01 μm or more to 0.23 μm or less, and it is more preferable that it is in the range of 0.1 μm or more to 0.20 μm or less.

In a squamiform particle, it is defined that the sphere-equivalent diameter of a particle/a is the aspect ratio. As the aspect ratio of a squamiform particle in the present invention, it is preferable that the aspect ratio is in the range from 1.1 or more to 30 or less, and as a result of making the aspect ratio be these ranges, it does not easily generate flocculation in the photosensitive material and the image-keeping property becomes excellent. It is more preferable that the aspect is in the range from 1.1 or more to 15 or less.

Moreover, the sphere-equivalent diameter of a squamiform particle in the present invention is characterized in that the diameter is in the range from 0.05 μm or more to 1 μm or less, thereby not easily generating flocculation in the photosensitive material, and the image-keeping property becomes excellent. It is preferable that the diameter is in the range from 0.1 μm or more to 1 μm or less.

In the present invention, in a method of measuring a sphere-equivalent diameter, the sample is directly shot using an electron microscopy, and subsequently, the diameter is found by image-processing the negative film.

It is preferable that the particle size distribution of an organic silver salt is a monodispersed distribution. In the monodispersed distribution, a percentage (variation coefficient) corresponding to the standard deviation of volume-weighted average diameter of the organic silver salt divided by the volume-weighted average diameter, found by a method for finding the standard deviation of the volume-weighted average diameter of the organic silver salt, is preferably 100% or less, more preferably 80% or less and further preferably 50% or less.

As a method of measuring this, it can be found, for example, from the particle size (volume-weighted average diameter) obtained by irradiating an organic silver salt dispersed in the liquid using a laser beam and by finding autocorrelation function with respect to a time change of fluctuation of its scattering beam.

[Preparation of Non-photosensitive Organic Silver Salt Particle]

A non-photosensitive organic silver salt particle in the present invention is preferable in such a point that it is prepared at the reaction temperature of 60° C. or less from the viewpoint that a particle having a low Dmin is prepared. As an agent to be added, for example an alkali metal aqueous solution of an organic acid may be higher than the temperature of 60° C., however, the temperature of the reaction bath into which the reactive liquid is added is preferably at 60° C. or less. Furthermore, it is more preferable that it is at 50° C. or less, and particularly preferable that it is at 40° C. or less.

Although an organic silver salt particle in the present invention is prepared by reacting a solution containing silver ions such as silver nitrate and an alkali metallic salt solution of an organic acid or its suspension, it is preferable that the addition of 50% or more of the total silver additive amount is performed at the same time with the addition of the alkali metallic salt solution or its suspension of an organic acid.

As an addition method, a method for adding on the liquid level of the reaction bath, a method for adding in the liquid, and further, a method for adding in the sealing and mixing means described later and the like are listed, but any of these may be utilized.

As one example of a method for preparing it by adding in the sealing and mixing means, a method similar to the first aspect in a heat-developable photosensitive material of the present invention is listed, however, the present invention is not limited to this.

The pH of a solution containing silver ions used in the present invention (e.g., silver nitrate aqueous solution) is preferably a pH in the range from pH 1 or more to pH 6 or less, and further preferably a pH in the range from pH 1.5 or more to pH 4 or less. Furthermore, in order to adjust the pH, an acid and an alkali can be added. The kinds of acids and alkalies are not particularly limited.

An organic silver salt in the present invention may be maturated by raising the reaction temperature after the addition of a solution containing silver ions (e.g., silver nitrate aqueous solution) and/or an alkali metallic salt solution of an organic acid is terminated. It is considered that the maturation in the present invention is different from the reaction temperature described above. During the maturation, the addition of a silver nitrate and an alkali metallic salt solution or its suspension of an organic acid is not performed at all. It is preferable that the maturation is performed at the temperature in the range from the reaction temperature plus 1° C. or more to the reaction temperature plus 20° C. or less, and it is preferable that it is in the range from the reaction temperature plus 1° C. or more to the reaction temperature plus 10° C. or less. Note that it is preferable that the maturation time is determined by performing the method of trial and error.

In the preparation of an organic silver salt in the present invention, the addition of an alkali metallic salt solution of an organic acid may be performed the number of times from two times or more to six times or less by dividing it. As a result of dividing and adding it here, for example, addition for enhancing the photographic performance, addition for changing the hydrophilic nature of the surface and the like can give a variety of functions to the particle. The number of times of the divided additions is preferably in the range from two times or more to four times or less. Now, since a salt of an organic acid is solidified unless it is at a high temperature, when the divided additions are performed, it is necessary to consider to have a plurality of addition lines for dividing it or contrive a method for circulating it or the like.

In the preparation of an organic silver salt in the present invention, it is preferable that the amount ranging from 0.5% by mol or more to 30% by mol or less out of the number of moles of the total addition of an alkali metallic salt solution of an organic acid is singly added after the addition of a solution containing silver ions is terminated. It is preferable that it is added singly in the range from 3% by mol or more to 20% by mol or less. It is preferable that this addition is performed with one portion of the divided addition amount. This may be added in the sealing and mixing means or in any of the reaction bathes, but it is preferable that this is added in the reaction bath.

The hydrophilic nature of the surface of the particles can be enhanced by carrying out this addition, as a result of it, the layer preparing property of the sensitive material is made better, and the layer peeling off is improved.

Although the silver ion concentration of a solution containing silver ions used in the present invention is optionally determined, it is preferable that as a molar concentration, it is in the range from 0.03 mol/L or more to 6.5 mol/L or less, and it is more preferable that it is in the range from 0.1 mol/L or more to 5 mol/L or less.

Upon carrying out the present invention, in order to form an organic acid particle, in at least one of a solution containing silver ions, an alkali metallic salt solution or its suspension of an organic acid and a solution previously prepared in a reactive field, it is preferable that an alkali metallic salt of an organic acid contains an amount capable of making it a substantially transparent solution but does not contain an associated body in a string shape and a micelle. Although the solution may be a single organic solvent, it is preferable that it is a mixed solution with water.

As an organic solvent used in the present invention, if it is water soluble and has the above-described natures, the kind of it is not particularly limited, but it is not preferable if it interferes with the photographic performances, it is preferable that it is an alcohol, acetone or the like capable of being mixed with water, and it is further preferable that the tertiary alcohol having 4 to 6 carbon atoms.

It is preferable that an alkali metal of the alkali metallic salt of an organic acid is concretely Na, K. An alkali metallic salt of an organic acid is prepared by adding NaOH or KOH to the organic acid. At this time, it is preferable that the amount of alkali is made the equivalent weight or less of the organic acid and non-reacted organic acid is made remained. The residual amount of the organic acid in this case is in the range from 3% by mol or more to 50% by mol or less, and preferably in the range from 3% by mol or more to 30% by mol or less with respect to the total amount of the organic acid. Moreover, after an alkali is added more than the desired amount, an acid such as nitric acid, sulfuric acid or the like is added, and it may be prepared by neutralizing the portion of the excessive alkali.

Furthermore, as a solution containing silver ions and an alkali metallic salt solution of an organic acid or a liquid for a sealing and mixing container in which the above-described both liquids are added, an example similar to an example of the first aspect in a heat-developable photosensitive material of the present invention is listed.

As an alkali metallic salt solution of an organic acid used in the present invention, it is preferable that the amount of an organic solvent is in the range from 3% or more to 70% or less as a solvent volume with respect to the volume of water, and it is more preferable that it is in the range from 5% or more to 50% or less. At this time, since the optimal solvent volume changes at the reaction temperature, the optimal amount can be determined by performing a method of trial and error.

The concentration of an alkali metallic salt of an organic acid used in the present invention is in the range from 5% by weight or more to 50% by weight or less as weight ratio, it is preferable that it is in the range from 7% by weight or more to 45% by weight or less, and further preferable that it is in the range from 10% by weight or more to 40% by weight or less.

As a temperature of a tertiary alcohol aqueous solution of an alkali metallic salt of an organic acid that is added into the sealing and mixing means or reaction container, it is preferable that it is in the range from 50° C. or more to 90° C. or less for the purpose of maintaining the required temperature so as to avoid the phenomena of crystallization and solidification of an alkali metallic salt of an organic acid, and more preferable that it is in the range from 60° C. or more to 85° C. or less, and most preferable that it is in the range from 65° C. or more to 85° C. or less. Moreover, in order to control the reaction temperature at a certain level, it is preferable that a certain level of the temperature selected from the above-described range is controlled.

As a result of having done it, the speed at which the tertiary alcohol aqueous solution of an alkali metallic salt of an organic acid at a high temperature is rapidly cooled down in the sealing and mixing means and precipitated into a refined, crystallized shape, and the speed at which it is made an organic silver salt by the reaction with a solution containing silver ions are preferably controlled, then the crystallization form of the organic silver salt, the size of the crystal, crystal size distribution can be preferably controlled. And at the same time, as a heat-developable material, particularly as a heat-developable photosensitive material, the performances can be enhanced.

In the reaction container, a solvent may have been previously contained, and water is preferably used as a solvent previously put, however, the mixed solvent with the tertialry alcohol is preferably used.

A dispersion auxiliary agent soluble to an aqueous medium can be added to the tertiary alcohol aqueous solution of an alkali metallic salt of an organic acid, a solution containing silver ions, or a reaction solution. As a dispersion auxiliary agent, any may be used if it is capable of dispersing the formed organic silver salt. As a concrete example, it is in conformity with the description on the dispersion auxiliary agent of an organic silver salt described later.

In a method for preparing an organic silver salt, it is preferable that desalting/dehydration step is performed after the silver salt is formed. There are no limitations for its method, a means which is well known/commonly used can be used. For example, a well known method for filtering such as a centrifugal filtration, an absorption filtration, an ultrafiltration, a flock-forming washing with water by a condensation method, or the like, and the removal of supernatant by centrifuge separation precipitation or the like are preferably used. Desalting/dehydration may be performed once, or may be repeated a plurality of times. The addition and removal of water may be performed in series, or may be performed individually.

As the desalting/dehydration, it is preferable that the desalting/dehydration is performed in such a degree that the conductivity of water finally dehydrated is 300 μS/cm or less, it is more preferable that it is performed in such a degree that the conductivity is 100 μS/cm or less, and it is most preferable that it is performed in such a degree that the conductivity is 60 μS/cm or less. There is no particular lower limit of the conductivity in this case, however, usually the lower limit is about 5 μS/cm.

The ultrafiltration method (operational conditions, ultrafiltration membrane, means for dispersing a liquid and liquid temperature from the time after the formation of the particle until the proceeding of the operation of desalting) is similar to a method described in the first aspect in a heat-developable photosensitive material of the present invention.

Furthermore, particularly in order to make the coated surface state of a heat-developable material, particularly of a heat-developable photosensitive material, it is preferable that a dispersion agent is added to the organic silver salt which has been desalted and dehydrated, and dispersed to be a refined, dispersed matter.

The known method or the like can be applied to a method for manufacturing an organic silver salt and its method for dispersing it used in the present invention. As the known method, a method similar to the first aspect in a heat-developable photosensitive material of the present invention is listed.

As a method for dispersing an organic silver salt into a refined particle, it can be mechanically dispersed by utilizing the known refining means (for example, a high speed mixer, a homogenizer, a high speed impact mill, a Banbury mixer, a homomixer, a kneader, a ball mill, a vibrating ball mill, a planetary ball mill, an attaritor, a sand mill, a beads mill, a collide mill, a jet mill, a roller mill, a thoron mill and a high speed stone mill).

In order to obtain a small particle sized, uniform fatty silver salt solid dispersed matter having a high S/N ratio without flocculation, it is preferable that a large force is uniformly given in such a range that the damage of the organic silver salt particle which is an image formation medium and the organic silver salt particle being at a high temperature are not generated. Therefore, a dispersing method for dropping the pressure after the dispersed matter consisted of an organic silver salt and dispersing agent solution is converted into a high speed flow is preferable. As a dispersing medium, in this case, any one may be used if it is the solvent with which the dispersing auxiliary agent functions, however, it is preferable that it is only water but it may contain an organic solvent if it is 20 wt % or less. Moreover, since the fogging is raised and the sensitivity is significantly lowered if a photosensitive silver salt is coexistent with it at the time when it is dispersed, it is more preferable that it substantially does not contain the photosensitive silver salt at the time when it is dispersed.

In the present invention, the amount of a photosensitive silver salt in a dispersion liquid where it is dispersed is 0.1% by mol or less with respect to the organic silver salt 1 mol in the liquid, it is preferable that the addition of the photosensitive silver salt is not performed.

On a dispersing apparatus and its technology used for carrying out a method for re-dispersing as described above, those similar to the first aspect in a heat-developable photosensitive material of the present invention are listed, a method for re-dispersing in the present invention is a method in which after a dispersion liquid containing at least organic silver salt is pressurized by a high pressure pump and the like and intromitted it into the piping, made it pass through a narrow slit provided within the piping, and subsequently, a refined dispersion is performed by generating a rapid pressure lowering in the dispersion liquid.

The description on a highly pressuried homogenizer is similar to the description in the first aspect of a heat-developable photosensitive material of the present invention.

Although an organic silver salt can be dispersed into a desired particle size by adjusting the flow rate, the pressure difference at the time when the pressure is dropped and the processing number of times, from the viewpoint of photograph characteristics and particle size, it is preferable that the flow rate is in the range from 200 to 600 m/sec, the pressure difference at the time when the pressure is dropped is in the range from 900 to 3000 kg/cm$^2$ (from 9 to 30 MPa), and further, it is more preferable that the flow rate is in the range from 300 to 600 m/sec, the pressure difference is in the range from 1500 to 3000 kg/cm$^2$ (from 15 to 30 MPa). The number of times of dispersion processing can be selected according to the necessity. Usually, the range from once to 10 times is selected, however, from the viewpoint of the productivity, the range from once to three times or the like is selected. It is not preferable from the viewpoints of dispersion property/photographic property that the temperature of such a dispersion liquid is raised to a high temperature under the high pressure, the particle size is easily enlarged at such a high temperature such as over 90° C. or the like and the fogging tends to be increased. Therefore, it is preferable that a cooling apparatus is included in the step prior to the step in which it is converted into the a high pressure, a high speed flow, or the step after the pressure is dropped, or a cooling apparatus is included in both steps, the temperature of such a dispersion is maintained in the range from 5 to 90° C. by the cooling step and it is further preferable that it is maintained in the range from 5 to 80° C., and it is particularly preferable that it is maintained in the range from 5 to 65° C. It is particularly effective to set the cooling apparatus at the time when the dispersion is performed at a high pressure ranging from 1500 to 3000 kg/cm$^2$ (from 15 to 30 MPa).

As a cooling apparatus, according to the required heat exchange amount, a cooling apparatus using a static mixer for duplex tube and triplet tube, a multitube type heat exchanger, a hose type heat exchanger or the like can be appropriately selected. Moreover, in order to enhance the efficiency of the heat exchanging, the size of the tube, the thickness, the quality of the material and the like may be selected in consideration of utilized pressure. As a refrigeration medium used for the cooler, from the viewpoint of heat exchanging amount, a refrigeration medium such as water from a well at the temperature of 20° C., chilled water at the temperature ranging from 5 to 10° C. processed in a refrigerator and ethylene glycol/water or the like at the temperature of −30° C. can be used according to the necessity.

As a polymer compound when an organic silver salt is solidified and refined into a particle using a dispersing agent, compounds similar to the first aspect in a heat-developable photosensitive material of the present invention are listed, from these, the compound is appropriately selected and used.

Moreover, in the case where a solvent is used as a dispersion medium, polyvinyl butyral, butylethyl cellulose, methacrylate copolymer, maleic anhydride ester copolymer, polystyrene and butadiene-styrene copolymer and the like are preferably used.

Although it is a general method in which a dispersing auxiliary agent is mixed with an organic silver salt in a powder or in a wet cake prior to the dispersion and intromitted into a dispersing apparatus as a slurry, a method may be used in which an organic silver salt powder or wet cake is made by performing the processing with heat treatment or solvent in a state of previously having mixed with an organic silver salt. The pH may be controlled by a suitable pH preparation agent before and after the dispersion or during the dispersion.

Except that the dispersion is performed by mechanical force, a coarse dispersion may be performed in the solvent by controlling pH, and subsequently, the refining of the particle is performed by changing pH in the presence of a dispersion auxiliary agent. At this time, as a solvent used for coarse dispersion, a fatty acid solvent may be used.

It should be noted that since the fogging is increased and the sensitivity is significantly lowered if a photosensitive silver salt is coexistent with an organic silver salt at the time when the organic silver salt is dispersed, it is more preferable that it substantially does not contain the photosensitive silver salt at the time when it is dispersed. In the present invention, the amount of a photosensitive silver salt in a dispersion liquid where it is dispersed is 0.1% by mol or less with respect to the organic silver salt 1 mol in the liquid, it is preferable that the photosensitive silver salt is not added.

In the present invention, although it is possible that a photosensitive material is manufactured by mixing an organic silver salt aqueous dispersion liquid and a photosensitive silver salt aqueous dispersion liquid, and the mixture ratio of the organic silver salt and the photosensitive silver salt is selected according to the objects, however, the ratio of the photosensitive silver salt with respect to the organic silver salt is preferably in the range from 1 to 30% by mol, further preferably in the range from 3 to 20% by mol, and particularly preferably in the range from 5 to 15% by mol. Upon mixing, a method in which two kinds or more of the organic silver salt aqueous dispersion liquids and two kinds or more of the photosensitive silver salt aqueous dispersion liquids are mixed is preferably used in order to adjust the photographic characteristics.

Although an organic silver salt of the present invention can be used in a desired amount, as a silver amount, the range from 0.1 to 5 g/m$^2$ is preferable and it is more preferable that it ranges from 1 to 3 g/m$^2$.

<Development Accelerator>

A development accelerator contained in a heat-developable photosensitive material of the present invention is a compound that the required exposure to light indicating the optical density=1.0 when 10% of the development accelerator with respect to the principal reducing agent as a molar ratio is added becomes 90% or less comparing to the case where the development accelerator is not added. It is preferable it is the compound so that the required exposure to light indicating the optical density=1.0 when 5%, more preferably 2%, of the development accelerator with respect to the principal reducing agent as a molar ratio is added becomes 90% or less comparing to the case where the development accelerator is not added.

Any compound may be used if it promotes the phenomenon in a heat-development as a development accelerator. What is called a reducing agent can be used.

Concretely, compounds such as p-aminophenols, p-phenylenediamines, sulfonamide phenols, phenydones, ascorbic acid, hydrazines, phenols, naphthols and the like can be used. Among these, sulfonamide phenols (e.g., compound represented by the general formula (1) described in JP-A No. 10-221806; compound represented by the formula (A) described in the specification of JP-A No. 2000-267222) and hydrazines are preferable.

A development accelerator represented by the general formula (P) or (Q) will be described below.

In the general formulas (P) and (Q), each of $X_{1a}$ and $X_{2a}$ independently represents a hydrogen atom or substituent.

As an example of substituent represented by $X^{1a}$ and $X^{2a}$, a halogen atom (e.g., fluorine atom, chlorine atom, bromine atom and iodine atom), aryl group (e.g., preferably having 6 to 30 carbon atoms, more preferably having 6 to 20 carbon atoms, and further preferably having 6 to 12 carbon atoms, for example, phenyl, p-methylphenyl, naphthyl and the like), an alkoxy group (preferably having 1 to 20 carbon atoms, more preferably having 1 to 12 carbon atoms, and further preferably having 1 to 8 carbon atoms, for example, methoxy, ethoxy, butoxy and the like), an aryloxy group (preferably having 6 to 20, more preferably having 6–16 carbon atoms, and further preferably having 6 to 12 carbon atoms, for example, phenyloxy, 2-naphthyloxy and the like), an alkylthio group (preferably having 1 to 20, more preferably having 1 to 16 carbon atoms, and further preferably having 1 to 12 carbon atoms, for example, methlthio, ethylthio, butylthio and the like), an arylthio group (preferably having 6 to 20 carbon atoms, more preferably having 1 to 16 carbon atoms, and further preferably having 6 to 12 carbon atoms, for example, phenylthio, naphthylthio and the like), an acyloxy group (preferably having 1 to 20 carbon atoms, more preferably having 2 to 16 carbon atoms, and further preferably having 2 to 10 carbon atoms, for example, acetoxy, benzoyloxy and the like), an acylamino group (preferably having 2 to 20 carbon atoms, more preferably having 2 to 16 carbon atoms, and further preferably having 2 to 10 carbon atoms, for example, N-methylacetylamino, benzoylamino and the like), a sulfonylamino group (preferably having 1 to 20 carbon atoms, more preferably having 1 to 16 carbon atoms, and further preferably having 1 to 12 carbon atoms, for example, methanesulfonylamino, benzenesulfonylamino and the like), a carbamoyl group (preferably having 1 to 20 carbon atoms, more preferably having 1 to 16 carbon atoms, and further preferably having 1 to 12 carbon atoms, for example, carbamoyl, N,N-diethylcarbamoyl, N-phenylcarbamoyl and the like), an acyl group (preferably having 2 to 20 carbon atoms, more preferably having 2 to 16 carbon atoms, and further preferably having 2 to 12 carbon atoms, for example, acetyl, benzoyl, formyl, pivaloyl and the like), an alkoxycarbonyl group (preferably having 2 to 20 carbon atoms, more preferably having 2 to 16 carbon atoms and further preferably having 2 to 12 carbon atoms, for example, methoxycarbonyl and the like), a sulfo group, sulfonyl group (preferably having 1 to 20 carbon atoms, more preferably having 1 to 16 carbon atoms, and further preferably having 1 to 12 carbon atoms, for example, mesyl, tosyl and the like), a sulfonyloxy group (preferably having 1 to 20 carbon atoms, more preferably having 1 to 16 carbon atoms, and further preferably having 1 to 12 carbon atoms, for example, methanesulfonyloxy, benzenesulfonyloxy and the like), an azo group, a heterocyclic group, a heterocyclic mercapto group, a cyano group and the like are listed.

As used herein, the term heterocyclic group represents a saturated or unsaturated heterocyclic group, for example, a pyridyl group, a quinolyl group, a quinoxalynyl group, a pyrazinyl group, a benzotriazole group, a pyrazolyl group, an imidazolyl group, a benzoimidazolyl group, a tetrazolyl group, a hydantoin-1-yl group, a succinimide group, a phthalimide group and the like are listed.

A substituent represented by $X_{1a}$ and $X_{2a}$ in the general formula (P) or the general formula (Q) is more preferably an alkoxy group, an aryloxy group. A substituent represented by $X_{1a}$ and $X_{2a}$ may be further substituted by the other substituent, any substituent generally known may be used unless the photographic performances are not deteriorated.

In the general formulas (P) and (Q), each of $R^{1a}$ through $R^{3a}$ independently represents a hydrogen atom or a substituent.

Each of m and p independently represents an integer of 0 through 4, and n represents an integer of 0 through 2.

As a substituent represented by $R^{1a}$ through $R^{3a}$, any substituent may be used if there is no bad influence on the photographic property. For example, a halogen atom (e.g., a fluorine atom, a chlorine atom, a bromine atom and an iodine atom), a linear, branched, cyclic or their combined alkyl group (preferably having 1 to 20 carbon atoms, more preferably 1 to 16 carbon atoms, and further preferably having 1 to 13 carbon atoms, for example, a methyl, an ethyl, a n-propyl, an isopropyl, a sec-butyl, a tert-butyl, a tert-octyl, a n-amyl, a tert-amyl, a n-dodecyl, a n-tridecyl, a cyclohexyl and the like), an alkenyl group (preferably having 2 to 20 carbon atoms, more preferably having 2 to 16 carbon atoms, and further preferably having 2 to 12 carbon atoms, for example, a vinyl, an allyl, a 2-butenyl, a 3-pentenyl and the like), an aryl group (preferably having 6 to 30 carbon atoms, more preferably having 6 to 20 carbon atoms and further preferably having 6 to 12 carbon atoms, for example, a phenyl, a p-methylphenyl, a naphthyl and the like), an alkoxy group (preferably having 1 to 20 carbon atoms, more preferably having 1 to 16 carbon atoms, and further preferably having 1 to 12 carbon atoms, for example, a methoxy, an ethoxy, a propoxy, a butoxy and the like), an aryloxy group (preferably having 6 to 30 carbon atoms, more preferably having 6 to 20 carbon atoms, and further preferably having 6 to 12 carbon atoms, for example, a phenyloxy, a 2-naphthyloxy and the like), an acyloxy group (preferably having 2 to 20 carbon atoms, more preferably having 2 to 16 carbon atoms, and further preferably having 2 to 12 carbon atoms, for example, an acetoxy, a benzoyloxy and the like), an amino group (preferably having 0 to 20 carbon atoms, more preferably having 1 to 16 carbon atoms, and further preferably having 1 to 12 carbon atoms, for example, a dimethylamino group, a diethylamino group, a dibutylamino group, an anilino group and the like), an acylamino group (preferably having 2 to 20 carbon atoms, more preferably having 2 to 16 carbon atoms and further preferably having 2 to 13 carbon atoms, for example, an acetylamino, a tridecanoylamino, a benzoylamino and the like), a sulfonylamino group (preferably having 1 to 20 carbon atoms, more preferably having 1 to 16 carbon atoms, and further preferably having 1 to 12 carbon atoms, for example, a methanesufonylamino, a butanesulfonylamino, a benzenesufonylamino and the like), a ureido group (preferably having 1 to 20 carbon atoms, more preferably having 1 to 16 carbon atoms, and further preferably having 1 to 12 carbon atoms, for example, a ureido, a methylureide, a phenylureide and the like), a carbamate group (preferably having 2 to 20 carbon atoms, more preferably having 2 to 16 carbon atoms, and further preferably having 2 to 12 carbon atoms, for example, a methoxycarbonylamino, a phenyloxycaronylamino and the like), a carboxyl group, a carbamoyl group (preferably having 1 to 20 carbon atoms, more preferably having 1 to 16 carbon atoms, and further preferably having 1 to 12 carbon atoms, for example, a carbamoyl, a N,N-diethylcarbamoyl, a N-dodecylcarbamoyl, a N-Phenylcarbamoyl and the like), an alkoxycarbonyl group (preferably having 2 to 20 carbon atoms, more preferably having 2 to 16 carbon atoms and further preferably having 2 to 12 carbon atoms, for example, a methoxycarbonyl, an ethoxycarbonyl, a butoxycarbonyl and the like), an acyl group (preferably having 2 to 20 carbon atoms, more preferably having 2 to 16 carbon atoms, and further preferably having 2 to 12 carbon atoms, for example, an acetyl, a benzoyl, a formyl, a pivaloyl and the like), a sulfo group, sulfonyl group (preferably having 1 to 20 carbon atoms, more preferably having 1 to 16 carbon atoms, and further preferably having 1 to 12 carbon atoms, for example, a mesyl, a tosyl and the like), a sulfamoyl group (preferably having 0 to 20 carbon atoms, more preferably having 0 to 16 carbon atoms, and further preferably having 0 to 12 carbon atoms, for example, a sulfamoyl, a methylsulfamoyl, a dimethylsulfamoyl, a phenylsulfamoyl and the like), a cyano group, a nitro group, a hydroxyl group, a mercapto group, an alkylthio group (preferably having 1 to 20 carbon atoms, more preferably having 1 to 16 carbon atoms, and further preferably having 1 to 12 carbon atoms, for example, a methylthio, a butylthio and the like), a heterocyclic group (preferably having 2 to 20 carbon atoms, more preferably having 2 to 16 carbon atoms, and further preferably having 2 to 12 carbon atoms, for example, a pyridyl, an imidazoyl, a pyrrolidyl and the like) and the like are listed.

These substituents may be further substituted by other substituents.

As a preferable substituent represented by $R^{1a}$ through $R^{3a}$, among the above-described ones, a halogen atom, an alkyl group, an aryl group, an alkoxy group, an aryloxy group, an acyloxy group, an anililo group, an acylamino group, a sulfonylamino group, a carboxyl group, a carbamoyl group, an acyl group, a sulfo group, a sulfonyl group, a sulfamoyl group, a cyano group, hydroxyl group, a mercapto group, an alkylthio group and a heterocyclic group are listed.

Compounds represented by the general formula (P) are more preferably have a carbamoyl group at 2-position (preferably having 1 to 20 carbon atoms, more preferably having 1 to 16 carbon atoms, and further preferably having 1 to 12 carbon atoms, for example, carbamoyl, N,N-diethylcaramoyl, N-dodecylcarbamoyl, N-phenylcarbamoyl, N-(2-chlorophenyl) carbamoyl), N-(4-chlorophenyl) carbamoyl, N-(2,4-dichlorophenyl) carbamoyl, N-(3,4-dichlorophenyl) carbamoyl and the like), and particularly and preferably have an arylcarbamoyl group at 2-position (preferably having 7 to 12 carbon atoms, more preferably having 7 to 16 carbon atoms, and further preferably having 7 to 12 carbon atoms, for example, N-phenylcarbamoyl, N-(2-chlorophenyl) carbamoyl, N-(4-chlorophenyl) carbamoyl, N-(2,4-dichlorophenyl) carbamoyl, N-(3,4-dichlorophenyl) carbamoyl and the like).

As a preferable structure of the general formula (P) or (Q), compounds represented by the general formulas (1), (3) and (4) are listed.

<Development Accelerator Represented by General Formula (1)>

A development accelerator represented by the general formula (1) will be described below.

General Formula (1)

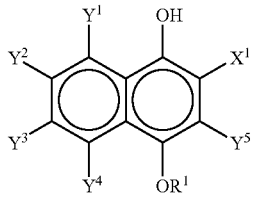

In the general formula (1), $R^1$ represents an alkyl group, an aryl group, an alkenyl group, a heterocyclic group, an acyl group, an alkoxycarbonyl group, a carbamoyl group, and an alkynyl group.

An alkyl group represented by a $R^1$ is a linear, branched, cyclic or combined, alkyl group preferably having 1 to 30 carbon atoms, more preferably having 1 to 16 carbon atoms, and further preferably having 1 to 13 carbon atoms, for example, a methyl, an ethyl, a n-propyl, an isopropyl, a n-butyl, a sec-butyl, a tert-butyl, a n-hexyl, a cyclohexyl, a n-octyl, an i-octyl, a n-amyl, a t-amyl, a n-decyl, a n-dodecyl, a n-tridecyl, a benzyl, a phenethyl and the like are listed.

An aryl group represented by $R^1$ is an aryl group preferably having 6 to 30 carbon atoms, more preferably having 6 to 20 carbon atoms, and further preferably having 6 to 12 carbon atoms, for example, phenyl, 4-methylphenyl, 2-chloropheyl, 4-chlorophenyl, 2,4-dichlorophenyl, 3,4-dichlorophnyl, 2-methoxyphenyl, 4-methoxyphenyl, 4-hexyloxyphenyl, 2-dodecyloxyphenyl, naphthyl and the like can be listed.

An alkenyl group represented by $R^1$ is an alkenyl group preferably having 2 to 30 carbon atoms, more preferably having 2 to 20 carbon atoms, and further preferably having 2 to 12 carbon atoms, for example, a vinyl group, an allyl group, an isopropenyl group, a butenyl group, a cylohexenyl group and the like can be listed.

An alkynyl group represented by $R^1$ is an alkynyl group preferably having 2 to 30 carbon atoms, more preferably having 2 to 20 carbon atoms, and further preferably having 2 to 12 carbon atoms, for example, an ethynyl group, a propyl group and the like can be listed.

$R^1$ may further have a substituent, as a preferable example of a substituent, groups represented by $Y^1$ through $Y^5$ in compounds represented by the general formula (1) described later can be listed.

$R^1$ further preferably represents an alkyl group or an aryl group, and particularly preferably an alkyl group.

In compounds represented by the general formula (1), $X^1$ represents an acyl group, an alkoxycarbonyl group, a carbamoyl group, a sulfonyl group or a sulfamoyl group.

An acyl group represented by $X^1$ is an acyl group preferably having 2 to 20 carbon atoms, more preferably having 2 to 16 carbon atoms, and further preferably having 2 to 12 carbon atoms, for example, acetyl, propyonyl, butylyl, valelyl, hexanoyl, mistyrylyl, parmitoyl, stearyl, oleyl, acryloyl, cyclohexanecarbonyl, benzoyl, formyl, pivaloyol and the like are listed.

An alkoxycarbonyl group represented by $X^1$ is an alkoxycarbonyl group preferably having 2 to 20 carbon atoms, more preferably having 2 to 16 carbon atoms, and further preferably having 2 to 12 carbon atoms, for example, methoxycarbony, ethoxycarbony, butoxycarbonyl, phenoxycarbonyl and the like are listed.

A carbamoyl group represented by $X^1$ is a carbamoyl group preferably having 1 to 20 carbon atoms, more preferably having 1 to 16 carbon atoms, and further preferably having 1 to 12 carbon atoms, for example, carbamoyl, N,N-diethylcarbamoyl, N-dodecylcarbamoyl, N-decylcarbamoyl, N-hexadecylcarbamoyl, N-phenylcarbamoyl, N-(2-chlorophenyl) carbamoyl, N-(4-chlorophenyl) carbamoyl, N-(2,4-dichlorophenyl) carbamoyl, N-(3,4-dichlorophenyl) carbamoyl and the like, N-pentachlorophenylcarbamoyl, N-(2-methoxyphenyl) carbamoyl, N-(4-methoxyphenyl)carbamoyl, N-(2,4-dimethoxyphenyl) carbamoyl, N-(2-dodecyloxyphenyl) carbamoyl, N-(4-dodecyloxyphenyl) carbamoyl and the like are listed.

A sulfonyl group represented by $X^1$ is a sulfonyl group preferably having 1 to 20 carbon atoms, more preferably having 1 to 16 carbon atoms, and further preferably having 1 to 12 carbon atoms, for example, mesyl, ethanesulfonyl, cyclohexanesulfonyl, benzenesulfonyl, tosyl, 4-chlorobenzenesulfonyl and the like are listed.

A sulfamoyl group represented by $X^1$ is a sulfamoyl group preferably having 0 to 20 carbon atoms, more preferably having 0 to 16 carbon atoms, and further preferably having 0 to 12 carbon atoms, for example, sulfamoyl, methysulfamoyl, dimethylsulfamoyl, phenylsulfamoyl and the like are listed.

$X^1$ may further have a substituent, as an example of preferable substituent, groups represented by $Y^1$ through $Y^5$ in the compounds represented by the general formula (1) described later can be listed.

$X^1$ preferably represents a carbamoyl group, more preferably represents an alkylcarbamoyl group, or an arylcarbamoyl group, and particularly preferably an arylcarbamoyl group.

Each of $Y^1$ through $Y^5$ independently represents a hydrogen atom or a substituent.

As a substituent represented by $Y^1$ through $Y^5$, any substituent may be used if there is no bad influence on the photographic property. For example, a halogen atom (e.g., fluorine atom, chlorine atom, bromine atom and iodine atom), a linear, branched, cyclic or their combined alkyl group (preferably having 1 to 20 carbon atoms, more preferably 1 to 16 carbon atoms, and further preferably having 1 to 13 carbon atoms, for example, a methyl, an ethyl, a n-propyl, an isopropyl, a sec-butyl, a tert-butyl, a tert-octyl, a n-amyl, a tert-amyl, a n-dodecyl, a n-tridecyl, a cyclohexyl and the like), an alkenyl group (preferably having 2 to 20 carbon atoms, more preferably having 2 to 16 carbon atoms, and further preferably having 2 to 12 carbon atoms, for example, a vinyl, an allyl, a 2-butenyl, a 3-pentenyl and the like), an aryl group (preferably having 6 to 30 carbon atoms, more preferably having 6 to 20 carbon atoms and further preferably having 6 to 12 carbon atoms, for example, a phenyl, a p-methylphenyl, a naphthyl and the like), an alkoxy group (preferably having 1 to 20 carbon atoms, more preferably having 1 to 16 carbon atoms, and further preferably having 1 to 12 carbon atoms, for example, a methoxy, an ethoxy, a propoxy, a butoxy and the like), an aryloxy group (preferably having 6 to 30 carbon atoms, more preferably having 6 to 20 carbon atoms, and further preferably having 6 to 12 carbon atoms, for example, a phenyloxy, a 2-naphthyloxy and the like), an acyloxy group (preferably having 2 to 20 carbon atoms, more preferably having 2 to 16 carbon atoms, and further preferably having 2 to 12 carbon atoms, for example, an acetoxy, a benzoyloxy and the like), an amino group (preferably having 0 to 20 carbon atoms, more preferably having 1 to 16 carbon atoms, and further preferably having 1 to 12 carbon atoms, for example, a dimethylamino group, a diethylamino group, a dibutylamino group, an anilino group and the like), an acylamino group (preferably having 2 to 20 carbon atoms, more preferably having 2 to 16 carbon atoms and further preferably having 2 to 13 carbon atoms, for example, an acetylamino, a tridecanoylamino, a benzoylamino and the like), a sulfonylamino group (preferably having 1 to 20 carbon atoms, more preferably having 1 to 16 carbon atoms, and further preferably having 1 to 12 carbon atoms, for example, a methanesufonylamino, a butanesulfonylamino, a benzenesufonylamino and the like), a ureido group (preferably having 2 to 20 carbon atoms, more preferably having 2 to 16 carbon atoms, and further preferably having 1 to 12 carbon atoms, for example, a ureido, a methylureide, a phenylureide and the like), a carbamate group (preferably having 2 to 20 carbon atoms, more preferably having 2 to 16 carbon atoms, and further preferably having 2 to 12 carbon atoms, for example, a methoxycarbonylamino, a phenyloxycaronylamino and the like), a carboxyl group, a carbamoyl group (preferably having 1 to 20 carbon atoms, more preferably having 1 to 16 carbon atoms, and further preferably having 1 to 12 carbon atoms, for example, a carbamoyl, a N,N-diethylcarbamoyl, a N-dodecylcarbamoyl, a N-Phenylcarbamoyl and the like), an alkoxycarbonyl group (preferably having 2 to 20 carbon atoms, more preferably having 2 to 16 carbon atoms and further preferably having 2 to 12 carbon atoms, for example, a methoxycarbonyl, an ethoxycarbonyl, a butoxycarbonyl and the like), an acyl group (preferably having 2 to 20 carbon atoms, more preferably having 2 to 16 carbon atoms, and further preferably having 2 to 12 carbon atoms, for example, an acetyl, a benzoyl, a formyl, a pivaloyl and the like), a sulfo group, sulfonyl group (preferably having 1 to 20 carbon atoms, more preferably having 1 to 16 carbon atoms, and further preferably having 1 to 12 carbon atoms, for example, a mesyl, a tosyl and the like), a sulfamoyl group (preferably having 0 to 20 carbon atoms, more preferably having 0 to 16 carbon atoms, and further preferably having 0 to 12 carbon atoms, for example, a sulfamoyl, a methylsulfamoyl, a dimethylsulfamoyl, a phenylsulfamoyl and the like), a cyano group, a nitro group, a hydroxyl group, a mercapto group, an alkylthio group (preferably having 1 to 20 carbon atoms, more preferably having 1 to 16 carbon atoms, and further preferably having 1 to 12 carbon atoms, for example, a methylthio, a butylthio and the like), a heterocyclic group (preferably having 2 to 20 carbon atoms, more preferably having 2 to 16 carbon atoms, and further preferably having 2 to 12 carbon atoms, for example, a pyridyl, an imidazoyl, a pyrrolidyl and the like) and the like are listed.

These substituents may be further substituted by other substituents.

As a preferable substituent represented by $Y^1$ through $Y^5$, among the above-described ones, a halogen atom, an alkyl group, an aryl group, an alkoxy group, an aryloxy group, an acyloxy group, an anililo group, an acylamino group, a sulfonylamino group, a carboxyl group, a carbamoyl group, an acyl group, a sulfo group, a sulfonyl group, a sulfamoyl group, a cyano group, hydroxyl group, a mercapto group, an alkylthio group and a heterocyclic group are listed.

In compounds represented by the general formula (1), the combination that $R^1$ represents an alkyl group, $X^1$ represents a carbamoyl group and $Y^1$ through $Y^5$ represents hydrogen atoms is preferable.

Although concrete examples (from 1-1 to 1-159) of compounds represented by the general formula (1) are listed below, compounds used in the present invention are not limited by these concrete examples.

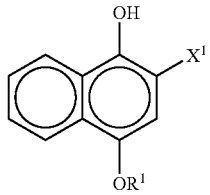

| Compounds | $X^1$ | $R^1$ |
|---|---|---|
| 1-1 | $CONHC_6H_5$ | $CH_3$ |
| 1-2 | " | $C_2H_5$ |
| 1-3 | " | $C_3H_7$ |
| 1-4 | " | (i)$C_3H_7$ |
| 1-5 | " | $C_4H_9$ |
| 1-6 | " | $C_5H_{11}$ |
| 1-7 | " | $C_6H_{13}$ |
| 1-8 | " | c-$C_6H_{11}$ |
| 1-9 | " | $C_{10}H_{21}$ |
| 1-10 | " | $C_{12}H_{25}$ |
| 1-11 | " | $C_{16}H_{33}$ |
| 1-12 | " | $CH_2C_6H_5$ |
| 1-13 | " | $(CH_2)_2C_6H_5$ |
| 1-14 | " | $(CH_2)_2NHSO_2CH_3$ |
| 1-15 | " | $(CH_2)_2OCH_2CH_3$ |
| 1-16 | " | $(CH_2)_2O(CH_2)_2OH$ |
| 1-17 | " | $(CH_2)_2OCH_2CO_2H$ |
| 1-18 | " | $C_8H_{17}$ |
| 1-19 | " | $(CH_2)_2SO_2CH_3$ |
| 1-20 | " | $(CH_2)_2SO_2CH_2CH_3$ |
| 1-21 | " | $(CH_2)_2O(CH_2)_2OCH_2CH_3$ |
| 1-22 | " | 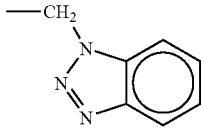 |

-continued
| | | |
|---|---|---|
| 1-23 | $CONHC_6H_5$ | 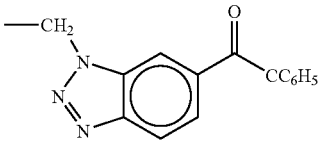 |
| 1-24 | " | $C_6H_5$ |
| 1-25 | " | p-$CH_3$—$C_6H_4$ |
| 1-26 | " | p-Cl—$C_6H_4$ |
| 1-27 | " | 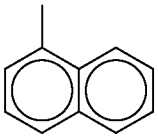 |
| 1-28 | " | 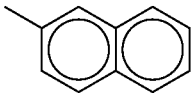 |
| 1-29 | CONH-2-Cl—$C_6H_4$ | $CH_3$ |
| 1-30 | " | $C_4H_9$ |
| 1-31 | " | $C_6H_{13}$ |
| 1-32 | " | $CH_2CH_2C_6H_5$ |
| 1-33 | " | $C_{12}H_{25}$ |
| 1-34 | CONH-4-Cl—$C_6H_4$ | $C_4H_9$ |
| 1-35 | " | $C_6H_{13}$ |
| 1-36 | " | $C_8H_{17}$ |
| 1-37 | " | $CH_2CH_2C_6H_5$ |
| 1-38 | " | $C_{10}H_{25}$ |
| 1-39 | 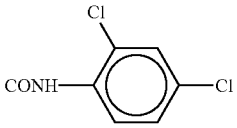 | $CH_3$ |
| 1-40 | " | $C_4H_9$ |
| 1-41 | " | $C_6H_{13}$ |
| 1-42 | " | $C_8H_{17}$ |
| 1-43 | " | $CH_2CH_2C_6H_5$ |
| 1-44 | " | $C_{10}H_{21}$ |
| 1-45 | 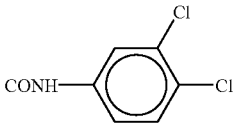 | CH═$CHCH_3$ |
| 1-46 | " | $C_4H_9$ |
| 1-47 | " | $C_6H_{13}$ |
| 1-48 | " | C≡CH |
| 1-49 | " | $C_8H_{17}$ |
| 1-50 | " | $CH_2CH_2C_6H_5$ |
| 1-51 | " | $CH_2C_6H_5$ |
| 1-52 | " | $C_6H_5$ |
| 1-53 | " | $CH_2CH_2SO_2CH_3$ |
| 1-54 | 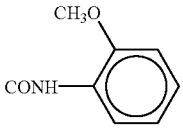 | $C_6H_{13}$ |
| 1-55 | " | $CH_2CH_2C_6H_5$ |
| 1-56 | " | $C_4H_9$ |
| 1-57 | $CONHCH_3$ | $C_6H_{13}$ |
| 1-58 | $CONHC_4H_9$ | " |
| 1-59 | $CONHC_6H_{13}$ | " |
| 1-60 | $CONHC_{10}H_{21}$ | " |

-continued
| | | |
|---|---|---|
| 1-61 | $CONHC_{12}H_{25}$ | " |
| 1-62 | $CONHC_{16}H_{33}$ | " |
| 1-63 | 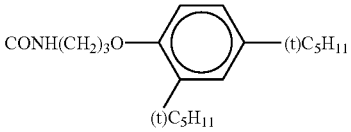 | " |
| 1-64 | $CONH(CH_2)_3OC_{12}H_{25}$ | " |
| 1-65 | 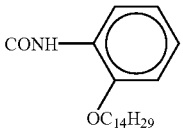 | " |
| 1-66 | $CONHCH_2C_6H_5$ | " |
| 1-67 | 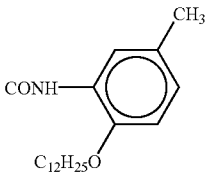 | " |
| 1-68 | 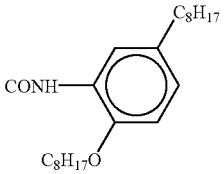 | " |
| 1-69 | $CONH\text{-}(t)C_4H_9$ | " |
| 1-70 | $CONH\text{-}(t)C_8H_{17}$ | " |
| 1-71 | $CON(C_2H_5)_2$ | $C_6H_{13}$ |
| 1-72 | 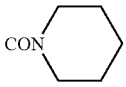 | " |
| 1-73 | 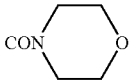 | " |
| 1-74 | 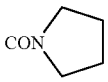 | " |
| 1-75 | $CONHC_4H_9$ | $(CH_2)_2C_6H_5$ |
| 1-76 | $CONHC_{10}H_{21}$ | " |
| 1-77 | $CONHC_{12}H_{25}$ | " |
| 1-78 | $CONH\text{-}(t)C_4H_9$ | " |
| 1-79 | $CONH\text{-}(t)C_8H_{17}$ | " |
| 1-80 | $CONHCH_3$ | " |
| 1-81 | 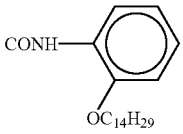 | " |
| 1-82 | $CON(C_2H_5)_2$ | " |
| 1-83 | 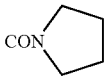 | " |

-continued
| | | |
|---|---|---|
| 1-84 | $CONHCH_2C_6H_5$ | " |
(1-85)
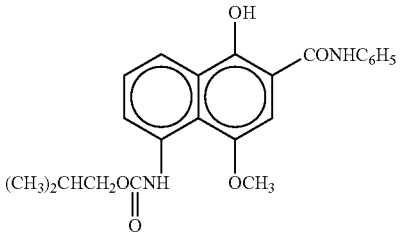
(1-86)
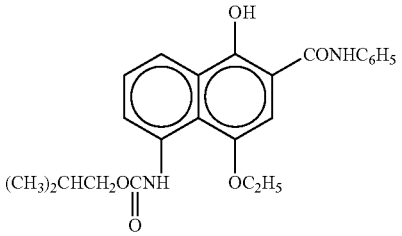
(1-87)
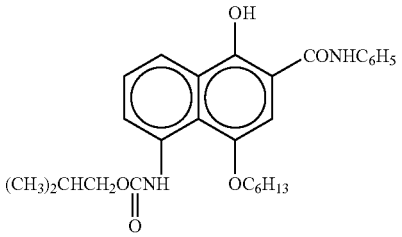
(1-88)
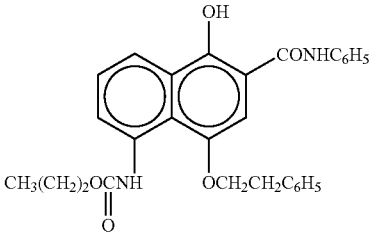
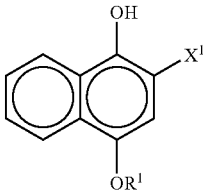
| Compounds | $X^1$ | $R^1$ |
|---|---|---|
| 1-89 | $COCH_3$ | $C_6H_{13}$ |
| 1-90 | $COC_2H_5$ | " |
| 1-91 | $COC_7H_{15}$ | " |
| 1-92 | $COC_{11}H_{23}$ | " |
| 1-93 | $COCH_3$ | $(CH_2)_2C_6H_5$ |
| 1-94 | $COC_2H_5$ | " |
| 1-95 | $COC_7H_{15}$ | " |
| 1-96 | $COC_{11}H_{23}$ | " |
| 1-97 | $COCH_3$ | $CH_3$ |
| 1-98 | " | $C_4H_9$ |

-continued

| | | |
|---|---|---|
| 1-99 | " | $C_6H_5$ |
| 1-100 | " | $CH_2C_6H_5$ |
| 1-101 | " | $C_{10}H_{21}$ |
| 1-102 | " | $C_{12}H_{25}$ |
| 1-103 | " | $C_{16}H_{33}$ |
| 1-104 | $CO_2C_6H_5$ | $C_6H_5$ |
| 1-105 | " | $CH_3$ |
| 1-106 | " | $C_2H_5$ |
| 1-107 | " | $C_4H_9$ |
| 1-108 | " | $C_6H_{13}$ |
| 1-109 | " | $C_{10}H_{21}$ |
| 1-110 | " | $CH_2C_6H_5$ |
| 1-111 | " | $(CH_2)_2C_6H_5$ |
| 1-112 | " | $C_{12}H_{25}$ |
| 1-113 | " | $C_{16}H_{33}$ |
| 1-114 | $CO_2C_6H_5$ | $(CH_2)_2SO_2CH_3$ |
| 1-115 | " | $(CH_2)_2SO_2NHCH_3$ |
| 1-116 | " | $(CH_2)_2NHSO_2C_2H_5$ |
| 1-117 | $CO_2CH_3$ | $CH_3$ |
| 1-118 | " | $C_4H_9$ |
| 1-119 | $CO_2C_2H_5$ | $C_6H_{13}$ |
| 1-120 | " | $(CH_2)_2C_6H_5$ |
| 1-121 | " | $C_{12}H_{25}$ |
| 1-122 | $CO_2C_{12}H_{25}$ | $CH_3$ |
| 1-123 | " | $C_4H_9$ |
| 1-124 | " | $C_6H_{13}$ |
| 1-125 | " | $(CH_2)_2C_6H_5$ |
| 1-126 | " | $(CH_2)_2SO_2CH_3$ |
| 1-127 | " | $CH{=}CHCH_3$ |
| 1-128 | " | $CH_2CH{=}CH_2$ |
| 1-129 | " | $C{\equiv}CCH_3$ |
| 1-130 | " | $C{-}C_6H_{11}$ |
| 1-131 | " | $C_6H_5$ |
| 1-132 | $SO_2CH_3$ | $C_4H_9$ |
| 1-133 | " | $C_6H_{13}$ |
| 1-134 | " | $C_6H_5$ |
| 1-135 | " | $CH_3$ |
| 1-136 | " | $(CH_2)_2C_6H_5$ |
| 1-137 | " | $CH_2C_6H_5$ |
| 1-138 | $SO_2C_6H_5$ | $C_4H_9$ |
| 1-139 | " | $C_6H_{13}$ |
| 1-140 | " | $CH_3$ |
| 1-141 | " | $(CH_2)_2C_6H_5$ |
| 1-142 | " | $C_{12}H_{25}$ |
| 1-143 | $SO_2NHC_6H_5$ | $C_6H_5$ |
| 1-144 | $SO_2NHCH_3$ | " |
| 1-145 | $SO_2NHC_2H_5$ | " |
| 1-146 | $SO_2NHC_6H_{13}$ | " |
| 1-147 | $SO_2NHC_4H_9$ | " |
| 1-148 | $SO_2NH$-(t)$C_4H_9$ | " |
| 1-149 | $SO_2NH$-(t)$C_8H_{17}$ | " |
| 1-150 | $SO_2NHC_8H_5$ | $C_6H_{13}$ |
| 1-151 | $SO_2NHCH_3$ | " |
| 1-152 | $SO_2NHC_2H_5$ | " |
| 1-153 | $SO_2NHC_4H_9$ | " |
| 1-154 | $SO_2NH$-(t)$C_4H_9$ | " |
| 1-155 | $SO_2NH$-(t)$C_8H_{17}$ | " |
| 1-156 | $SO_2NHC_6H_{13}$ | $(CH_2)_2C_6H_5$ |
| 1-157 | $SO_2NHC_6H_5$ | " |
| 1-158 | $SO_2NHCH_3$ | " |
| 1-159 | $SO_2NH$-(t)$C_8H_{17}$ | " |

<Development Accelerator Represented by General Formula (2)>

A development accelerator represented by the general formula (2) will be described below.

$$Q^1\text{—NHNH—}R^{1b} \qquad \text{General Formula (2)}$$

A Reducing compound represented by the general formula (2) is a principal agent for development generally called as a hydrazine based principal agent for development. In the formula, $Q^1$ represents an unsaturated ring having 5 to 7 members bonding to NHNH—$R^{1b}$ with a carbon atom, and $R^{1b}$ represents a carbamoyl group, an acyl group, an alkoxycarbonyl group, an aryloxycarbonyl group, a sulfonyl group or a sulfamoyl group.

As an example of an unsaturated ring having 5 to 7 members represented by $Q^1$, a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isoxazole ring, a thiophene ring and the like are listed, and a condensed ring in which these rings are condensed with each other is also preferable.

These rings may have a substituent, in the case where these rings have two or more substituents, these substituents may be either identical or different.

As an example of a substituent, a halogen atom, an alkyl group, an aryl group, a carbonamide group, an alkylsulfonamide group, an arylsulfonamide, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group and an acyl group can be listed.

In the case where these substituents can be substituted, these further have substituents, as an example of a preferable substituent, a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group and an acyloxy group can be listed.

A carbamoyl group represented by $R^{1b}$ preferably has 1 to 50 carbon atoms and more preferably has 6 to 40 carbon atoms, for example, a non-substitutional carbamoyl, a methylcarbamoyl, a N-ethylcarbamoyl, N-propylcarbamoyl, a N-sec-butylcarbamoyl, a N-octylcarbamoyl, a N-cyclohexylcarbamoyl, a N-tert-butylcabamoyl, a N-dodecylcarbamoyl, N-(3-dodecyloxypropyl) carbamoyl, a N-oxyadecylcarbamoyl, a N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, a N-(2-chloro-5-dodecyloxycarbonylphenyl)carbamoyl, a N-naphthylcarbamoyl, a N-3-pyridylcarbamoyl, N-benzylcarbamoyl are listed.

An acyl group represented by $R^{1b}$ preferably has 1 to 50 carbon atoms and more preferably has 6 to 40 carbon atoms, for example, a formyl, an acetyl, 2-methylpropanoyl, a cyclohexylcarbonyl, an octanoyl, a 2-hexyldecanoyl, dodecanoyl, a chloroacetyl, a trifluoracetyl, a benzoyl, a 4-dodecyloxybenzoyl, a 2-hydroxymethybenzoyl are listed.

An alkoxycarbonyl group represented by $R^{1b}$ preferably has 2 to 50 carbon atoms and more preferably has 6 to 40 carbon atoms, for example, a methoxycarbonyl, an ethoxycarbonyl, an isobutyloxycarbonyl, a cyclohexyloxycarbonyl, a dodecyoxycarbonyl, and a benzyloxycarbonyl are listed.

An aryloxycarbonyl group represented by $R^{1b}$ preferably has 7 to 50 carbon atoms and more preferably has 7 to 40 carbon atoms, for example, a phenoxycarbonyl, a 4-octyloxyphenoxycarbonyl, a 2-hydroxymethylphenoxycarbonyl, a 4-dodecyoxylphenoxycarbonyl are listed.

A sulfonyl group represented by R1b preferably has 1 to 50 carbon atoms and more preferably has 6 to 40 carbon atoms, for example, a methysulfonyl, a butylsulfonyl, an octylsulfonyl, a 2-hexadecylsulfonyl, a 3-dodecyloxypropylsulfonyl, a 2-octyloxy-5-tert-octylphenylsulfonyl, a 4-dodecyloxyphenysulfonyl are listed.

A sulfamoyl group represented by $R^{1b}$ preferably has 0 to 50 carbon atoms and more preferably has 6 to 40 carbon atoms, for example, a non-substitutional sulfamoyl, a N-ethylsulfamoyl group, a N-(2-ethylhexyl)sulfamoyl, a N-decylsufamoyl, a N-hexadecylsulfamoyl, N-{3-(2-ethylhexyloxy) propyl}sulfamoyl, a N-(2-chloro-5-dodecyloxycarbonylphenyl)sulfamoyl, a N-(2-tetradecyloxyphenyl)sulfamoyl are listed.

A group represented by $R^{1b}$ further may have a group listed as an example of a substituent of an unsaturated ring having 5 to 7 members represented by the $Q^1$ at the position capable of being substituted, and in the case where the group has two or more substituents, these substituents may be either identical or different.

Among compounds represented by the general formula (2), it is preferable that $Q^1$ represents an unsaturated ring having 5 or 6 members, and it is more preferable that $Q^1$ represents a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isooxazole ring, or a ring in which these rings are condensed with a benzene ring or an unsaturated heterocyclic ring, and particularly preferable that $Q^1$ represents a quinazoline ring.

It is preferable that $Q^1$ has at least one electron-withdrawing substituent, as a preferable substituent, a fluoroalkyl group (e.g., a trifluoromethyl group, a pentafluoroethyl group, a 1,1-difluoroethyl group, a difluoromethyl group, a fluoromethyl group, a heptafluoroprply group, a pentafluorophenyl group), a cyano group, a halogen atom (fluoro, chloro, bromo, iodo), an acyl group, an alkoxycarbonyl group, a carbamoyl group, an alkylsulfonyl group, an arylsulfonyl group can be listed, and as a particularly preferable substituent, a trifluoromethyl group can be listed.

It is preferable that $R^{1b}$ represents a carbamoyl group, particularly preferable that $R^{1b}$ represents a substitutional carbamoyl group represented by —C═O—NH—$R^{11}$ and $R^{11}$ represents an alkyl group or an aryl group having 1 to 10 carbon atoms.

Hereinafter, concrete examples of reducing compounds (from Compound Nos. 2-101 to 2-206) represented by the general formula (2) are indicated, however, compounds used in the present invention are not limited to these concrete examples.

2-101

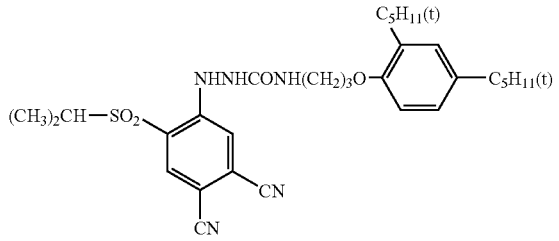

2-102

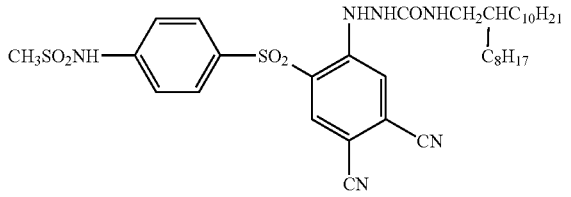

-continued
2-103
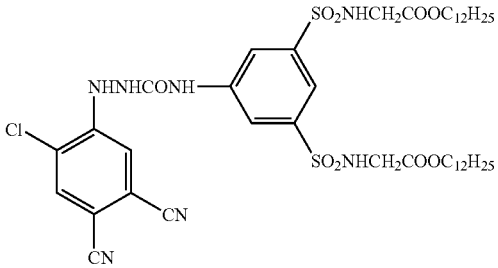
2-104
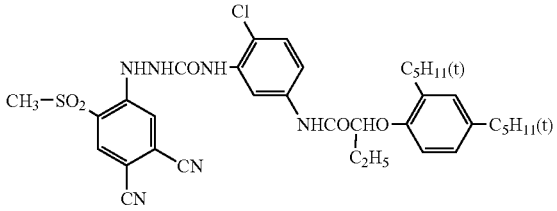
2-105
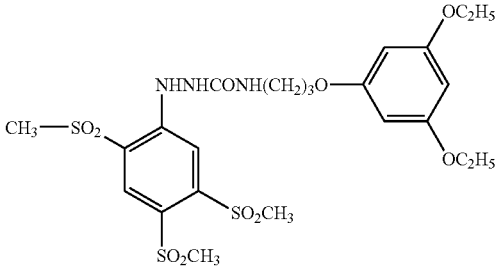
2-106
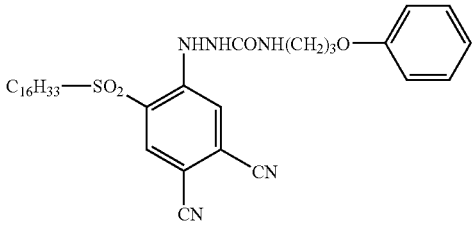
2-107
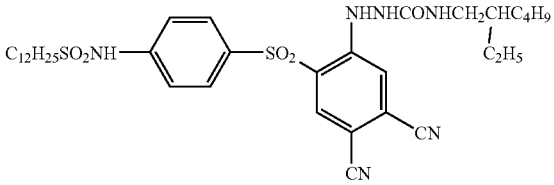
2-108
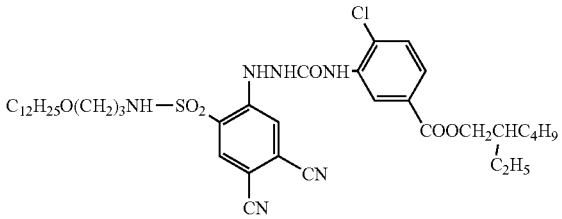
2-109
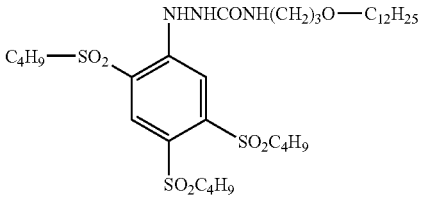
2-110
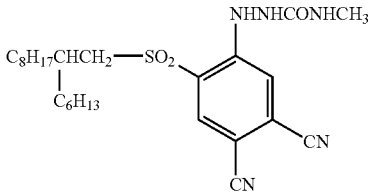
2-111
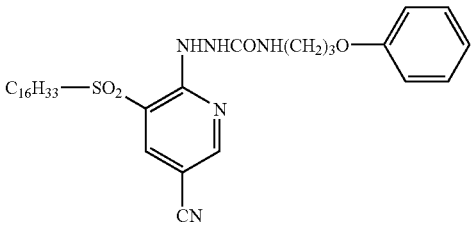
2-112
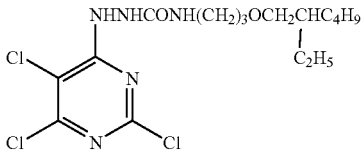
2-113
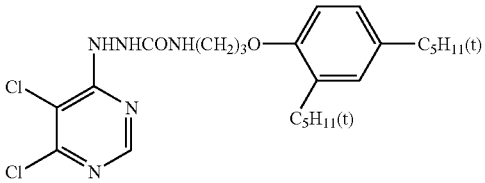
2-114
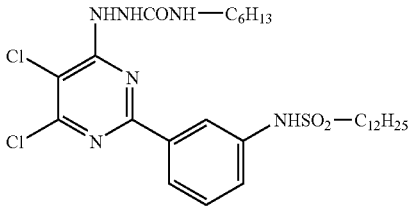

-continued
2-115
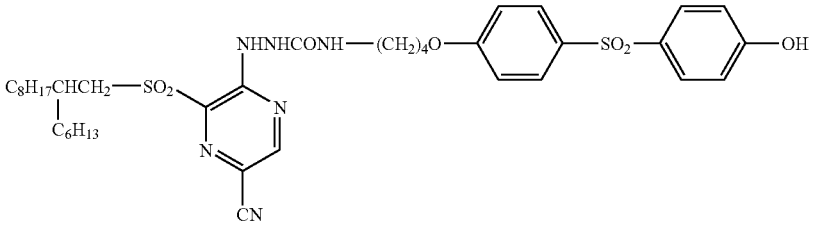
2-116
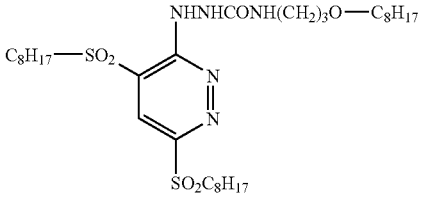
2-117
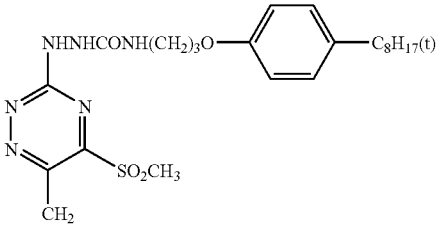
2-118
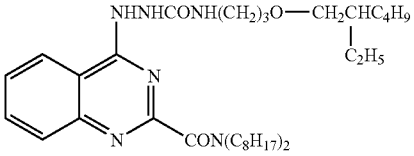
2-119
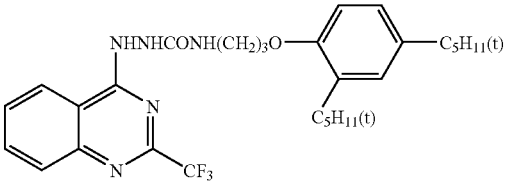
2-120
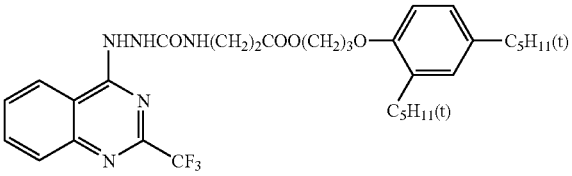
2-121
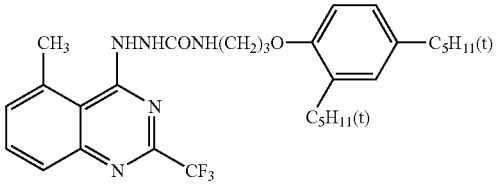
2-122
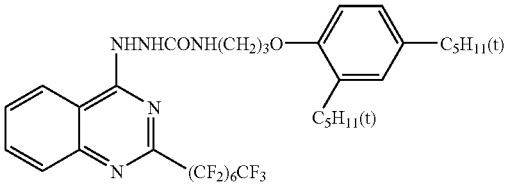
2-123
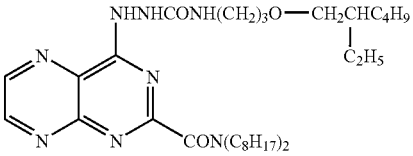
2-124
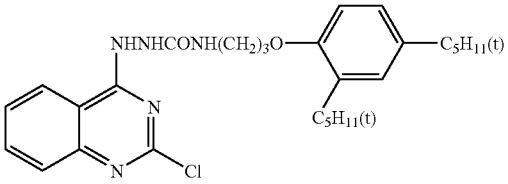
2-125
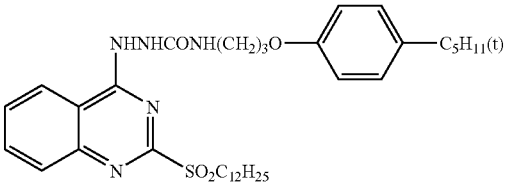
2-126
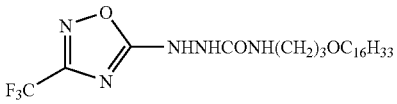
2-127
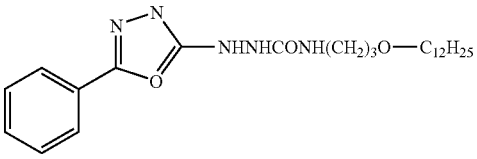

-continued
2-128
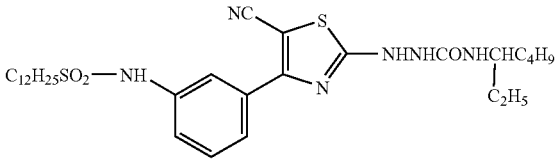
2-129
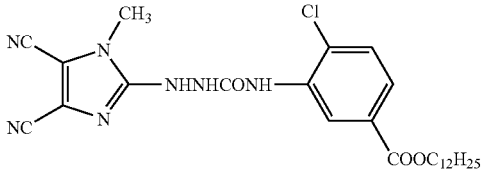
2-130
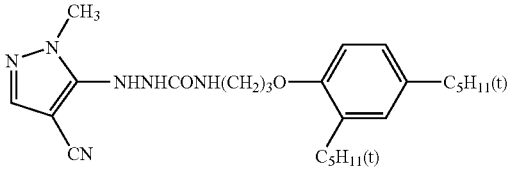
2-131
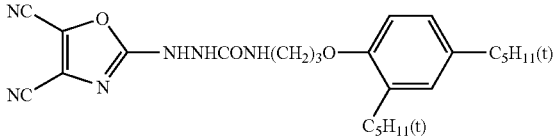
2-132
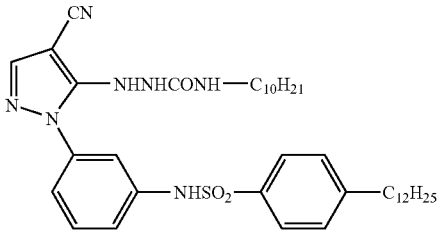
2-133
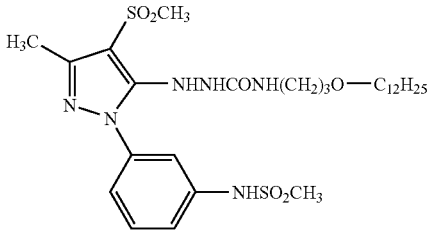
2-134
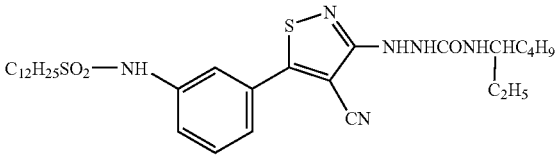
2-135
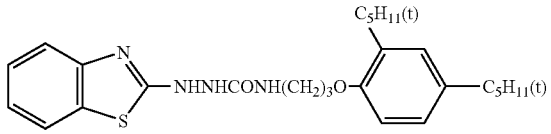
2-136
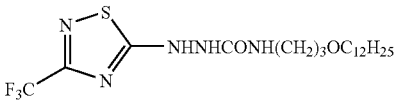
2-137
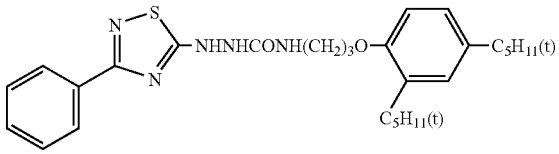
2-138
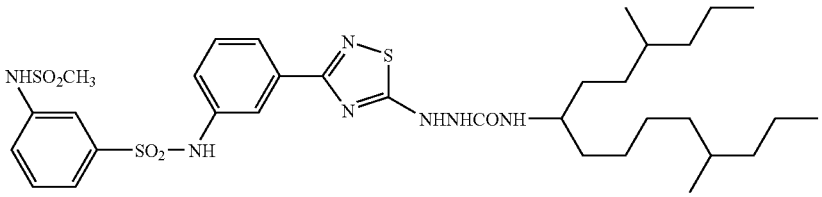
2-139
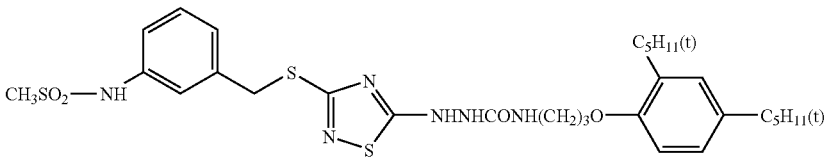

-continued
2-140
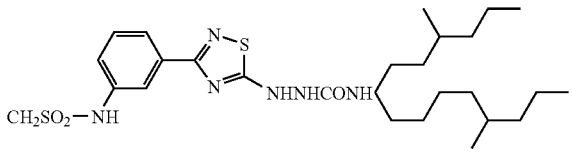
2-141
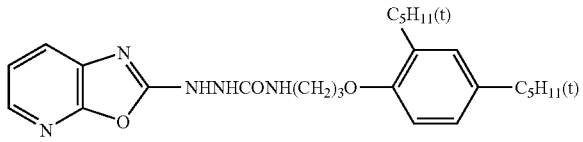
2-142
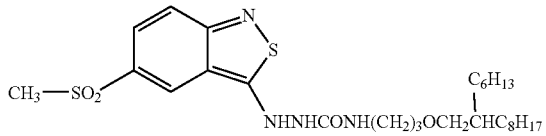
2-143
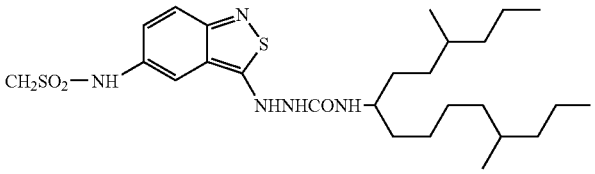
2-144
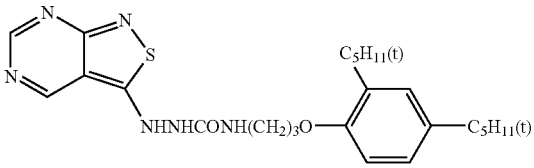
2-145
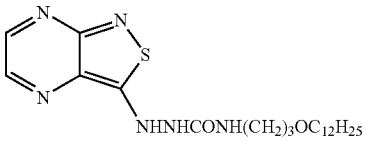
2-146
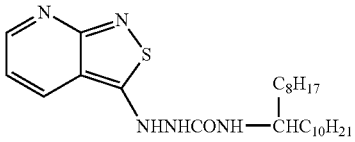
2-147
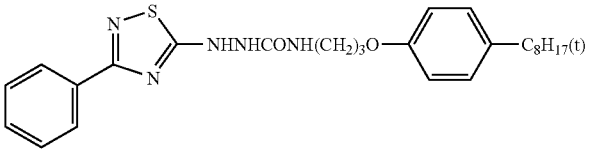
2-148
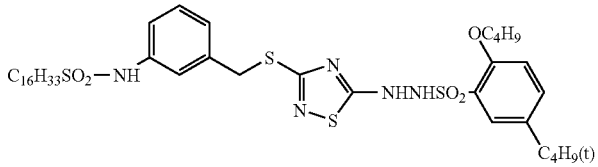
2-149
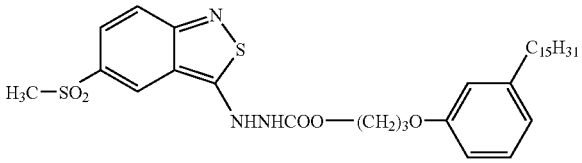
2-150
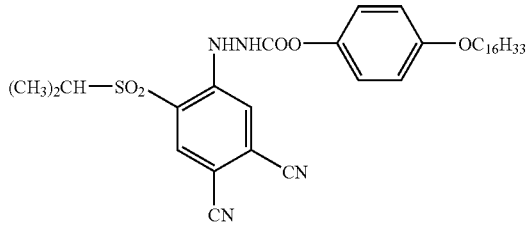
2-151
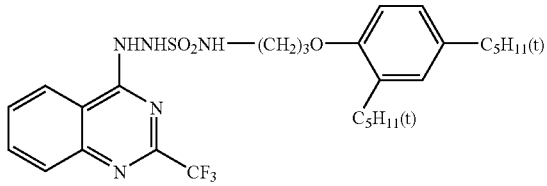
2-152
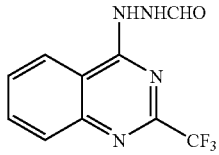
2-153
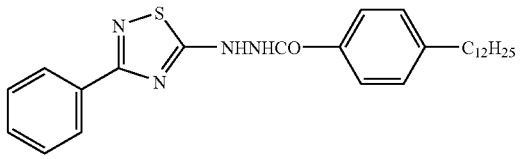

-continued
2-154
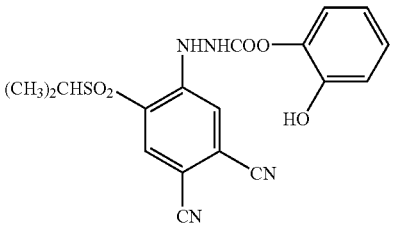
-continued
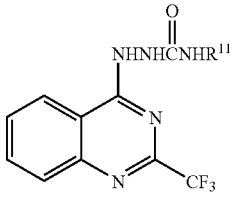
| Compound Nos. | $R^{11}$ |
|---|---|
| 2-155 | $CH_3$ |
| 2-156 | $C_2H_5$ |
| 2-157 | (n)$C_3H_7$ |
| 2-158 | (i)$C_3H_7$ |
| 2-159 | (n)$C_4H_9$ |
| 2-160 | (i)$C_4H_9$ |
| 2-161 | (sec)$C_4H_9$ |
| 2-162 | (t)$C_4H_9$ |
| 2-163 | (n)$C_5H_{11}$ |
| 2-164 | (t)$C_5H_{11}$ |
| 2-165 | (n)$C_6H_{13}$ |
| 2-166 | 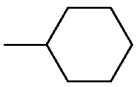 |
| 2-167 | (n)$C_8H_{17}$ |
| 2-168 | (t)$C_8H_{17}$ |
| 2-169 | 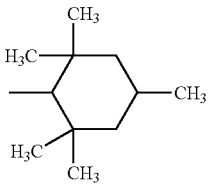 |
| 2-170 | 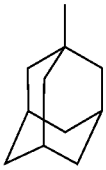 |
| 2-171 | 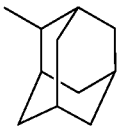 |
-continued
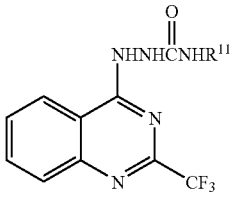
| Compound Nos. | $R^{11}$ |
|---|---|
| 2-172 | 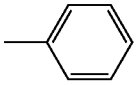 |
| 2-173 | 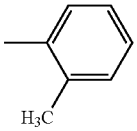 |
| 2-174 | 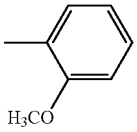 |
| 2-175 | 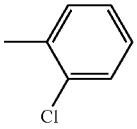 |
| 2-176 | 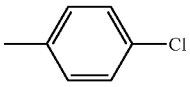 |
| 2-177 | 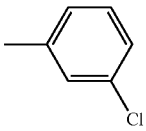 |
| 2-178 | 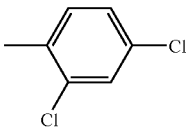 |

-continued
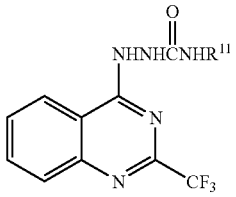
| Compound Nos. | $R^{11}$ |
|---|---|
| 2-179 | 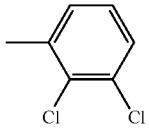 |
| 2-180 | 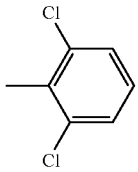 |
| 2-181 | 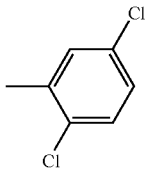 |
| 2-182 | 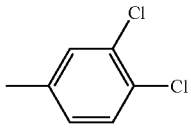 |
| 2-183 | 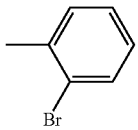 |
| 2-184 | 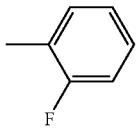 |
| 2-185 | 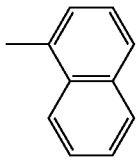 |
| 2-186 | 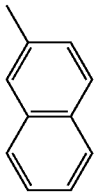 |
-continued
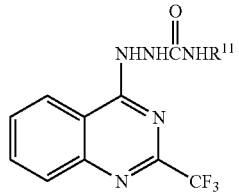
| Compound Nos. | $R^{11}$ |
|---|---|
| 2-187 | $CH_2C_6H_5$ |
| 2-188 | $CH_2CH_2OC_6H_5$ |
| 2-189 | $CH_2CH_2OCH_2CH_3$ |
| 2-130 | $CH_2CH_2OCH_3$ |
2-191
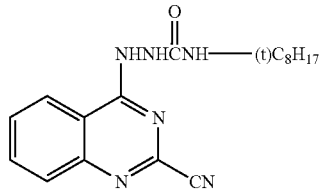
2-192
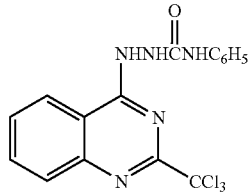
2-193
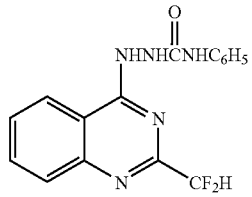
2-194
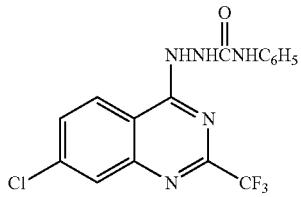
2-195
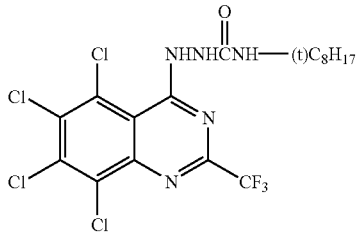

-continued 2-196

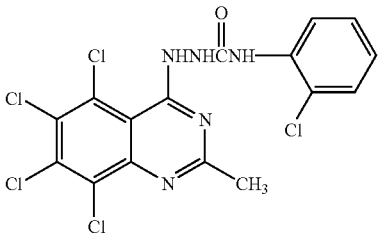

2-197

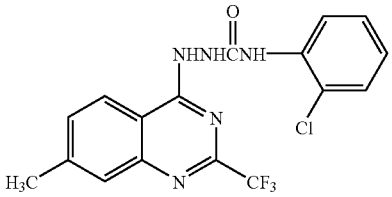

2-198

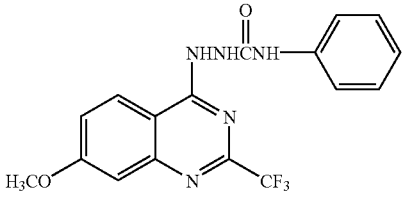

2-199

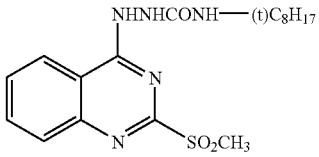

2-200

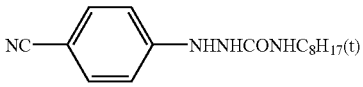

2-201

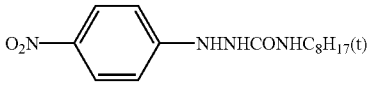

2-202

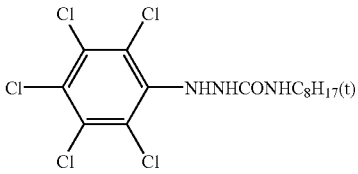

2-203

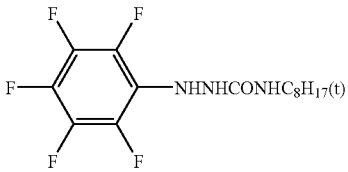

2-204

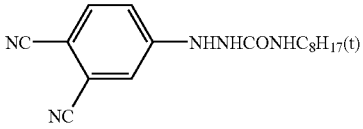

-continued 2-205

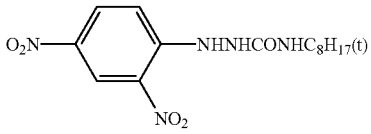

2-206

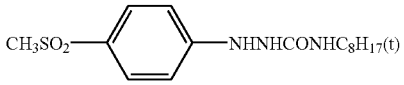

The synthesis of reducing compounds represented by the general formula (2) can be carried out according to the methods described in JP-A No. 09-152702 gazette, JP-A No. 08-266340 gazette, JP-A No. 09-152700 gazette, JP-A No. 09-152701 gazette, JP-A No. 09-152703 gazette, JP-A No. 09-152704 gazette and the like.

The melting point of the reducing compounds represented by the general formula (2) is preferably 250° C. or less, and more preferably 200° C.

A development accelerator represented by the general formula (3) will be described below.

General Formula (3)

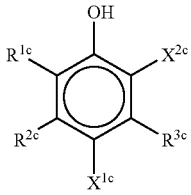

Each of $R^{1c}$, $R^{2c}$ and $R^{3c}$ of the general formula (3) independently represents a hydrogen atom; a halogen atom; and a substituent bonded to a benzene ring with a carbon atom, a oxygen atom, a nitrogen atom, sulfur atom or a phosphorus atom.

As a non-limited example of a substituent bonded to a benzene ring with a carbon atom, a linear, branched or cyclic alkyl group (e.g., a methyl, an ethyl, an iso-propyl, a tert-butyl, a n-octyl, a tert-amyl, a 1,3-tetramethylbutyl, a cyclohexyl and the like are listed), alkenyl group (e.g., a vinyl, an aryl, a 2-butenyl, a 3-pentenyl and the like are listed), akynyl group (e.g., a propargyl group, a 3-pentynyl group and the like are listed), aryl group (e.g., a phenyl, a p-methylphenyl, a naphthyl and the like are listed), acyl group (e.g., an acetyl, a benzoyl, a formyl, a pivaloyl and the like are listed), alkoxycarbonyl group (e.g., a methoxycarbonyl group, an ethoxycarbonyl and the like are listed), aryloxycarbonyl group (e.g., a phenoxycarbonyl and the like are listed), carbamoyl group (a carbamoyl, a diethylcarbamoyl, phenylcarbamoyl and the like are listed), cyano group, carboxyl group, heterocyclic group (e.g., a 3-pyrazolyl group and the like are listed) and like are listed.

As a non-limited concrete example of a substituent bonded to a benzene ring with an oxygen atom, a hydroxyl group, an alkoxy group (e.g., a methoxy, an ethoxy, a butoxy and the like are listed), an aryloxy group (e.g., a phenyloxy, a 2-naphthyloxy and the like are listed), a heterocyclic oxy group (e.g., a 4-pyridyloxy group and the like are listed), an acyloxy group (e.g., an acetoxy, a benzoyloxy and the like are listed) and the like are listed. As a non-limited example of a substituent bonded to a benzene ring with a nitrogen atom, an amino group (e.g., an amino, a methylamino, a dimethylamino, a diethylamino, dibenzylamino and the like are listed), a nitro group, a hydrazino group, a heterocyclic group (e.g., a 1-imidazolyl, a molyphoryl and the like are listed), an acylamino group (e.g., an acetylamino, a benzoylamino and the like are listed), an alkoxycarbonyl amino group (e.g., an ethoxycarbonylamino and the like are listed), an aryloxycarbonylamino group (e.g., phenyloxycarbonylamino and the like are listed), a sulfonyl amino group (e.g., a methane sulfonyl amino, benzenesulfonyl amino and the like are listed), a sulfamoyl group (e.g., a sulfamoyl, a methylsulfamoyl, a dimethylsulfamoyl, a phenylsulfamoyl and the like are listed), a ureido group (e.g., a ureido, a methylureide, a phenylureide and the like are listed), a phosphoryl group (e.g., diethylphosphorylamino and the like are listed), an imide group (e.g., a succinimide, a phthalimide, a trifluoromethanesulfonimide and the like are listed) and the like are listed.

As a non-limited concrete example of a substituent bonded to a benzene ring with a sulfur atom, a mercapto group, a disulfide group, a sulfo group, a sulfino group, a sulfonylthio group, a thiosulfonyl group, an alkylthio group (e.g., a methylthio, an ethylthio and the like are listed), an arylthio group (e.g., a phenylthio and the like are listed), a sulfonyl group (e.g., a mesyl, a tosyl, a phenylsulfonyl and the like are listed), a sulfinyl group (e.g., a methanesulfinyl, a benzensulfinyl and the like are listed), a heterocyclic thio group (e.g., a 2-imidazolylthio group and the like are listed), and the like are listed. As a non-limited concrete example of a substituent bonded to a benzene ring with a phosphorus atom, a phosphoric ester group (e.g., a diethyl phosphate, a diphenyl phosphate and the like are listed) and the like are listed.

$R^{1c}$, $R^{2c}$ and $R^{3c}$ preferably represent a hydrogen atom, a halogen atom, a linear, branched or cyclic alkyl group, aryl group, acyl group, alkoxycarbonyl group, aryloxycarbonyl group, cyano group, carboxyl group, heterocyclic group, hydroxyl group, alkoxy group, aryloxy group, heterocyclic oxy group, acyloxy group, amino group, nitro group, heterocyclic group, acylamino group, alkoxycarbonylamino group, aryloxycarbonylamino group, sulfonylamino group, imide group, sulfamoyl group, carbamoyl group, ureido group, mercapto group, disulfide group, sulfo group, sulfino group, alkylthio group, arylthio group, sulfonyl group, sulfinyl group, heterocyclic thio group and the like.

$R^{1c}$, $R^{2c}$ and $R^{3c}$ more preferably represent a hydrogen atom, a halogen atom, a linear, branched or cyclic alkyl group, aryl group, acyl group, alkoxycarbonyl group, arylxoycarbonyl group, cyano group, carboxyl group, heterocyclic group, hydroxyl group, alkoxy group, aryloxy group, acyloxy group, amino group, nitro group, heterocyclic group, acylamino group, alkoxycarbonylamino group, aryloycarbonylamino group, sulfonylamino group, imide group, carbamoyl group, mercapto group, sulfo group, alkylthio group, arylthio group, and sulfonyl group.

$R^{1c}$, $R^{2c}$ and $R^{3c}$, in particular, preferably represent a hydrogen atom, a halogen atom, a linear, branched or cyclic alkyl group, aryl group, acyl group, alkoxycarbonyl group, arylxoycarbonyl group, cyano group, carboxyl group, acyloxy group, acylamino group, alkoxycarbonylamino group, aryloxycarbonyamino group, sulfonylamino group, carbamoyl group, sulfo group, alkylsulfonyl group, and arylsulfonyl group.

$X^{1c}$ and $X^{2c}$ represent a hydrogen atom; a halogen atom; or a substituent bonded to a benzene ring with a carbon atom, an oxygen atom, a nitrogen atom, a sulfur atom or phosphorus atom.

As a non-limited concrete example of a substituent bonded to a benzene ring with a carbon atom, a linear, branched or cyclic alkyl group (e.g., a methyl, an ethyl, an iso-propyl, a tert-butyl, a n-octyl, a tert-amyl, a 1,3-tetramethylbutyl, a cyclohexyl and the like are listed), alkenyl group (e.g., a vinyl, an aryl, a 2-butenyl, a 3-pentenyl and the like are listed), akynyl group (e.g., a propargyl group, a 3-pentynyl group and the like are listed), aryl group (e.g., a phenyl, a p-methylpheny, a naphthyl and the like are listed), acyl group (e.g., an acetyl, a benzoyl, a formyl, a pivaloyl and the like are listed), alkoxycarbonyl group (e.g., a methoxycarbonyl, an ethoxycarbonyl and the like are listed), aryloxycarbonyl group (e.g., a phenoxycarbonyl and the like are listed), cyano group, carboxyl group, heterocyclic group (e.g., a 3-pyrazolyl group and the like are listed), carbamoyl group (a carbamoyl, a diethylcarbamoyl, phenycarbamoyl and the like are listed), and like are listed.

As a non-limited concrete example of a substituent bonded to a benzene ring with an oxygen atom, a hydroxyl group, an alkoxy group (e.g., a methoxy, an ethoxy, a butoxy and the like are listed), an aryloxy group (e.g., a phenyloxy, a 2-naphthyloxy and the like are listed), a heterocyclic oxy group (e.g., a 4-pyridyloxy group and the like are listed), an acyloxy group (e.g., an acetoxy, a benzoyloxy and the like are listed) and the like are listed.

As a non-limited example of a substituent bonded to a benzene ring with a nitrogen atom, an amino group (e.g., an amino, a methylamino, a dimethylamino, a diethylamino, dibenzylamino and the like are listed), a nitro group, a hydroxame group, a hydrazino group, a heterocyclic group (e.g., a 1-imidazolyl, a molyphoryl and the like are listed), an acylamino group (e.g., an acetylamino, a benzoylamino and the like are listed), an alkoxycarbonyl group (e.g., an ethoxycarbonylamino and the like are listed), an aryloxycarbonylamino group (e.g., a phenyloxycarbonylamino and the like are listed), a sulfonylamino group (e.g., a methanesufonylamino, benzenesulfonylamino and the like are listed), a sulfamoyl group (e.g., a sulfamoyl, a methylsufamoyl, a dimethysulfamoyl, a phenylsulfamoyl and the like are listed), a phosphorylamino group (e.g., a diethylphosphorylamino and the like are listed), and the like are listed.

As a non-limited example of a substituent bonded to a benzene ring with a sulfur atom, a mercapto group, a disulfide group, a sulfo group, a sulfino group, a sulfonylthio group, a thiosulfonyl group, an alkylthio group (e.g., a methylthio, an ethylthio and the like are listed), an arylthio group (e.g., a phenylthio and the like are listed), a sulfonyl group (e.g., a mesyl, a tosyl, a phenylsulfonyl and the like are listed), a sulfinyl group (e.g., a methanesulfinyl, a benzenesulfinyl and the like are listed), a heterocyclic thio group (e.g., a 2-imidazolylthio group and the like are listed) and the like are listed.

As a non-limited concrete example of a substituent bonded to a benzene ring with a phosphorus atom, a phosphoric ester group (e.g., a diethyl phosphate, a diphenyl phosphate and the like are listed) and the like are listed.

Each of $X^{1c}$ and $X^{2c}$ preferably represents a hydrogen atom, a halogen atom, a linear, branched or cyclic alkyl group, aryl group, acyl group, alkoxycarbonyl group, aryloxycarbonyl group, cyano group, carboxyl group, heterocyclic group, hydroxyl group, alkoxy group, aryloxy group, heterocyclic oxy group, acyloxy group, amino group, nitro group, heterocyclic group, acylamino group, alkoxycarbonylamino group, aryloxycarbonylamino group, sulfonylamino group, imide group, sulfamoyl group, carbamoyl group, ureido group, mercapto group, disulfide group, sulfo group, alkylthio group, arylthio group, sulfonyl group, heterocyclic thio group and the like.

Each of $X^{1c}$ and $X^{2c}$, more preferably represents a hydrogen atom, a halogen atom, a linear, branched or cyclic alkyl group, aryl group, acyl group, alkoxycarbonyl group, aryloxycarbonyl group, cyano group, carboxyl group, hydroxyl group, alkoxy group, aryloxy group, acyloxy group, amino group, acylamino group, alkoxycarbonylamino group, aryloxycarbonylamino group, sulfonylamino group, imide group, carbamoyl group, sulfo group, arylsulfonyl group, and the like.

Each of $X^{1c}$ and $X^{2c}$ in particular, preferably represents a hydrogen atom, a halogen atom, a linear, branched or cyclic alkyl group, aryl group, acyl group, alkoxycarbonyl group, aryloxycarbonyl group, cyano group, carboxyl group, alkoxy group, aryloxy group, acyloxy group, acylamino group, alkoxycarbonylamino group, aryloxycarbonylamino group, sulfonylamino group, carbamoyl group, mercapto group, alkylthio group and the like.

At least one of $X^{1c}$ and $X^{2c}$ is a group represented by —$NR^4R^5$. Each of $R^4$ and $R^5$ independently represents a hydrogen atom, an alkyl group, an alkenyl group, an alkynyl group, an aryl group, a heterocyclic group, or a group represented by —C(=O)—R, —C(=O)—C(=)—R, —$SO_2$—R, —SO—R, —P(=O) $(R)_2$, —C(=NR')—R. Each of R and R' independently represents a group selected from a hydrogen atom, an alkyl group, an aryl group, a heterocyclic group, an amino group, an alkoxy group and an aryloxy group.

In the case where each of $R^4$ and $R^5$ represents a hydrogen atom, an alkyl group, an alkenyl group, an alkynyl group, an aryl group and a heterocyclic group, these represent, for example, a linear, branched or cyclic alkyl group (e.g., a methyl, an ethyl, an iso-propyl, a tert-butyl, a n-octyl, a tert-amyl, a 1,3-tetramethylbutyl, a cyclohexyl and the like are listed), alkenyl group (e.g., a vinyl, an aryl, a 2-bytenyl, a 3-pentenyl and the like are listed), alkynyl group (e.g., a propargyl group, a 3-pentenyl group and the like are listed), aryl group (e.g., a phenyl, a p-methylphenyl, a naphthyl and the like are listed), heterocyclic group (e.g., a 2-imidazolyl, a 1-pyrazolyl group and the like are listed) and like.

In the case where each of $R^4$ and $R^5$ represents a group represented by —C(=O)—R, —C(=O)—C(=)—R, —$SO_2$—R, —SO—R, —P(=O) $(R)_2$, —C(=NR')—R, each of R and R' independently represents a hydrogen atom, an alkyl group (e.g., a methyl, an ethyl, an iso-propyl, a tert-butyl, a n-octyl, a tert-amyl, a 1,3-tetramethylbutyl, a cyclohexyl and the like are listed), an aryl group (e.g., a phenyl, a p-methylphenyl, a naphthyl and the like are listed), a heterocyclic group (e.g., a 4-pyridyl, a 2-thienyl, a 1-methyl-2-pyrolyl and the like are listed), an amino group (e.g., an amino, a dimethylamino, a diphenylamino, a phenylamino, a 2-pyrydylamino and the like are listed), an alkoxy group (e.g., a methoxy, an ethoxy, a cyclohexyloxy and the like are listed), an aryloxy group (e.g., a phenoxy, a 2-naphthoxhy and the like are listed) and like.

Each of $R^4$ and $R^5$ preferably represents a hydrogen atom, a linear, branched or cyclic alkyl group, aryl group, acyl group, alkoxycarbonyl group, aryloxycarbonyl group, sulfamoyl group, carbamoyl group, sulfonyl group, and sulfinyl group.

Each of $R^4$ and $R^5$ more preferably represents a hydrogen atom, a linear, branched or cyclic alkyl group, aryl group, acyl group, and sulfonyl group. Moreover, particularly preferable combination is a combination that one of $R^4$ and $R^5$ represents a hydrogen atom, and the other represents an alkylsulfonyl group, or an arylsulfonyl group.

These substituents may be further substituted by a substituent of these as described above. Moreover, if these substituents have a hydrogen atom of a high acidity, its proton may dissociate and form the salt. As its counter cation, a metal ion, ammonium ion, and phosphonium ion are used. A state where an active hydrogen is thus dissociated can be an effective treatment for the case where the volatility during the developing a compound becomes a problem.

$R^{1c}$, $R^{2c}$, $R^{3c}$, $X^{1c}$ and $X^{2c}$ may form a ring by adjacent groups joining each other.

In the case where one molecule of the compounds represented by the general formula (3) has only one of the phenol structure, it is preferable that the total number of carbon atoms of the substituent is in the range from 1 to 200 pieces, more preferable that it is in the range from 1 to 150 pieces, and further preferable that it is in the range from 1 to 100 pieces. However, in the case where a plurality of the relevant phenol structures are bonded to chains of polymer, it is not the case for the above-described treatment, as the average molecular weight of the total polymer, 500000 or less is used. Moreover, compounds such as bis-compound, tris-compound bonded by a linking group having 1 to 100 carbon atoms are also effective. It can be an effective treatment for the case where the volatility during the developing a compound is a problem to increase the molecule weight as these described above.

Hereinafter, concrete examples (from 3-1 to 3-89) of reducing compounds represented by the general formula (3) are shown, however, compounds used in the present invention are not limited by these concrete examples.

3-1

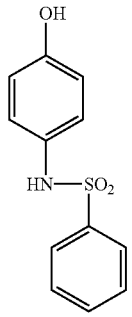

3-2

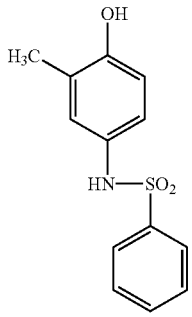

-continued
3-3
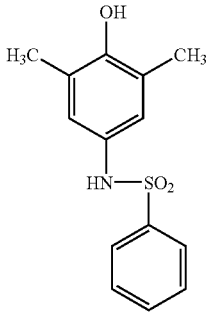
3-4
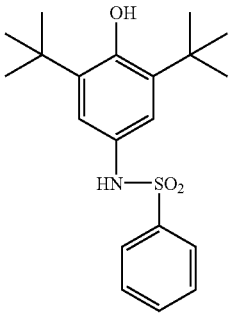
3-5
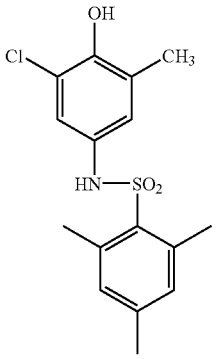
3-6
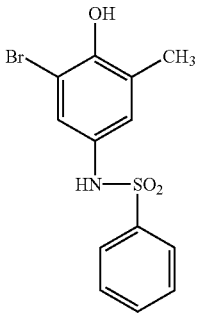
-continued
3-7
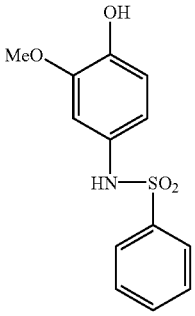
3-8
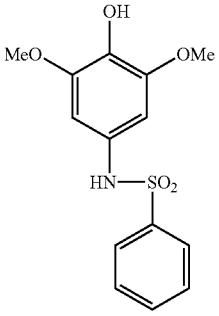
3-9
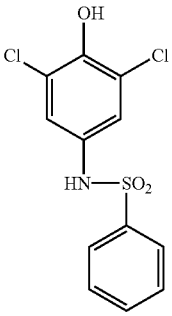
3-10
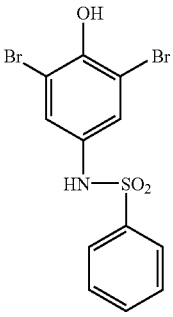
3-11
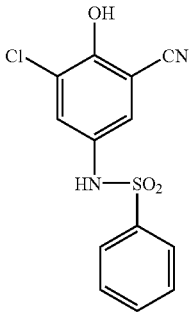

-continued
3-12
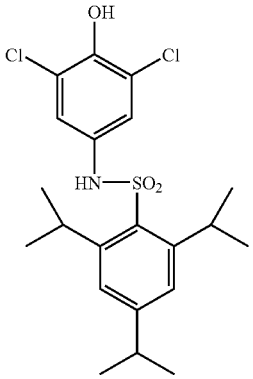
3-13
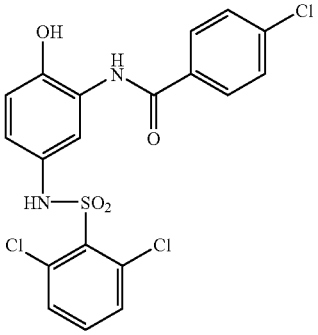
3-14
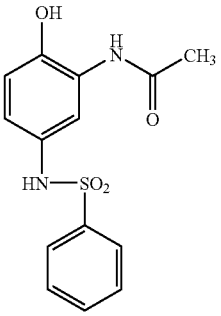
3-15
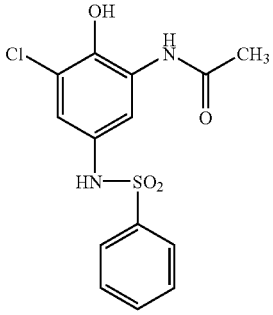
-continued
3-16
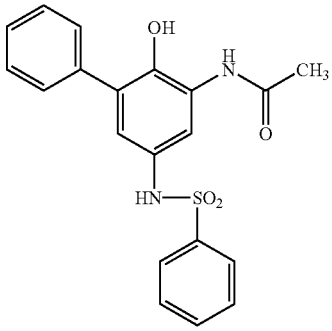
3-17
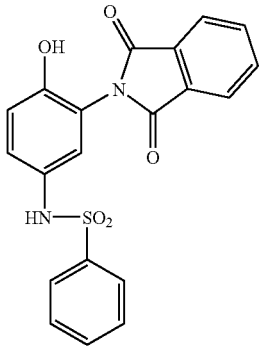
3-18
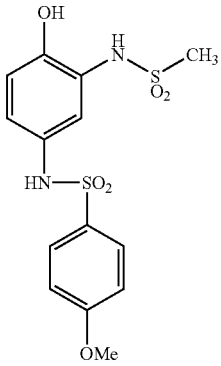
3-19
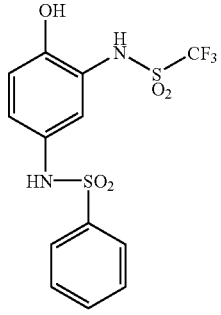

-continued
3-20
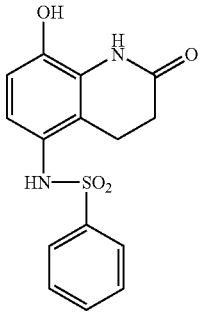
3-21
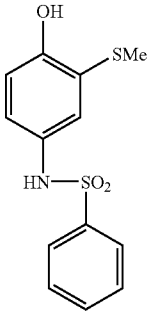
3-22
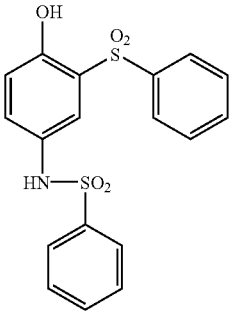
3-23
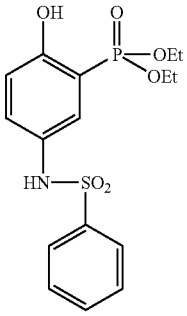
3-24
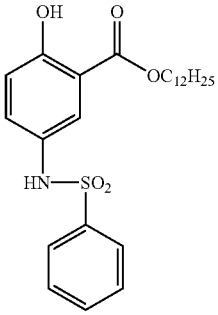
-continued
3-25
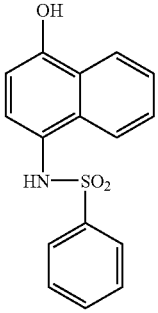
3-26
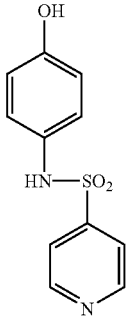
3-27
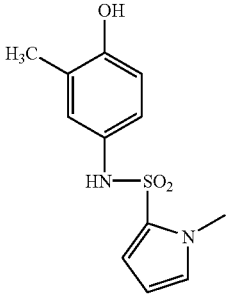
3-28
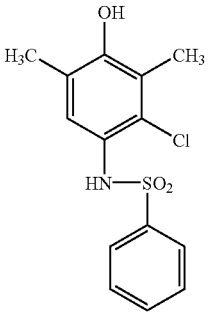
3-29
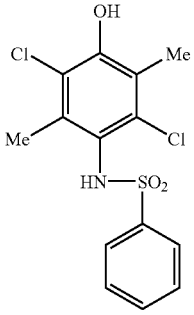

-continued
3-30
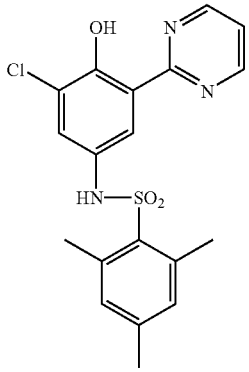
3-31
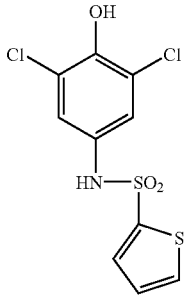
3-32
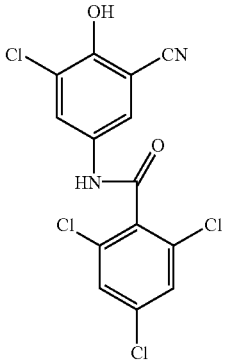
3-33
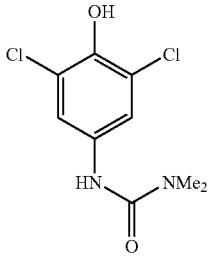
-continued
3-34
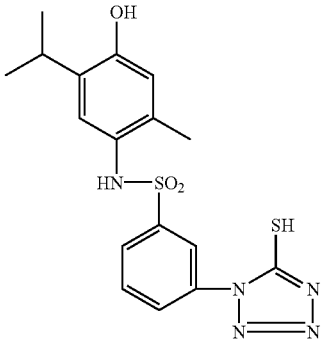
3-35
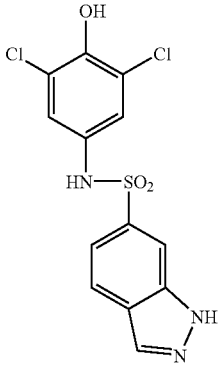
3-36
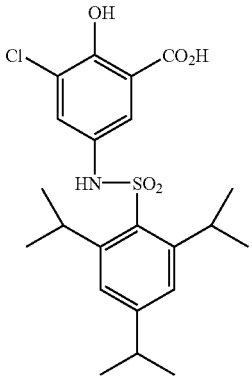
3-37
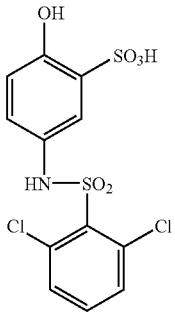

-continued
3-38
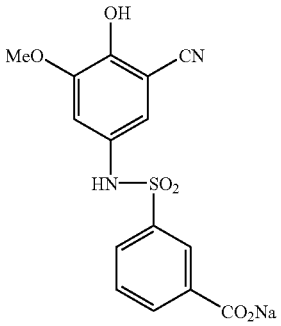
3-39
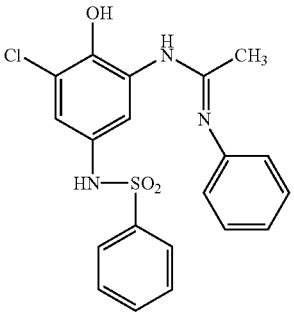
3-40
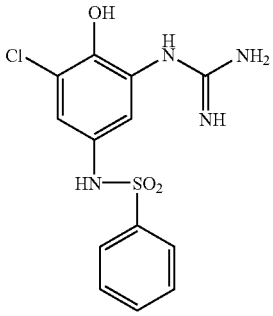
3-41
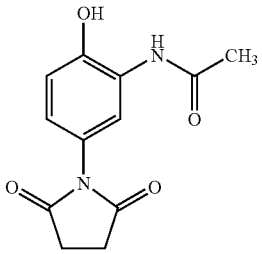
3-42
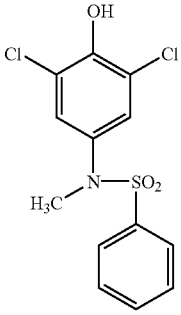
-continued
3-43
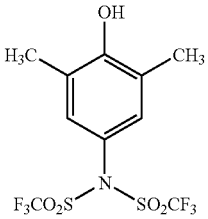
3-44
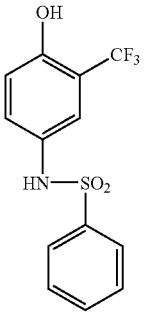
3-45
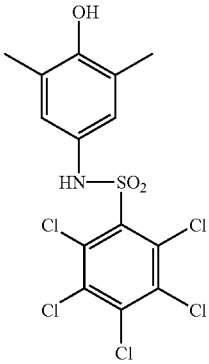
3-46
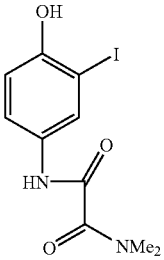
3-47
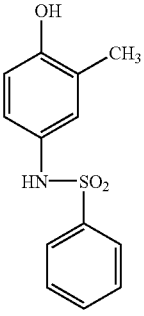

-continued
3-48
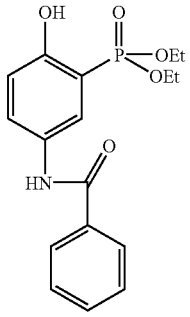
3-49
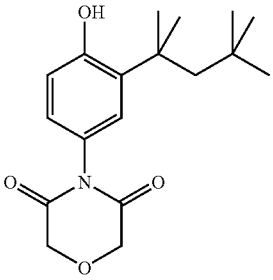
3-50
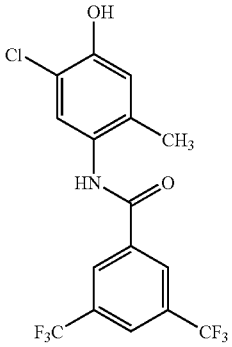
3-51
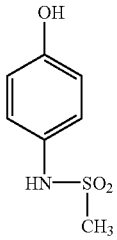
3-52
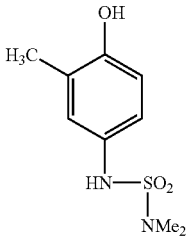
-continued
3-53
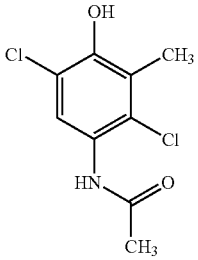
3-54
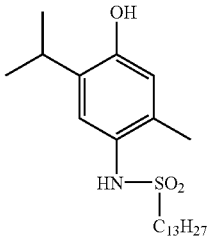
3-55
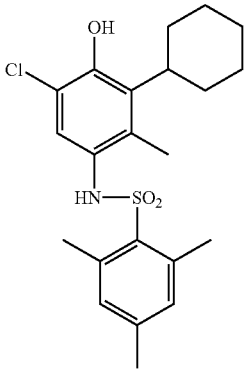
3-56
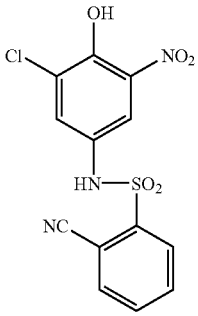
3-57
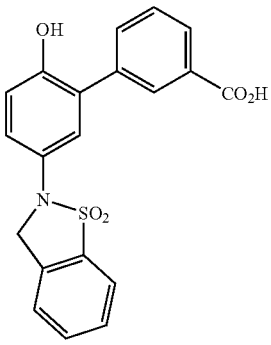

-continued
3-58
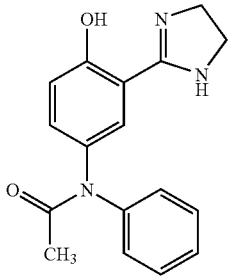
3-59
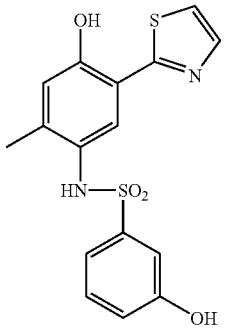
3-60
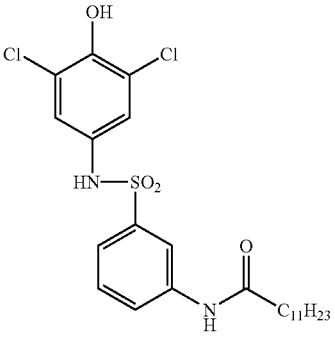
3-61
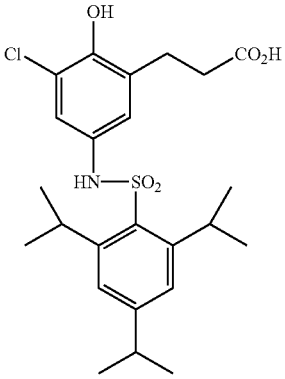
-continued
3-62
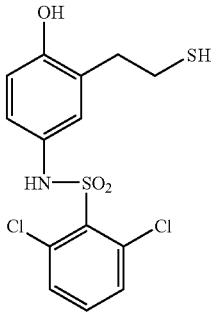
3-63
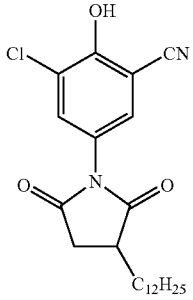
3-64
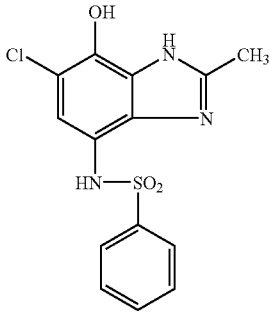
3-65
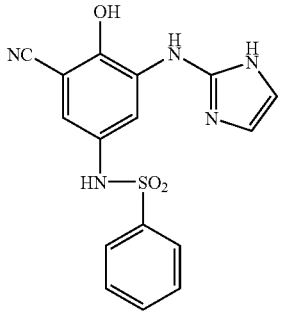
3-66
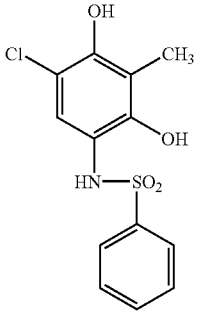

-continued
3-67
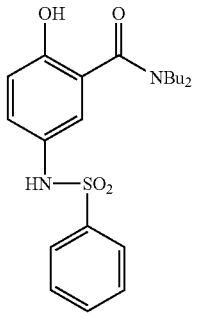
3-68
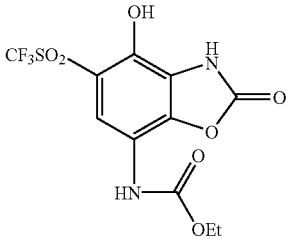
3-69
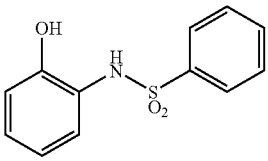
3-70
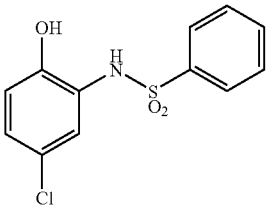
3-71
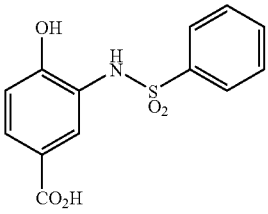
3-72
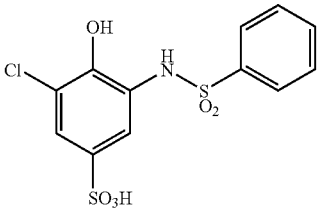
3-73
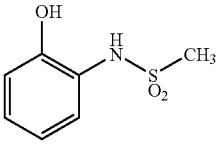
-continued
3-74
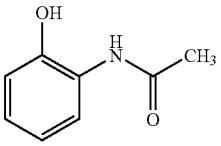
3-75
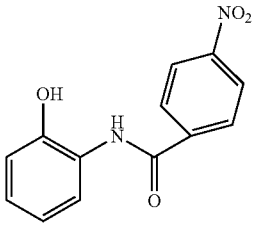
3-76
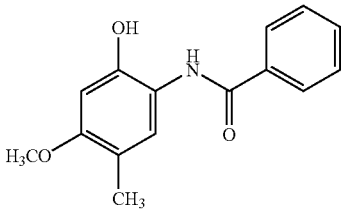
3-77
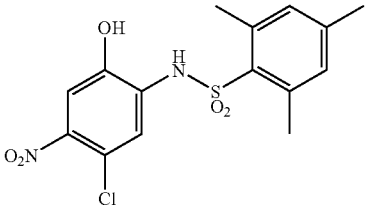
3-78
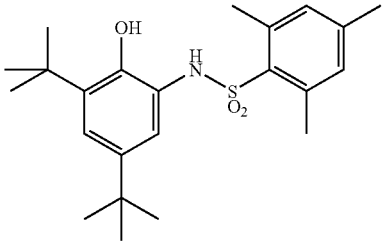
3-79
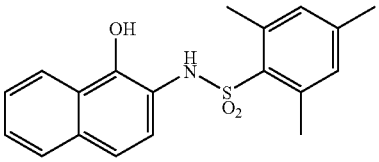
3-80
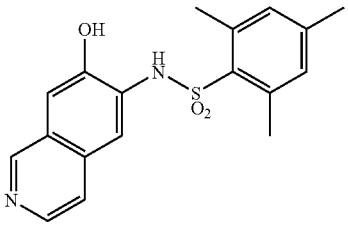

-continued 3-81

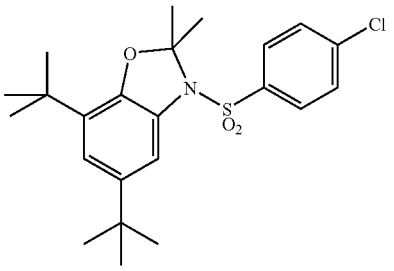

3-82

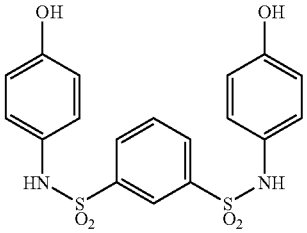

3-83

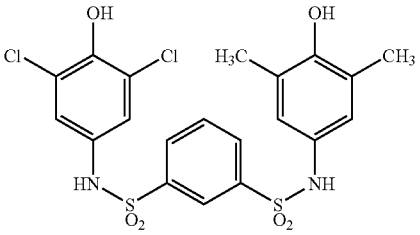

3-84

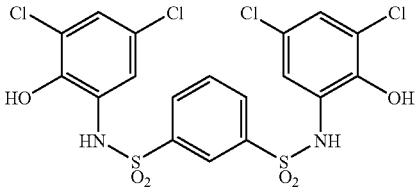

3-85

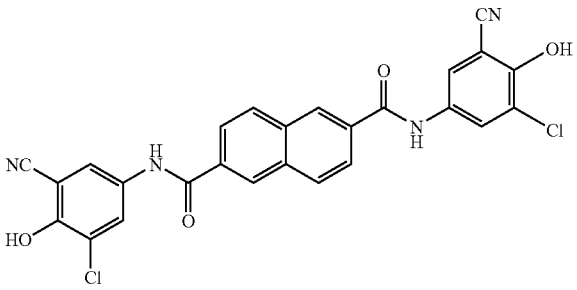

3-86

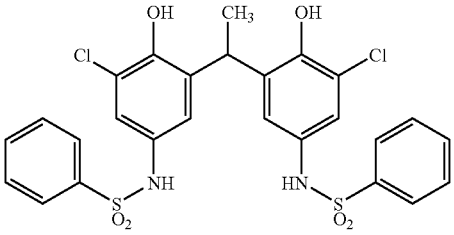

-continued 3-87

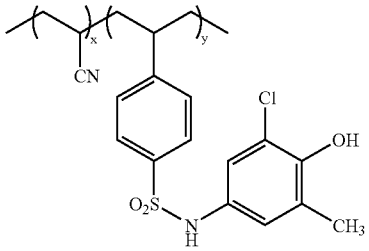

3-88

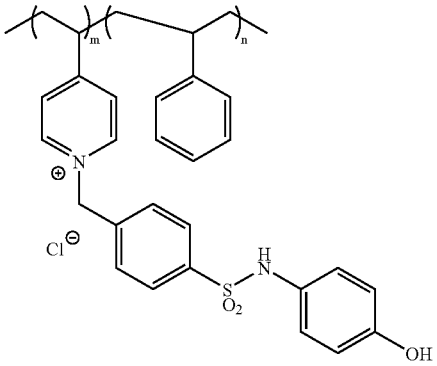

3-89

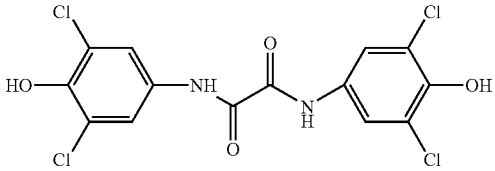

<Development Accelerator Represented By General Formula (4)>

A development accelerator represented by the general formula (4) will be described below.

General Formula (4)

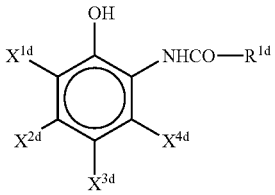

In the general formula (4), $X^{1d}$ represents a substituent capable of substituting on a benzene ring (there is no case that it is a hydrogen atom). However, there is no case where $X^{1d}$ represents a hydroxyl group.

As a concrete example of a substituent, a halogen atom, an alkyl group (including a cycloalkyl group, a bicycloalkyl group), an alkenyl (including cycloalkenyl group, a bicycloalkenyl group), an alkynyl group, an aryl group, a heterocyclic group, a cyano group, a nitro group, a carboxyl group, an alkoxy group, an aryloxy group, a silyloxy group, a heterocyclic oxy group, an acyloxy group, a carbamoyloxy group, an alkoxycarbonyl group, an aryloxycarbonyloxy group, an acylamino group, an aminocarbonyl amino group, an alkoxycarbonyl amino group, an aryloxycarbonylamino group, a sulfamoylamino group, an alkyl and arylsulfonylamino group, a mercapto group, an alkylthio group, an arylthio group, a heterocyclic thio group, a sufamoyl group, a sulfo group, an alkyl and aryl sulfinyl group, an alkyl and arylsulfonyl group, an acyl group, an aryloxycarbonyl group, an alkoxycarbonyl group, a carbamoyl group, an aryl and heterocyclic azo group, an imide group, a phosphino group, a phosphinyl group, a phosphinyloxy group, a phosphinylamino group, and a silyl group are listed.

Further in detail, a halogen atom (a fluorine atom, a chlorine atom, a bromine atom and an iodine atom), an alkyl group [representing a linear, branched or cyclic alkyl group for substitution or non-substitution. These are an alkyl group (preferably, an alkyl group having 1 to 30 carbon atoms, for example, a methyl group, an ethyl group, a n-propyl group, an isopropyl group, a tert-butyl group, a n-octyl group, an eicosyl group, a 2-chloroethyl group, a 2-cyanoethyl group, a 2-ethylhexyl group), a cycloalkyl group (preferably cycloalkyl group having 3 to 30 carbon atoms for substitution or non-substitution, for example, a cyclohexyl group, a cyclopentyl group, a 4-n-dodecylcyclohexyl group), bicycloalkyl group (preferably bicycloalkyl group having 5 to 30 carbon atoms for substitution or non-substitution, that is, a monovalent group that one piece of hydrogen atoms is removed from a bicycloalkane. For example, a bicyclo[1,2,2]heptane-2-yl group, a bicyclo[2,2,2]octane-3-yl group), and further, also including a tricyclo structure that may have a number of ring structure. An alkyl group among the substituents described below (e.g., an alkyl group of an alkylthio group) also represents an alkyl group according to such a concept.], an alkenyl group [representing a linear, branched or cyclic alkenyl group for substitution or non-substitution. These are an alkenyl group (preferably an alkenyl group having 2 to 30 carbon atoms for substitution or non-substitution, for example, a vinyl group, an allyl group, a prenyl group, a geranyl group, an oleyl group), a cycloalkenyl group (preferably a cycloalkenyl group having 3 to 30 carbon atoms for substitution or non-substitution, that is, a monovalent group that one piece of hydrogen atoms of a cycloalkene group having 3 to 30 carbon atoms is removed. For example, a 2-cyclopentene-1-yl group, a 2-cyclohexane-1-yl group), a bicycloalkenyl group (a bicylcoalkenyl group for substitution or non-substitution, preferably a bicycloalkenyl group having 5 to 30 carbon atoms for substitution or non-substitution, that is, a monovalent group that one piece of hydrogen atoms is removed from a bicycloalkene having one double bond. For example, it includes a bicyclo[2,2,1]hepto-2-en-1-yl group, a bicyclo[2,2,2]octo-2-en-4-yl group)], an alkynyl group (preferably an alkynyl group having 2 to 30 carbon atoms for substitution or non-substitution, for example, an ethynyl group, a propargyl group, a trimethylsilylethynyl group, an aryl group (preferably an aryl group having 6 to 30 carbon atoms for substitution or non-substitution, for example, a phenyl group, a p-tolyl group, a naphthyl group, a m-chlorrophenyl group, a o-hexadecanoylaminophenyl group), a heterocyclic group (preferably a monovalent group that one piece of hydrogen atoms is removed from a 5-membered or 6-membered aromatic or non-aromatic heterocyclic compound for substitution or non-substitution and more preferably a 5-membered or 6-membered aromatic heterocyclic group having 3 to 30 carbon atoms. For example, a 2-furil group, a 2-thienyl group, a 2-pyrimidinyl group, a 2-benzothiozolyl group), a cyano group, a nitro group, a carboxyl group, an alkoxy group (preferably an alkoxy group having 1 to 30 carbon atoms for substitution or non-substitution, for example, a methoxy group, an ethoxy group, an isopropoxy group, a tert-butoxy group, a n-octyloxy group, a 2-methoxyethoxy group), an aryloxy group (preferably an aryloxy group having 6 to 30 carbon atoms for substitution or non-substitution, for example a phenoxy group, a 2-methylphenoxy group, a 4-tert-butylphenoxy group, a 3-nitrophenoxy group, a 2-tetradecanoylaminophenoxy group), a silyloxy group (preferably a silyloxy group having 3 to 20 carbon atoms, for example, a trimethylsilyloxy group, a tert-buthyldimethylsilyloxy group), a heterocyclic oxy group (preferably a heterocyclic oxy group having 2 to 30 carbon atoms for substitution or non-substitution, a 1-phenyltetrazole-5-oxy group, a 2-tetrahydropyranyloxy group), an acyloxy group (preferably formyloxy group, an alkylcarbonyloxy group having 2 to 30 carbon atoms for substitution or non-substitution, an arylcarbonyloxy group having 6 to 30 carbon atoms for substitution or non-substitution, for example, a formyloxy group, an acetyloxy group, a pivaloyloxy group, a stearoyloxy group, a benzoyloxy group, a p-methoxyphenylcarbonyloxy group), a carbamoyloxy group (preferably a carbamoyloxy group having 1 to 30 carbon atoms for substitution or non-substitution, for example, N,N-dimethycarbamoyloxy group, N,N-diethylcarbamoyloxy group, a morpholinocarbonyloxy group, N,N-di-n-octylaminocarbonyoxy group, N-n-octylcarbamoyloxy group), an alkoxycarbonyloxy group (preferably an alkoxycarbonyloxy group having 2 to 30 carbon atoms for substitution or non-substitution, for example, methoxycarbonyloxy group, an ethoxycarbonyloxy group, a tert-butoxycarbonyloxy group, a n-octylcarbonyloxy group), an aryloxycarbonyloxy group (preferably an aryloxycarbonyloxy group having 7 to 30 carbon atoms for substitution or non-substitution, for example, a phenoxy carbonyl group, a p-methoxyphenoxy carbonyloxy group, a p-n-hexadecyloxyphenoxycarbonylxoy group), an acylamino group (preferably a formylamino group, an alkylcarbonylamino group having 1 to 30 carbon atoms for substitution or non-substitution, an arylcarbonylamino group having 6 to 30 carbon atoms for substitution or non-substitution, for example, a formylamino group, an acetylamino group, a pivaloylamino group, a lauroylamino group, benzoylamino group, a 3,4,5-tri-n-octyloxyphenylcaronylamino group), an aminocarbonylamino group (preferably an aminocarbonylamino group having 1 to 30 carbon atoms for substitution or non-substitution, for example, carbamoylamino group, N,N-dimethyaminocarbonylamino group, N,N-diethylaminocarbonylamino group, a morpholinocarbonylamino group), an alkoxycarbonylamino group (preferably an alkoxycarbonylamino group having 2 to 30 carbon atoms for substitution or non-substitution, for example, a methoxycarbonylamino group, an ethoxycarbonylamino group, a tert-butoxycarbonylamino group, a n-octadecyloxycarbonylamino group, N-methyl-methoxycarbonylamino group), an aryloxycarbonylamino group (preferably an aryloxycarbonylamino group having 7 to 30 carbon atoms for substitution or non-substitution, for example, a phenoxycarbonylamino group, a p-chlorophenoxycarbonylamino group, a m-n-octyloxyphenoxycarbonylamino group), a sulfamoylamino group (preferably a sulfamoylamino group having 0 to 30 carbon atoms for substitution or non-substitution, for example, a sulfamoylamino group, a N,N-dimethylaminosulfonylamino group, a N-n-octylaminosulfonylamino group), an alkyl and arylsulfonylamino group (preferably an alkylsulfonylamino group having 1 to 30 carbon atoms for substitution or non-substitution, an arylsulfonylamino group having 6 to 30 carbon atoms for substitution or non-substitution, for example, a methylsulfonylamino group, a butylsulfonylamino group, a phenylsulfonylamino group, a 2,3,5-trichlorophenyl sulfonylamino group, p-methylphenylsulfonylamino group), a mercapto group, and an alkylthio group (preferably an alkylthio group having 1 to 30 carbon atoms for substitution or non-substitution, for example, a methylthio group, an ethylthio group, a n-hexadecylthio group), an arylthio group (preferably an arylthio group having 6 to 30 carbon atoms for substitution or non-substitution, for example, a phenylthio group, a p-chlorophenylthio group, a m-methoxyphenylthio group), a heterocyclic thio group (preferably a heterocyclic thio group having 2 to 30 carbon atoms for substitution or non-substitution, for example, a 2-benzothiazolyltho group, a 1-phenyltetrazole-5-yl thio group), a sulfamoyl group (preferably a sulfamoyl group having 0 to 30 carbon atoms for substitution or non-substitution, for example, N-ethylsulfamoyl group, N-(3-dodecyloxypropyl) sulfamoyl group, N,N-dimethylsulfamoyl group, a N-acetylsulfamoyl group, a N-benzoylsulfamoyl group, a N-(N'-phenylcarbamoyl)sulfamoyl group), a sulfo group, an alkyl and arylsulfinyl group (preferably an alkylsulfinyl group having 1 to 30 carbon atoms for substitution or non-substitution, an arylsulfinyl group having 6 to 30 carbon atoms for substitution or non-substitution, for example, a methylsufinyl group, an ethylsulfinyl group, a phenylsulfinyl group, p-methylphenylsulfinyl group), an alkyl and arylsulfonyl group (preferably an alkylsulfonyl group having 1 to 30 carbon atoms for substitution or non-substitution, an arylsulfonyl group having 6 to 30 carbon atoms for substitution or non-substitution, for example, a methylsulfonyl group, an ethylsulfonyl group, a phenylsulfonyl group, a p-methylphenylsulfonyl group), an acyl group (preferably a formyl group, an alkylcarobnyl group having 2 to 30 carbon atoms for substitution or non-substitution, an arylcarbonyl group having 7 to 30 carbon atoms for substitution or non-substitution, and a heterocyclic carbonyl group bonded to a carbonyl group having 4 to 30 carbon atoms for substitution or non-substitution with a carbon atom, for example, an acetyl group, a pivaloyl group, a 2-chloroacetyl group, a stearoyl group, a benzoyl group, a p-n-octyloxyphenylcarbonyl group, a 2-pyridylcarbonyl group, a 2-furilcarbonyl group), an aryloxycarbonyl group (preferably an aryloxycarbonyl group having 7 to 30 carbon atoms for substitution or non-substitution, for example, a phenoxycarbonyl group, an o-chlorophenoxycarbonyl group, a m-nitrophenoxycarbonyl group, a p-tert-butylphenoxycarbonyl group), an alkoxycarbonyl group (preferably an alkoxycarbonyl group having 2 to 30 carbon atoms for substitution or non-substitution, for example, a methoxycarbonyl group, an ethoxycarbonyl group, a tert-butoxycarbonyl group, a n-octadecyloxycarbonyl group), a carbamoyl group (preferably a carbamoyl group having 1 to 30 carbon atoms for substitution or non-substitution, for example, a carbamoyl group, N-methylcarbamoyl group, a N,N-dimethylcarbamoyl group, a N,N-di-n-octylcarbamoyl group, N-(methylsulfonyl)carbamoyl group), an aryl and heterocyclic azo group (preferably an arylazo group having 6 to 30 carbon atoms for substitution or non-substitution, a heterocyclic azo group having 3 to 30 carbon atoms for substitution or non-substitution, for example, a phenylazo group, a p-chlorophenylazo group, a 5-ethylthio-1,3,4-thiadiazole-2-yl azo group), an imide group (preferably N-succinimde group, a N-phthalimide group), a phosphino group (preferably a phosphino group having 2 to 30 carbon atoms for substitution or non-substitution, for example, a dimethylphosphino group, a diphenyphosphino group, a methylphenoxyphosphino group), a phosphinyl group(preferably a phosphinyl group having 2 to 30 carbon atoms for substitution or non-substitution, for example, a phosphinyl group, a dioctyloxyphosphinyl group, a diethoxyphosphinyl group), a phosphinyloxy group (preferably a phosphinyloxy group having 2 to 30 carbon atoms for substitution or non-substitution, for example, a diphenoxyphosphinyloxy group, a dioctyloxyphosphinyloxy group), a phosphinylamino group (preferably a phosphinylamino having 2 to 30 carbon atoms for substitution or non-substitution, for example, a dimethoxyphosphinylamino group, a dimethylaminophosphinylamino group), a silyl group (preferably a silyl group having 3 to 30 carbon atoms for substitution or non-substitution, for example, a trimethylsilyl, a tert-butyldimethylsilyl group, and a phenyldimethylsilyl group) are listed.

As a substituent preferably represented by $X^{1d}$, a halogen atom (a fluorine atom, a chlorine atom, a bromine atom, and an iondine atom, preferably a chlorine atom and a bromine atom), an acylamino group (preferably having 1 to 20 carbon atoms, more preferably having 1 to 14 carbon atoms, and particular preferably having 1 to 8 carbon atoms, for example, a formylamino group, an acetylamino group, a benzoylamino group and the like), an alkyl group (preferably having 1 to 20 carbon atoms, more preferably having 1 to 14 carbon atoms, and particularly preferably having 1 to 8 carbon atoms, for example, a methyl group, an ethyl group, an isopropyle group, a cyclohexyl group and the like), an aryl group (preferably having 6 to 20 carbon atoms, more preferably having 6 to 14 carbon atoms, and particularly preferably having 6 to 8 carbon atoms, for example, a phenyl group, a naphthyl group, a p-methylphenyl group and the like), an alkoxy group (preferably having 1 to 20 carbon atoms, more preferably having 1 to 14 carbon atoms, and particularly preferably having 1 to 8 carbon atoms, for example, a methoxy group, an ethoxy group and the like), an aryloxy group (preferably having 6 to 20 carbon atoms, more preferably having 6 to 14 carbon atoms, and particularly preferably having 6 to 8 carbon atoms, for example, a phenoxy group, a 2-naphthyloxy group and the like), an acyloxy group (preferably having 1 to 20 carbon atoms, more preferably having 1 to 14 carbon atoms, and particularly preferably having 1 to 8 carbon atoms, for example, an acetoxy group, a benzoyloxy group and the like), a sulfonylamino group (preferably having 1 to 20 carbon atoms, more preferably having 1 to 14 carbon atoms and particularly preferably having 1 to 8 carbon atoms, for example, a methanesulfonylamino group, a benzenesulfonylamino group and the like), a carbamoyl group (preferably having 1 to 20 carbon atoms, more preferably having 1 to 14 carbon atoms, and particularly preferably having 1 to 8 carbon atoms, for example, a carbamoyl group, a N,N-dimethylcarbamoyl group, a N-phenylcarbamoyl group and the like), an acyl group (preferably having 1 to 20 carbon atoms, more preferably having 1 to 14 carbon atoms, and particularly preferably having 1 to 8 carbon atoms, for example a formyl group, an acetyl group, a benzoyl group and the like), an alkoxycarbonyl group (preferably having 2 to 20 carbon atoms, more preferably having 2 to 16 carbon atoms, and further preferably having 2 to 12 carbon atoms, for example, a methoxycarbonyl group, an ethoxycarbonyl group, a butoxycarbonyl group and the like), an aryloxycarbonyl group (preferably having 6 to 20 carbon atoms, more preferably having 6 to 16 carbon atoms, and further preferably having 6 to 12 carbon atoms, for example, a phenoxycarbonyl group, a 2-naphthyloxycarbonyl group and the like), a cyano group, a nitro group, and more preferably a halogen atom, an acylamino group, and an alkyl group, and particularly preferably a chlorine atom and a bromine atom are listed.

In the general fomula (4), $X^{3d}$ represents a hydrogen atom or a substituent. However, there is not a case where $X^{3d}$ represents a hydroxyl group or a sulfonamide group. As a concrete example of a substituent, a substituent listed as examples of $X^{1d}$ of the general formula (4) is listed (except for sulfonamide group).

$X^{3d}$ preferably represents a hydrogen atom, a halogen atom (a fluorine atom, a chlorine atom, a bromine atom, and an iodine atom, and preferably a chlorine atom and a bromine atom), an acylamino group (preferably having 1 to 20 carbon atoms, more preferably 1 to 14 carbon atoms, and particular preferably having 1 to 8 carbon atoms, for example, a formylamino group, an acetylamino group, a benzoylamino group and the like), an alkyl group (preferably having 1 to 20 carbon atoms, more preferably having 1 to 14 carbon atoms, and particularly preferably having 1 to 8 carbon atoms, for example, a methyl group, an ethyl group, an isopropyle group, a cyclohexyl group and the like), an aryl group (preferably having 6 to 20 carbon atoms, more preferably having 6 to 14 carbon atoms, and particularly preferably having 6 to 8 carbon atoms, for example, a phenyl group, a naphthyl group, a p-methylphenyl group and the like), an alkoxy group (preferably having 1 to 20 carbon atoms, more preferably having 1 to 14 carbon atoms, and particularly preferably having 1 to 8 carbon atoms, for example, a methoxy group, an ethoxy group and the like), an aryloxy group (preferably having 6 to 20 carbon atoms, more preferably having 6 to 14 carbon atoms, and particularly preferably having 6 to 8 carbon atoms, for example, a phenoxy group, a 2-naphthyloxy group and the like), an acyloxy group (preferably having 1 to 20 carbon atoms, more preferably having 1 to 14 carbon atoms, and particularly preferably having 1 to 8 carbon atoms, for example, an acetoxy group, a benzoyloxy group and the like), a carbamoyl group (preferably having 1 to 20 carbon atoms, more preferably having 1 to 14 carbon atoms, and particularly preferably having 1 to 8 carbon atoms, for example, a carbamoyl group, a N,N-dimethylcarbamoyl group, a N-phenylcarbamoyl group and the like), an acyl group (preferably having 1 to 20 carbon atoms, more preferably having 1 to 14 carbon atoms, and particularly preferably having 1 to 8 carbon atoms, for example a formyl group, an acetyl group, a benzoyl group and the like), an alkoxycarbonyl group (preferably having 2 to 20 carbon atoms, more preferably having 2 to 16 carbon atoms, and further preferably having 2 to 12 carbon atoms, for example, a methoxycarbonyl group, an ethoxycarbonyl group, a butoxycarbonyl group and the like), an aryloxycarbonyl group (preferably having 6 to 20 carbon atoms, more preferably having 6 to 16 carbon atoms, and further preferably having 6 to 12 carbon atoms, for example, a phenoxycarbonyl group, a 2-naphthyloxycarbonyl group and the like), a cyano group, a nitro group, and more preferably a halogen atom, an acylamino group, and an alkyl group, and particularly preferably a chlorine atom and a bromine atom are listed.

It is preferable that as a substituent represented by $X^{1d}$, $X^{3d}$, at least one of these is an electron withdrawing group. The term "electron withdrawing group" means a substituent whose Hammett substituent constant $\sigma p$ value is a positive value, as a concrete example, a halogen atom, a cyano group, a nitro group, an alkoxycarbonyl group, an aryloxycarbonyl group, an imino group, an imino group substituted with an nitrogen (N) atom, a thiocarbonyl group, a perfluoroalkyl group, a sulfonamide group, a formyl group, a phosphoryl group, a carboxyl group, a carbamoyl group, an acyl group, a sulfo group (or their salts), an alkylsulfonyl group, an arylsulfonyl group, a sulfamoyl group, an acyloxy group, an acylthio group, a sulfonyloxy group, a heterocyclic group or an aryl group substituted by their electron withdrawing groups and the like are listed.

$X^{1d}$ and $X^{3d}$ are more preferably both electron withdrawing groups, and further preferably both are halogen atoms, and particularly preferably both are chlorine atoms or bromine atoms.

In the general formula (4), each of $X^{2d}$ and $X^{4d}$ represents a hydrogen atom or a substituent. However, there is not a case where each of $X^{2d}$ and $X^{4d}$ is a hydroxyl group. As a concrete example of a substituent, substituents listed as examples of $X^{1d}$ of the general formula (4) are listed.

Each of $X^{2d}$ and $X^{4d}$ preferably represents a hydrogen atom, a halogen atom (a fluorine atom, a chlorine atom, a bromine atom, and an iondine atom, preferably a chlorine atom and a bromine atom), an acylamino group (preferably having 1 to 20 carbon atoms, more preferably 1 to 14 carbon atoms, and particular preferably having 1 to 8 carbon atoms, for example, a formylamino group, an acetylamino group, a benzoylamino group and the like), an alkyl group (preferably having 1 to 20 carbon atoms, more preferably having 1 to 14 carbon atoms, and particularly preferably having 1 to 8 carbon atoms, for example, a methyl group, an ethyl group, an isopropyl group, a cyclohexyl group and the like), an aryl group (preferably having 6 to 20 carbon atoms, more preferably having 6 to 14 carbon atoms, and particularly preferably having 6 to 8 carbon atoms, for example, a phenyl group, a naphthyl group, a p-methylphenyl group and the like), an alkoxy group (preferably having 1 to 20 carbon atoms, more preferably having 1 to 14 carbon atoms, and particularly preferably having 1 to 8 carbon atoms, for example, a methoxy group, an ethoxy group and the like), an aryloxy group (preferably having 6 to 20 carbon atoms, more preferably having 6 to 14 carbon atoms, and particularly preferably having 6 to 8 carbon atoms, for example, a phenoxy group, a 2-naphthyloxy group and the like), an acyloxy group (preferably having 1 to 20 carbon atoms, more preferably having 1 to 14 carbon atoms, and particularly preferably having 1 to 8 carbon atoms, for example, an acetoxy group, a benzoyloxy group and the like), a sulfonylamino group (preferably having 1 to 20 carbon atoms, more preferably having 1 to 14 carbon atoms and particularly preferably having 1 to 8 carbon atoms, for example, a methanesulfonylamino group, a benzenesulfonylamino group and the like), a carbamoyl group (preferably having 1 to 20 carbon atoms, more preferably having 1 to 14 carbon atoms, and particularly preferably having 1 to 8 carbon atoms, for example, a carbamoyl group, a N,N-dimethylcarbamoyl group, a N-phenylcarbamoyl group and the like), an acyl group (preferably having 1 to 20 carbon atoms, more preferably having 1 to 14 carbon atoms, and particularly preferably having 1 to 8 carbon atoms, for example a formyl group, an acetyl group, a benzoyl group and the like), an alkoxycarbonyl group (preferably having 2 to 20 carbon atoms, more preferably having 2 to 16 carbon atoms, and further preferably having 2 to 12 carbon atoms, for example, a methoxycarbonyl group, an ethoxycarbonyl group, a butoxycarbonyl group and the like), an aryloxycarbonyl group (preferably having 6 to 20 carbon atoms, more preferably having 6 to 16 carbon atoms, and further preferably having 6 to 12 carbon atoms, for example, a phenoxycarbonyl group, a 2-naphthyloxycarbonyl group and the like), a cyano group, and a nitro group. And each of these represents more preferably a hydrogen atom, an aryl group, a halogen atom, an acylamino group, and particularly preferably a hydrogen atom and a methyl group and an ethyl group.

$X^{1d}$ through $X^{4d}$ may be further substituted, as a concrete example of a substituent, substituents listed as examples of $X^{1d}$ of the general formula (4) are listed. Moreover, $X^{1d}$ through $X^{4d}$ may form a ring by joining each other.

In the general formula (4), $R^{1d}$ represents a hydrogen atom, an alkyl group (preferably having 1 to 20 carbon atoms, more preferably having 1 to 14 carbon atoms, and particularly preferably having 1 to 7 carbon atoms, for example, a methyl group, an ethyl group, an isopropyl group, a cyclohexyl group and the like), an aryl group (preferably having 6 to 20 carbon atoms, more preferably 6 to 14 carbon atoms, and particularly preferably 6 to 8 carbon atoms, for example, a phenyl group, a naphthyl group, a p-methylphenyl group and the like), a heterocyclic group (e.g., a pyridyl group, an imidazolyl group, and a pyrrolidyl group), an amino group (preferably having 0 to 20 carbon atoms, more preferably having 0 to 14 carbon atoms, and particularly preferably having 0 to 8 carbon atoms, for example, an amino group, a methylamino group, a N,N-dimethylamino group, a N-phenylamino group and the like), and an alkoxy group (preferably having 1 to 20 carbon atom, more preferably 1 to 14 carbon atoms, and particularly preferably having 1 to 8 carbon atoms, for example, a methoxy group, an ethoxy group and the like). It preferably represents a hydrogen atom, an aryl group, a heterocyclic group, an amino group, an alkoxy group, and an alkyl group having 1 to 7 carbon atoms, and further preferably an aryl group or an alkyl group having 1 to 7 carbon atoms, and particularly preferably an aryl group.

$R^{1d}$ may be further substituted, as concrete examples of substituents, the substituents listed as examples of $X^{1d}$ represented by the general formula (4) are listed.

As a preferable combination of $X^{1d}$ through $X^{4d}$ and $R^{1d}$, at least one of $X^{1d}$ and $X^{3d}$ represents a hologen atom, each of $X^{2d}$ and $X^{4d}$ represents a hydrogen atom or an alkyl group, and $R^{id}$ represents an aryl group or an alkyl group having 1 to 7 carbon atoms. As a further preferable combination of these, both $X^{1d}$ and $X^{3d}$ represent a chlorine atom or a bromine atom, $X^{2d}$ represents a hydrogen atom or an alkyl group, $X^{4d}$ represents a hydrogen atom and $R^{1d}$ represents an aryl group.

The total molecular weight of the compound represented by the general formula (4) is preferably in the range from 170 to 800, more preferably in the range from 220 to 650, and particularly preferably in the range from 220 to 500.

Hereinafter, concrete examples (from 4-1 to 4-74) of the compounds represented by the general formula (4) are listed, but the compounds represented by the general formula (4) capable of being used in the present invention are not limited to these concrete examples.

4-1

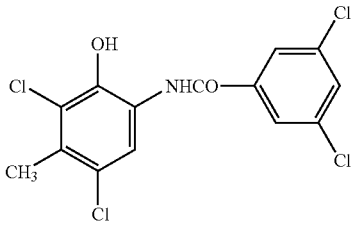

-continued 4-2

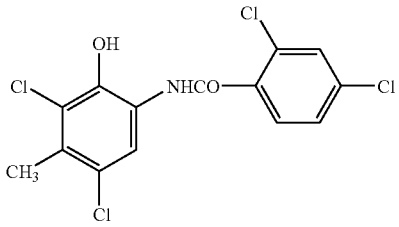

4-3

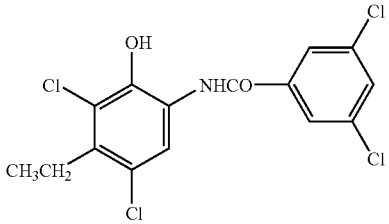

4-4

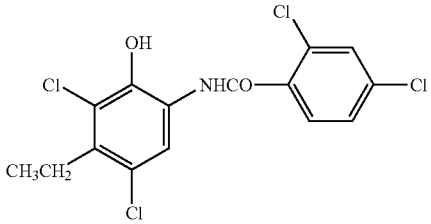

4-5

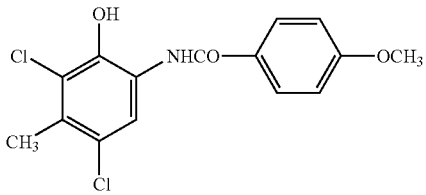

4-6

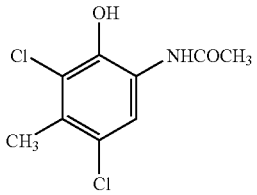

4-7

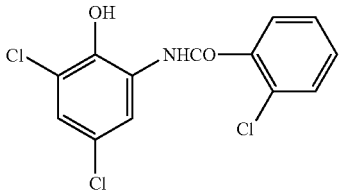

4-8

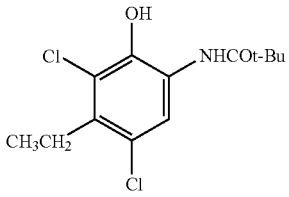

-continued
4-9
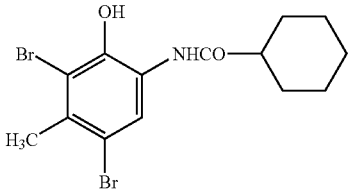
4-10
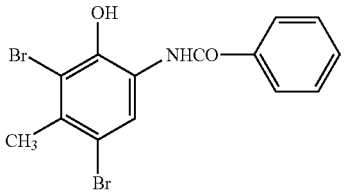
4-11
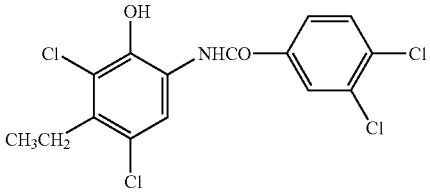
4-12
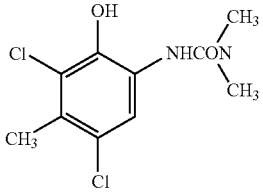
4-13
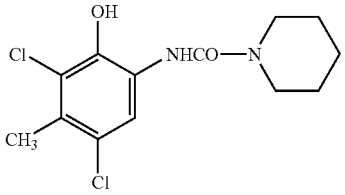
4-14
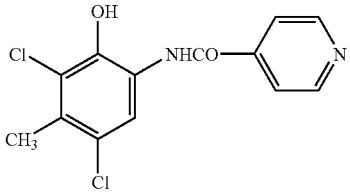
4-15
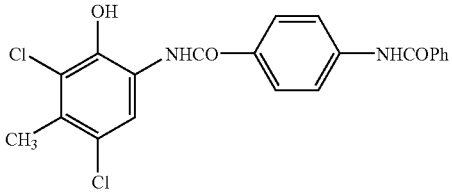
4-16
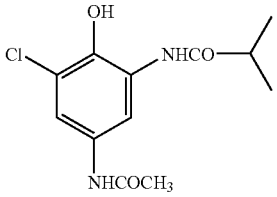
-continued
4-17
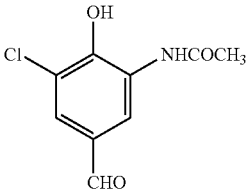
4-18
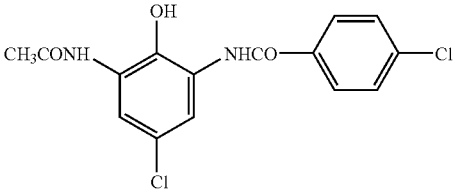
4-19
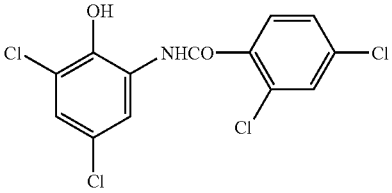
4-20
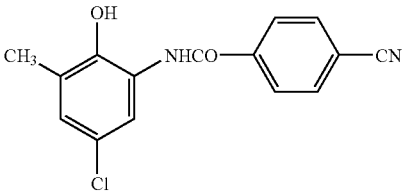
4-21
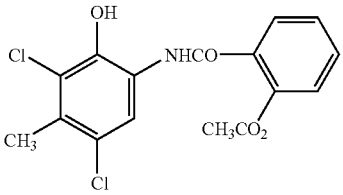
4-22
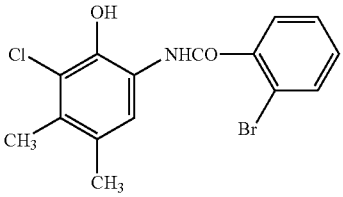
4-23
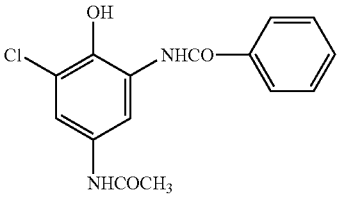

-continued
4-24
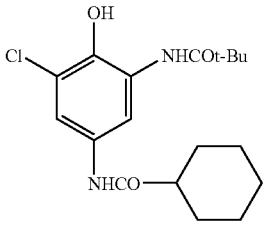
4-25
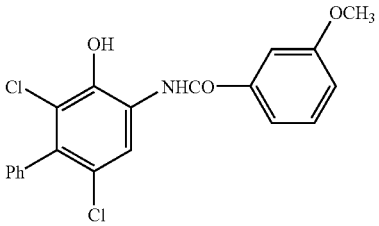
4-26
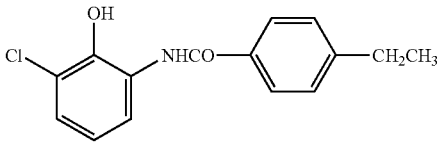
4-27
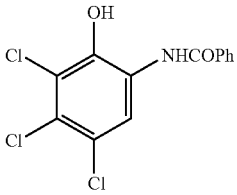
4-28
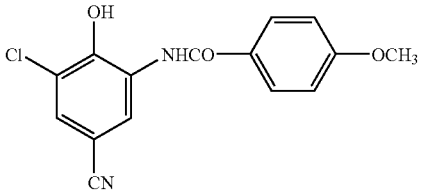
4-29
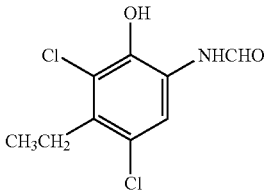
4-30
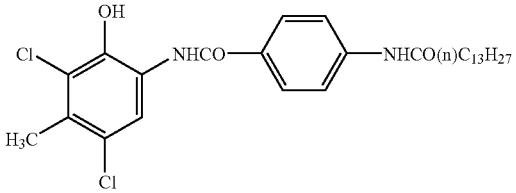
-continued
4-31
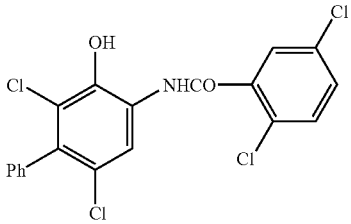
4-32
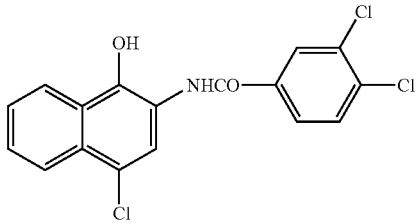
4-33
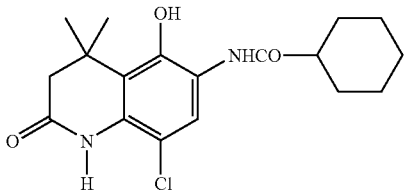
4-34
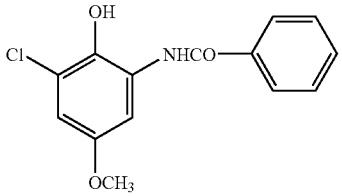
4-35
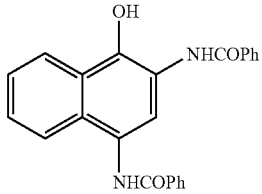
4-36
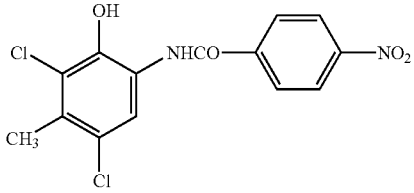
4-37
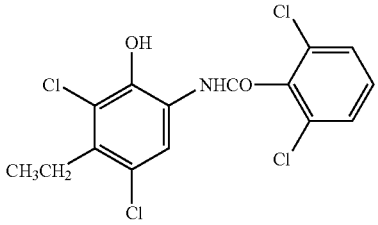

-continued
4-38
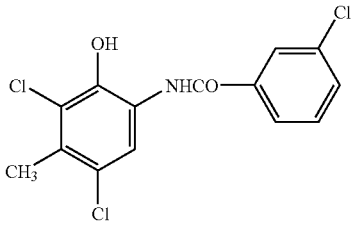
4-39
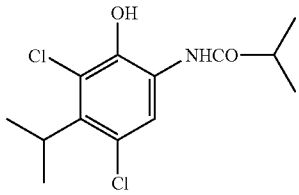
4-40
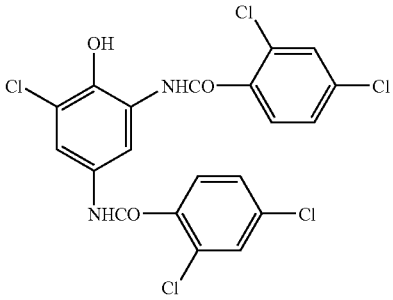
4-41
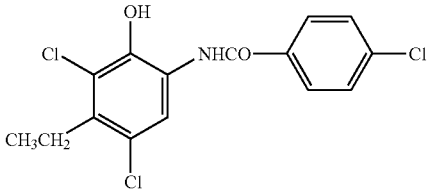
4-42
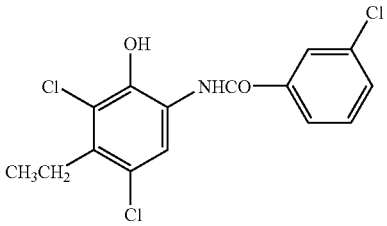
4-43
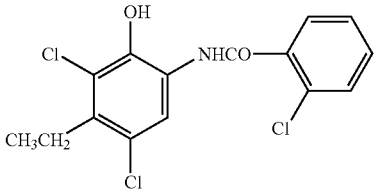
4-44
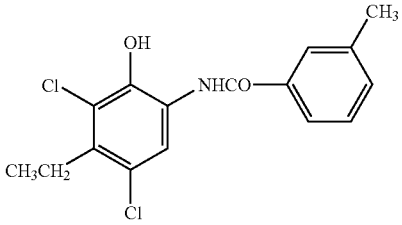
-continued
4-45
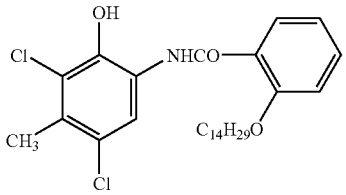
4-46
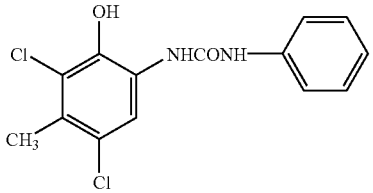
4-47
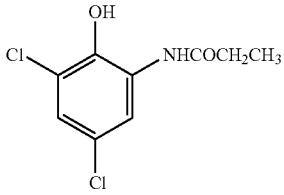
4-48
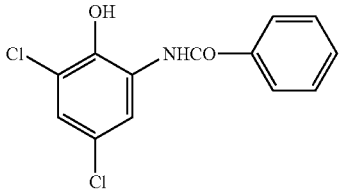
4-49
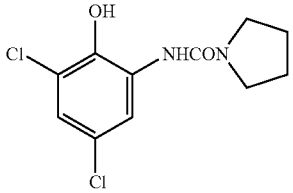
4-50
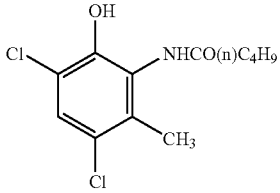
4-51
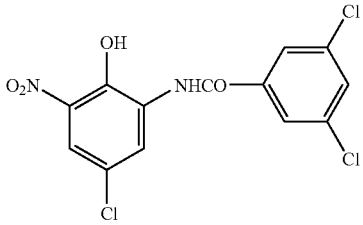

-continued
4-52
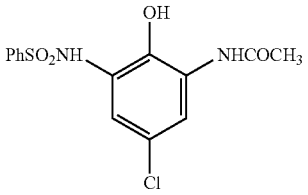
4-53
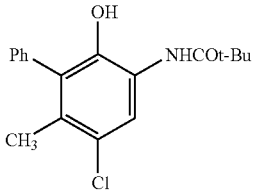
4-54
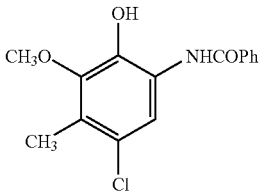
4-55
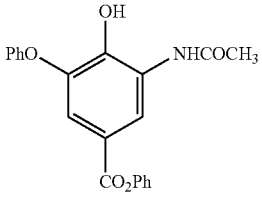
4-56
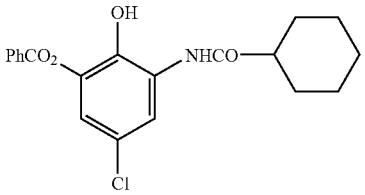
4-57
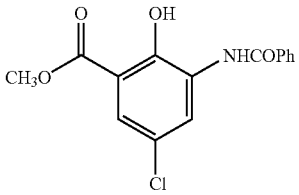
4-58
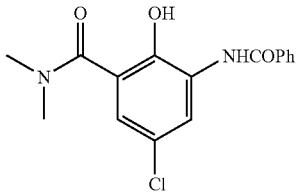
4-59
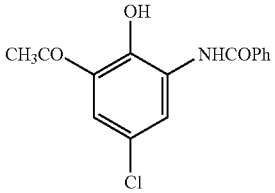
-continued
4-60
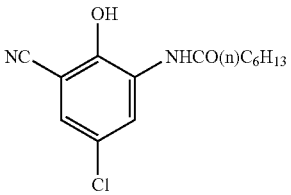
4-61
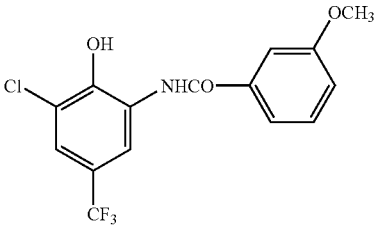
4-62
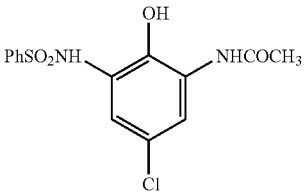
4-63
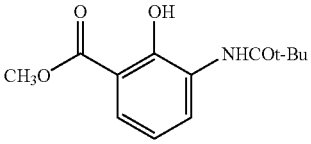
4-64
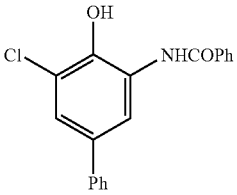
4-65
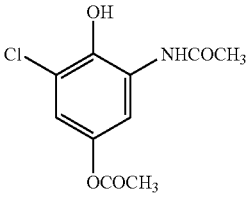
4-66
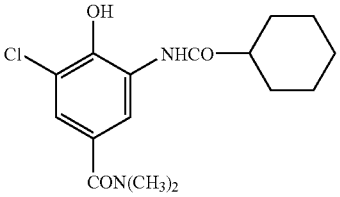
4-67
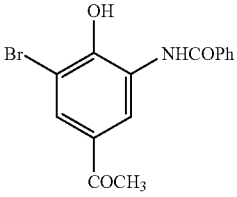

-continued 4-68

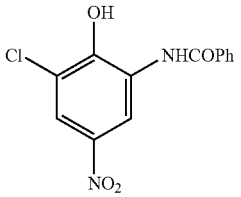

4-69

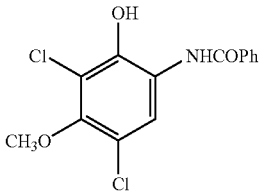

4-70

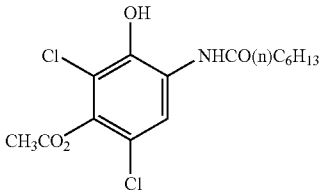

4-71

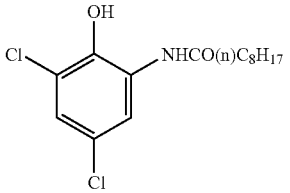

4-72

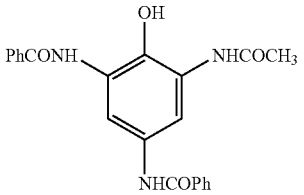

4-73

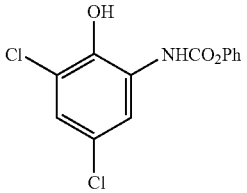

4-74

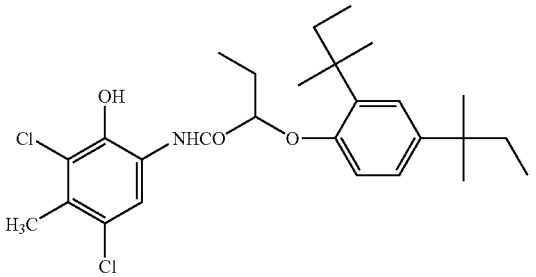

Although the range of the additive amount of a development accelerator used in the present invention is wide, it is in the range from 0.001% by mol to 100% by mol, preferably in the range from 0.01% by mol to 10% by mol, further preferably in the range from 0.1% by mol to 10% by mol, and particularly preferably in the range from 0.1% by mol to 5% by mol with respect to the principal reducing agent.

A development accelerator used in the present invention can be used by dissolving it in water or a suitable organic solvent, for example, alcohols (methanol, ethanol, propanol, and fluorinated alcohol), ketones (acetone, methylethylketone, and methylisobutylkenote), dimethylformamide, dimethylsulfoxide, methyl Cellsolv and the like.

Moreover, the development accelerator is dissolved using an oil such as dibutylphthalate, tricresyl phosphate, glycelyl triacetate or diethylphthalate, an auxiliary solvent such as ethyl acetate, cyclohexanone and like by an emulsified dispersing method already well known, then, an emulsified dispersed matter can be mechanically prepared. Or, by a method, which is known as a solid dispersion method, the powder is dispersed in water using a ball mill, a collidal mill, a sand grinder mill, a Manton-Gorlin homogenize, a microfluidizer or a supersonic wave, and can be used.

A development accelerator used in the present invention may be added to a layer located on the side of the image formation layer with respect to the support, that is, to the image formation layer, or any other layer located on the side of this image, however it is preferable that it is added to the image formation layer or the layer adjacent to it.

<Reducing Agent>

In the seventh aspect of a heat-developable photosensitive material of the present invention, it is preferable that it contains a heat-developing agent, which is a reducing agent for an organic silver salt. A reducing agent for an organic silver salt may be any substance that reduces a silver ion into a metallic silver (preferably an organic substance). Examples of such reducing agents have been described in the paragraph numbers of [0043] through [0045] of JP-A No. 11-65021 and in the paragraph from 34th line of the 7th page to the 12th of the 18th page of European Patent Publication No. 0803764 A1.

In the present invention, as a reducing agent, it is preferable that it is what is called a hindered phenol based reducing agent or bisphenol based reducing agent having a substitutent at ortho position of a phenolic hydroxyl group, and a compound represented by the following general formula (R) is more preferable.

General formula (R)

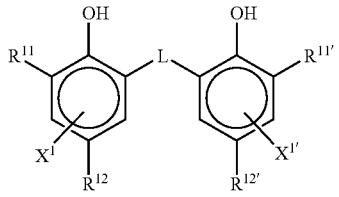

[In the general formula (R), each of $R^{11}$ and $R^{11'}$ independently represents an alkyl group having 1 to 20 carbon atoms. Each of $R^{12}$ and $R^{12'}$ independently represents a hydrogen atom or a substituent capable of being substituted by a benzene ring. L represents —S— group or —$CHR^{13}$— group. $R^{13}$ represents a hydrogen atom or an alkyl group having 1 to 20 carbon atoms. Each of $X^1$ and $X^{1'}$ represents hydrogen atom or a group being substituted with a benzene ring.]

The general formula (R) will be described in detail below.

Each of $R^{11}$ and $R^{11'}$ independently represents an alkyl group having 1 to 20 carbon atoms for substitution or non-substitution, a substituent of an alkyl group is not particularly limited, but an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom and the like are preferably listed.

Each of $R^{12}$ and $R^{12'}$ independently represents a hydrogen atom or a substituent with which the corresponding benzene ring can be substituted, each of $X^1$ and $X^{1'}$ independently represents a hydrogen atom or a substituent with which the corresponding benzene ring can be substituted. As groups capable of being substituted with benzene rings respectively, an alkyl group, an aryl group, a halogen atom, an alkoxy group and an acyl amino group are preferably listed.

L represents a —S— group or a —$CHR^3$— group. $R^{13}$ represents a hydrogen atom or an alkyl group having 1 to 20 carbon atoms, and the alkyl group may have a substituent.

As a concrete example of an alkyl group for non-substitution, a methyl group, an ethyl group, a propyl group, a butyl group, a heptyl group, a undecyl group, an isopropyl group, a 1-ethylpentyl group, a 2,4,4-trimethylpentyl group and the like are preferably listed. As an example of a substituent of the alkyl group, groups similarly to a substituent of $R^{11}$ are preferably listed.

As $R^{11}$ and $R^{11'}$, a secondary or tertiary alkyl group having 3 to 15 carbon atoms is preferred, and concretely, an isopropyl group, an isobutyl group, a t-butyl group, a t-amyl group, a t-octyl group, a cyclohexyl group, a cyclopentyl group, a 1-methylcyclohexyl group, a 1-methylcyclopropyl group and the like are preferably listed. As $R^{11}$ and $R^{11'}$, a tertiary alkyl group having 4 to 12 carbon atoms is more preferred, among these, a t-butyl group, a t-amyl group, a 1-methylcyclohexyl group is further preferred, and a t-butyl group is most preferred.

As $R^{12}$ and $R^{12'}$, an alkyl group having 1 to 20 carbon atoms is preferred, concretely, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group and the like are preferably listed, and more preferably a methyl group, an ethyl group, a propyl group, an isopropyl group, a t-butyl group are listed.

As $X^1$ and $X^{1'}$, a hydrogen atom, a halogen atom, and an alkyl group are preferred, and a hydrogen atom is more preferred.

As L, —$CHR^{13}$— group is preferred.

As $R^{13}$, a hydrogen atom or an alkyl group having 1 to 15 carbon atoms, and as an alkyl group, a methyl group, an ethyl group, a propyl group, an isopropyl group, a 2,4,4-trimethylpentyl group are preferably listed. As $R^{13}$, a hydrogen atom, a methyl group, an etyl group, a propyl group or an isopropyl group is particularly preferred.

In the case where $R^{13}$ is a hydrogen atom, as $R^{12}$ and $R^{12'}$, an alkyl group having 2 to 5 carbon atoms is preferred, an ethyl group, a propyl group are more preferred, and an ethyl group is most preferred.

In the case where $R^{13}$ is a primary or secondary alkyl group having 1 to 8 carbon atoms, as $R^{12}$ and $R^{12}$, a methyl group is preferred. As $R^{13}$, as a primary or secondary alkyl group having 1 to 8 carbon atoms, a methyl group, an ethyl group, a propyl group and an isopropyl group are more preferred, and a methyl group, an ethyl group and a propyl group are further preferred.

In the case where each of $R^{11}$, $R^{11'}$, $R^{12}$ and $R^{12'}$ represents a methyl group, $R_{13}$ is preferably a secondary alkyl group, in this case, as the secondary alkyl group of $R^{13}$, an isopropyl group, an isobutyl group and a 1-ethylpentyl group are preferred, and an isopropyl group is more preferred.

The reducing agents are different from the viewpoint of the heat-developing quality, developing silver tone and the like depending on the combinations of $R^{11}$, $R^{11'}$, $R^{12}$, $R^{12'}$ and $R^{13}$. Since these can be adjusted by combining two or more species of reducing agents, it is preferable that these are used by combining two or more kinds of reducing agents according to the objects.

Although hereinafter, concrete examples, including compounds represented by the general formula (R) of the present invention and others will be shown, the present invention is not limited to these.

(R-1)

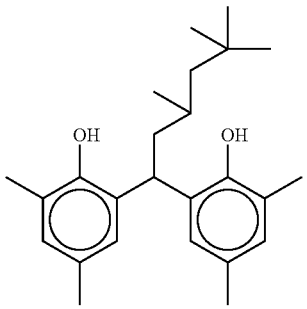

(R-2)

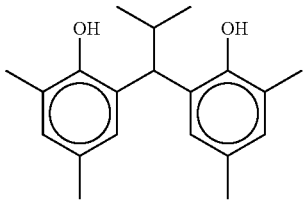

(R-3)

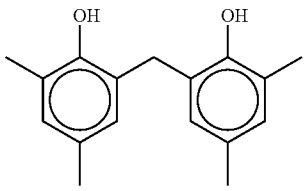

(R-4)

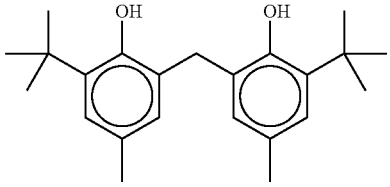

(R-5)

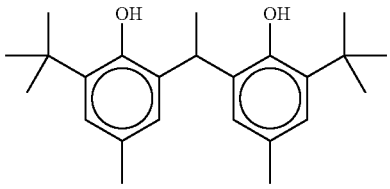

-continued
(R-6)
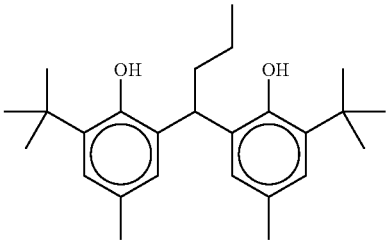
(R-7)
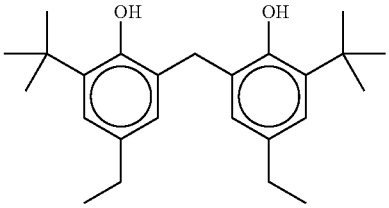
(R-8)
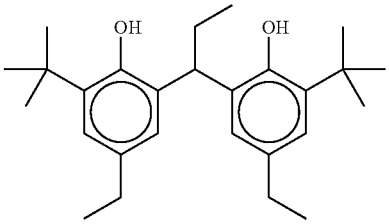
(R-9)
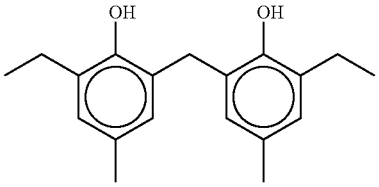
(R-10)
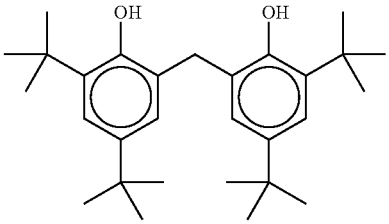
(R-21)
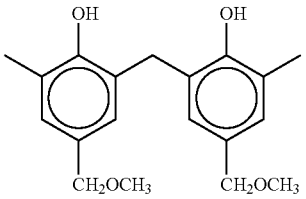
(R-22)
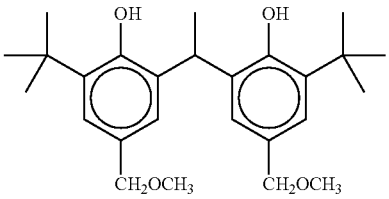
-continued
(R-23)
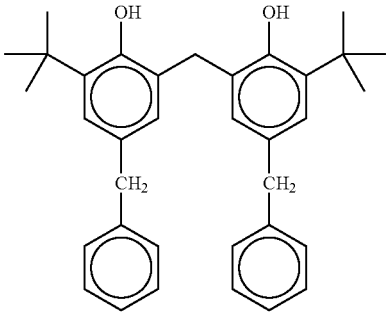
(R-24)
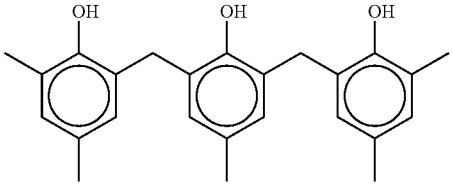
(R-25)
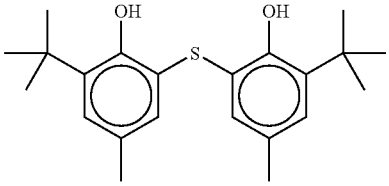
(R-26)
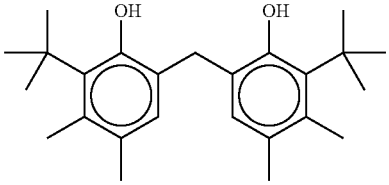
(R-27)
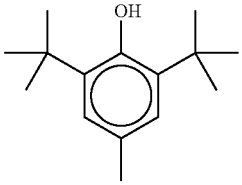
(R-28)
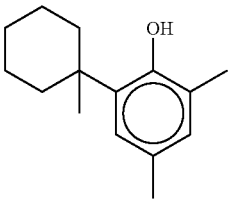
(R-29)
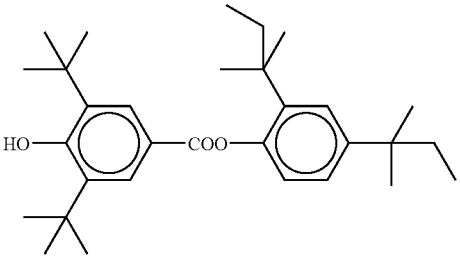

-continued (R-30)

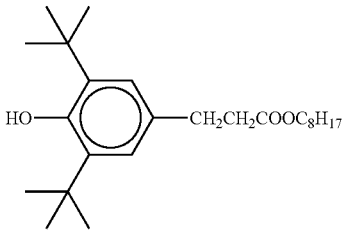

(R-31)

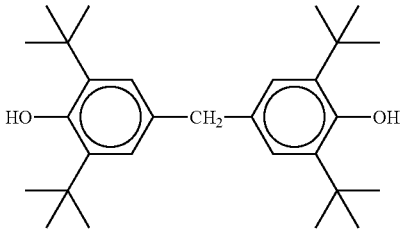

(R-32)

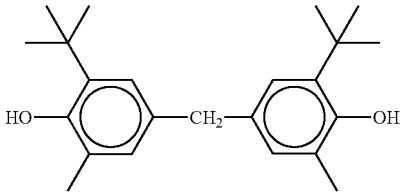

(R-33)

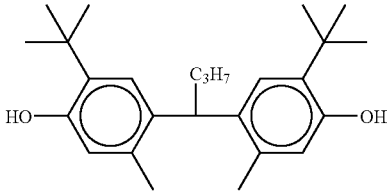

(R-34)

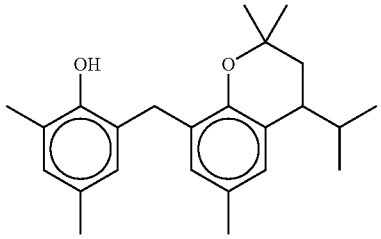

As an additive amount of a reducing agent in the present invention, it is preferable that it is in the range from 0.1 to 3.0 g/m$^2$, more preferable that it is in the range from 0.2 to 1.5 g/m$^2$, and further preferable that it is in the range from 0.3 to 1.0 g/m$^2$. It is preferable that the content of it ranges from 5 to 50% by mol with respect to 1 mole of silver on the surface having the image formation layer, and it is more preferable that the content of it ranges from 8 to 30% by mol, and further preferable that the content of it ranges from 10 to 20% by mol. Moreover, it is preferable that the reducing agent is contained in the image formation layer.

A reducing agent may be contained in a coating liquid by any method such as in a solution form, in an emulsified dispersion form, in a solid refined particle dispersed matter form and the like and may be contained in a photosensitive material.

As the well known emulsified dispersion method, a method for mechanically preparing an emulsified dispersed matter using an oil such as dibutylphthalate, tricresyl phosphate, glyceryl triacetate or diethyl phthalate and the like, an auxiliary solvent such as ethyl acetate, cyclohexanone and the like is listed.

Moreover, as a method for dispersing a solid refined particle, a method for preparing a solid dispersed matter by dispersing the powder of a reducing agent in an appropriate solvent such as water or the like using a ball mill, a collide mill, a vibrating ball mill, a sand mill, a jet mill, a roller mill or supersonic wave. Note that a protective colloid (e.g., polyvinyl alcohol), a surfactant (e.g., anionic surfactant such as sodium triisopropyl naphthalene sulfonate (mixed matter of three kinds of isopropyl groups whose substitution positions are different)) may be used at that time.

As the mills, as a dispersed medium, usually beads such as zirconia and the like are used, and zirconium (Zr) and the like eluted from these beads may be mixed into the dispersed matter. Although also depending on the dispersing conditions, usually it is in the range from 1 ppm to 1000 ppm. If the content of zirconium (Zr) in the photosensitive material is 0.5 mg or less per each 1 g of silver, it may be practically used.

An antiseptic agent (e.g., benzoisothiazolinone sodium salt) can be contained in an aqueous dispersed matter.

<Hydrogen-bonding Compound>

In the case where a reducing agent of the present invention has a hydroxyl group (—OH) of aromatic property, particularly in the case where that is one of the bisphenols, it is preferable that a non-reducing compound having a group capable of forming a hydrogen bonding is used in combination. A hydrogen-bonding compound of the present invention has been described in detail in the specification of European Patent No. 1096310.

In the present invention, particularly preferred hydrogen-bonding compounds are compounds represented by the following general formula (D):

General Formula (D)

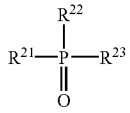

In the general formula (D), each of $R^{21}$ or and $R^{23}$ independently represents an alkyl group, an aryl group, an alkoxy group, an aryloxy group, an amino group or a heterocyclic group, and these groups may be a group for non-substitution, or may have a substituent.

Although hereinafter, concrete examples of hydrogen-bonding compounds, including compounds represented by the general formula (D) in the present invention, are shown, the present invention is not limited to these.

(D-1)

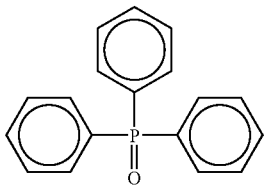

-continued
(D-2)
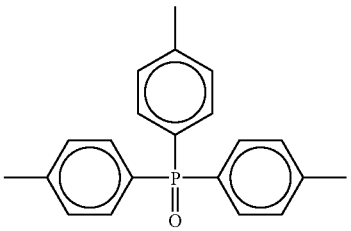
(D-3)
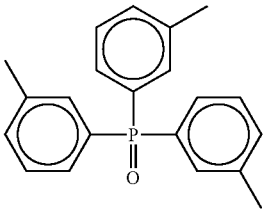
(D-4)
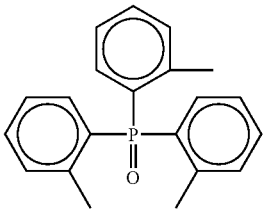
(D-5)
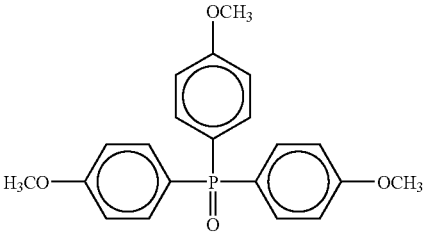
(D-6)
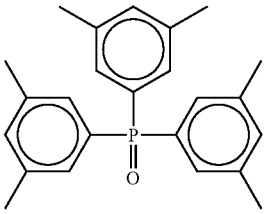
(D-7)
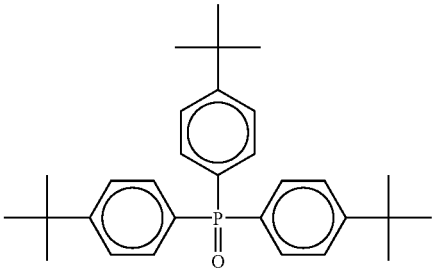
-continued
(D-8)
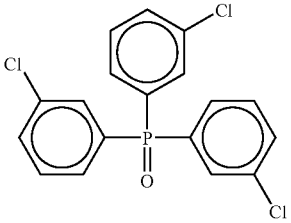
(D-9)
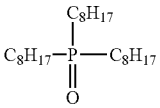
(D-10)
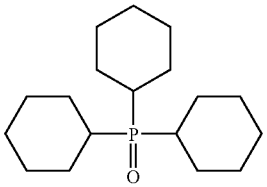
(D-11)
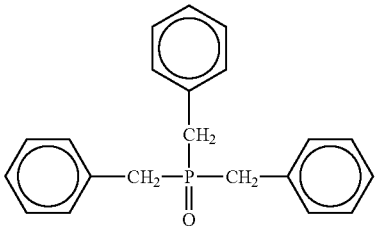
(D-12)
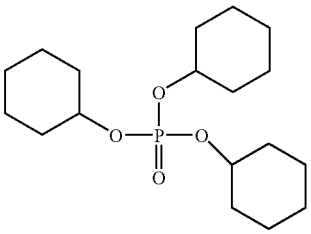
(D-13)
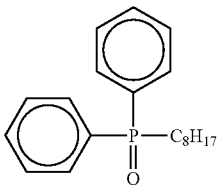
(D-14)
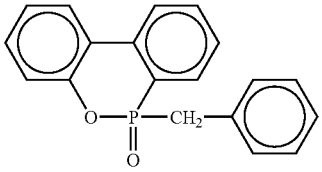
(D-15)
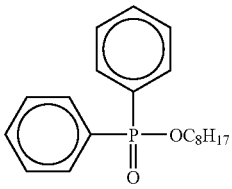

-continued (D-16)

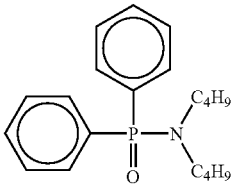

(D-17)

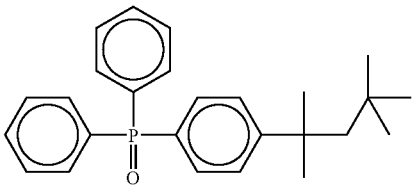

(D-18)

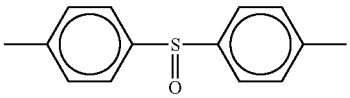

(D-19)

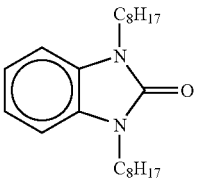

(D-20)

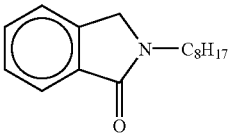

(D-21)

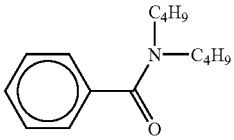

As concrete examples of hydrogen-bonding compounds, compounds described in the specification of European Patent No. 1096310, Japanese Patent Application No. 2000-270498 and Japanese Patent Application No. 2001-124796 are listed.

A compound represented by the general formula (D) of the present invention may be contained in a coating liquid in a solution form, in an emulsified dispersion form, and in a solid refined particle dispersed matter form similarly to the reducing agent and may be used in a photosensitive material.

A compound represented by the general formula (D) of the present invention is preferably used with respect to a reducing agent in the range from 1 to 200% by mol, more preferably used in the range from 10 to 150% by mol, and further preferably used from 20 to 100% by mol.

<Photosensitive Silver Halide>

A photosensitive silver halide used for a heat-developable photosensitive material of the seventh aspect of the present invention is not particularly limited as a halogen composition, silver chloride, salt silver bromide, silver bromide, iodine silver bromide, and iodine salt silver bromide can be used. Among these, silver bromide and iodine silver bromide are preferred. The distribution of the halogen composition within a particle may be uniform, the distribution may be a distribution in which the halogen composition is changed in a stepwise manner, or changed in series. Moreover, a silver halide particle having a core/shell structure can be preferably used.

It is preferable that it has the double structure through the quintet structure as a structure, and it is more preferable that a core/shell particle having the double structure through the quartet structure can be used. Moreover, the technology with which silver bromide is localized on the surface of silver chloride or salt silver bromide particle can be preferably used.

A method for forming a photosensitive silver halide is well known to a person skilled in the art, for example, methods described in Research Disclosure No. 17029 (June, 1978) and U.S. Pat. No. 3,700,458 can be used, however, concretely, a method in which a photosensitive silver halide is prepared by adding a silver supplying compound and halogen supplying compound in a gelatin or the other polymer solutions, and subsequently it is mixed with an organic silver salt is used. Moreover, a method described in the paragraph numbers from [0217] to [0224] of JP-A No. 11-11937 gazette, methods described in Japanese Patent Application No. 11-98708 and Japanese Patent Application No. 2000-42335 are also preferable.

It is preferable that the particle size of a photosensitive silver halide is small for the purpose of suppressing the whitish turbidity emerging after the image formation, concretely, it is preferable that the size is 0.20 μm or less, it is more preferable that it is in the range from 0.0 μm to 0.15 μm or less, and it is further preferable that it is in the range from 0.02 μm or more to 0.12 μm or less. Note that as used herein, the term "particle size" refers to a diameter found when the projected area of a silver halide particle (in the case of a tabular particle, the projected area of the principal plate) is converted into a circle image having the identical area.

As a shape of a silver halide particle, a particle in a cubic shape, a particle in an octahedral shape, a particle in a tabular shape, a particle in a spherical shape, a particle in a bar shape, a particle in an Irish potato shape and the like can be listed, however, in the present invention, a particle in a cubic shape is particularly preferred. A particle whose corner of a silver halide particle is rounded can be also preferably used.

In the present invention, a silver halide particle that 6-cyano metallic complex is existed on the outermost surface of the particle is preferred. As a 6-cyano metallic complex, $[Fe(CN)_6]^{4-}$], $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, $[Re(CN)_6]^{3-}$ and the like are listed. In the present invention, 6-cyano Fe complex is preferred.

As an additive amount of 6-cyano metallic complex, it is preferable that it is in the range from $1\times10^{-5}$ mol or more per one mole of silver to $1\times10^{-2}$ mol or less, and it is more preferable that it is in the range from $1\times10^{-4}$ mol or more to $1\times10^{-3}$ mol or less.

A photosensitive silver halide salt particle in the present invention can contain a metal or a metallic complex of the 8th group through the 10th group of the periodic table (indicating the 1st group through the 18th group). As a central metal of metal or metallic complex of the 8th group through the 10th group of the periodic table, rhodium, ruthenium and iridium are preferred. These metallic complexes may be one species, and two species or more of similar metals and dissimilar metals may be used in combination.

As a preferable content, it is preferable that it is in the range from $1\times10^{-9}$ mol to $1\times10^{-3}$ mol with respect to one mole of silver. These heavy metals, metallic complexes and methods for adding these have been described in JP-A No. 07-225449, the paragraph numbers of [0018] through [0024] of JP-A No. 11-65021, and the paragraph numbers of [0227] through [0240] of JP-A No. 11-119374.

Furthermore, metal atom (e.g., $[Fe(CN)_6]^{4-}$) capable of being contained in a photosensitive silver halide particle used in the present invention, a method for desalting a photosensitive silver halide emulsion and a chemical sensitizing method have been described in the paragraph numbers of [0046] through [0050] of JP-A No. 11-84574 gazette, in the paragraph numbers of [0025] through [0031] of JP-A No. 11-65021 gazette, and in the paragraph numbers of [0242] through [0250] of JP-A No. 11-119374 gazette.

As a gelatin contained in a photosensitive silver halide use in the present invention, a variety of gelatins can be used. In order to maintain the dispersion state excellently in a coating liquid containing an organic silver salt of a photosensitive silver halide emulsion, it is preferable that a gelatin having a low molecular weight in the range from 500 to 60,000 is used. Although these gelatins having a low molecular weight may be used during the formation of the particle or during the dispersion after the desalting treatment, it is preferable that it is used during the dispersion after the desalting treatment.

The description on a sensitizing pigment and additive method capable of being used in the seventh aspect in a heat-developable photosensitive material of the present invention is similar to the description described in the first aspect in a heat-developable photosensitive material of the present invention.

The additive amount of a sensitizing pigment in the present invention can be adjusted to the desired amount corresponding to the performances such as sensitivity and fogging, however, it is preferable that it is in the range from $10^{-6}$ to 1 mol per one mole of silver halide of a photosensitive layer, and it is further preferable that it is in the range from $10^{-4}$ and to $10^{-1}$ mol per each one mole of silver halide of a photosensitive layer.

In the present invention, in order to enhance the spectral sensitization efficiency, a strong color sensitizing agent can be used. As a strong color sensitizing agent used in the seventh aspect in a heat-developable photosensitive material of the present invention, compounds similar to the first aspect in a heat-developable photosensitive material of the present invention are listed.

It is preferable that a photosensitive silver halide particle in the present invention is chemically sensitized by sulfur sensitizing method, selenium sensitizing method or tellurium sensitizing method. As a compound preferably used in the sulfur sensitizing method, the selenium sensitizing method, and the tellurium sensitizing method, the known compound, for example, compounds described in JP-A No. 07-128768 gazette or the like can be used. In the present invention, it is particularly preferable that tellurium sensitizing is employed, and it is more preferable that compounds described in the document described in the paragraph number of [0030] of JP-A No. 11-65021 gazette, and compounds represented by the general formulas (II), (III) and (IV) of JP-A No. 05-313284 are used.

In the present invention, the chemical sensitizing can be carried out at any time if the timing is after the formation of the particle and before the coating, and it can be done after the desalting, (1) before the spectral sensitizing, (2) at the same time with spectral sensitizing, (3) after the spectral sensitizing, (4) immediately before the coating and the like. It is particularly preferable that it is performed after the spectral sensitizing.

As an amount of the usage of sulfur, selenium and tellurium sensitizing agents used in the present invention, although it is changed depending on the silver halide particle to be used, chemical maturation conditions or the like, it is used in the range from $10^{-8}$ to $10^{-2}$ mol and it is preferable that it is used in the range from about $10^{-7}$ to about $10^{-3}$ mol. As the conditions for chemical sensitizing used in the present invention, there are no particular limitations, but as pH, it is in the range from 5 to 8, as pAg, it is in the range from 6 to 11, and as the temperature, it is in the range from about 40 to about 95° C.

To a silver halide emulsion used in the present invention, thiosulfonic acid compound may be added by a method indicated in European Patent Publication No. 293,917 gazette.

As a photosensitive silver halide emulsion used for a heat-developable photosensitive material of the present invention, only one species may be used, or two species or more (e.g., ones having different average particle sizes, ones having different halogen composition, ones having different crystal habits, ones of conditions of chemical sensitizing conditions) may be used in combination. The gradation can be adjusted by employing a plurality of species of photosensitive silver halides having different sensitivities. The technologies concerning with these have been described in JP-A No. 57-119341 gazette, JP-A No. 53-106125 gazette, JP-A No. 47-3929 gazette, JP-A No. 48-55730 gazette, JP-A No. 46-5187 gazette, JP-A No. 50-73627 gazette, JP-A No. 57-150841 gazette and the like. As a difference of sensitivity, it is preferable that the difference of 0.2 logE or more in the respective emulsions is held.

Although the additive amount of a photosensitive silver halide is indicated by the coating silver amount per 1 $m^2$ of the sensitive material, it is preferable that the amount is in the range from 0.03 to 0.6 $g/m^2$ and it is more preferable that it is in the range from 0.07 to 0.4 $g/m^2$, and it is most preferable that it is in the range from 0.05 to 0.3 $g/m^2$, and with respect to 1 mol of an organic salt, it is preferable that a photosensitive silver halide is added in the range from 0.01 mol or more to 0.5 mol or less, it is more preferable that it is added in the range from 0.02 mol or more to 0.3 mol or less, and further preferable that it is added in the range from 0.03 mol or more to 0.2 mol or less.

In the seventh aspect of a heat-developable photosensitive material of the present invention, the descriptions on a method for mixing a photosensitive silver halide and an organic silver salt individually prepared and its mixture conditions, a preferable additive timing of a silver halide of the present invention into the coating liquid of the image formation layer and concrete mixing method are similar to the descriptions described in the first aspect in a heat-developable photosensitive material of the present invention.

<Binders>

As a binder contained in a layer containing an organic silver salt, any polymer may be used, as a preferred binder, transparent or translucent, in general, colorless, natural resins, polymers and copolymers, synthesized resins, polymers and copolymer, and a medium for forming the other films are listed. The concrete examples of these are similar to the examples listed in the first aspect in a heat-developable photosensitive material of the present invention. A binder may be coated and formed with water, an organic solvent or an emulsion.

In the present invention, as the glass transition temperature of a binder also used for a layer containing an organic silver salt, it is preferable that the temperature is in the range from 10° C. or higher to 80° C. or lower (hereinafter, in some cases, may be referred to as high Tg binder), it is more preferable that it is in the range from 15° C. to 70° C., and it is further preferable that it is in the range from 20° C. or higher to 65° C. or lower.

In the present invention, as a polymer to be a binder, it is particularly preferable that the polymer is a polymer capable of dispersing in an aqueous solvent. As an example of a dispersed state, it is preferable that a latex in which refined particles of water-insoluble hydrophobic polymer are dispersed and a polymer in which the polymer molecules are dispersed and form a molecular state or a micelle. As the average particle diameter of the dispersed particle, it is preferable that the average diameter is in the range from 1 to 50000 nm, it is preferable that it is in the range from 5 to about 1000 nm, it is more preferable that it is in the range from 10 to 500 nm, and further preferable that it is in the range from 50 to 200 nm.

As a particle diameter distribution of the dispersed particles, there are no particular limitations, particles having a wide particle diameter distribution may be used or particles having a monodispersed particle distribution may be used. It is also a preferable to use a method in which two kinds or more of particles having a monodispersed particle distribution are mixed and used from the viewpoint of controlling the physical properties of the coating liquid.

In the present invention, as a preferable aspect of a polymer capable of being dispersed in an aqueous solvent, hydrophobic polymers such as acryl based polymer, poly (ester), rubbers (e.g., SBR resin), poly (urethane), poly (vinyl chloride), poly (vinyl acetate), poly (vinylidene chloride), poly (olefin) and the like can be preferably used. As these polymers, a polymer having a linear chain, a branched polymer, and a crosslinked polymer may be used, what is called a homopolymer in which a single monomer is polymerized may be used, and a copolymer in which two kinds or more monomers are polymerized may be used. In the case of a copolymer, a random copolymer or a block copolymer may be used.

As a molecular weight of these polymers, it is preferable that it is in the range from 5000 to 1000000 at the number average molecular weight, and it is more preferable that it is in the range from 10000 to 200000. A polymer whose molecular weight is too small is insufficient for dynamical strength of a silver halide emulsion layer, and a polymer whose molecular weight is too large is bad for film forming property and it is not preferable. Moreover, a polymer latex having a crosslinking property is particularly preferably used.

<Concrete Examples of Latex>

As a concrete example of a preferable polymer latex, examples similar to the first aspect in a heat-developable photosensitive material of the present invention (from P-1 to P-16) are listed. Moreover, as concrete examples which are polymer latex, commercially available, and capable of being utilized, examples similar to the first aspect are listed.

These polymer latexes may be singly used, or two species of these may be blended if it is necessary.

<Preferable Latex>

As a polymer latex used in the present invention, particularly a latex of styrene-butadiene copolymer is preferable. It is preferable that the weight ratio of monomer unit of styrene in the styrene-butadiene copolymer and monomer unit of the butadiene is in the range from 40:60 to 95:5. Moreover, it is preferable that the mass ratio of monomer unit of styrene and monomer unit of butadiene occupying the copolymer is in the range from 60 to 99% by mass.

Moreover, it is preferable that a polymer latex of the present invention contains acrylic acid or methacrylic acid in the range from 1 to 6% by mass with respect to the sum of styrene and butadiene, and it is more preferable that it contains these in the range from 2 to 5% by mass. It is preferable that a polymer latex of the present invention contains acrylic acid.

As a latex of styrene-butadiene copolymer preferably used in the present invention, the P-3 through P-8 and 15, and LACSTAR-3307B, 7132C, Nipol Lx 416 and the like are listed.

To the layer containing the organic silver salt of a heat-developable photosensitive material of the present invention, if it is necessary, a hydrophilic polymer such as gelatin, polyvinyl alcohol, methyl cellulose, hydroxypropyl cellulose, carboxymethyl cellulose and the like may be added.

The additive amount of these hydrophilic polymers is preferably 30% by mass or less of the total binders of the layer containing the organic silver salt, and more preferably 20% by mass or less.

As the layer containing the organic silver salt in the present invention (i.e., image formation layer), it is preferable that it is a layer formed using a polymer latex. It is preferable that as the amount of the binder of the layer containing the organic silver salt, it is preferable that the weight ratio of the total binder/organic silver salt is in the range from 1/10 to 10/1, it is more preferable that it is in the range from 1/3 to 5/1, and it is further preferable that it is in the range from 1/1 to 3/1.

Moreover, usually, such a layer containing an organic silver salt is also a photosensitive layer (emulsion layer) in which a photosensitive silver halide, that is, a photosensitive silver salt is contained, in this case, as the weight ratio of the total binders/silver halide, it is preferable to be in the range from 400 to 5, and it is more preferable that it is in the range from 200 to 10.

As the amount of total binders of the image formation layer in the present invention, it is preferable that the amount is in the range from 0.2 to 30 g/m$^2$, and it is more preferable that it is in the range from 1 to 15 g/m$^2$ and it is further preferable that it is in the range from 2 to 10 g/m$^2$.

To the image formation layer in the present invention, a crosslinking agent for crosslinking, a surfactant for improving the coating property, and the like may be added.

<Preferable Solvent of Coating Liquid>

In the present invention, as a solvent of coating liquid for the layer containing an organic silver salt (where for the sake of being simplified, the solvent and the dispersion medium is represented as a solvent collectively), it is preferable that an aqueous solvent containing 30% by mass of water is used.

As components except for water, any water-miscible organic solvent such as methyl alcohol, ethyl alcohol, isopropyl alcohol, methyl Cellosolv, ethyl Cellosolv, dimethylformamide, ethyl acetate and the like may be used. It is preferable that the content of water in a solvent of the coating liquid is 50% by mass or more, and it is more preferable that it is 50% by mass or more.

As a preferable example of a solvent composition, except for water, water/methyl alcohol=90/10, water/methyl alcohol=70/30, water/methyl alcohol/dimethylformamide=80/15/5, water/methyl alcohol/ethyl Cellosolv=85/10/5, water/methyl alcohol/isopropyl alcohol=85/10/5 and the like are listed (the above-described numerical values represent % by mass).

<Antifoggants>

As an antifoggant, stabilizer and stabilizer precursor capable of being employed in the 7th aspect in a heat-developable photosensitive material of the present invention, patented ones described in the paragraph number of [0070] of JP-A No. 10-62899 gazette, in the paragraph from the 57th line of the 20th page to the 7th line of the 21st page of European Patent Publication No. 0803764 A1, compounds described in the official gazette of JP-A No. 09-281637, JP-A No.9-329864, U.S. Pat. No. 06,083,681, U.S. Pat. No. 6,083,681, and European Patent No. 10488975 are listed.

Moreover, as an antifoggant preferably used in the present invention, organic halides are listed, and as these, ones disclosed in the patent specification described in the paragraph numbers of [0111] and [0112] of JP-A No. 11-65021 gazette are listed. Particularly, organic halogen compounds represented by the formula (P) of JP-A No. 2000-284399 gazette, organic polyhalogen compounds represented by the general formula (II) of JP-A No. 10-339934 gazette, and organic polyhalogen compounds described in JP-A No. 2001-31644 and JP-A No. 2001-33911 are preferable.

<Organic Polyhalogen Compound>

Hereinafter, preferable organic polyhalogen compounds in the present invention will be concretely described. The preferable polyhalogen compounds of the present invention are compounds represented by the following general formula (H):

$$Q\text{-}(Y)n\text{-}C(Z_1)(Z_2)X \qquad \text{General formula (H):}$$

In the general formula (H), Q represents an alkyl group, an aryl group or a heterocyclic group, Y represents bivalent linking group, n represents 0 or 1, $Z_1$ and $Z_2$ represent a halogen atom, and X represents a hydrogen atom or an electron withdrawing group.

In the general formula (H), Q represents a phenyl group substituted with an electron withdrawing group in which Hammett substituting group constant σp is preferably a positive value. As the Hammett substituting group constant, Journal of Medicinal Chemistry, 1973, Vol. 16, No. 11, 1207–1216 and the like can be made reference to.

X preferably represents an electron withdrawing group, and more preferably, a halogen atom, a fatty/aryl or heterocyclic sulfonyl group, a fatty/aryl or heterocyclic acyl group, a fatty/aryl or heterocyclic oxycarbonyl group, a carbamoyl group and a sulfamoyl group, and particularly preferably represents the halogen atom. Among the halogen atoms, it preferably represents a chlorine atom, a bromine atom, and an iodine atom, further preferably represents a chlorine atom, a bromine atom, and particularly preferably represents the bromine atom.

Y preferably represents —C(═O)—, —SO— or $SO_2$—, more preferably represents —C(═O)— and —$SO_2$—, and particularly preferably represents —$SO_2$—. N represents 0 or 1, and preferably represents 1.

Hereinafter, concrete examples of the compounds represented by the general formula (H) will be shown.

(H-1)

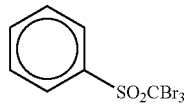

(H-2)

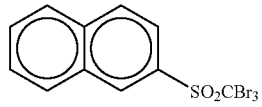

(H-3)

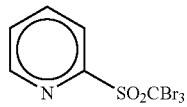

(H-4)

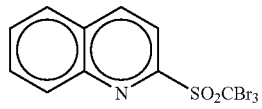

(H-5)

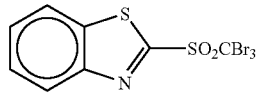

(H-6)

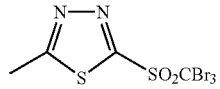

(H-7)

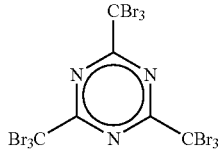

(H-8)

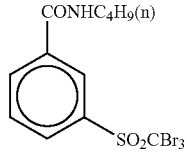

(H-9)

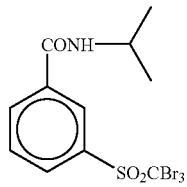

(H-10)

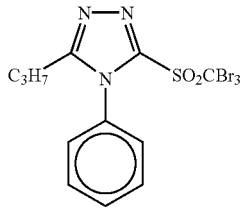

-continued (H-11)

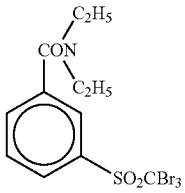

(H-12)

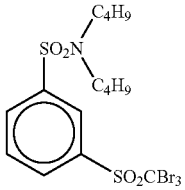

(H-13)

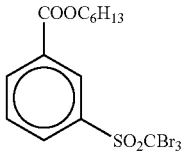

(H-14)

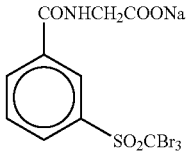

(H-15)

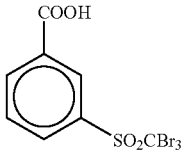

(H-16)

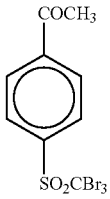

(H-17)

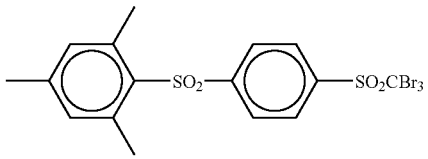

(H-18)

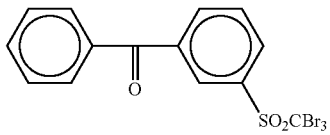

(H-19)

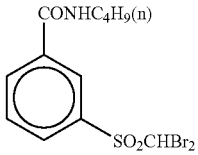

-continued (H-20)

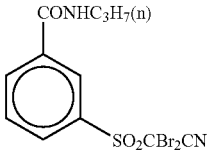

(H-21)

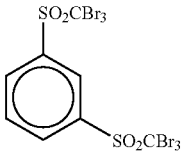

(H-22)

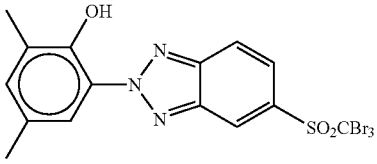

(H-23)

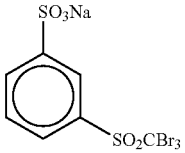

(H-24)

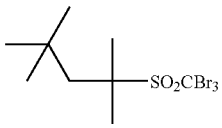

It is preferable that a compound represented by the general formula (H) is used in the range from $10^{-4}$ to 1 mol per each one mole of non-photosensitive silver salt of the image formation layer, it is more preferable that it is used in the range from $10^{-3}$ to 0.5 mol, and it is further preferable that it is used in the range from $1\times10^{-2}$ to 0.2 mol.

In the present invention, as a method of making the photosensitive material contain an antifoggant, methods described in the methods containing reducing agents are listed, as an organic polyhalogen compound, it is preferable that the compound is added as a solid refined particle dispersed matter.

<Other Antifoggants>

As the other antifoggants, antifoggants similar to the first aspect in a heat-developable photosensitive material of the present invention are preferably listed.

A heat-developable photosensitive material in the present invention may contain azolium salt for the purpose of preventing it from being fogged. The description of the azolium salt is similar to the description described in the first aspect in a heat-developable photosensitive material of the present invention.

To the material of the present invention, a mercapto compound, a disulfide compound and a thione compound can be contained in order to suppress or accelerate the development and control the development, in order to enhance the spectral sensitizing efficiency, and in order to enhance the keeping property before and after the development and so on, this has been described in the paragraph numbers of [0067] through [0069] of JP-A No. 10-62899 gazette, in the paragraph numbers of [0033] through [0052]

of JP-A No. 10-186572 gazette as compounds and their concrete examples, and in the paragraph from the 36th line to the 56th line of the 20th page of European Patent Publication No. 0803764 A1. Among these, a mercapto substituted complex aromatic compound is preferable.

<Color Tone Adjuster>

In a heat-developable photosensitive material of the present invention, the addition of a color tone adjuster is preferable, as a color tone adjuster, it has been described in the paragraph numbers of [0054] and [0055] of JP-A No. 10-62899 gazette, in the paragraph from the 23rd line to the 48th line of the 21st page of European Patent Publication No. 0803764 Al, and in the respective specifications of JP-A No. 2000-356317 and Japanese Patent Application No. 2000-187298, phthalazinones; combinations of phthalazinones and phthalic acids; phthalazines; combinations of phthalazines and phthalic acids are preferable, and the combinations of phthalazines and phthalic acids are particularly preferable. Among these, the most preferable combination is the combination of 6-isopropylphthalazine and phthalic acid or 4-methyl phthalic acid.

<Other Additive Agents>

A plasticizer and a lubricant capable of being used for a photosensitive layer of the present invention has been described in the paragraph number of [0117] of Japanese Patent Publication No. 11-65021 gazette, an ultra-high contrast agent for forming an ultra-high contrast image, its method for adding it and its amount have been described in the paragraph number of [0118] of JP-A No. 11-65021 gazette, in the paragraph numbers of [0136] through [0193] of JP-A No. 11-223898 gazette, in the compounds of the formulas (H), formulas (1) through (3), formulas (A) and (B) described in JP-A No. 2000-284399, and in the compounds of the general formulas (III) through (V) (concrete compounds: chemical formula No.21 through chemical formula No.24) described in the specification of Japanese Patent Application No. 11-91652, and a high contrast accelerator has been described in the paragraph number of [0102] of JP-A No. 11-65021 gazette, and in the paragraph numbers of [0194] and [0195] of JP-A No. 11-223898.

In order to use formic acid and formate as a strongly enforcing fogging material, it is preferable that the material is contained on the side having the image formation layer containing a photosensitive silver halide at a ratio of 5 mmol or less per each one mole of silver and it is more preferable that it is contained at a ratio of 1 mmol or less per each one mole of silver.

In a heat-developable photosensitive material of the present invention, in the case where an ultra-high contrast agent is used, it is preferable that acid made by hydration by, that is, the addition of water to, diphosphorus pentaoxide or its salt is used in combination with the agent.

The description on acid made by hydration of diphophrus pentaoxide or its salt is similar to the description described in the first aspect in a heat-developable photosensitive material of the present invention.

As the amount of its use of an acid made by hydration of diphosphorus pentaoxide or its salt (coating amount per 1 $m^2$ of a photosensitive material), although the desired amount is used corresponding to the performances such as the sensitivity, fogging and the like, it is preferable that the amount is in the range from 0.1 to 500 $mg/m^2$, and it is more preferable that it is in the range from 0.5 to 100 $mg/m^2$.

<Layer Configuration>

A heat-developable photosensitive material in the present invention can be provided with a surface protective layer for the purpose of preventing the image formation layer from attaching. The surface protective layer may be a single layer, or may be a plurality of layers. The surface protective layer has been described in the paragraph numbers of [0119] and [0120] of JP-A No. 11-65021 gazette, and in the specification of Japanese Patent Application No.2000-171936.

The description on a binder of the surface protective layer of the present invention is similar to the description in the first aspect in a heat-developable photosensitive material of the present invention.

As polyvinyl alcohol coating amount (per 1 $m^2$ of support) of a surface protective layer (per each one layer), it is preferable that the amount is in the range from 0.3 to 4.0 $g/m^2$, and it is more preferable that it is in the range from 0.3 to 2.0 $g/m^2$.

In the case where a heat-developable photosensitive material of the present invention is used for the printing use in which particularly, the size changing is to be a problem, it is preferable that a polymer latex is used for a surface protective layer and a backing layer.

The description on such a polymer latex is similar to the description described in the first aspect in a heat-developable photosensitive material of the present invention.

Furthermore, as a binder for a surface protective layer, the combinations of polymer latexes described in the specification of Japanese Patent Application No. 11-6872, the technology described in the paragraph numbers of [0021] through [0025] of the specification of Japanese Patent Application No. 11-143058, the technology described in the paragraph numbers of [0027] and [0028] of the specification of Japanese Patent Application No. 11-6872, the technology described in the paragraph numbers of [0023] through [0041] of the specification of Japanese Patent Application No. 10-199626 may be applied.

As the ratio of polymer latex of the surface protective layer, it is preferable that the ratio is in the range from 10% by mass or more to 90% by mass or less of the total binders, and it is particularly preferable that the ratio is in the range from 20% by mass or more to 80% by mass or less of the total binders.

As the coating amount (per 1 $m^2$ of support) of the total binders (including water-soluble polymer and latex polymer) for a surface protective layer (per each layer), it is preferable that the amount is in the range from 0.3 to 5.0 $g/m^2$, and it is more preferable that it is in the range from 0.3 to 2.0 g $/m^2$.

As a temperature for preparation of an image formation layer coating liquid of the present invention, it is preferable that the temperature is in the range from 30° C. or more to 65° C. or less, it is more preferable that it is in the range from 35° C. or more to less than 60° C., and it is further preferable that it is in the range from 35° C. or more to 55° C. or less. Moreover, it is preferable that the temperature of an image formation layer coating liquid immediately after the addition of a polymer latex is maintained in the range from 30° C. or more to 65° C. or less.

An image formation layer of the present invention is configured by one or more layers on a support. In the case where it is configured by one layer, it includes an organic silver salt, a photosensitive silver halide, a reducing agent and a binder, and if it is necessary, it includes the additional materials according to the desire, such as a color tone adjuster, a coating auxiliary agent and the other auxiliary agents.

In the case where it is configured by two or more layers, an organic silver salt and a photosensitive silver halide must be contained in the first image formation layer (usually, a layer adjacent to the support), and some other components must be contained in the second image formation layer or both layers.

As the configuration of a heat-developable photosensitive material for a plurality of colors, it may contain the combinations of these two layers concerning with the respective colors, and it may contain the whole components within a single layer as described in U.S. Pat. No. 4,708,928. In the case of a heat-developable photosensitive material for a plurality of dyes and colors, as described in U.S. Pat. No. 4,460,681, in general, the respective emulsion layers are discriminated from each other and maintained by utilizing a functional or non-functional barrier layer between the respective photosensitive layers.

As a photosensitive layer of the present invention, from the viewpoints of improving the color tone, preventing the interference stripes from being generated at the time of exposure to the laser beam, and preventing the irradiation, a variety of dyes and pigments (e.g., C. I. Pigment Blue 60,C.I. Pigment Blue 64, C. I. Pigment Blue 15:6) can be employed. These have been described in detail in WO98/36322, JP-A No. 10-268465, and JP-A No. 11-338098.

In a heat-developable photosensitive material of the present invention, an antihalation layer can be provided against the photosensitive layer on the far side from the light source.

A heat-developable photosensitive material has, in general, a non-photosensitive layer in addition to a photosensitive layer. As non-photosensitive layers, these layers can be classified into (1) a protective layer provided above the photosensitive layer (on far side rather than the support), (2) an intermediate layer provided between a plurality of photosensitive layers and between a photosensitive layer and a protective layer, (3) an undercoat layer provided between a photosensitive layer and a support, and (4) a backing layer provided on the opposite side of a photosensitive layer, from the respective positions of the arrangement. A filter layer is provided on a photosensitive material as a layer of (1) or (2). An antihalation layer is provided on a photosensitive material as a layer of (3) or (4).

Antihalation layers have been described in the paragraph numbers of [0123] and [0124] of JP-A No. 11-65021 gazette, in the official gazette of JP-A No. 11-223898, JP-A No. 09-230531, JP-A No. 10-36695, JP-A No. 10-104779, JP-A No. 11-231457, JP-A No. 11-352625, and JP-A No. 11-352626 and the like.

The antihalation layer contains an antihalation dye having an absorbance at the exposure wavelength. In the case where the wavelength is in the infrared region, an infrared ray absorption dye may be employed, and in this case, it is preferable that a dye not having an absorbance in the visible region is used.

In the case where an antihalation is performed by utilizing a dye having an absorbance in the visible region, it is preferable so that the color of the dye does not substantially remain after the image formation, it is preferable that the means for decoloring by the heat of heat-developing is employed, and it is particularly preferable that a non-photosensitive layer is made function as an antihalation layer by adding thermally decoloring dye and a base precursor to the non-photosensitive layer. These technologies have been described in JP-A No. 11-231457 gazette and the like.

The additive amount of the decoloring dye is determined depending on the use of the dye. In general, such an amount that is required by an optical density (absorbance) exceeding over 0.1 at the time when the optical density is measured at the wavelength of the object is used. It is preferable that the optical density is in the range from 0.5 to 2, more preferably, 0.2 to 1. The usage amount of a dye for obtaining such an optical density is, in general, in the range from about 0.001 to about 1 $g/m^2$.

Note that when thus decoloring a dye, the optical density after the heat-development can be lowered to be 0.1 or less. Two kinds of decoloring dyes may be used in combination with a thermally decoloring type recording material and a heat-developable photosensitive material. Similarly, two kinds or more of base precursors may be used in combination.

In a thermally decoloring using such decoloring dyes and base precursors, it is preferable that a material (e.g., diphenyl sulfone, 4-chlorophenyl (phenyl) sulfone) for lowering the melting point by 3° C.(degrees) or more by blending it with a base precursor as described in JP-A No. 11-352626 gazette and 2-naphtylbenzoate are used in combination from the viewpoints of thermally decoloring property and the like.

In the present invention, a coloring agent having the absorption maximum at 300 nm-450 nm can be added for the purpose of improving the silver tone and time period changing of an image. These coloring agents have been described in the official gazette of JP-A No. 62-210458, JP-A No. 63-104046, JP-A No. 63-103235, JP-A No. 63-208846, JP-A No. 63-306436, JP-A No. 63-314535, JP-A No. 01-61745, and JP-A No. 2001-100363 and the like.

These coloring agents are usually added in the range from 0.1 $mg/m^2$ to 1 $g/m^2$, and it is preferable that a layer to which the agent is added is the backing layer provided on the opposite side of the photosensitive layer.

It is preferable that a heat-developable photosensitive material in the present invention is what is called a one-side photosensitive material having at least one photosensitive layer containing photosensitive silver halide emulsion on one side of the support, and having a backing layer on the other side.

In the present invention, it is preferable that a matting agent is added in order to improve the conveyance, matting agents have been described in the paragraph numbers of [0126] and [0127] of JP-A No. 11-65021 gazette. When the amount of a matting agent is indicated by the coating amount per 1 $m^2$ of the photosensitive material, it is preferable that the coating amount of a matting agent is in the range from 1 to 400 $mg/m^2$, and it is more preferable that it is in the range from 5 to 300 $mg/m^2$.

In the present invention, a shape of a matting agent may be either a typical form or an a typical form, it is preferable that a typical spherical form is preferably used. As average particle diameter, it is preferable that it is in the range from 0.5 to 10 μm, it is more preferable that it is in the range from 1.0 to 8.0 μm, and it is further preferable that it is in the range from 2.0 to 6.0 μm.

Moreover, as a variation coefficient of the size distribution, it is preferable that it is 50% or less, it is more preferable that it is 40% or less, and it is further particularly preferable that it is 30% or less. Here, the variation coefficient means a value represented by the expression (standard deviation of particle diameter)/(average value of particle diameter)×100. Moreover, it is also preferable that two species of matting agents having a small variation coefficient and whose ratio of the particle diameter is more than 3 are used in combination.

Moreover, any matting degree of an emulsion surface may be employed unless a stardust failure is generated, it is preferable that Beck smoothness of it is in the range from 30 seconds or more to 2000 seconds or less, and it is particularly preferable that it is in the range from 40 seconds to 1500 seconds. A Beck smoothness can be easily found according to Japanese Industrial Standards (JIS) P8119 "Smoothness Test Method for Paper and Board by Beck Testing Device" and TAPPI standard method T479.

In the present invention, as a mat degree of the backing layer, it is preferable that the Beck smoothness is in the range from 1200 seconds or less to 10 seconds or more, it is preferable that it is in the range from 800 seconds or less to 20 seconds or more, and it is further preferable that it is in the range from 500 seconds or less to 40 seconds or more.

In the present invention, it is preferable that a matting agent is contained in the outermost surface layer or a layer functioning as the outermost surface layer of the photosensitive material or in a layer close to the outer surface, and in a layer acting as what is called a protective layer.

A backing layer capable of being applied to the present invention has been described in the paragraph numbers of [0128] through [0130] of JP-A No. 11-65021 gazette.

As a heat-developable photosensitive material of the present invention, it is preferable that pH of layer surface prior to the heat-developing processing is 7.0 or less, and it is more preferable that it is 6.6 or less. As its lowest limit, there are no particular limitations, but it is about 3. The most preferable range of pH is in the range from 4 to 6.2. For adjusting pH of a layer surface, it is preferable from the viewpoint of reducing the pH of the layer surface that an organic acid such as phthalic acid derivative or the like, a nonvolatile acid such as sulfuric acid or the like, and a volatile base such as ammonia or the like are used. It is particularly preferable to use ammonia for achieving the lower pH layer surface since ammonia readily volatiles and it can be removed prior to the step of coating and the step of heat-developing.

Moreover, it is preferable that non-volatile base such as sodium hydroxide, potassium hydroxide and lithium hydroxide and ammonia are used in combination. Note that a method for measuring a pH of layer surface has been described in the paragraph number of [0123] of the specification of Japanese Patent Application No. 11-87297.

A hardening agent may be used in the respective layers such as a photosensitive layer, a protective layer, a backing layer and the like of the present invention. The description on the hardening agent is similar to the description described in the first aspect in a heat-developable photosensitive material of the present invention.

The description on the surfactant capable of being applied to the present invention is also similar to the description described in the first aspect in a heat-developable photosensitive material of the present invention.

It is preferable that the present invention has an electrically conductive layer containing a metal oxide. As an electrically conductive material used for an electrically conductive layer, it is preferable that a metal oxide is used in order to enhance the electrical conductivity by introducing an oxygen deficiency, dissimilar metal atom into a metal oxide.

As an example of a metal oxide, ZnO, $TiO_2$ and $Sno_2$ are preferable, and the addition of Al, In with respect to $ZnO_2$, the addition of Sb, Nb, P, a halogen atom and the like with respect to $SnO_2$, the addition of Nb, Ta and the like with respect to $TiO_2$ are preferable. Particularly, $SnO_2$ to which Sb is added is preferable.

It is preferable that the additive amount of dissimilar atom is in the range from 0.01 to 30% by mol, and it is more preferable that it is in the range from 0.1 to 10% by mol. As a shape of a metal oxide may be any of a spherical shape, a needle shape, a tubular shape, however, from the viewpoint of the effectiveness for giving an electrically conductivity, major axis/minor axis ratio is 2.0 or more and it is preferable that it is in the range from 3.0 to 50 and the metal oxide is in a needle shape.

The usage amount of a metal oxide is preferably in the range from 1 mg/$m^2$ to 1000 mg /$m^2$, it is more preferable that it is in the range from 10 mg/$m^2$ to 500 mg/$m^2$, and it is further preferable that it is in the range from 20 mg/$m^2$ to 200 mg/$m^2$. As an electrically conductive layer of the present invention, it may be provided and set either on the side of the emulsion surface or on the side of the backing surface, however, it is preferable that it is provided and set between the support and the backing layer. Concrete examples of electrically conductive layers of the present invention have been described in JP-A No. 07-295146 and JP-A No. 11-223901.

In the present invention, it is preferable that a fluorine based surfactant is used. As concrete examples of fluorine based surfactants, compounds described in JP-A No. 10-197985, JP-A No. 2000-19680, JP-A No. 2000-214554 and the like are listed. Moreover, it is also preferable that polymer fluorine based surfactants described in JP-A No. 09-281636 is used. In the present invention, it is particularly preferable that fluorine based surfactants described in JP-A No. 2000-206560 are used.

<Supports>

As a transparent support used, in order to relax the interior distortion remained in the film at the time when the film is biaxially oriented and in order to null the distortion by heat shrinkage generated during the heat-developing processing, a polyester to which the heat-developing processing is provided in the range of the temperature from 130 to 185° C., particularly a poly (ethylene terephthalate) (PET) is preferably used. In the case of a heat-developable photosensitive material for medical use, a transparent support may be colored with a blue dye (e.g., Dye-1 described in Example of JP-A No. 08-240877), or may be colorless.

To a support, it is preferable to apply an undercoat technology such as water-soluble polyesters described in JP-A No. 11-84574 gazette, styrene-butadiene copolymers described in JP-A No. 10-186565 gazette, and vinylidene chloride copolymers described in JP-A No.2000-39684 gazette and in the paragraph numbers of [0063] through [0080] of Japanese Patent Application No. 11-106881. Moreover, as an antistatic layer or an undercoat, the technologies described in JP-A No. 56-143430 gazette, JP-A No. 56-143431 gazette, JP-A No. 58-62646 gazette, JP-A No. 56-120519 gazette, the paragraph numbers of [0040] through [0051] of JP-A No. 11-84573 gazette, U.S. Pat. No. 5,575,957, and the paragraph numbers of [0078] through [0084] of JP-A No. 11-223898 gazette can be applied.

To a heat-developable photosensitive material of the present invention, further, an antioxidant, a stabilizer, a plasticizer, an ultraviolet ray absorbing agent or a coating auxiliary agent may be added. A variety of additive agents are added to either of a photosensitive layer or a non-photosensitive layer. These can be made reference to WO 98/36322, EP803764 A1, JP-A No. 10-186567, JP-A No. 10-18568 and the like.

It is preferable that a heat-developable photosensitive material is a mono-sheet type (type in which an image can be formed on the heat-developable photosensitive material without utilizing the other sheet like a receiving image material).

<Preparation of Heat-developable Photosensitive Material>

A heat-developable photosensitive material in the present invention may be coated by any method. The description on concrete coating method is similar to the description described in the first aspect in a heat-developable photosensitive material of the present invention.

It is preferable that a coating liquid for a layer containing an organic sliver salt in the present invention is what is called a thixotropy fluid. As this technology, one can make reference to JP-A No. 11-52509 gazette.

As to a coating liquid for a layer containing an organic silver salt in the present invention, it is preferable that its viscosity at 0.1 $S^{-1}$ of shearing speed is in the range from 400 mPa·s or more to 100,000 mPa·s or less, and it is more preferable that it is in the range from 500 mPa·s or more to 20,000 mPa·s or less.

Moreover, at 1000$S^{-1}$ of shearing speed, it is preferable that its viscosity is in the range from 1 mPa·s or more to 200 mPa·s or less, and it is further preferable that it is in the range from 5 mPa·s or more to 80 mPa·s or less.

As technologies capable of being used for a heat-developable photosensitive material of the present invention, technologies similar to those of the first aspect in a heat-developable photosensitive material of the present invention are listed.

<Wrapping Materials>

In order to suppress the variation of the photographic properties during the storing, or in order to improve the curl, imperfect winding and the like, it is preferable that a photosensitive material of the present invention is wrapped with a wrapping material having a low oxygen permeability and/or water permeability.

It is preferable that the oxygen permeability is in 50 ml/atm·$m^2$·day or less at 25° C., and it is more preferable that it is 10 ml/atm·$m^2$·day or less, and it is further preferable that it is 1.0 ml/atm·$m^2$·day or less. It is preferable that water permeability is 10 g/atm·$m^2$·day or less, it is more preferable that it is 5 g/atm·$m^2$·day or less, and it is further preferable that it is 1 g/atm·$m^2$·day or less.

As concrete examples of wrapping materials having the oxygen permeability and/or water permeability, for example, wrapping materials described in the specifications of JP-A No. 08-254793 and JP-A No.2000-206653 are listed.

<Image Formation Using Heat-developable Photosensitive Material>

Although a heat-developable photosensitive material of the present invention may be developed by any method, usually, it is developed by raising the temperature of the heat-developable photosensitive material exposed in an image-wise. As a temperature of development, it is preferable that the temperature is in the range from 80 to 250° C., it is more preferable that it is in the range from 100 to 140° C., and it is further preferable that it is in the range from 110 to 130° C.

As a developing time, it is preferable that the developing time is in the range from 1 to 60 seconds, it is more preferable that the developing time is in the range from 3 to 30 seconds, it is further preferable that the developing time is in the range from 5 to 25 seconds and it is particularly preferable that the developing time is in the range from 7 to 15 seconds.

As a method of heat-development, either a drum type heater or a plate type heater method is preferably used, however, the plate heater method is more preferably used. Among a method of heat-development using a plate heater method, a method described in JP-A No. 11-133572 gazette is preferably used, this is a heat-development apparatus for obtaining a visible image by bringing the heat-developable photosensitive material whose latent image has been formed into contact with a heating means in a heat development section, the heating means including a plate-heater, and a plurality of pieces of presser rollers being provided and arranged in an opposing manner along one surface of the plate-heater, and the heat-development being carried out by making the heat-developable photosensitive material pass through between the presser roller and the plate-heater. The plate heater is preferably divided into two to six sections in a stepwise manner and it is preferable that its tip section should be cooled down by about 1–10° C.

For example using four pairs of plate-heaters capable of independently controlling the temperature, an example in which the respective plate-heaters are controlled so as to be 112° C., 119° C., 121° C., and 120° C. is listed.

These methods have been also described in JP-A No. 54-30032, water and organic solvents contained in the heat-developable photosensitive material can be removed to the exterior of the system and can also suppress the change of the support shape of the heat-developable photosensitive material by rapidly heating the heat-developable photosensitive material.

The photosensitive material of the invention may be exposed to light by any methods, however, as a light source of exposure, laser beam is preferred. As a laser beam of the present invention, the beam similar to that of the first aspect in a heat-developable photosensitive material of the present invention is listed.

As a laser imager for medical use equipped with an exposure section and a heat-development section, Fuji Medical dry laser imager FM-DP L can be listed.

Concerning with FM-DP L, the references have been described in Fuji Medical Review No.8, pp.39–55, needless to say, these technologies are applied as technologies for a laser imager of a heat-developable photosensitive material of the present invention. Moreover, as a heat-developable photosensitive material for a laser imager in the "AD network" proposed by Fuji Medical System, which is a network system adapted to DICOM standards, it can be also applied.

It is preferable that a heat-developable photosensitive material of the present invention, which forms a black and white image due to a silver image, is used as a heat-developable photosensitive material for medical diagnosis, a heat-developable photosensitive material for industrial photograph, a heat-developable photosensitive material for printing, and a heat-developable photosensitive material for COM.

EXAMPLES

Hereinafter, the present invention will be described in a concrete manner by Examples, however, the present invention is not limited to these.

Example 1

[Preparation of PET Support]

PET having an inherent viscosity IV=0.66 (measured in phenol/tetrachlorethane=6/4 (mass ratio) at 25° C.) was obtained using terephthalic acid and ethylene glycol according to the conventional method. After this was pelleted, it was dried at 130° C. for 4 hours, rapidly cooled down by intruding it from a T-type die after melting at 300° C., a non-oriented film was prepared so that the film have a film thickness of 175 μm after the heat-fixation.

This was oriented in 3.3-fold in a longitudinal direction using roller having different circumferential speeds, subsequently, the orientation was carried out in 4.5-fold in a traverse direction by a tentor. The temperatures at these times are 110° C. and 130° C., respectively. Subsequently, after it was thermally fixed at 240° C. for 20 seconds, 4% in a traverse direction were relaxed at the same temperature as the above-described. Subsequently, after the chuck section of the tentor was slitted, the processing was performed at both ends, wound up at 4 kg/cm$^2$(4×10$^4$ Pa), a roll having a thickness of 175 μm was obtained.

[Surface Corona Treatment]

Using a solid state corona treatment apparatus 6KVA model made by Pillard, Co., Ltd., both surfaces of the support were treated for 20 m/min. at room temperature. It was understood that a treatment of 0.375 kV·A·min./m$^2$ was performed with respect to the support from the read values concerning with current and voltage at this time. The treating frequency at this time was 9.6 kHz, and the gap clearance between the electrode and the dielectric roll was 1.6 mm.

[Preparation of undercoat support]
<Preparation of undercoat layer coating liquid>

| Formulation 1-(1)(for undercoat layer on photosensitive layer side) | |
|---|---|
| Pesresin A-515GB (30% by mass solution) made by Takamatsu fatts and oils, Co., Ltd. | 234 g |
| polyethylene glycol monononylphenyethyl (Average ethylene oxide number = 8.5) 10% by mass solution | 21.5 g |
| MP-1000 made by Soken Chemical, Co., Ltd. (polymer refined particle, average particle diameter 0.4 μm) | 0.91 g |
| distilled water | 744 ml |
| **Formulation 1-(2) (used for backing surface first layer)** | |
| styrene-butadiene copolymer latex (Solid portion 40% by mass, styrene/butadiene mass ratio = 68/32) | 158 g |
| 2,4-dichloro-6-hydroxy-S-triazine sodium salt 8% by mass aqueous solution | 20 g |
| 1% by mass aqueous solution of sodium laurylbenzenesulfonate | 10 ml |
| distilled water | 854 ml |
| **Formulation 1-(3)(used for backing surface side second layer)** | |
| $SnO_2$/SbO (9/1 mass ratio, average particle diameter 0.38 μm, 17% by mass dispersed matter) | 84 g |
| gelatin (10% by mass aqueous solution) | 89.2 g |
| Methorse TC-5 made by Shinetsu Chemical, Co., Ltd. (2% by mass aqueous solution) | 8.6 g |
| MP-1000 made by Soken Chemical, Co., Ltd. | 0.01 g |
| 1% by mass aqueous solution of sodium dodecyl benzene-sulfonate | 10 ml |
| NaOH (1% by mass) | 6 ml |
| proxell (made by ICI, Co., Ltd.) | 1 ml |
| distilled water | 805 ml |

<Preparation of Undercoat Support>

After each of both surfaces of biaxial oriented polyethylene terephthalate support having a thickness of the above-described 175 μm was provided with the above-described corona discharging treatment, the above-described undercoat coating liquid formulation 1-(1) is coated on one surface (photosensitive layer surface) so that wet coating amount becomes 6.6 ml/m$^2$ (per one surface) by a wire bar, dried at 180° C. for 5 minutes, subsequently, on this reverse face (backing surface), the above-described undercoat coating liquid formulation 1-(2) was coated so that wet coating amount becomes 5.7 ml/m$^2$ by a wire bar, dried at 180° C. for 5 minutes, further on the reverse face (backing surface), the above-described undercoat coating liquid formulation 1-(3) was coated so that wet coating amount becomes 7.7 ml/m$^2$ by a wire bar, dried at 180° C. for 6 minutes, then an undercoat support was prepared.

[Preparing of Backing Surface Coating Liquid]

<Preparation of Solid Particle Refined Dispersion Liquid (a) of Base Precursor>

64 g of a base precursor compound 11, 28 g of diphenylsulfone and 10 g of surfactant Demole N made by Kao, Inc., were mixed with 220 ml of distilled water, the mixture was beads-dispersed using a sand mill (¼ Gallon sand grinder mill, Imex, Co., Ltd.), a solid refined dispersion liquid (a) of a base precursor compound having the average particle diameter 0.2 μm was obtained.

<Preparation of Dyeing Solid Refined Particle Dispersion Liquid>

9.6 g of a cyanine dyeing compound 13, and 5.8 g of p-sodium dodecy benzenesulfonate were mixed with 305 ml of distilled water, the mixture was beads-dispersed using the sand mill (¼ gallon sand grinder mill made by Imex, Co., Ltd.), and a dispersion liquid of a dyeing solid refined particle having 0.2 μm of average particle diameter was obtained.

<Preparation of Coating Liquid for Antihalation Layer>

17 g of gelatin, 9.6 g of polyacrylamide, 70 g of a dispersing liquid (a) of a solid refined particle of the above-described base precursor, 56 g of a dispersion liquid of the above-described dyeing solid refined particle, 1.5 g of monodispersed polymethylmethacrylate refined particle (average particle size 8 μm, standard deviation of particle diameter 0.4), 0.03 g of benzoisothiazolinone, 2.2 g of polyethylene sodium sulfonate, 0.2 g of a blue dyeing compound 14, 3.9 g of a yellow dyeing compound 15, and 844 ml of water were mixed, and a coating liquid for antihalation layer was prepared.

<Preparation of Coating Liquid for Backing Surface Protective Layer>

The container was maintained at 40° C., 50 g of gelatin, 0.2 g of sodium polystyrene sulfonate, 2.4 g of N,N-ethylene bis (vinylsulfone acetoamide), 1 g of t-octylphenoxyethoxyethane sodium sulfonate, 30 mg of benzoisothiazolinone, 37 mg of fluorine based surfactant (F-1: N-perfluorooctylsulfonyl-N-propylalanine potassium salt), 0.15 g of fluorine based surfactant (F-2: polyethylene glycol mono (N-perfluorooctylsulfonyl-N-propyl-2-aminoethyl) ether [15 of ethyleneoxide average degree of polyerization]), 64 mg of a fluorine based surfactant (F-3), 32 mg of a florine based surfactant (F-4), 8.8 g of an acrlic acid/ethylacrylate copolymer (mass ratio of copolymerization: 5/95), 0.6 g of aerozole OT (made by American Cyanamide, Co., Ltd.), 1.8 g of liquid paraffin emulsified matter as a liquid paraffin, and 950 ml of water were mixed, and it was made as a coating liquid for a backing surface protective layer.

[Preparation of the Respective Components Contained in Coating Liquid of Emulsion Layer]

<Silver Halide Emulsion>

<<Preparation of Silver Halide Emulsion 1>>

3.1 ml of 1% by mass potassium bromide solution was added to 142 ml of distilled water, and further, the liquid to which 3.5 ml of sulfuric acid at 0.5 mol/L concentration, 31.7 g of gelatin phthalate were added was maintained at 30° C. of liquid temperature while agitating the liquid in a stainless made reaction pot, a 95.4 ml of solution A into which 22.22 g of silver nitrate was diluted by adding distilled water, and 97.4 ml of a solution B into which 15.3 g of potassium bromide and 0.8 g of potassium iodide were diluted by adding distilled water were added in total amount for 45 seconds at a certain flow rate. Subsequently, 10 ml of hydrogen peroxide aqueous solution of 3.5% by mass was added, and further, 10.8 ml of benzoimidazole of 10% by mass was added. Furthermore, as 317.5 ml of a solution C into which 51.86 g of silver nitrate was diluted by adding distilled water, and 400 ml volume of a solution d into which 44.2 g of potassium bromide and 2.2 g of potassium iodide were diluted by adding distilled water, the solution C was added in total amount for 20 minutes at a certain flow rate, the solution D was added while maintaining pAg at 8.1 by a controlled double jet method. 6-iridium chloride (III) acid potassium salt was added in total amount so that it becomes $1\times10^{-4}$ mol per each 1 mol of silver at the time when 10 minutes passed after the solution C and the solution D were begun to be added. Moreover, at the time when 5 seconds passed after the solution C was terminated for being added, $3\times10^{-4}$ mol per each 1 mole of silver of potassium iron (II) 6-cyanide aqueous solution was added in total amount. The pH was adjusted into 3.8 using sulfuric acid of 0.5 mol/L concentration, the agitation was stopped, precipitation/desalting/water washing steps were performed. Using sodium hydroxide of 1 mol/L concentration, the pH was adjusted into pH 5.9, and a silver halide dispersed matter of pAg 8.0 was prepared.

The above-described silver halide dispersed matter was maintained at 38° C. while it was agitated, 5 ml of methanol solution of 1,2-benzoisothiazoline-3-on of 0.34% by mass was added, after 40 minutes, the methanol solution at the molar ratio of a spectral sensitizing pigment A and a spectral sensitizing pigment B of $1.2\times10^{-3}$ mol per each 1 mol of silver as the total of spectral sensitizing pigment A and a spectral sensitizing pigment B was added, after 1 minute, raised to 47° C. At the time when 20 minutes passed after raising the temperature, $7.6\times10^{-5}$ mol of sodium benzenethiosulfonate was added with methanol solution with respect to 1 mole of silver, and further, at the time when 5 minutes passed after that, $2.9\times10^{-4}$ mol per each 1 mol of silver tellurium sensitizing agent C with methanol solution was added, and maturated for 91 minutes. 1.3 ml of methanol solution of N,N'-dihydroxy-N"-diethylmelamine of 0.8% by mass was added, and further after 4 minutes, the silver halide emulsion 1 was prepared by adding $4.8\times10^{-3}$ mol per each 1 mole of silver of 5-methyl-2-mercaptobenzimidazole in methanol solution and $5.4\times10^{-3}$ mol per each 1 mole of silver of 1-phenyl-2-heptyl-5-mercapto-1,3,4-triazole in methanol solution.

The prepared particle in silver halide emulsion was a silver iodine bromide particle having 0.042 μm of the average sphere-equivalent diameter and uniformly containing iodine of 3.5% by mol containing iodine of the variation coefficient of the sphere-equivalent diameter. The particle size and the like were found from the average of 1000 pieces of particles using an electron microscope. The {100} face ratio of this particle was found as 80% using Kubelka-Munk method.

<<Preparation of Silver Halide Emulsion 2>>

Except that the liquid temperature of 30° C. at the time when the particle wasmed was changed to 47° C., the solution B was changed to a volume of 97.4 ml into which 15.9 g of potassium bromide was diluted by distilled water, the solution D was changed to a volume of 400 ml into which 45.8 g of potassium bromide was distilled by distilled water, the additive time of the solution C was changed to 30 minutes, and potassium 6-cyano iron (II) was removed, the preparation of the silver halide emulsion 2 was performed similarly to the preparation of the silver halide emulsion 1. A precipitation/desalting/washing with water/dispersion were performed similarly to the silver halide emulsion 1. Furthermore, except that the additive amount of the spectral sensitizing pigment A and the spectral sensitizing pigment B in total at the molar ratio of 1:1 in methanol solution was changed to $7.5\times10^{-4}$ mol, the additive amount of the tellurium sensitizing pigment C was changed to $1.1\times10^{-4}$ mol per each 1 mole of silver, the additive amount of 1-phenyl-2-heptyl-5-mercapto-1,3,4-triazole was changed to $3.3\times10^{-3}$ mol with respect to 1 mol of silver, similarly to the preparation of the silver halide, the additions of the spectral sensitizing pigments, chemical sensitizing agents and 5-methyl-2-mercaptobenzimidazole, 1-phenyl-2-heptyl-5-mercapto-1,3,4-triazole were performed, and the silver halide emulsion 2 was obtained. The emulsion particle of the silver halide emulsion 2 was a pure silver bromide cubic particle having 0.080 μm of the average sphere-equivalent diameter and 20% of variation coefficient of the sphere-equivalent diameter.

<<Preparation of Silver Halide Emulsion 3>>

Except that the liquid temperature 30° C. at the time when the particle wasmed was changed to 27° C., the preparation of the silver halide emulsion 3 was performed similarly to the preparation of the silver halide emulsion. Moreover, the precipitation/desalting/washing with water/dispersion were performed similarly to the preparation of the silver halide emulsion 1. Except that the additive amount of the solid dispersed matter at the molar ratio of the spectral sensitizing pigment A and the spectral sensitizing pigment B was changed to $6\times10^{-3}$ mol as the total of the spectral sensitizing pigment A and the spectral sensitizing pigment B per each 1 mole of silver, the additive amount of the tellurium sensitizing agent C was changed to $5.2\times10^{-4}$ mol per each 1 mole of silver, the silver halide emulsion 3 was obtained similarly to the preparation of the silver halide emulsion 1. The emulsion particle of the silver halide emulsion 3 was an iodine silver bromide particle having 0.034 μm of the average sphere-equivalent diameter and uniformly containing iodine of 3.5% by mol of 20% variation coefficient of the sphere-equivalent diameter.

<<Preparation of Silver Halide Mixed Emulsion A for Coating Liquid>>

The silver halide emulsion 1 of 70% by mass, the silver halide emulsion 2 of 15% by mass, the silver halide emulsion 3 of 15% by mass were dissolved, $7\times10^{-3}$ mol per each 1 mole of silver of benzothiazolium iodide in aqueous solution of 1% by mass was added. Furthermore, water was added so that the content of silver halide per each 1 kg of silver halide mixed emulsion for coating liquid becomes 38.2 g as silver.

<Preparation of Organic Silver Salt Dispersed Matters A through G>

To make composition in Table 1, 258.5 mol of an organic acid, 423 L of distilled water, 49.2 L of NaOH aqueous solution of 5 mol/L concentration, and 120 L of tert-butanol were mixed, agitated at 75° C. for 1 hour and reacted, then, sodium organic acid ester solution was obtained. Separately, 40.4 kg of silver nitrate in 206.2 L of aqueous solution (pH 4.0) was prepared, maintained at the temperature of 10° C. A reactive container in which 635 L of distilled water and 30 L of tert-butanol were inputted was maintained at the temperature of 30° C., while sufficiently agitating it, the total amount of the above-described sodium organic acid ester solution and the total amount of silver nitrate aqueous solution were added at a certain flow rate for 93 minutes and 15 seconds and for 90 minutes, respectively. At this time, it was made so that only silver nitrate aqueous solution was added for 11 minutes after the addition of silver nitrate aqueous solution was initiated, after that, the addition of the sodium organic acid ester was initiated, and after the termination of the addition of silver nitrate aqueous solution, for 14 minutes and 15 seconds, only the sodium organic acid ester was added. At this time, the reaction temperature within the reactive container was made the temperature of Table 1, and for maintaining the liquid temperature at a certain temperature, the outside temperature was controlled. Moreover, the temperature of the piping of addition system of sodium organic acid salt solution was maintained by the double pipings, controlled so that the liquid temperature at the outlet of the tip end of the addition nozzle is 75° C. Moreover, the temperature of the piping of additive system of silver nitrate aqueous solution was maintained by circulating the cooling water on the outside of the double pipings. The additive position of the sodium organic acid ester solution and the additive position of silver nitrate aqueous solution were arranged in a symmetrical manner by making the agitating axis as center, and adjusted to the height not so as to contact with the reactive solution.

<Maturation/Centrifuge Filtration>>

After the addition of sodium organic acid ester was terminated, agitated and left for 20 minutes at the temperature as it was, the temperature was raised to 35° C. for 35 minutes, subsequently, the maturation was performed for 210 minutes. Immediately after the termination of the maturation, the solid content was filtered off by centrifuge filtration, and the solid content was washed with water until the conductivity of the filtering water became 30 μS/cm. At that time, in order to promote the lowering of the conductivity, the operations in which wet cake was made in a slurry shape by adding purewater to the wet cake were repeated 3 times. The obtained wet cake of the organic silver was centrifuged out at 700× g centrifuge. Note that G is represented by $1.119\times10^{-5}\times$radius (cm) of the container x speed of rotation (rpm)$^2$. The content of the solid content of the organic silver wet cake thus obtained (1 g of wet cake was dried at 110° C. for 2 hours and measured) was 44%.

<<Preliminary Dispersion>>

19.3 kg of polyvinyl alcohol (trade name: PVA-217) and water were added with respect to a wet cake corresponding to 260 kg of the dried solid content, after the total amount was made to be 1000 kg, it was made in a slurry state by dissolver feathers, and further, the preliminary dispersion was performed by the pipe line mixer (made by Mizuho Industry, Co., Ltd.: PM-10 type).

<<Final Dispersion>>

Next, the stock solution already preliminary dispersed was treated 3 times by adjusting the pressure of the dispersing machine (trade name: Microfluidizer M-610, made by Microfluidex International Corporation, using Z type interaction chamber) to 1260 kg/cm$^2$ (12.6 MPa), and an organic silver salt dispersed matter (silver behenate dispersed matter) was obtained. The characteristic value of shape of the dispersed matter was identical with that after the washing with water. As the cooling operation, hose type heat exchangers were mounted in front and on back of the interaction chamber, the dispersion temperature of 18° C. was set by adjusting the temperature of the coolant.

As the organic silver salt particle contained in the organic silver salt dispersed matters A through G thus obtained, the volume-weighted average diameter (sphere-equivalent diameter), the variation coefficient of volume addition average diameter (sphere-equivalent diameter) were as those of Table 1. The measurement of the particle size was preformed by Master Sizer X, made by Malvern Instruments, Ltd.

TABLE 1

| Organic silver salt dispersed matters | Content (%) Silver behenate | Content (%) Silver stearate | Reaction temperature (° C.) | Sphere-equivalent diameter (μm) | Variation coefficient (%) | Slenderness ratio |
|---|---|---|---|---|---|---|
| A | 93 | 2 | 30 | 0.48 | 14 | 1.5 |
| B | 91.5 | 0.5 | 30 | 0.48 | 13.5 | 1.7 |
| C | 96 | 0 | 30 | 0.42 | 12 | 1.1 |
| D | 98 | 0 | 30 | 0.4 | 11 | 1 |
| E | 88 | 1.5 | 30 | 0.5 | 16 | 4 |
| F | 98 | 0 | 45 | 0.55 | 18 | 8 |
| G | 98 | 0 | 65 | 1.1 | 22 | 12 |

<Preparation of Reducing Agent Dispersed Matter or Reducing Agent Complex Dispersed Matter>

<<Preparation of Reducing Agent Dispersed Matter>>

16 kg of water was added to 10 kg of a reducing agent (as described elsewhere) and 10 kg in total of the denatured polyvinyl alcohol (Poval MP203; made by Kuraray, Co., Ltd.) of 20% by mass in an aqueous solution, these were mixed well, and made it in a slurry state. This slurry was sent by a diaphragm pump, after it was dispersed for 3 hours and 30 minutes in a horizontal type sand mill (UVM-2: Imex, Co., Ltd.) filled with zirconia beads having the average diameter of 0.5 mm, adjusted it so that the concentration of the reducing agent became 25% by mass by adding benzoisothiazolinone sodium salt 0.2 g and water, and the reducing agent dispersed matter was obtained.

The reducing agent particle contained in the reducing agent dispersed matter thus obtained was a particle having 0.42 μm of median diameter and 2.0 μm of the maximum particle diameter. The reducing agent dispersed matter obtained was subjected to the filtration through a filter made of polypropylene having the hole diameter of 10.0 μm, the foreign matters such as rubbish and the like were removed and stored.

<<Preparation of Reducing Agent Complex Dispersed Matter>>

7.2 kg of water was added to 10 kg of reducing agent complex (as described elsewhere), 0.12 kg of triphenylphophineoxide and 16 kg in total of the denatured polyvinyl alcohol (Poval MP203; made by Kuraray, Inc.) of 10% by mass in an aqueous solution, these were mixed well and made it in a slurry state. This slurry was sent by a diaphragm pump, after it was dispersed for 4 hours and 30 minutes in a horizontal type sand mill (UVM-2: Imex, Co., Ltd.) filled with zirconia beads having the average diameter of 0.5 mm, adjusted it so that the concentration of the reducing agent became 25% by mass by adding benzoisothiazolinone sodium salt 0.2 g and water, and the reducing agent dispersed matter was obtained. The reducing agent particle contained in the reducing agent dispersed matter thus obtained was a particle having 0.46 μm of median diameter and 1.6 μm or less of the maximum particle diameter. The reducing agent dispersed matter thus obtained was subjected to the filtration through a filer made of polyprpylene having the hole diameter of 3.0 μm, the foreign matters such as rubbish and the like were removed and stored.

<Preparation of Hydrogen-bonding Compound Dispersed Matter>

10 kg of water was added to 10 kg of hydrogen-bonding compound (as described elsewhere), and 20 kg in total of the denatured polyvinyl alcohol (Poval MP203; made by Kuraray, Inc.) of 10% by mass in an aqueous solution, these were mixed well and made it in a slurry state. This slurry was sent by a diaphragm pump, after it was dispersed for 3 hours and 30 minutes in a horizontal type sand mill (UVM-2: Imex, Co., Ltd.) filled with zirconia beads having the average diameter of 0.5 mm, adjusted it so that the concentration of the hydrogen-bonding compound became 22% by mass by adding benzoisothiazolinone sodium salt 0.2 g and water, and the hydrogen-bonding compound was obtained. The compound particle contained in the dispersed matter thus obtained was a particle having 0.35 μm of median diameter and 1.5 μm or less of the maximum particle diameter. The hydrogen-bonding compound thus obtained was subjected to the filtration through a filter made of polypropylene having the hole diameter of 3.0 μm, the foreign matters such as rubbish and the like were removed and stored.

<Preparation of Organic Polyhalogen Compound Dispersed Matter>

<<Preparation of Organic Polyhalogen Compound-1 Dispersed Matter>>

16 kg of water was added to 10 kg of the organic polyhalogen compound-1 (2-tribromomethanesulfonylnaphthalene), 10 kg in total of the denatured polyvinyl alcohol (Poval MP203; made by Kuraray, Inc.) of 20% by mass in an aqueous solution, and 0.4 kg in total of sodium triisopropylnaphthalene sulfonate of 20% by mass in an aqueous solution, these were mixed well and made it in a slurry state. This slurry was sent by a diaphragm pump, after it was dispersed for 5 hours in a horizontal type sand mill (UVM-2: Imex, Co., Ltd.) filled with zirconia beads having the average diameter of 0.5 mm, adjusted it so that the concentration of the organic polyhalogen compound became 23.5% by mass by adding 0.2 g of benzoisothiazolinone sodium salt and water, and the organic polyhalogen compound-1 dispersed matter was obtained.

The organic polyhalogen compound particle contained in the polyhalogen compound dispersed matter thus obtained was a particle having 0.36 μm of median diameter and 2.0 μm or less of the maximum particle diameter. The organic polyhalogen compound dispersed matter thus obtained was subjected to the filtration through a filter made of polypropylene having the hole diameter of 10.0 μm, the foreign matters such as rubbish and the like were removed and stored.

<<Preparation of Organic Polyhalogen Compound-2 Dispersed Matter>>

14 kg of water was added to 10 kg of the organic polyhalogen compound-2 (tribromomethanesulfonylbenzene), 10 kg in total of the denatured polyvinyl alcohol (Poval MP203; made by Kuraray, Inc.) of 20% by mass in an aqueous solution, and 0.4 kg in total of sodium triisopropylnaphthalene sulfonate of 20% by mass in an aqueous solution, these were mixed well and made it in a slurry state. This slurry was sent by a diaphragm pump, after it was dispersed for 5 hours in a horizontal type sand mill (UVM-2: Imex, Co., Ltd.) filled with zirconia beads having the average diameter of 0.5 mm, adjusted it so that the concentration of the organic polyhalogen compound became 26% by mass by adding 0.2 g of benzoisothiazolinone sodium salt and water, and the organic polyhalogen compound-2 dispersed matter was obtained.

The organic polyhalogen compound particle contained in the polyhalogen compound dispersed matter thus obtained was a particle having 0.41 μm of median diameter and 2.0 μm or less of the maximum particle diameter. The organic polyhalogen compound dispersed matter obtained was subjected to the filtration through a filter made of polypropylene having the hole diameter of 10.0 μm, the foreign matters such as rubbish and the like were removed and stored.

<<Preparation of Organic Polyhalogen Compound-3 Dispersed Matter>>

8 kg of water was added to 10 kg of the organic polyhalogen compound-3 (N-butyl-3-tribromomethanesulfonylbenzamide), 20 kg in total of the denatured polyvinyl alcohol (Poval MP203; made by Kuraray, Inc.) of 10% by mass in an aqueous solution, and 0.4 kg in total of sodium triisopropylnaphthalene sulfonate of 20% by mass in an aqueous solution, these were mixed well and made it in a slurry state. This slurry was sent by a diaphragm pump, after it was dispersed for 5 hours in a horizontal type sand mill (UVM-2: Imex, Co., Ltd.) filled with zirconia beads having the average diameter of 0.5 mm, adjusted it so that the concentration of the organic polyhalogen compound became 25% by mass by adding 0.2 g of benzoisothiazolinone sodium salt and water, this dispersed liquid was heated at 40° C. for 5 hours and the organic polyhalogen compound-2 dispersed matter was obtained.

The organic polyhalogen compound particle contained in the polyhalogen compound dispersed matter thus obtained was a particle having 0.36 μm of median diameter and 1.5 μm or less of the maximum particle diameter. The organic polyhalogen compound dispersed matter obtained was subjected to the filtration through a filter made of polypropylene having the hole diameter of 3.0 μm, the foreign matters such as rubbish and the like were removed and stored.

<Preparation of Phthalazine Compound-1 Solution>

8 kg of the denatured polyvinyl alcohol MP203 made by Kuraray, Inc. was dissolved in 174.57 kg of water, subsequently, 3.15 kg in total of sodium triisopropylnaphthanlenesulfonate of 20% by mass and 14.28 kg in total of phthalazine compound (6-isopropylphthalazine) of 70% by mass in an aqueous solution were added, and phthalazine compound of 5% by mass in a solution was prepared.

<Preparation of Mercapto Compound-1 Aqueous Solution>

7 g of mercapto compound (1-(3-sulfonyl)-5-mercaptotetrazole sodium salt) was dissolved in 993 g of water, and made it an aqueous solution of 0.7% by mass.

<Preparation of Pigment Dispersed Matter>

250 g of water was added to 64 g of C.I.Pigment Blue 60 and 6.4 g of Demole N made by Kao, Inc., these were mixed well, and made it in a slurry state. 800 g of zirconia beads having 0.5 mm of the average diameter was prepared and putted it into a vessel with the slurry, dispersed for 25 hours in a dispersion machine (¼ G sand grinder mill; made by Imex, Co., Ltd.), and the pigment-1 dispersed matter was obtained. The pigment particle contained in the pigment dispersed matter thus obtained was a particle having 0.21 μm of the average particle diameter.

<Preparation of SBR Latex Liquid>

A SBR latex whose Tg is 23° C. was made by the following procedures:

After 70.5 mass portions of styrene, 26.5 mass portions of butadiene and 3 mass portions of acrylic acid were emulsified and polymerized using ammonium persulfate as a polymerization initiator, an anionic surfactant as an emulsion, an ageing was performed at 80° C. for 8 hours. Subsequently, it was cooled down to 40° C., made it pH 7.0 by ammonia water, and further, Sandet BL made by Sanyo Kasei, Co., Ltd., was added so as to be 0.22%. Next, 5% sodium hydroxide aqueous solution was added, made it pH 8.3, and further, adjusted it so as to be pH 8.4 by ammonia water. The molar ratio of $Na^+$ ion and $NH_4^+$ ion used at this time was 1:2.3. Furthermore, 0.15 ml of benzoisothiazolinone sodium salt of 7% in an aqueous solution was added to 1 kg of this liquid, and a SBR latex liquid was prepared.

(SBR latex: latex of -St(70.5)-Bu(26.5)-AA (3)-) Tg=23° C.

The average particle diameter: 0.1 μm, concentration: 43% by mass, equilibrium moisture content at 25° C. and 60% humidity (RH): 0.6% by mass, ionic conductivity: 4.2 mS/cm (latex stock solution (43% by mass) was measured at 25° C. using conductometry CM-30S made by Toa Denpa Kogyo, Co., Ltd., for measurement of ionic conductance), and pH 8.4. As SBR latex of different Tgs, the ratios of styrene and butadiene were appropriately changed and prepared by similar methods.

[Preparation of Coating Liquid of Emulsion Layer (Photosensitive Layer)]

<Preparation of Coating Liquid-1 of Emulsion Layer (Photosensitive Layer)>

Each of 1000 g of organic silver salt dispersed matters A through G obtained in the above-described procedure, 125 ml of water, the reducing agent dispersed matter (to be an coating amount indicated in Table 2), 27 g of the pigment dispersed matter, 82 g of the organic polyhalogen compound-1, 40 g of the organic polyhalogen compound-2, 173 g of phthalazine compound solution, 1082 g of SBR latex (Tg: 20.5° C.) liquid, and 9 g of mercapto compound aqueous solution were in turn added, a coating liquid for emulsion layer in which 158 g of the silver halide mixed emulsion A was added and mixed well was sent to the coating die immediately before coating, and coated.

The viscosity of the above-described coating liquid for emulsion layer was measured by B type viscosometer made by Tokyo Keiki, Co., Ltd., resulted in 85 [mPa·s] at 40° C. (No. 1 rotor, 60 rpm).

The viscosity of the coating liquid at 25° C. using a RFS fluid spectrometer made by Rheometrix Far East Co., Ltd., were 1500, 220, 70, 40 and 20 [mPa·s] at shearing speeds of 0.1, 1, 10, 100 and 1000 [1/sec.], respectively.

<Preparation of Coating Liquid-2 for Emulsion Layer (Photosensitive Layer)>

1000 g of the organic silver salt dispersed matter D obtained in the above-described procedure, 104 ml of water, 30 g of the pigment dispersed matter, 21 g of the organic polyhalogen compound-2, 69 g of the organic polyhalogen compound-3 dispersed matter, 173 g of phthalazine compound-1 solution, 1082 g of SBR latex (Tg:23° C.) liquid, 258 g of reducing agent or reducing agent complex (indicated in Table 2), 9 g of mercapto compound-I aqueous solution were in turn added, 110 g of the silver halide mixed emulsion A for coating liquid was added immediately before the coating, the well mixed coating liquid for emulsion layer was sent to the coating die as it was, and coated.

<Preparation of Coating Liquid for Emulsion Face Intermediate Layer>

Water was added to 772 g in total of polyvinyl alcohol PVA-205 (made by Kuraray, Co., Ltd.) of 10% by mass in an aqueous solution, 5.3 g of pigment of 20% by mass dispersed matter, 226 g in total of methylmethacrylate/styrene/butylacrylate/hydroxyethylmethacrylate/acrylic acid copolymer (copolymer mass ratio 64/9/20/5/2) latex of 27.5% by mass in a liquid, 2 ml in total of Aerosol OT (made by American Cyanamide, Co., Ltd.) of 5% by mass in a solution, and 10.5 ml in total of phthalic acid diammonium salt of 20% by mass in a solution so that the total amount became 880 g, adjusted it pH 7.5 with NaOH, and made it a coating liquid for intermediate layer, and sent it to the coating die so as to be coated at 10 ml/$m^2$.

The viscosity of the coating liquid was measured at 40° C. by the B type viscometer (No.1 rotor, 60 rpm), resulted in 21 [mPa·s].

<Preparation of Coating Liquid for Emulsion Face Protective First Layer>

64 g of inert gelatin was dissolved in water, water was added to 80 g in total of methylmethacrylate/styrene/butylacrylate/hydroxyethylmethacrylate/acrylic acid copolymer (copolymer mass ratio: 64/9/20/5/2) latex of 27.5% by mass in a liquid, 23 ml in total of phthalic acid of 10% by mass in methanol solution, 23 ml in total of 4-methylphthalic acid of 10% by mass in an aqueous solution, 28 ml of sulfuric acid of 0.5 mol/L concentration, 5 ml of Aerosol OT (American Cyanamide, Co., Ltd.) of 5% by mass in an aqueous solution, 0.5 g of phenoxyethanol, 0.1 g of benzoisothiazolinone so that the total amount became 750 g, made it a coating liquid, 26 ml of chrome alum of 4% by mass mixed in a static mixer was sent to the coating die immediately before the coating so as to be coated at 18.6 ml/$m^2$.

The viscosity of the coating liquid was measured at 40° C. by the B type viscometer (No.1 rotor, 60 rpm), resulted in 17 [mPa·s].

<Preparation of Coating Liquid for Emulsion Face Protective Second Layer>

80 g of inert gelatin was dissolved in water, water was added to 102 g in total of methylmethacrylate/styrene/butylacrylate/hydroxyethylmethacrylate/acrylic acid copolymer (copolymer mass ratio: 64/9/20/5/2) latex of 27.5% by mass in a liquid, 3.2 ml in total of fluorine based surfactant (F-1: N-perfluorooctylsulfonyl-N-propylalanine potassium salt) of 5% by mass in a solution, 32 ml of fluorine based surfactant (F-2: polyethyleneglycol mono(N-perfluorooctylsulfonyl-N-propyl-2-aminoethyl)ether[ethylene oxide average degree of polymerization=15]) of 2% by mass in an aqueous solution, 23 ml in total of Aerosol OT (made by American Cyanamide, Co., Ltd.) of 5% by mass in a solution, 4 g of polymethylmethacrylate refined particle (average particle diameter, 0.7 μm), 21 g of polymethylmethacrylate refined particle (average particle diameter, 4.5 μm), 1.6 g of 4-methylphthalic acid, 4.8 g of phthalic acid, 44 ml sulfuric acid of 0.5 mol/L concentration, 10 mg of benzoisothiazolinone were added so that the total amount became 650 g, 445 ml of an aqueous solution containing chrome alum of 4% by mass and phthalic acid of 0.67% by mass mixed in a static mixer was made a coating liquid for surface protective layer, and it was sent to the coating die immediately before the coating so as to be coated at 8.3 ml/m$^2$.

The viscosity of the coating liquid was measured at 40° C. by the B type viscometer (No.1 rotor, 60 rpm), resulted in 9 [mPa·s].

<Preparation of Heat-developable Photosensitive Material-1 (1A through 1G)>

On the side of the backing face of the above-described undercoat support, the coating liquid for an antihalation layer was simultaneously coated in double layers so that the coating amount of the solid content of the solid refined particle dye became 0.04 g/m$^2$, and the coating liquid for the backing face protective layer was simultaneously coated in double layers so that the coating amount of gelatin became 1.7 g/m$^2$, dried and the backing layer was prepared.

On the opposite face to the backing face, from the undercoat face, the emulsion layer (photosensitive layer), the intermediate layer, the protective layer of the first layer, the protective layer of the second layer were in turn simultaneously coated in double layers by a slide beads method, and a sample of heat-developable photosensitive material was prepared. At this time, the emulsion layer and the intermediate layer were adjusted to 31° C., the protective layer of the first layer was adjusted to 36° C., and the protective layer of the second layer was adjusted to 37° C.

The coating amounts of the respective compounds (g/m$^2$) of the respective emulsion layer formed using the coating liquid-1 (1A through 1G) for emulsion layer (photosensitive layer) are as follows:

| | |
|---|---|
| organic silver salts A through G, respectively | 6.19 |
| reducing agent or reducing agent complex indicated in Table 2 | |
| pigment (C.I. Pigment Blue 60) | 0.032 |
| organic polyhalogen compound-1 | 0.46 |
| organic polyhalogen compound-2 | 0.25 |
| phthalazine compound-1 | 0.21 |
| SBR latex | 11.1 |
| mercapto compound-1 | 0.002 |
| silver halide (as Ag) | 0.145 |

The coating and drying conditions are as follows:

The coating was performed at the speed of 160 m/min., the gap between tip end of the coating die and the support was made 0.10–0.30 mm, the pressure of the decompression chamber was set to be lowered by 196–882 Pa comparing to the atmosphere. The electricity of the support was removed by an ionic wind prior to the coating.

Subsequently, after the coating liquid was cooled down by the wind at 10–20° C. of the dry bulb temperature in a chilling zone, carried by a non-contanct type carrier, and dried by the drying wind at 23–45° C. and at 15–21° C. of the dry bulb temperature in a winding type non-contact type drying apparatus.

Following the drying, after it was adjusted at 25° C. and 40–60% humidity (RH), the film face was heated so as to be 70–90° C. After the heating, the film face was cooled to 25° C.

The degree of matting of the prepared heat-developable photosensitive material was 550 seconds on the side of the photosensitive layer face in Beck smoothness, and 130 seconds on the backing face. Moreover, when the pH of the film face on the side of the photosensitive layer face was measured, the value was 6.0.

<<Preparation of the Heat-developable Photosensitive Material-2>>

Except that, for the heat-developable photosensitive material-1, the coating liquid-1 for emulsion layer (photosensitive layer) (1A through 1G) was changed to the coating liquid-2 for emulsion layer (photosensitive layer), and further, the yellow dye compound 15 was removed from the antihalation layer, the heat-developable photosensitive material-2 was prepared similarly to the heat-developable photosensitive material-1.

At this time, the coating amounts (g/m$^2$) of the respective compounds for emulsion layer are as follows:

| | |
|---|---|
| organic silver salt D | 6.19 |
| pigment (C.I. Pigment Blue 60) | 0.036 |
| organic polyhalogen compound-2 | 0.13 |
| organic polyhalogen compound-3 | 0.41 |
| phthalazine compound-1 | 0.21 |
| SBR latex | 11.1 |
| reducing agent or reducing agent complex indicated in Table 2 | |
| mercapto compound-1 | 0.002 |
| silver halide (as Ag) | 0.10 |

<<Preparation of the Heat-developable Photosensitive Material-3>>

Except that, for the heat-developable photosensitive material-1, the coating liquid-1 for emulsion layer (photosensitive layer) (1A through 1G) was changed to the coating liquid-2 for emulsion layer (photosensitive layer), and further, the yellow dye compound 15 was removed from the antihalation layer, and F-1, F-2 F-3 and F-4 of the fluorine based surfactants for the protective layer of the second layer and the backing face protective layer were changed to F-5, F-6, F-7 and F-8 of the fluorine based surfactants having the same mass respectively. The heat-developable photosensitive material-3 was prepared similarly to the heat-developable photosensitive material-1.

At this time, the coating amounts (g/m$^2$) of the respective compounds for emulsion layer are as follows:

| | |
|---|---|
| organic silver salt D | 5.57 |
| pigment (C.I. Pigment Blue 60) | 0.032 |
| organic polyhalogen compound-2 | 0.12 |
| organic polyhalogen compound-3 | 0.37 |
| phthalazine compound-1 | 0.19 |

-continued

| | |
|---|---|
| cSBR latex | 10.0 |
| reducing agent or reducing agent complex indicated in Table 2 | |
| mercapto compound-1 | 0.002 |
| silver halide (as Ag) | 0.09 |

Hereinafter, the chemical structures of the compounds used in Examples of the present invention are shown.

Spectral sensitizing pigment A

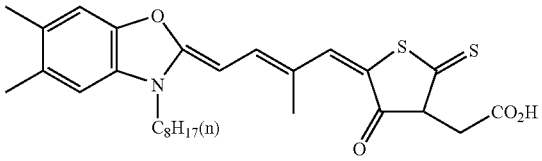

Spectral sensitizing pigment B

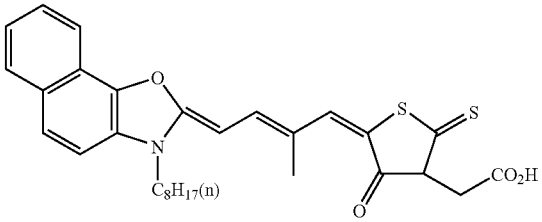

Tellurium sensitizing agent C

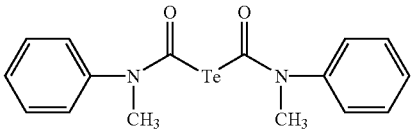

Base precursor compound 11

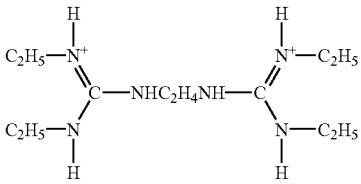

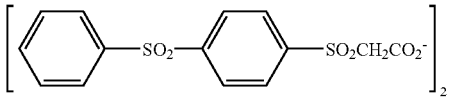

Cyanine dye compound 13

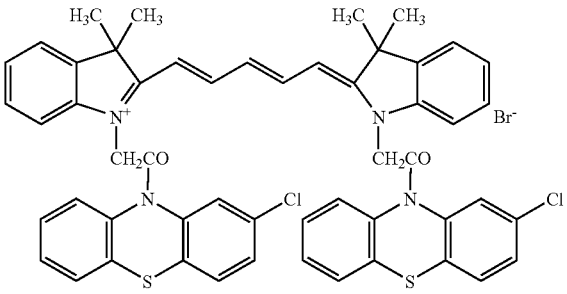

-continued

Blue dye compound 14

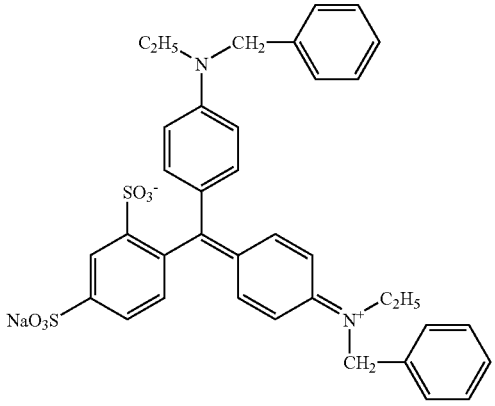

Phthalazine compound-1

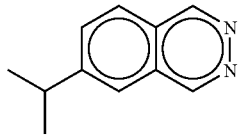

Yellow dye compound 15

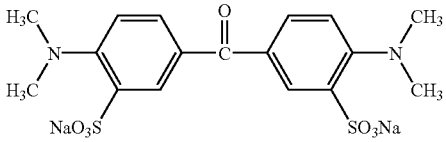

Mercapto compound-1

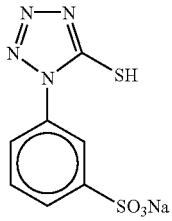

Organic polyhalogen compound-1

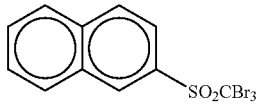

Organic polyhalogen compound-2

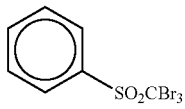

Organic polyhalogen compound-3

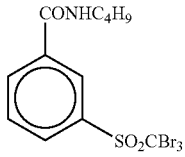

-continued

Reducing agent (I-1)

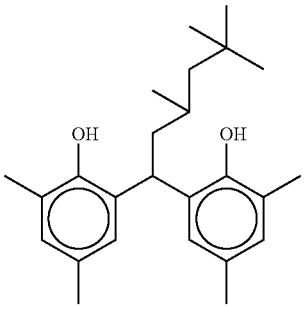

(F-1)

$C_8F_{17}SO_2-N(C_3H_7(n))-CH_2COOK$ (F-2)

$C_8F_{17}SO_2-N(C_3H_7(n))-CH_2CH_2O(CH_2CH_2O)_n-H$ n = 15 (average)

(F-3)

$C_8F_{17}SO_2-N(C_3H_7(n))-(CH_2CH_2O)_4(CH_2)_4SO_3Na$ (F-4)

$C_8F_{17}SO_3K$ (F-5)

$C_8F_{17}(CH_2)_2SO_2-N(C_3H_7(n))-CH_2COOK$ (F-6)

$C_8F_{17}(CH_2)_2SO_2-N(C_3H_7(n))-CH_2CH_2O(CH_2CH_2O)_n-H$ n = 15 (average)

(F-7)

$C_8F_{17}(CH_2)_2SO_2-N(C_3H_7(n))-(CH_2CH_2O)_4(CH_2)_4SO_3Na$ (F-8)

$C_8F_{17}(CH_2)_2SO_3K$

<Evaluation of Photographic Performances>

The heat-developable photosensitive material obtained as described above was exposed and heat-developed (24 seconds in total by 4 sheets of panel heaters set at 112° C.-119° C.-121° C.-121° C.) by Fuji Medical dry laser imager FM-DP L (660 nm semiconductor laser of the maximum output 60 mW (IIIB) mounted), the evaluation of the obtained images were performed by a densitometer.

The sample obtained in the above-described procedure was subjected to a laser exposure, and after the heat-development was performed by the above-described method, the relative sensitivity (AS), the minimum concentration (Dmin) and the maximum concentration (Dmax) of the respective samples were measured at the time when the value of the heat-developable photosensitive material-1A is supposed to be 100. Furthermore, the respective samples were stored for 3 days under the conditions of being at 60° C. and relative humidity 50%, the fogging concentration (ΔDmin) of the non-imaging portion increased during the time was measured. These values are indicated in Table.

<Evaluation of Image-keeping Property>

After the photographic material obtained as described above was >!exposed and heat-developed (24 seconds in total by 4 sheets of panel heaters set at 112° C.-119° C.-121° C.-121° C.) by Fuji Medical dry laser imager FM-DP L (660 nm semiconductor laser of the maximum output 60 mW (IIIB) mounted), and after sufficiently lighted and adjusted for 3 hours at 70% relative humidity (RH), the material was sealed in the bag capable of blocking the light, and left in the circumstances at 60° C. for 24 hours. The changing rates of Dmin at this time are indicated in Table.

The results of measuring and evaluating by the above-described evaluating method on the samples 1A through 1G of the heat-developable photosensitive material-1, the heat-developable photosensitive material-2, and the heat-developable photosensitive material-3 are indicated in the following Table 2.

TABLE 2

| Heat-developable photosensitive materials | Reduing agent Kinds | Reduing agent Coating amount (g/m$^2$) | Sensitivity Δ S | Dmin | Fogging when time passing Δ Dmin | Changing ratio of image-keeping property (%) | |
|---|---|---|---|---|---|---|---|
| 1A | I-6/I-4 | 0.414/0.382 | 100 | 0.16 | 0.03 | 12 | Present invention |
| 1B | I-6/I-4 | 0.414/0.382 | 100 | 0.16 | 0.02 | 10 | Present invention |
| 1C | I-6/I-4 | 0.414/0.382 | 99 | 0.15 | 0 | 7 | Present invention |
| 1D-(1) | I-6/I-4 | 0.414/0.382 | 98 | 0.15 | 0 | 5 | Present invention |
| 1D-(2) | I-5 | 0.814 | 95 | 0.15 | 0 | 5 | Present invention |
| 1D-(3) | I-6 | 0.871 | 99 | 0.15 | 0 | 5 | Present invention |
| 1D-(4) | I-5* | 0.814 | 95 | 0.15 | 0 | 5 | Present invention |
| 1D-(5) | I-1 | 1.345 | 80 | 0.15 | 0 | 5 | Comparative example |
| 1E | I-6/I-4 | 0.414/0.382 | 102 | 0.16 | 0.21 | 53 | Comparative example |
| 1F | I-6/I-4 | 0.414/0 382 | 98 | 0.16 | 0.01 | 14 | Present invention |
| 1G | I-6/I-4 | 0.414/0.382 | 98 | 0.16 | 0.01 | 17 | Present invention |
| 2 | I-6/I-4 | 0.414/0.382 | 99 | 0.09 | 0 | 5 | Present invention |
| 3 | I-6/I-4 | 0.414/0.382 | 99 | 0.09 | 0.01 | 5 | Present invention |

I-5*: 1:1 complex of reducing agent I-5 and hydrogen bonding compound II-2

From the Table 2, it has been confirmed that the content of silver behenate of the non-photosensitive organic silver salt particle is in the range from 90% by mol or more to 100% by mol or less, and in the combinations using reducing agents of the present invention, heat-developable photosensitive materials of the present invention have approximately same degrees of sensitivities, the foggings occurring along with the time passing are slight and the changing rate of the image-keeping property is also small.

Example 2

[Preparation of PET Supports]

PET supports were prepared by a method similar to that of Example 1.

[Surface Corona Treatment]

The surface corona treatment was performed on the both faces of the PET supports by a method similar to that of Example 1.

[Preparation of undercoat support]
<Preparation of undercoat layer coating liquid>

| Formulation 2-(1)(for undercoat layer on photosensitive layer side) | |
|---|---|
| Pesresin A-520 (30% by mass solution) made by Takamatsu fatts and Oils, Co., Ltd. | 59 g |
| polyethylene glycol monononylphenyethyl (Average ethylene oxide number = 8.5) 10% by mass in solution | 5.4 g |
| MP-1000 made by Soken Chemical, Co., Ltd. (polymer refined particle, average particle diameter 0.4 μm) | 0.91 g |
| distilled water | 935 ml |
| **Formulation 2-(2) (used for backing surface first layer)** | |
| styrene-butadiene copolymer latex (Solid portion 40% by mass, styrene/butadiene mass ratio = 68/32) | 158 g |
| 2,4-dichloro-6-hydroxy-S-triazine sodium salt 8% by mass in aqueous solution | 20 g |
| 1% by mass in aqueous solution of sodium laurylbenzenesulfonate | 10 ml |
| distilled water | 854 ml |
| **Formulation 2-(3)(used for backing surface side second layer)** | |
| $SnO_2$/SbO (9/1 mass ratio, average particle diameter 0.38 μm, 17% by mass dispersed matter) | 84 g |
| gelatin (10% by mass in aqueous solution) | 89.2 g |
| Methorse TC-5 made by Shinetsu Chemical, Co., Ltd. (2% by mass in aqueous solution) | 8.6 g |
| MP-1000 made by Soken Chemical, Co., Ltd. | 0.01 g |
| 1% by mass in aqueous solution of sodium dodecyl benzenesulfonate | 10 ml |
| NaOH (1% by mass) | 6 ml |
| proxell (made by ICI, Co., Ltd.) | 1 ml |
| distilled water | 805 ml |

<<Preparation of Undercoated Support.>

After each of both surfaces of biaxial oriented polyethylene terephthalate support having a thickness of the above-described 175 μm was subjected to the above-described corona discharging treatment, the above-described undercoat coating liquid formulation 2-(1) is coated on one surface (photosensitive layer surface) so that wet coating amount became 6.6 ml/$m^2$ (per one surface) by a wire bar, dried at 180° C. for 5 minutes, subsequently, on this reverse face (backing surface), the above-described undercoat coating liquid formulation 2-(2) was coated so that wet coating amount became 5.7 ml/$m^2$ by a wire bar, dried at 180° C. for 5 minutes, further on the reverse face (backing surface), the above-described undercoat coating liquid formulation 2-(3) was coated so that wet coating amount became 7.7 ml/$m^2$ by a wire bar, dried at 180° C. for 6 minutes, then an undercoat support was prepared.

[Preparing of Backing Face Coating Liquid]

<Preparation of Solid Particle Refined Dispersion Liquid (a') of Base Precursor>

Except that the base precursor compound-1' was used, the solid refined dispersion liquid (a') of base precursor compound was obtained by a method similar to that of Example 1.

<Preparation of Dyeing Solid Refined Particle Dispersion Liquid>

Except that the cyanine dyeing compound-1' was used, the dispersion liquid of the dyeing solid refined particle having 0.2 μm of average particle diameter was obtained by a method similar to that of Example 1.

<Preparation of Coating Liquid for Antihalation Layer>

17 g of gelatin, 9.6 g of polyacrylamide, 56 g of a dispersion liquid (a') of a solid refined particle of the above-described base precursor, 50 g of the dispersion liquid of the dyeing solid refined particle, 1.5 g of monodispersed polymethylmethacrylate refined particle (average particle size, 8 μm; standard deviation of particle diameter, 0.4), 0.03 g of benzoisothiazolinone, 2.2 g of sodium polyethylene sulfonate, 0.1 g of the blue dyeing compound-1', 0.1 g of the yellow dyeing compound-1', and 844 ml of water were mixed, and a coating liquid for antihalation layer was prepared.

<Preparation of Coating Liquid for Backing Surface Protective Layer>

The coating liquid for a backing surface protective layer was prepared by materials and preparation method similar to those of Example 1.

[Preparation of the Respective Components Contained in Silver Halide Emulsion]

<Preparation of Silver Halide Emulsion 1'>

3.1 ml in total of potassium bromide of 1% by mass in a solution was added to 1421 ml of distilled water, and further, the liquid to which 3.5 ml of sulfuric acid at 0.5 mol/L concentration, 31.7 g of gelatin phthalated were added was maintained at 30° C. of the liquid temperature while agitating the liquid in a stainless made reaction pot, a 95.4 ml of solution A into which 22.22 g of silver nitrate was diluted by adding distilled water, and 97.4 ml of a solution B into which 15.3 g of potassium bromide and 0.8 g of potassium iodide were diluted by adding distilled water were added in total amount for 45 seconds at a certain flow rate.

Subsequently, 10 ml of hydrogen peroxide aqueous solution of 3.5% by mass was added, and further, 10.8 ml of benzoimidazole of 10% by mass was added. Furthermore, as 317.5 ml of a solution C into which 51.86 g of silver nitrate was diluted by adding distilled water, and as 400 ml volume of a solution d into which 44.2 g of potassium bromide and 2.2 g of potassium iodide were diluted by adding distilled water, the solution C was added in total amount for 20 minutes at a certain flow rate, the solution D was added while maintaining pAg at 8.1 by a controlled double jet method.

6-iridium chloride (III) acid potassium salt was added in total amount so that it became $1\times10^{-4}$ mol per each 1 mol of silver at the time when 10 minutes passed after the solution C and the solution D were begun to be added. Moreover, at the time when 5 seconds passed after the solution C was terminated for being added, $3\times10^{-4}$ mol per each 1 mole of silver of potassium iron (II) 6-cyanide aqueous solution was added in total amount. The pH was adjusted into 3.8 using sulfuric acid of 0.5 mol/L concentration, the agitation was stopped, precipitation/desalting/washing with water steps were performed. Using sodium hydroxide of 1 mol/L concentration, the pH was adjusted into pH 5.9, and a silver halide dispersed matter of pAg 8.0 was prepared.

The above-described silver halide dispersed matter was maintained at 38° C. while it was agitated, 5 ml of methanol solution of 1,2-benzoisothiazoline-3-on of 0.34% by mass was added, after 40 minutes, the methanol solution at the molar ratio of the spectral sensitizing pigment A' and the spectral sensitizing pigment B' of $1.2\times10^{-3}$ mol per each 1 mol of silver as the total of the spectral sensitizing pigment A' and the spectral sensitizing pigment B' was added, after 1 minute, the temperature was raised to 47° C. At the time when 20 minutes passed after raising the temperature, $7.6\times10^{-5}$ mol of sodium benzenethiosulfonate was added with methanol solution with respect to 1 mole of silver, and further, at the time when 5 minutes passed after that, $2.9\times10^{-4}$ mol per each 1 mol of silver tellurium sensitizing agent B with methanol solution was added, and maturated for 91 minutes.

1.3 ml of methanol solution of N,N'-dihydroxy-N"-diethylmelamine of 0.8% by mass was added, and further after 4 minutes, the silver halide emulsion 1' was prepared by adding $4.8\times10^{-3}$ mol per each 1 mole of silver of 5-methyl-2-mercaptobenzimidazole in methanol solution and $5.4\times10^{-3}$ mol per each 1 mole of silver of 1-phenyl-2-heptyl-5-mercapto-1,3,4-triazole in methanol solution.

The prepared particle in silver halide emulsion was a silver iodine bromide particle having 0.042 μm of the average sphere-equivalent diameter and uniformly containing 3.5% by mol iodine whose variation coefficient of the sphere-equivalent diameter is 20%. The particle size and the like were found from the average of 1000 pieces of particles using an electron microscope. The {100} face ratio of this particle was found as 80% using Kubelka-Munk method.

<Preparation of Silver Halide Emulsion 2'>

Except that the liquid temperature of 30° C. at the time when the particle wasmed was changed to 47° C., the solution B was changed to a volume of 97.4 ml of the solution B into which 15.9 g of potassium bromide was diluted by distilled water, the solution D was changed to a volume of 400 ml of the solution D into which potassium bromide 45.8 g was diluted by distilled water, the additive time of the solution C was changed to 30 minutes, and potassium 6-cyano iron (II) was removed, the preparation of the silver halide emulsion 2' was performed similarly to the preparation of the silver halide emulsion 1'.

A precipitation/desalting/washing with water/dispersion were performed similarly to the silver halide emulsion 1'. Furthermore, except that the additive amount of the spectral sensitizing pigment A' and the spectral sensitizing pigment B' in total at the molar ratio of 1:1 in methanol solution was changed to $7.5\times10^{-4}$ mol, the additive amount of the tellurium sensitizing pigment B' was changed to $1.1\times10^{-4}$ mol per each 1 mole of silver, the additive amount of 1-phenyl-2-heptyl-5-mercapto-1,3,4-triazole was changed to $3.3\times10^{-3}$ mol with respect to 1 mol of silver, the additions of the spectral sensitizing pigments, chemical sensitizing agents and 5-methyl-2-mercaptobenzimidazole, 1-phenyl-2-heptyl-5-mercapto-1,3,4-triazole were performed, and the silver halide emulsion 2' was obtained similarly to the emulsion 1'.

The emulsion particle of the silver halide emulsion 2' was a pure silver bromide cubic particle having 0.080 μm of the average sphere-equivalent diameter and 20% of variation coefficient of sphere-equivalent diameter.

<<Preparation of Silver Halide Emulsion 3'>>

Except that the liquid temperature 30° C. at the time when the particle wasmed was changed to 27° C., the preparation of the silver halide emulsion 3' was performed similarly to the emulsion 1'. Moreover, the precipitation/desalting/washing with water/dispersion were performed similarly to the preparation of the silver halide emulsion 1'.

Except that the additive amount of the solid dispersed matter at the molar ratio of the spectral sensitizing pigment A' and the spectral sensitizing pigment B' was changed to $6\times10^{-3}$ mol as the total of the spectral sensitizing pigment A' and the spectral sensitizing pigment B' per each 1 mole of silver, the additive amount of the tellurium sensitizing agent B' was changed to $5.2\times10^{-4}$ mol per each 1 mole of silver, the silver halide emulsion 3' was obtained similarly to the preparation of the silver halide emulsion 1'.

The emulsion particle of the silver halide emulsion 3' was an iodine silver bromide particle having 0.034 μm of the average sphere-equivalent diameter and uniformly containing iodine of 3.5% by mol of 20% variation coefficient of the sphere-equivalent diameter.

<<Preparation of Silver Halide Mixed Emulsion A' for Coating Liquid>>

The silver halide emulsion 1' of 70% by mass, the silver halide emulsion 2' of 15% by mass, the silver halide emulsion 3' of 15% by mass were dissolved, $7\times10^{-3}$ mol per each 1 mole of silver of benzothiazolium iodide in aqueous solution of 1% by mass was added. Furthermore, water was added so that the content of silver halide per each 1 kg of silver halide mixed emulsion for coating liquid became 38.2 g as silver.

<<Preparation of Organic Silver Salt Dispersed Matters A' through G'>>

258.5 mol of an organic silver, 423 L of distilled water, 49.2 L of NaOH aqueous solution of 5 mol/L concentration, 120 L of tert-butanol were mixed, agitated at 75° C. for 1 hour and reacted, then, sodium organic acid solution was obtained. Separately, 40.4 kg of silver nitrate in 206.2 L of aqueous solution (pH 4.0) was prepared, maintained at the temperature of 10° C. A reactive container in which 635 L of distilled water and 30 L of tert-butanol were put was maintained at the temperature of 30° C., while sufficiently agitating it, the total amount of sodium organic acid solution and the total amount of silver nitrate aqueous solution were added at a certain flow rate for 93 minutes and 15 seconds and for 90 minutes, respectively.

At this time, it was made so that only silver nitrate aqueous solution was added for 11 minutes after the addition of silver nitrate aqueous solution was initiated, after that, the addition of the sodium organic acid aqueous solution was initiated, and after the termination of the addition of silver nitrate aqueous solution, for 14 minutes and 15 seconds, only the sodium organic acid aqueous solution was added. At this time, the reaction temperature within the reactive container was made the temperature of Table 3, and for maintaining the liquid temperature at a certain temperature, the outside temperature was controlled. Moreover, the temperature of the piping of addition system of silver nitrate aqueous solution was maintained by circulating the hot water on the outside of the double pipings and prepared so that the liquid temperature at the outlet of the tip end of the addition nozzle is 75° C. The temperature of the addition system of silver nitrate aqueous solution was maintained by circulating the cool water outside of the double pipings.

The additive position of the sodium organic acid ester solution and the additive position of silver nitrate aqueous solution were arranged in a symmetrical manner by making the agitating axis as center, and adjusted to the height not so as to contact with the reactive solution.

<<Maturation/Centrifuge Filtration>>

After the addition of sodium organic acid was terminated, agitated and left for 20 minutes at the temperature as it was, raised to 35° C. for 35 minutes, subsequently, the maturation was performed for 210 minutes. Immediately after the termination of the maturation, the solid content was filtered off by a centrifuge filtration, and the solid content was washed with water until the conductance of the filtering water became 30 μS/cm. At that time, in order to promote the lowering of the conductance, the operations in which wet cake was made in a slurry shape by adding purewater to the wet cake were repeated 3 times.

The obtained wet cake of the organic silver was completely centrifuged at 700×g. Note that G is represented by $1.119\times10^{-5}\times$radius (cm) of the container x speed of rotation $(\text{rpm})^2$. The content of the solid content of the organic silver wet cake thus obtained (1 g of wet cake was dried at 110° C. for 2 hours and measured) was 44%.

<<Preliminary Dispersion>

19.3 kg of polyvinyl alcohol (trade name: PVA-217) and water were added with respect to a wet cake corresponding to 260 kg of the dried solid content, after the total amount was made 1000 kg, it was made in a slurry state by dissolver feathers, and further, the preliminary dispersion was performed by the pipe line mixer (made by Mizuho Industry, Co., Ltd.: PM-10 type).

<<Final Dispersion>>

Next, the stock solution already preliminarily dispersed was treated 3 times by adjusting the pressure of the dispersing machine (trade name: Microfluidizer M-610, made by Microfluidex International Corporation, using Z type interaction chamber) to 1260 kg/cm$^2$ (12.6 MPa), and an organic silver salt dispersed matter (silver behenate dispersed matter) was obtained. The characteristic value of shape of the dispersed matter was identical with that after the washing with water. As the cooling operation, hose type heat exchangers were mounted in front and on back of the interaction chamber, the dispersion temperature of 18° C. was set by adjusting the temperature of the coolant.

As the organic silver salt particle contained in the organic silver salt dispersed matters A' through G' thus obtained, the volume-weighted average diameter (sphere-equivalent diameter), the variation coefficient of volume-weighted average diameter (sphere-equivalent diameter) were as those of Table 3. The measurement of the particle size was preformed by Master Sizer X, made by Malvern Instruments, Ltd.

<<Preparation of Organic Silver Salt Dispersed Matters H' through K'>>

(1) Preparation of Organic Silver Salt Solution 258.5 mol of an organic acid, 423 L of distilled water, 49.2 L of NaOH aqueous solution of 5 mol/L concentration, 120 L of tert-butyl alcohol, which are the components of the composition of Table 3, were mixed, agitated at 75° C. for 1 hour and reacted, then, sodium organic acid ester solution was obtained.

(2) Preparation of Solution Containing Silver Ion 206.2 L of an aqueous solution containing 40.4 kg of silver nitrate (pH 4.0) was prepared, and maintained at 10° C.

(3) Preparation of Reactive Bath Solution

A reaction container in which 635 L of distilled water and 30 L of tert-butyl alcohol were putted was maintained at 30° C.

As a sealing and mixing means, a small size crystallizer as shown in FIG. 1 was used. (1) was measured and putted in the tank 12, (2) was measured and putted in the tank 11, and (3) was measured and putted in the tank 20, and circulated at the flow rate of 250 L/min. via the pump 17.

While it was agitated at 2500 rpm by pipe line mixer LR-I type made by Mizuho Industry, Co., Ltd., as shown as the reference numeral 18 in FIG. 1, (1) and (2) were added. The addition of (2) was performed for 100 minutes at a certain flow rate, the addition of (1) was initiated at the time when 1 minute passed after the initiation of the addition of (2), the amount corresponding to 90% of the total additive amount was added for 74 minutes at a certain flow rate. At the time when 10 minutes passed after the addition of (2) was terminated, the remaining total amount of (1) (corresponding to 10% of the total additive amount) was added on the liquid level of (3) at a certain flow rate for 7 minutes. During the addition, the agitation of (3) was agitated as strongly as possible in the range that the bubbles were not involved in. As control of temperature, the heat exchanger 19 was used in addition to that the tank 20 was cooled down.

Here, water at the suitable temperature was supplied at 20 L/min. to the jackets of the heat exchanger 19 and the tank 20 and the temperature was controlled so that the temperature there became a temperature of Table 1.

Moreover, the temperature of the piping of addition system of organic acid salt (sodium organic acid) solution was maintained by the double pipings, controlled so that the liquid temperature at the outlet of the tip end of the addition nozzle is 75° C. Moreover, the temperature of the addition system of silver nitrate aqueous solution was maintained by circulating the cool water outside of the double pipings.

Next, the above-described maturation, centrifuge filtration, preliminary dispersion and the final dispersion treatment were performed.

As Organic silver salt particles contained in the organic silver salt dispersed matters H' through K' thus obtained, the volume-weighted average diameter (sphere-equivalent diameter), the variation coefficient of the volume-weighted average diameter, and the ratio of the long side c and the short side b (slenderness ratio) and the aspect ratio were as indicated in Table 3. The measurement of the particle size was performed by Master Sizer X made by Malvern Instruments, Ltd.

<<Preparation of Organic Silver Salt Dispersed Matters L' through O'>>

To the organic silver salt charged liquid obtained by the same method with that of the preparation of organic silver salt dispersed matters H' through K', PVA 217 was added in a state where 7.4 g was dissolved in 74 g of water with respect to 100 g of dried solid content, it was treated once using the microfluidizer, but whose pressure was adjusted at 600 kg/cm$^2$ (6 MPa). The liquid was transferred to the ultrafiltration apparatus, and the desalting treatment was performed.

The ultrafiltration apparatus is fundamentarily consisted of a tank for stocking an organic silver salt dispersed matter and a pump for circulating for supplying the stocked dispersed matter to the ultrafiltration module, and has a flowmeter for measuring a refilling purewater, a flowmeter for measuring a permeated water, a pump for washing in a reverse direction and the like.

The utilized membrane module is ACP-1050 made by Asahi Kakei, Co., Ltd., which is a hollow fiber type, the flow rate at the time when the liquid was sent was made 181/min., the pressure difference between the front and back of the module was made 1.0 kg/cm$^2$ ($1\times10^4$ Pa). The temperature of the treated liquid during the treatment was maintained at 17° C. or less, and the treatment was carried out.

At the time when the electrical conductivity was lowered to 100 μS/cm, the refilling of purewater was stopped, and condensed to 26% by mass. Subsequently, using the microfluidizer, the pressure was adjusted to 1750 kg/cm$^2$ (17.5 MPa), treated twice and organic silver salt dispersed matters L through O were obtained. As the measurement of the solid content concentration, a digital specific gravity meter DA-300 type made by Kyoto electron, Ltd., was used, and the test was finally performed by measuring absolute dry weight.

As Organic silver salt particles contained in the organic silver salt dispersed matters L' through O' thus obtained, the volume-weighted average diameter (sphere-equivalent diameter), the variation coefficient of the volume-weighted average diameter, the ratio of the long side c and the short side b (slenderness ratio) and the aspect ratio were as indicated in Table 3. The measurement of the particle size was performed by Master Sizer X made by Malvern Instruments, Ltd.Table 3.

sand mill (UVM-2: Imex, Co., Ltd.) filled with zirconia beads having the average diameter of 0.5 mm, adjusted it so that the concentration of the reducing agent became 22% by mass by adding benzoisothiazolinone sodium salt 0.2 g and water, and the reducing agent complex-1' dispersed matter was obtained.

The reducing agent complex particle contained in the reducing agent complex dispersed matter thus obtained was a particle having 0.45 μm of median diameter and 1.4 μm or less of the maximum particle diameter. The reducing agent dispersed matter obtained was subjected to the filtration through a filter made of polypropylene having the hole diameter of 3.0 μm, the foreign matters such as rubbish and the like were removed and stored.

<<Preparation of Reducing Agent-2' Dispersed Matter>>

10 kg of water was added to 10 kg of the reducing agent-2'(6,6'-di-t-butyl-4,4'-dimethyl-2,2'-buthylidene-diphenol) and 16 kg in total of the denatured polyvinyl alcohol (Poval MP203; made by Kuraray, Co., Ltd.) of 10% by mass in an aqueous solution, these were mixed well, and made it in a slurry state.

This slurry was sent by a diaphragm pump, after it was dispersed for 3 hours and 30 minutes in a horizontal type sand mill (UVM-2: Imex, Co., Ltd.) filled with zirconia beads having the average diameter of 0.5 mm, adjusted it so that the concentration of the reducing agent became 25% by mass by adding benzoisothiazolinone sodium salt 0.2 g and water, and the reducing agent-2' dispersed matter was obtained.

TABLE 3

| Silver organic acid dispersed matters | Content (mol %) Silver stearate | Silver arachidate | Silver behenate | Reaction temperature (° C.) | Volume weighted average dimeter (Sphere-equivalent diameter) (μm) | Variation coefficient (%) | Slenderness ratio | Aspect ratio |
|---|---|---|---|---|---|---|---|---|
| A' | 2 | 11 | 87 | 32 | 0.45 | 12 | 1.5 | 19 |
| B' | 0.5 | 8 | 91.5 | 32 | 0.48 | 13 | 1.7 | 23 |
| C' | 0.5 | 4 | 95.5 | 32 | 0.41 | 12 | 1.1 | 11 |
| D' | 0 | 12 | 88 | 32 | 0.41 | 11 | 1 | 11 |
| E' | 5 | 105 | 84.5 | 32 | 0.49 | 15 | 4 | 33 |
| F' | 0 | 2 | 98 | 45 | 0.55 | 18 | 8 | 27 |
| G' | 0 | 1 | 99 | 65 | 1.2 | 21 | 12 | 45 |
| H' | 2 | 10 | 88 | 32 | 0.48 | 14 | 2 | 17 |
| I' | 0.5 | 4 | 95.5 | 32 | 0.42 | 11 | 1.6 | 13 |
| J' | 0 | 13 | 87 | 32 | 0.42 | 12 | 1 | 8 |
| K' | 0.5 | 2 | 97.5 | 65 | 0.55 | 16 | 8 | 27 |
| L' | 2 | 12 | 86 | 32 | 0.47 | 13 | 1.5 | 18 |
| M' | 0 | 3 | 97 | 32 | 0.42 | 12 | 1.1 | 13 |
| N' | 0.3 | 11 | 88.7 | 32 | 0.41 | 12 | 1 | 9 |
| O' | 0 | 2 | 98 | 65 | 0.55 | 16 | 8 | 29 |

<<Preparation of Reducing Agent Dispersed Matter or Reducing Agent Complex Dispersed Matter>>

<Preparation of Reducing Agent Complex-1' Dispersed Matter>

10 kg of water was added to 10 kg of the reducing agent complex-1' (complex prepared at a ratio of 1:1 of 6,6'-di-t-butyl-4,4'-dimethyl-2,2'-buthylidenediphenol and triphenylphosphineoxide), 0.12 kg of triphenylphosphineoxide and 16 kg in total of the denatured polyvinyl alcohol (Poval MP203; made by Kuraray, Co., Ltd.) of 10% by mass in an aqueous solution, these were mixed well, and made it in a slurry state.

This slurry was sent by a diaphragm pump, after it was dispersed for 4 hours and 30 minutes in a horizontal type The reducing agent complex particle contained in the reducing agent complex dispersed matter thus obtained was a particle having 0.40 μm of median diameter and 1.5 μm or less of the maximum particle diameter. The reducing agent dispersed matter obtained was subjected to the filtration through a filter made of polypropylene having the hole diameter of 3.0 μm, the foreign matters such as rubbish and the like were removed and stored.

<<Preparation of Hydrogen-bonding Compound-1' Dispersed Matter>>

10 kg of water was added to 10 kg of the hydrogen-bonding compound-1'(tri(4-t-butylphenyl)phosphineoxide) and 16 kg in total of the denatured polyvinyl alcohol (Poval MP203; made by Kuraray, Co., Ltd.) of 10% by mass in an aqueous solution, these were mixed well, and made it in a slurry state.

This slurry was sent by a diaphragm pump, after it was dispersed for 3 hours and 30 minutes in a horizontal type sand mill (UVM-2: Imex, Co., Ltd.) filled with zirconia beads having the average diameter of 0.5 mm, adjusted it so that the concentration of the hydrogen-bonding compound became 25% by mass by adding benzoisothiazolinone sodium salt 0.2 g and water, and the hydrogen-bonding compound-l' dispersed matter was obtained.

The reducing agent particle contained in the reducing agent dispersed matter thus obtained was a particle having 0.35 μm of median diameter and 1.5 μm or less of the maximum particle diameter. The hydrogen-bonding compound dispersed matter obtained was subjected to the filtration through a filter made of polypropylene having the hole diameter of 3.0 μm, the foreign matters such as rubbish and the like were removed and stored.

<<Preparation of Compound Dispersed Matter Represented by General Formulas (1) through (4)>>

10 kg of water was added to 10 kg of the compound represented by the general formulas (1) through (4) of the present invention and 20 kg in total of the denatured polyvinyl alcohol (Poval MP203; made by Kuraray, Co., Ltd.) of 10% by mass in an aqueous solution, these were mixed well, and made it in a slurry state.

This slurry was sent by a diaphragm pump, after it was dispersed for 3 hours and 30 minutes (standard) in a horizontal type sand mill (UVM-2: Imex, Co., Ltd.) filled with zirconia beads having the average diameter of 0.5 mm, adjusted it so that the concentration became 25% by mass by adding benzoisothiazolinone sodium salt 0.2 g and water, and the compound dispersed matter represented by the general formulas (1) through (4) of the present invention was obtained.

The particle contained in the dispersed matter thus obtained was a particle having 0.48 μm of median diameter and 1.4 μm or less of the maximum particle diameter. The dispersed matter obtained was subjected to the filtration through a filter made of polypropylene having the hole diameter of 3.0 μm, the foreign matters such as rubbish and the like were removed and stored. The median diameter of the particle was made to be 0.48 μm by adjusting the dispersion time.

<Preparation of Organic Polyhalogen Compound>

<<Preparation of Organic Polyhalogen Compound-1' Dispersed Matter>>

14 kg of water was added to 10 kg of the organic polyhalogen compound-1' (tribromomethanesulfonylbenzene), 10 kg in total of the denatured polyvinyl alcohol (Poval MP203; made by Kuraray, Co., Ltd.) of 10% by mass in an aqueous solution, and 0.4 kg in total of sodium triisopropylnaphthalenesulfonate of 20% by mass in an aqueous solution, these were mixed well, and made it in a slurry state.

This slurry was sent by a diaphragm pump, after it was dispersed for 5 hours in a horizontal type sand mill (UVM-2: Imex, Co., Ltd.) filled with zirconia beads having the average diameter of 0.5 mm, adjusted it so that the concentration of the organic polyhalogen compound became 26% by mass by adding benzoisothiazolinone sodium salt 0.2 g and water, and the organic polyhalogen compound-1' dispersed matter was obtained.

The organic polyhalogen compound particle contained in the polyhalogen compound dispersed matter thus obtained was a particle having 0.41 μm of median diameter and 2.0 μm or less of the maximum particle diameter. The organic polyhalogen compound dispersed matter obtained was subjected to the filtration through a filter made of polypropylene having the hole diameter of 10.0 μm, the foreign matters such as rubbish and the like were removed and stored.

<<Preparation of Organic Polyhalogen Compound-2' Dispersed Matter>>

10 kg of the organic polyhalogen compound-2' (N-butyl-3-tribromomethanesulfonylbenzamide), 20 kg in total of the denatured polyvinyl alcohol (Poval MP203; made by Kuraray, Co., Ltd.) of 10% by mass in an aqueous solution, and 0.4 kg in total of sodium triisopropylnaphthalenesulfonate of 20% by mass in an aqueous solution, these were mixed well, and made it in a slurry state.

This slurry was sent by a diaphragm pump, after it was dispersed for 5 hours in a horizontal type sand mill (UVM-2: Imex, Co., Ltd.) filled with zirconia beads having the average diameter of 0.5 mm, adjusted it so that the concentration of the organic polyhalogen compound became 30% by mass by adding benzoisothiazolinone sodium salt 0.2 g and water. This dispersed liquid was heated at 40° C. for 5 hours and the organic polyhalogen compound-2 was obtained.

The organic polyhalogen compound particle contained in the polyhalogen compound dispersed matter thus obtained was a particle having 0.40 μm of median diameter and 1.3 μm or less of the maximum particle diameter. The organic polyhalogen compound dispersed matter obtained was subjected to the filtration through a filter made of polypropylene having the hole diameter of 3.0 μm, the foreign matters such as rubbish and the like were removed and stored.

<<Preparation of Color Tone Adjuster-1' Dispersed Matter>>

10 kg of the color tone adjuster-1', and 25 kg in total of the denatured polyvinyl alcohol (Poval MP203; made by Kuraray, Co., Ltd.) of 10% by mass in an aqueous solution were added, these were mixed well, and made it in a slurry state.

This slurry was sent by a diaphragm pump, after it was dispersed for 5 hours in a horizontal type sand mill (UVM-2: Imex, Co., Ltd.) filled with zirconia beads having the average diameter of 0.5 mm, adjusted it so that the concentration of the color tone adjuster-1' became 15% by mass by adding benzoisothiazolinone sodium salt 0.2 g and water, this dispersed liquid was heated at 40° C. for 5 hours and the color tone adjuster-1' dispersed matter was obtained.

The color tone adjuster-1' particle contained in the color tone adjuster-1' dispersed matter thus obtained was a particle having 0.28 μm of median diameter and 1.0 μm or less of the maximum particle diameter. The organic polyhalogen compound dispersed matter obtained was subjected to the filtration through a filter made of polypropylene having the hole diameter of 3.0 μm, the foreign matters such as rubbish and the like were removed and stored.

<<Preparation of Phthalazine Compound-1' Solution>>

8 kg in total of the denatured polyvinyl alcohol (Poval MP203; made by Kuraray, Co., Ltd.) was dissolved in 174.57 kg of water, subsequently, 3.15 kg in total of sodium trisopropylnaphthalene sulfonate of 20% by mass in an aqueous solution and 14.28 g in total of phthalazine compound-1(6-isopropylphthalazine) of 70% by mass in an aqueous solution were added, and phthalazine compound-l' of 5% by mass in a solution was prepared.

<Preparation of Mercapto Compound>

<<Preparation of Mercapto Compound-1' Aqueous Solution>>

7 g of mercapto compound-1' (1-(3-sulfonyl)-5-mercaptotetrazole sodium salt) was dissolved in 993 g of water, and made it 0.7% by mass in an aqueous solution.

<Preparation of Mercapto Compound-2' Aqueous Solution>

20 g of mercapto compound-2' (1-(3-metylureido)-5-mercaptotetrazole sodium salt) was dissolved in 980 g of water, and made it 2.0% by mass in an aqueous solution.

<<Preparation of Pigment-1' Dispersed Matter>>

The pigment-1' dispersed matter was obtained by materials and a preparation method similar to Example 1. The pigment particle contained in the obtained pigment dispersed matter is a particle having 0.21 μm of the average particle diameter.

<<Preparation of SBR Latex Liquid>>

A SBR latex whose Tg is 22° C. was made by the following procedures:

After 70.0 mass portions of styrene, 27.0 mass portions of butadiene and 3 mass portions of acrylic acid were emulsified and polymerized using ammonium persulfate as a polymerization initiator, an anionic surfactant as an emulsion, an ageing was performed at 80° C. for 8 hours. Subsequently, it was cooled down to 40° C., made it pH 7.0 by ammonia water, and further, Sandet BL made by Sanyo Kasei, Co., Ltd., was added so as to be 0.22%.

Next, 5% sodium hydroxide aqueous solution was added, made it pH 8.3, and further, adjusted it so as to be pH 8.4 by ammonia water. The molar ratio of $Na^+$ ion and $NH_4^+$ ion used at this time was 1:2.3. Furthermore, 0.15 ml of benzoisothiazolinone sodium salt of 7% in an aqueous solution was added to 1 kg of this liquid, and a SBR latex liquid was prepared.

(SBR latex: latex of -St(70.0)-Bu(27.0)-AA (3.0)-) Tg=22° C.

The average particle diameter: 0.1 μm, concentration: 43% by mass, equilibrium moisture content a 25° C. and 60% humidity (RH): 0.6% by mass, ionic conductivity: 4.2 mS/cm (latex stock solution (43% by mass) was measured at 25° C. using conductometry CM-30S made by Toa Denpa Kogyo, Co., Ltd., for measurement of ionic conductance), and pH 8.4.

As SBR latex of different Tgs, the ratios of styrene and butadiene were appropriately changed and prepared by similar methods.

[Preparation of Coating Liquid for Emulsion Layer (Photosensitive Layer)]

<<Preparation of Coating Liquid-1' for Emulsion Layer (Photosensitive Layer)>>

1000 g of silver organic acid salt dispersed matter (A' through O'; the kinds are indicated in Table 4) obtained in the above-described procedure, 276 ml of water, 33.2 g of the pigment-1'dispersed matter, 21 g of organic polyhalogen compound-1' dispersed matter, 58 g of organic polyhalogen compound-1' dispersed matter, 173 g of the phthalazine compound-1' solution, 1082 g of SBR latex (Tg: 22° C.) liquid, 299 g of the reducing agent complex-1' dispersed matter, the compounds dispersed matter represented by the general formulas (1) through (4) of the present invention (kinds and volumes are indicated in Table 4), 9 ml of mercapto compound-1' aqueous solution and 27 ml of mercapto compound-2' aqueous solution were in turn added, a coating liquid for emulsion layer in which 117 g of the silver halide mixed emulsion A' was added and mixed well was sent to the coating die immediately before coating, and coated.

The viscosity of the above-described coating liquid for emulsion layer was measured by B type viscosometer made by Tokyo Keiki, Co., Ltd., resulted in 25 [mPa·s] at 40° C. (No. 1 rotor, 60 rpm).

The viscosity of the coating liquid at 25° C. using a RFS fluid spectrometer made by Rheometrix Far East Co., Ltd., were 230, 60, 46, 24 and 18 [mPa·s] at shearing speeds of 0.1, 1, 10, 100 and 1000 [1/sec.], respectively.

The amount of Zirconium in the coating liquid was 0.45 mg per each 1 g of silver.

<<Preparation of Coating Liquid-2' for Emulsion Layer (Photosensitive Layer)>>

1000 g of silver organic acid dispersed matter (A' through O'; the kinds are indicated in Table 5) obtained in the above-described procedure, 276 ml of water, 32.8 g of the pigment-1' dispersed matter, 21 g of the organic polyhalogen compound-1' dispersed matter, 58 g of the organic polyhalogen compound-2' dispersed matter, 173 g of the phthalazine compound-1' solution, 1082 g of SBR latex (Tg: 20° C.) liquid, 155 g of the reducing agent-2' dispersed matter, 55 g of the hydrogen-bonding compound-1' dispersed matter, the compounds dispersed matter represented by the general formulas (1) through (4) of the present invention (kinds and volumes are indicated in Table 5), 2 g of the color tone adjuster-1' dispersed matter, 6 ml of mercapto compound-2' aqueous solution were in turn added, a coating liquid for emulsion layer in which 117 g of the silver halide mixed emulsion A' was added and mixed well was sent to the coating die immediately before coating, and coated.

The viscosity of the above-described coating liquid for emulsion layer was measured by B type viscosometer made by Tokyo Keiki, Co., Ltd., resulted in 40 [mPa·s] at 40° C. (No. 1 rotor, 60 rpm).

The viscosity of the coating liquid at 25° C. using a RFS fluid spectrometer made by Rheometrix Far East Co., Ltd., were 530, 144, 96, 51 and 28 [mPa-s] at shearing speeds of 0.1, 1, 10, 100 and 1000 [1/sec.], respectively.

The amount of zirconium in the coating liquid was 0.25 mg per each 1 g of silver.

[Preparation of Coating Liquid for Emulsion Face Intermediate Layer]

Water was added to 1000 g in total of polyvinyl alcohol PVA-205 (made by Kuraray, Co., Ltd.), 272 g of pigment of 5% by mass dispersed matter, 4200 ml in total of methylmethacrylate/styrene/butylacrylate/hydroxyethylmethacrylate/acrylic acid copolymer (copolymer mass ratio 64/9/20/5/2) latex of 19% by mass in a liquid, 27 ml in total of Aerosol OT (made by American Cyanamide, Co., Ltd.) of 5% by mass in an aqueous solution, and 135 ml in total of phthalic acid diammonium salt of 20% by mass in an aqueous solution so that the total amount became 10000 g, adjusted it pH 7.5 by NaOH, and made it a coating liquid for intermediate layer, and sent it to the coating die so as to be coated at 9.1 ml/$m^2$.

The viscosity of the coating liquid was measured at 40° C. by the B type viscometer (No.1 rotor, 60 rpm), resulted in 58 [mPa·s].

<Preparation of Coating Liquid for Emulsion Face Protective First Layer>

64 g of inert gelatin was dissolved in water, water was added to 80 g in total of methylmethacrylate/styrene/butylacrylate/hydroxyethylmethacrylate/acrylic acid copolymer (copolymer mass ratio: 64/9/20/5/2) latex of 27.5% by mass in a liquid, 23 ml of methanol of phthalic acid of 10% by mass in a solution, 23 ml of 4-methylphthalic acid of 10% by mass in a solution, 28 ml of sulfuric acid in 0.5 mol/L concentration, 5 ml of Aerosol OT (American Cyanamide, Co., Ltd.) of 5% by mass in a solution, 0.5 g of phenoxyethanole, 0.1 g mg of benzoisothiazolinone so that the total amount became 750 g, and 26 ml of an aqueous solution in which chrome alum of 4% by mass was contained, mixed and made it as a coating liquid for a surface protective layer in a static mixer immediately before the coating, was sent to the coating die so as to be coated at 18.6 ml/m$^2$.

The viscosity of the coating liquid was measured at 40° C. by the B type viscometer (No.1 rotor, 60 rpm), resulted in 20 [mPa·s].

<Preparation of Coating Liquid for Emulsion Face Protective Second Layer>

80 g of inert gelatin was dissolved in water, water was added to 102 g in total of methylmethacrylate/styrene/butylacrylate/hydroxyethylmethacrylate/acrylic acid copolymer (copolymer mass ratio: 64/9/20/5/2) latex of 27.5% by mass in a liquid, 3.2 ml in total of fluorine based surfactant (F-1':N-perfluorooctylsulfonyl-N-propylalanine potassium salt) of 5% by mass in a solution, 32 ml in total of fluorine based surfactant (F-2':polyethylene glycol mono (N-perfluorooctylsulfonyl-N-propyl-2-aminoethyl) ether [ethylene oxide average degree of polymerization=15]) of 2% by mass in a solution, 23 ml of Aerosol OT (American Cyanamide, Co., Ltd.) of 5% by mass in a solution, 4 g of polymethylmethacrylate refined particle (average particle diameter, 0.7 μm), 21 g of polymethylmethacrylate refined particle (average particle diameter, 4.5 μm), 1.6 g of 4-methylphthalic acid, 4.8 g of phthalic acid, 44 ml of sulfuric acid of 0.5 mol/L concentration, 10 mg of benzoisothiazolinone so that the total amount became 650 g, and 445 ml of an aqueous solution in which chrome alum of 4% by mass and phthalic acid of 0.67% by mass were contained, mixed and made it as a coating liquid for a surface protective layer in a static mixer immediately before the coating, was sent to the coating die so as to be coated at 8.3 ml/m$^2$.

The viscosity of the coating liquid was measured at 40° C. by the B type viscometer (No.1 rotor, 60 rpm), resulted in 19 [mPa·s].

[Preparation of Heat-developable Photosensitive Material]

<Preparation of Heat-developable Photosensitive Material-1'>

On the side of the backing face of the above-described undercoat support, the coating liquid for an antihalation layer was simultaneously coated in double layers so that the coating amount of the solid content of the solid refined particle dye became 0.04 g/m$^2$, and the coating liquid for the backing face protective layer was simultaneously coated in double layers so that the coating amount of gelatin became 1.7 g/m$^2$, dried and the backing layer was prepared.

On the opposite face to the backing face, from the undercoat face, the emulsion layer (photosensitive layer), the intermediate layer, the protective layer of the first layer, the protective layer of the second layer were in turn simultaneously coated in double layers by a slide beads method, and a sample of heat-developable photosensitive material was prepared. At this time, the emulsion layer and the intermediate layer were adjusted to 31° C., the protective layer of the first layer was adjusted to 36° C., and the protective layer of the second layer was adjusted to 37° C.

The coating amounts of the respective compounds (g/m$^2$) of the emulsion layer are as follows:

| | |
|---|---|
| silver organic acid (kinds are indicated in Table 4) | 5.55 |
| pigment (C.I. Pigment Blue 60) | 0.036 |
| polyhalogen compound-1' | 0.12 |
| polyhalogen compound-2' | 0.37 |
| phthalazine compound-1' | 0.19 |
| SBR latex | 9.97 |
| reducing agent complex-1' | 1.41 |
| compounds represented by the general formulas (1) through (4) (kinds and volumes are indicated in Table 2) | |
| mercapto compound-1' | 0.002 |
| mercapto compound-2' | 0.012 |
| silver halide (as Ag) | 0.91 |

The coating and drying conditions are as follows:

The coating was performed at the speed of 160 m/min., the gap between tip end of the coating die and the support was made 0.10–0.30 mm, the pressure of the decompression chamber was set to be lowered by 196–882 Pa comparing to the atmosphere. The electricity of the support was removed by an ionic wind prior to the coating.

Subsequently, after the coating liquid was cooled down by the wind at 10–20° C. of the dry bulb temperature in a chilling zone, carried by a non-contanct type carrier, and dried by the drying wind at 23–45° C. and at 15–21° C. of the dry bulb temperature in a winding type non-contact type drying apparatus.

Following the drying, after it was adjusted at 25° C. and 40–60% humidity (RH), the layer face was heated so as to be 70–90° C. After the heating, the layer face was cooled to 25° C.

The degree of matting of the prepared heat-developable photosensitive material was 550 seconds on the side of the photosensitive layer face in Beck smoothness, and 130 seconds on the backing face. Moreover, when the pH of the film face on the side of the photosensitive layer face was measured, the value was 6.0.

<Preparation of the Heat-developable Photosensitive Material-2'>

Except that the coating liquid-1' for emulsion layer was changed to the coating liquid-2' for emulsion layer, the yellow dye compound-1' was removed from the antihalation layer when comparing to the heat-developable photosensitive material-1', and further, as fluorine based surfactants for backing face protective layer and the emulsion face protective layer, F-1', F-2', F-3' and F-4' were changed to F-5', F-6', F-7' and F-8', the heat-developable photosensitive material-2' was prepared similarly to the heat-developable photosensitive material-1'.

At this time, the coating amounts (g/m$^2$) of the respective compounds for emulsion layer are as follows:

| | |
|---|---|
| Silver organic acid (kinds are indicated in Table 5) | 5.55 |
| pigment (C.I. Pigment Blue 60) | 0.036 |
| polyhalogen compound-1' | 0.12 |
| polyhalogen compound-2' | 0.37 |

-continued

| | |
|---|---|
| phthalazine compound-1' | 0.19 |
| SBR latex | 9.67 |
| reducing agent-2' | 0.81 |
| hydrogen-bonding compound-1' | 0.30 |
| compounds represented by the general formulas (1) through (4) of the present invention (kinds and volumes are indicated in Table 5) | |
| color tone adjuster-1' | 0.010 |
| mercapto compound-2' | 0.002 |
| silver halide (as Ag) | 0.091 |

Hereinafter, chemical structures of the compounds used in Examples of the present invention are shown.

Spectral sensitizing pigment A'

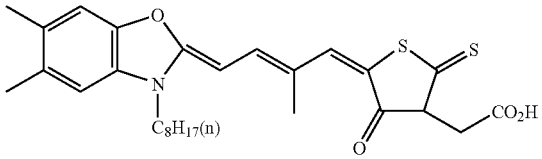

Spectral sensitizing pigment B'

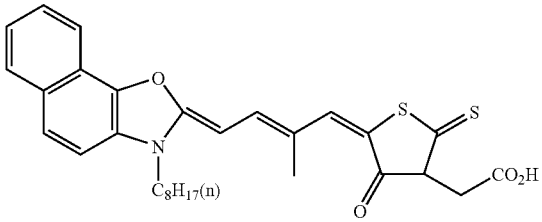

Tellurium sensitizing agent C'

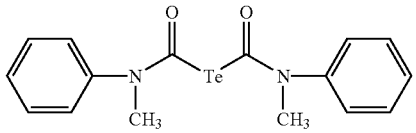

Base precursor compound 1'

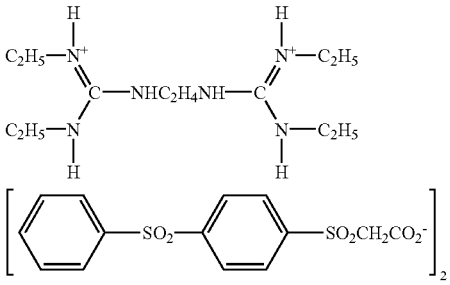

Cyanine dye compound 1'

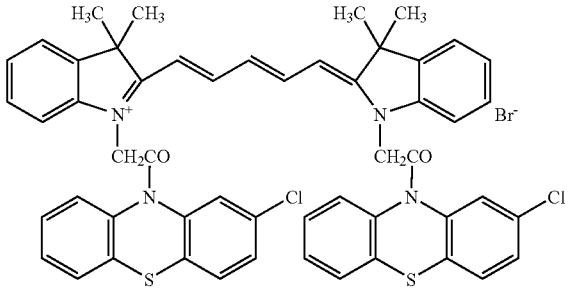

-continued

Blue dye compound 1'

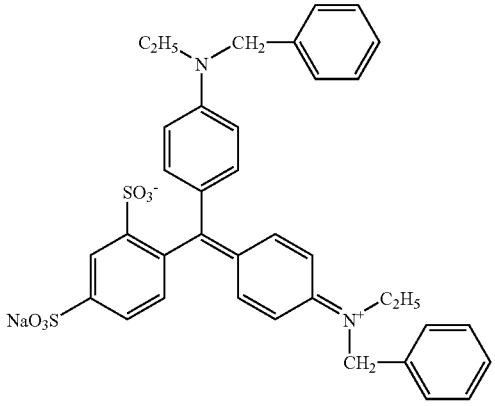

Yellow dye compound 15

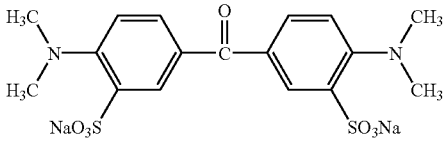

Complex at a 1:1 ratio of (Reducing agent complex-1')

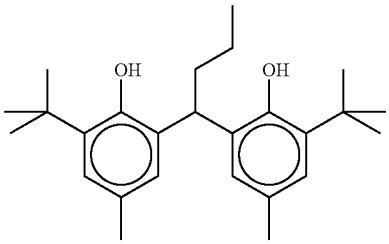

and

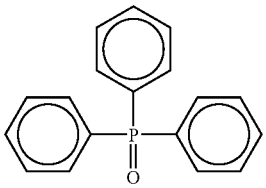

(Reducing agent-2')

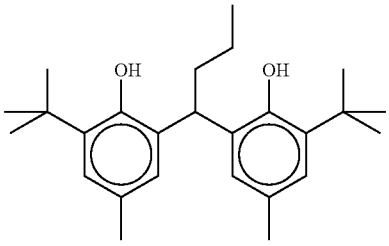

-continued (Hydrogen bonding compound-1′)

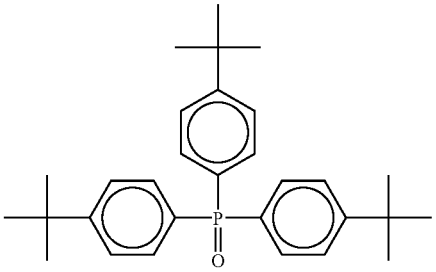

(Polyhalogen compound-1′)

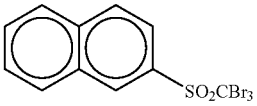

(Polyhalogen compound 2′)

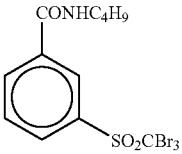

(Mercapto compound-1′)

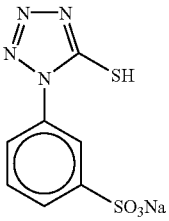

(Mercapto compound-2′)

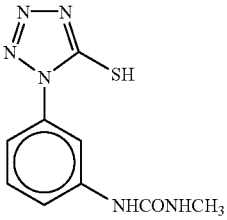

(Phthalazine compound-1′)

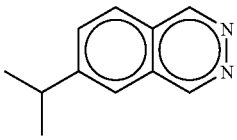

(Color tone adjuster-1′)

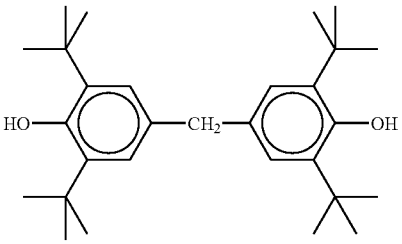

(F-1′)

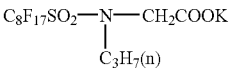

-continued (F-2′)

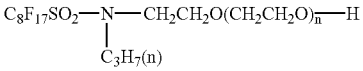

n = 15 (average)

(F-3′)

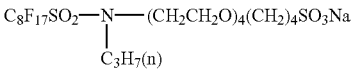

(F-4′)

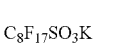

(F-5′)

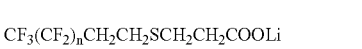

mixtures of n = 5–11

(F-6′)

mixtures of n = 5–11 and m = 5–15

(F-7′)

mixtures of n = 5–11

(F-8′)

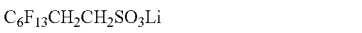

<Evaluation of Photographic Performances>

The obtained samples were cut in a half size, 100 sheets of these were laminated, wrapped in the following wrapping material under the circumstances being at 25% and 50% (RH), and after these were stored at ordinary temperature for 2 weeks, the following evaluations were performed.

<<Wrapping Material>>

50 μm of PE containing 10 μm of PET/12 μm of PE/9 μm of aluminum foil/15 μm of Ny/carbon 3%.

Oxygen permeability: 0 ml/atm·$m^2$·25° C.·day, water permeability: 0 g/atm·$m^2$·25° C.·day.

The samples was exposed and heat-developed (as the heat-developable photosensitive material-1, 24 seconds in total by 4 sheets of panel heaters set at 112° C.-119° C.-121° C.-121° C., and as the heat-developable photosensitive material-2, 14 seconds in total) by Fuji Medical dry laser imager FM-DP L (660 nm semiconductor laser of the maximum output 60 mW (IIIB) mounted), the evaluation of the obtained images were performed by a densitometer.

In Table 4, supposing the inverse number of the amount of exposure which gives the lowest concentration +1.0 for the blacking concentration of the sample No.12 is 100, the numbers were represented by relative sensitivity. The larger the number is, the greater the sensitivity is.

<Evaluation of Image-keeping Property>

After the above-described already treated sample was stored for 1 week under the conditions being at 60° C. and 50% (RH) in a dark, the concentration change of the fogging portions was measured. The sample whose change width is smaller is a heat-developable photosensitive material having an excellent image-keeping property.

TABLE 4

| Sample No. | Silver organic acid dispersed matter | Development accelerator Kinds | Development accelerator Amount (mol/m$^2$) | Photographic property Fogging | Photographic property Sensitivity | Image-keeping property Δ Dmin | |
|---|---|---|---|---|---|---|---|
| 1 | A' | 1–7 | $4 \times 10^{-5}$ | 0.15 | 105 | 0.45 | Comperative example |
| 2 | B' | 1–7 | $4 \times 10^{-5}$ | 0.15 | 103 | 0.1 | Present invention |
| 3 | C' | 1–7 | $4 \times 10^{-5}$ | 0.15 | 102 | 0.09 | Present invention |
| 4 | D' | 1–7 | $4 \times 10^{-5}$ | 0.14 | 102 | 0.32 | Comparative example |
| 5 | E' | 1–7 | $4 \times 10^{-5}$ | 0.15 | 145 | 0.75 | Comparative example |
| 6 | F' | 1–7 | $4 \times 10^{-5}$ | 0.15 | 99 | 0.1 | Present invention |
| 7 | G' | 1–7 | $4 \times 10^{-5}$ | 0.14 | 97 | 0.15 | Present invention |
| 8 | A' | — | — | 0.13 | 75 | 0.35 | Comparative example |
| 9 | B' | — | — | 0.14 | 68 | 0.09 | Comparative example |
| 10 | C' | — | — | 0.13 | 73 | 0.08 | Comparative example |
| 11 | D' | — | — | 0.13 | 75 | 0.28 | Comparative example |
| 12 | E' | — | — | 0.15 | 100 | 0.55 | Comparative example |
| 13 | F' | — | — | 0.13 | 63 | 0.03 | Comparative example |
| 14 | G' | — | — | 0.13 | 57 | 0.13 | Comparative example |
| 15 | B' | 2–168 | $6 \times 10^{-5}$ | 0.15 | 100 | 0.11 | Present invention |
| 16 | C' | 2–168 | $6 \times 10^{-5}$ | 0.15 | 101 | 0.10 | Present invention |
| 17 | B' | 3–60 | $6 \times 10^{-5}$ | 0.15 | 101 | 0.10 | Present invention |
| 18 | C' | 3–60 | $6 \times 10^{-5}$ | 0.15 | 102 | 0.10 | Present invention |
| 19 | B' | 4–41 | $4 \times 10^{-5}$ | 0.15 | 100 | 0.08 | Present invention |
| 20 | C' | 4–41 | $4 \times 10^{-5}$ | 0.15 | 99 | 0.07 | Present invention |

TABLE 5

| Sample No. | Silver organic acid dispersed matter | Development accelerator Kinds | Development accelerator Amount (mol/m$^2$) | Photographic property Fogging | Photographic property Sensitivity | Image-keeping property Δ Dmin | |
|---|---|---|---|---|---|---|---|
| 1 | H' | 1–41 | $6 \times 10^{-5}$ | 0.15 | 101 | 0.38 | Comparative example |
| 2 | I' | 1–41 | $6 \times 10^{-5}$ | 0.15 | 99 | 0.09 | Present invention |
| 3 | J' | 1–41 | $6 \times 10^{-5}$ | 0.14 | 101 | 0.35 | Comparative example |
| 4 | K' | 1–41 | $6 \times 10^{-5}$ | 0.15 | 100 | 0.09 | Present invention |
| 5 | L' | 1–41 | $6 \times 10^{-5}$ | 0.15 | 102 | 0.45 | Comparative example |
| 6 | M' | 1–41 | $6 \times 10^{-5}$ | 0.15 | 100 | 0.1 | Present invention |
| 7 | N' | 1–41 | $6 \times 10^{-5}$ | 0.14 | 99 | 0.36 | Comparative example |
| 8 | O' | 1–41 | $6 \times 10^{-5}$ | 0.15 | 100 | 0.06 | Present invention |
| 9 | I' | 2–168 | $8 \times 10^{-5}$ | 0.15 | 99 | 0.11 | Present invention |
| 10 | M' | 2–168 | $8 \times 10^{-5}$ | 0.15 | 98 | 0.11 | Present invention |
| 11 | I' | 3–60 | $8 \times 10^{-5}$ | 0.15 | 100 | 0.08 | Present invention |
| 12 | M' | 3–60 | $8 \times 10^{-5}$ | 0.15 | 100 | 0.08 | Present invention |
| 13 | I' | 4–41 | $4 \times 10^{-5}$ | 0.15 | 101 | 0.07 | Present invention |
| 14 | M' | 4–41 | $4 \times 10^{-5}$ | 0.15 | 100 | 0.08 | Present invention |

It has been confirmed that a heat-developable photosensitive material having a high sensitivity and an excellent image-keeping property can be provided by the combinations of the present invention.

According to the present invention, a heat-developable photosensitive material can be provided in which development activity is high, the delay in development has been eliminated, sensitivity is high, Dmin is low, the image-keeping property is excellent and fogging occurrences during storing are slight.

What is claimed is:

1. A heat-developable photosensitive material comprising, on one surface of a support, at least one photosensitive silver halide, a reducing agent for silver ions, a binder, non-photosensitive organic silver salt particles, and at least one development accelerator, the non-photosensitive organic silver salt particles including silver behenate in a content of from 90% by mole to 99.9% by mole based on the non-photosensitive organic silver salt particles, wherein the development accelerator is a compound in which, when added in an amount of 5% by mole relative to the reducing agent, exposure amount required to obtain an optical density=1.0 is reduced to 90% or less, as compared to the case where the compound is not added, wherein the development accelerator comprises at least one of compounds represented by the following formulae (1) and (4):

Formula (1)

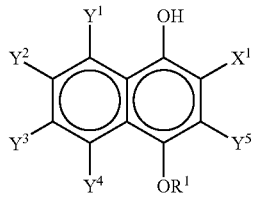

-continued

Formula (4)

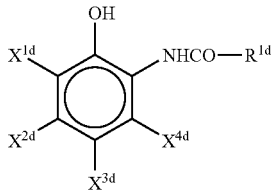

wherein, in formula (1): $R^1$ represents an alkyl group, aryl group, alkenyl group, heterocyclic group, acyl group, alkoxycarbonyl group, carbamoyl group or alkynyl group; $X^1$ represents an acyl group, alkoxycarbonyl group, carbamoyl group, sulfonyl group or sulfamoyl group; and $Y^1$, $Y^2$, $Y^4$ and $Y^5$ each independently represents a hydrogen atom or a substituent, and in formula (4): $X^{1d}$ represents a substituent; $X^{2d}$, $X^{3d}$ and $X^{4d}$ each independently represents a hydrogen atom or a substituent; none of $X^{1d}$, $X^{2d}$, $X^{3d}$ and $X^{4d}$ is a hydroxy group; $X^{3d}$ is not a sulfonamide group; substituents represented by $X^{1d}$, $X^{2d}$, $X^{3d}$ and $X^{4d}$ may be bonded to each other to form a ring; and $R^{1d}$ represents a hydrogen atom, alkyl group, aryl group, heterocyclic group, amino group or alkoxy group.

2. The material of claim 1, wherein the non-photosensitive organic silver salt particles comprise silver arachidate in a content of from 0% by mole to 6% by mole based on the non-photosensitive organic silver salt particles.

3. The material of claim 1, wherein the content of silver behenate in the non-photosensitive organic silver salt particles is from 95% by mole to 99.9% by mole based on the non-photosensitive organic silver salt particles.

4. The material of claim 1, wherein the content of silver behenate in the non-photosensitive organic silver salt particles is from 97% by mole to 99.9% by mole based on the non-photosensitive organic silver salt particles.

5. The material of claim 1, wherein the non-photosensitive organic silver salt particles are prepared by a process that includes adding an aqueous silver nitride solution and a solution or suspension of an alkali metal salt of an organic acid to a closed mixing container.

6. The material of claim 1, wherein the non-photosensitive organic silver salt particles have been desalted by an ultrafiltration method.

7. The material of claim 1, wherein at least some of the non-photosensitive organic silver salt particles are contained in a layer prepared from a coating solution, the coating solution including a solvent including water in a content of at least 80% based on the solvent.

* * * * *